US006874420B2

(12) United States Patent
Lewis, Jr. et al.

(10) Patent No.: US 6,874,420 B2
(45) Date of Patent: Apr. 5, 2005

(54) SYSTEM AND METHOD FOR REGISTER MARK RECOGNITION

(75) Inventors: Clarence A. Lewis, Jr., Casco, ME (US); Richard Dale Lewis, Windham, NH (US); James Edward Lewis, Boston, MA (US)

(73) Assignee: CC1, Inc., Manchester, NH (US)

( * ) Notice: Subject to any disclaimer, the term of this patent is extended or adjusted under 35 U.S.C. 154(b) by 55 days.

(21) Appl. No.: 10/626,915

(22) Filed: Jul. 25, 2003

(65) Prior Publication Data

US 2004/0163562 A1 Aug. 26, 2004

Related U.S. Application Data

(62) Division of application No. 09/422,720, filed on Oct. 22, 1999, now abandoned.

(51) Int. Cl.[7] ..... B41F 1/54

(52) U.S. Cl. ..... 101/485; 101/181; 101/248; 101/DIG. 46; 382/149; 382/151; 382/162; 382/294; 250/559.08; 250/559.39; 700/124; 700/125

(58) Field of Search ..... 101/483, 484, 101/DIG. 45, 485, 181, 216, 248, DIG. 46; 382/106, 112, 149, 162, 294; 250/559.01, 559.08, 559.19, 559.2, 559.39, 208.1; 700/124, 125

(56) References Cited

U.S. PATENT DOCUMENTS 4,553,478 A * 11/1985 Greiner et al. ..... 101/484
5,181,257 A * 1/1993 Steiner et al. ..... 382/162
5,339,176 A * 8/1994 Smilansky et al. ..... 358/504
5,689,425 A * 11/1997 Sainio et al. ..... 700/124
5,724,437 A * 3/1998 Bucher et al. ..... 382/112
5,812,705 A * 9/1998 Wang et al. ..... 382/294
5,992,318 A * 11/1999 DiBello et al. ..... 101/181
6,166,366 A * 12/2000 Lewis et al. ..... 250/208.1
6,266,437 B1 * 7/2001 Eichel et al. ..... 382/149

FOREIGN PATENT DOCUMENTS

JP 411099634 A * 4/1999 ..... B41F/33/14

* cited by examiner

*Primary Examiner*—Eugene H. Eickholt
(74) *Attorney, Agent, or Firm*—Bourque & Associates

(57) ABSTRACT

A system, method, and process that determine and automatically correct registration errors between printed objects and mechanically produced objects using advanced image processing techniques is disclosed. Means are also presented for maintaining all registered functions to within very close tolerances during normal running, with other means for rapidly obtaining initial registration with substantial savings in material waste. The disclosed system and method/process are compatible with the printing and converting industry in which rolls of material are processed by printing a number of colors that require close registration especially in pictorial representation. These roll-fed printing machines are quite versatile and in addition to the printing of any number of colors on both front and back can perform any number of additional operations on the printed web at the same time. Some of these additional operations can be the punching of line holes, scoring, perforation and die cutting all of which impart a specific shape mechanically on the printed web. All of these functions must be initially registered to each other and maintained within close tolerances during normal running conditions. The presently disclosed registration system permits these initial registration procedures to be performed with high accuracy, speed, and across a wide variety of web materials and colors. The system generally applies to any web material (5701) on which register marks (5702) are applied, wherein images of the web are obtained (5703) and image processed (5704) under optional control of an operator interface display (5705), resulting in web press motor control (5706) to affect improved print registration on the web material (5701).

7 Claims, 83 Drawing Sheets

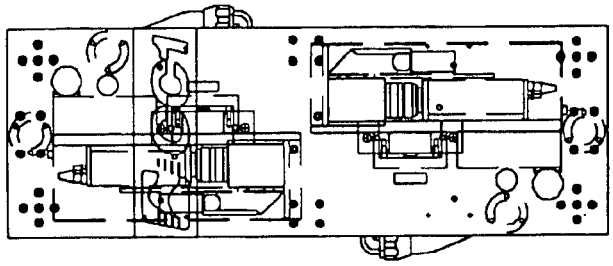
FIG. 4
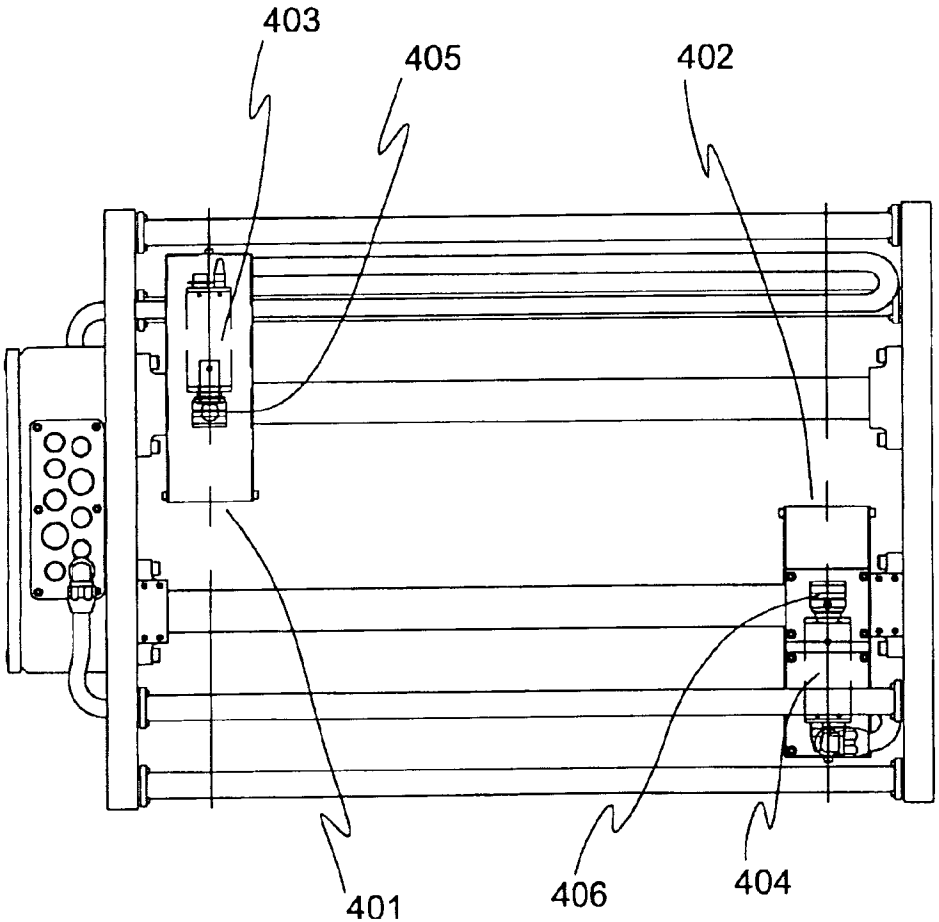

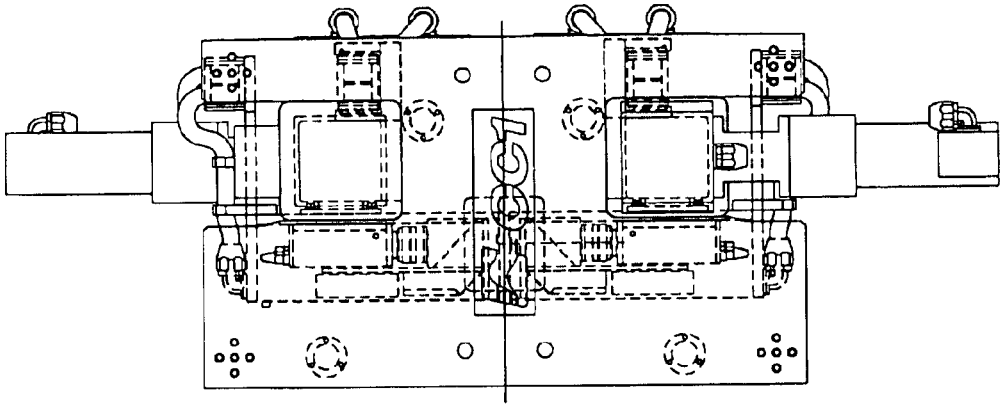
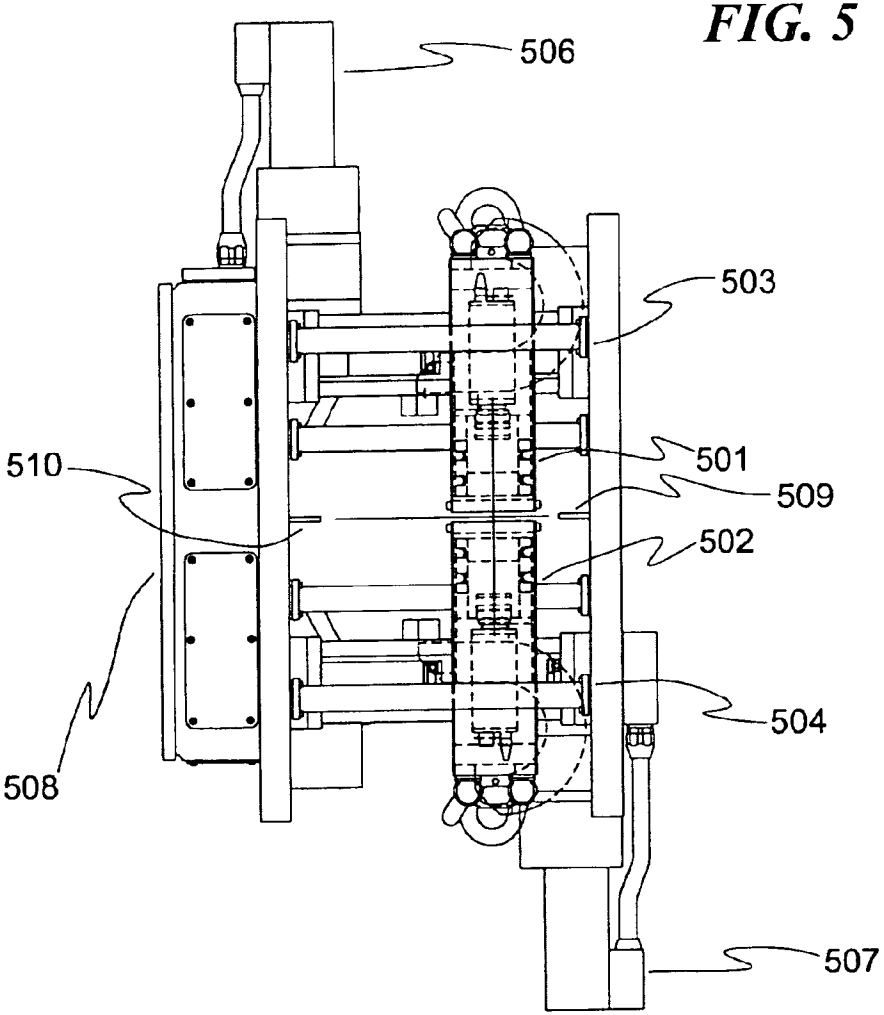
FIG. 5

*FIG. 19*

| Waste Savings Analysis<br>Exemplary Newspaper Application<br>1900 | |
|---|---|
| **Customer Information** | |
| **Description** | **Value** |
| 1901 Circulation | 50000 |
| 1902 Width (inches) | 14.75 |
| 1903 Length (inches) | 11.375 |
| 1904 Paper Pages Across Web Width | 2 |
| 1905 Paper Pages Around Circumference | 4 |
| 1906 # of Paper Pages/Cylinder Revolution | 8 |
| 1907 Newsprint Cost (US$/Pound) | US$ 0.25 |
| 1908 Paper Weight (Pounds/Ream) | 30 |
| 1909 Ink Cost (Percent of Paper Cost) | 10% |
| 1910 Make Ready Count / Day On Edition | 3 |
| 1911 Days per Week | 6 |
| 1912 Specials per Week | 5 |
| 1913 Number of Paper Pages per Newspaper | 36 |
| 1914 **Savings (Papers / Make Ready)** | **1000** |
| **Calculations** | |
| 1915 Number of Webs | 4.5 |
| 1916 Square Feet of Paper per Newspaper | 41.95 |
| 1917 Weight/Paper (Pounds) | 0.39 |
| 1918 Paper Cost per Newspaper | US$ 0.098 |
| 1919 Ink Cost per Newspaper | US$ 0.010 |
| 1920 Total Cost (per Newspaper) | US$ 0.108 |
| 1921 Cost per 1000 Papers | US$ 108.14 |
| 1922 Make Ready (per Week) | 23 |
| 1923 **Savings per Week (Number of Papers)** | **23000** |
| 1924 **Savings per Week (Tons of Newsprint)** | **4.5** |
| 1925 **Savings per Year (Tons of Newsprint)** | **235** |
| 1926 **Savings per Week (US$ paper & Ink only)** | **US$ 2487** |
| 1927 **Savings per Year (total US$)** | **US$ 129,336** |

2501 FV = FIELD OF VIEW
2502 FD = FOCAL DISTANCE
2503 ΔFD = CHANGE IN FOCAL DISTANCE
ΔFV = CHANGE IN FIELD OF VIEW
2504 ΔFV = ((ΔFD)(FV))/((FD)(2))

FOR
2505 ΔFD = 0.1"
2506 FD = 4.0"
2507 FV = 0.5"

2508 ΔFV = ((0.1)(0.5))/(4.0)(2) = 0.00625"

Prior Art Product Distribution

Present Invention Product Distribution

Exemplary Newspaper Publication Waste Recovery Profile Distribution

SYSTEM AND METHOD FOR REGISTER MARK RECOGNITION

CROSS REFERENCE TO RELATED APPLICATIONS

Utility Patent Applications

Parent Utility Patent Application

This Utility Patent Application is a divisional filing for patent utility patent application Ser. No. 09/422,720 filed Oct. 22, 1999, which is now abandoned, for SYSTEM AND METHOD FOR REGISTER MARK RECOGNITION. Applicants incorporate by reference and claim benefit pursuant to 35 U.S.C. § 119 and 35 U.S.C. § 120 for this U.S. Utility Patent Application and its related provisional patent application detailed below.

Zoom Lens Calibration

Applicants incorporate by reference and claim benefit pursuant to 35 U.S.C. § 120 for U.S. Utility Patent Application titled SYSTEM AND METHOD FOR ZOOM LENS CALIBRATION AND METHOD OF USING SAME, Ser. No. 08/924,595, filed Sep. 3, 1997 and submitted to the USPTO with Express Mail Label EM599197503US.

This parent application was issued a Notice of Allowance Jul. 30, 1999, and issued and U.S. Pat. No. 6,026,172 on Feb. 15, 2000.

Throughout the remainder of this document, the term "Zoom Lens Calibration" will refer to the teachings presented in the abovementioned patent application.

Monitoring and Controlling Pattern and Material Coatings

Applicants incorporate by reference and claim benefit pursuant to 35 U.S.C. § 120 for U.S. Utility Patent Application titled SYSTEM AND METHOD FOR MONITORING AND CONTROLLING THE DEPOSITION OF PATTERN AND OVERALL MATERIAL COATINGS, Ser. No. 09/120,825, filed Jul. 22, 1998 and submitted to the USPTO with Express Mail Label EM267141439US.

Provisional Patent Applications

Register Mark Recognition

Applicants incorporate by reference and claim benefit pursuant to 35 U.S.C. § 119 for Provisional Patent Application titled SYSTEM AND METHOD FOR REGISTER MARK RECOGNITION, Ser. No. 60/105,456, filed Oct. 23, 1998 and submitted to the USPTO with Express Mail Label EM267141354US.

Zoom Lens Calibration

Applicants incorporate by reference and claim benefit pursuant to 35 U.S.C. § 119 for Provisional Patent Application titled SYSTEM AND METHOD FOR ZOOM LENS CALIBRATION AND METHOD OF USING SAME, Ser. No. 60/025,592, filed Sep. 6, 1996.

Monitoring and Controlling Pattern and Material Coatings

Applicants incorporate by reference and claim benefit pursuant to 35 U.S.C. § 119 for Provisional Patent Application titled SYSTEM AND METHOD FOR MONITORING AND CONTROLLING THE DEPOSITION OF PATTERN AND OVERALL MATERIAL COATINGS, Ser. No. 60/053,519, filed Jul. 23, 1997 and submitted to the USPTO with Express Mail Label EI599262652US.

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

Zoom Lens Calibration

The teachings of Zoom Lens Calibration present a very versatile multiprocessing system that performs a number of functions using the same hardware with additional software for each function. This multi-functional capability provides an attractive overall cost structure when compared with the cost of a number of individual and separate products to provide the same performance. However, if only one or two of the functions are required, the cost of the complete system can be considerably more than the cost of one or two separate systems.

This disclosure describes a system that provides some of the benefits of Zoom Lens Calibration at a greatly reduced cost. In addition, the present invention describes new and improved features that provide significant new capabilities over those described in Zoom Lens Calibration.

In Zoom Lens Calibration a method for obtaining initial register with random insertion of printing cylinders was disclosed. The accuracy of this method is more than sufficient to align all of the marks in their relative positions with no overlap. The software would then recognize each of the marks, calculate their position errors relative to their ideal position, and introduce corrections to align all marks to their ideal position.

In practice this method works exactly as described. However, there are two common conditions that prevent the system from achieving final register automatically. These two conditions occur if the marks overlap or if a very light or faint color is printed. In both cases the marks cannot be identified and thus the automatic initial register procedure cannot be initiated. This disclosure presents means for overcoming these limitations.

Other improvements include software for object recognition using multiple cameras and a new means for registering objects on other than a continuous web.

DESCRIPTION OF THE PRIOR ART

The prior art applicable to the present invention disclosure is disclosed in the following sections.

Register Marks Prior Art

Printed marks used for measuring distances have been used since U.S. Pat. No. 2,802,666 issued Aug. 13, 1957 to John F. Crosfield for REGISTER CONTROL SYSTEM FOR MOVING WEBS. Numerous register (ink deposition alignment) controls have been developed around this patent including the following United States patents by Applicant Clarence A. Lewis, Jr.:

U.S. Pat. No. 3,264,983 issued Aug. 9, 1966 for REGISTRATION SYSTEM FOR A MOVING WEB. This invention relates to registration system for operations to be performed on a moving web, typically for multicolor printing. This system concentrates on the combination of analog and digital techniques to reduce measurement of error in web registration. The system concentrates on the use of photocells and conventional fixed-lens systems of image inspection to perform the registration function. The general registration system disclosed in this patent is the basis for many of the following patents mentioned in this application.

U.S. Pat. No. 4,322,802 issued Mar. 30, 1982 for CONTROL APPARATUS FOR ADJUSTING THE POSITION OF A WORKPIECE. This patent details an apparatus for adjusting the initial web position so as to minimize the overall material waste in the press setup initial register operation.

U.S. Pat. No. 4,482,972 issued Nov. 13, 1984 for DISTANCE SENSING APPARATUS AND METHOD. This patent describes a method by which web length distances may be calculated referenced to a registration mark placed on the web. Note that the application here is very specific and targeted towards the use of photosensors to perform the image detection. All of the inherent problems and limitations discussed later in the Sainio patent are applicable to this approach. While the distance method described in the U.S. Pat. No. 4,482,972 patent deals with rotational distance measurement, no attempt is made to provide support for both length and width measurements, nor is there any support for incorporating wide field of view or multifunction web inspection/control functions. This patent, like the others described herein, is for a single-purpose apparatus.

All of these patents use a photocell and incandescence lamp that requires the printed web be moving in order to obtain pulses that are then decoded to detect variations in the distances between marks.

These systems tend to be rather crude in their register control, as the sensitivity and accuracy of the systems depends on the use of a photocell as the detector element. Additionally, multiple spatially disparate registration marks require the use of separate detector systems, requiring a multiplication in hardware expense as well as consideration of mechanical drift issues as the web manufacturing equipment wears with time.

Television and Image Processing Prior Art

In the late 1950s television technology was used first to monitor register marks. These early systems used a standard television camera of the tube type. A strobe was employed and was fired by an encoder attached to a printing cylinder to illuminate the same position of the web. A high persistence monitor screen was used to retain the image that with repeated strobe cycles would provide an image of the printed web. The system was used to visually monitor register marks. A mark printed by each color station was when in register centered in a box printed by the first printed color station. Thus, by viewing the monitor it was easily determined if the image was in register (i.e., with proper color dot alignment) in both the lateral and circumferential directions.

Distance Measurement Prior Art

Other United States utility patents that focus on distance measurement using video technology are as follows:

U.S. Pat. No. 3,958,509 issued May 25, 1976 to James E. Murray, et. al., for IMAGE SCAN AND INK CONTROL SYSTEM. This patent describes a system for predetermining appropriate settings for the ink flow control devices of a printing press in dependence upon the average inked area in each of a plurality of image zones whose ink supply rate is controlled by a respective one of the ink flow control devices.

While this patent does involve lithographic printing, it remains primarily an inspection and quality control method as compared to a manufacturing control system. Specifically, while the ink deposition rate is controlled with the teaching of this patent, there is no method to perform accurage register control, an important and costly aspect of any manual printing process.

U.S. Pat. No. 3,986,007 issued Oct. 12, 1976 to Carl F. Ruoff, Jr., for METHOD AND APPARATUS FOR CALIBRATING MECHANICAL-VISUAL PART MANIPULATING SYSTEM. This patent describes a system for generating conversion factors used to translate positions in the vision system coordinates into the manipulating system coordinates. This system deals primarily with coordinate transformations that may be used to translate between the vision system coordinates and that of the mechanical manipulating system. The disclosure fails to mention any method of calibrating a moving camera system with Zoom Lens.

U.S. Pat. No. 3,988,535 issued Oct. 26, 1976 to Henry H. Hickman, et. al., for AUTOMATED POSITIONING. This patent describes a system in which beam-lead chips are held to a magnetic carrier and incident light is reflected by the shiny beam leads and detected by a TV camera. The reflection intensity is used to detect the beam-lead edges and from this information the center of the beam leads is determined.

This system operates on stationary materials, a significant constraint when compared with moving web manufacturing processes. Registration marks in the context of the U.S. Pat. No. 3,988,535 patent are essentially fixed in time and space, whereas in moving web printing the targets move and there is a significant issue of repeatable registration which must be addressed that is not present in beam-lead chip bonding.

U.S. Pat. No. 4,136,950 issued Jan. 30, 1979 to Joseph H. Labrum, et. al., for MICROSCOPE SYSTEM FOR OBSERVING MOVING PARTICLES. This patent describes a microscope system for observing moving particles that makes use of a television camera for producing a continuing series of images of such particles. Light pulses are used to strobe the particle position in a double-exposure, with time and distance differentials used to determine the particle movement.

No mention is made in this patent of the use of image signal processing techniques to perform edge detection or distance measurements for the disclosed applications. Additionally, the strobe method may allow calculation of travel distance for individual particles, but provides no method of determining the proper registration of a web printing process. Furthermore, the use of a microscope in a production web printing application would be inappropriate, as the required field of view would require significant movement of the microscope by precision mechanical stepper motors, or alternatively, a multiple number of fixed microscopes.

U.S. Pat. No. 4,146,907 issued Mar. 27, 1979 to Gerald A. Jensen, et. al., for MULTIPLE FRAME PROJECTOR FOR TV VIEWING SYSTEM. This patent describes a photographic packaging system including a monitoring system which permits the operator to compares frames of film negatives with prints which are being cut so as to ensure that the proper prints will be packaged with the corresponding film negatives. Again, the optics system described here is intended for manual quality control of the production process.

U.S. Pat. No. 4,160,263 issued Jul. 3, 1979 to Harold Christy, et. al., for DUAL OR MULTIPLE OBJECTIVE VIDEO MICROSCOPE FOR SUPERIMPOSING SPACED IMAGES. This patent describes a video microscope with wide potential range of magnification powers (10–1000) whose separate images originating from multiple objective lenses are combined on a half-silvered mirror and focused into a vidicon camera tube to produce a two-dimensional composite image. While this patent discloses the combination of multiple images into a single video image, it does not disclose any method by which the camera positions may be moved or calibrated across moving web material. No additional processing of the image data other than translation and combination is performed by this patent disclosure.

U.S. Pat. No. 4,208,675 issued Jun. 17, 1980 to Jean Bajon, et. al., for METHOD AND APPARATUS FOR POSITIONING AN OBJECT. This patent describes a method and apparatus for positioning an object in space in such a manner as to permit duplication of the positioning in a precise position using synthesized points on a television screen.

While this patent does deal with distance measurements, it is a fundamentally different task to position an object in space and to determine the object's position relative to other objects, as must be done with the web printing process during the initial registration procedure.

U.S. Pat. No. 4,232,336 issued Nov. 4, 1980 to James W. Henry, for INSPECTION OF ELONGATED MATERIAL. This patent describes an apparatus and method for inspecting elongated material such as strands, sheets, bundles or webs for the presence of surface irregularities. The method allows the count of irregularities within a given length of material and the angle of irregularities such as in the case of crimped fiber to be determined.

This patent describes the use of a TV camera to view the material and then electronically analyze the video image for alternating light and dark areas within a given length. This technique essentially replaces the use of photocells in the U.S. Pat. No. 2,802,666 Crosfield patent with the updated technology of television video. Note that no signal processing techniques are used in this patent save for crude edge detection algorithms.

U.S. Pat. No. 4,233,625 issued Nov. 11, 1980 to Norman G. Altman, for TELEVISION MONITORING SYSTEM FOR AUTOMATICALLY ALIGNING SEMICONDUCTOR DEVICES DURING MANUFACTURE. This patent describes a system for aligning successive configurations of minute semiconductors during manufacture, the configurations being carried on a table which is under automatic control of a standard TV camera, pattern-recognition and motor control circuitry that corrects for TV camera geometrical and shading distortions, and a monitor which may be used by an operator to supervise the system.

Note that this patent is primarily concerned with determining the orientation of a given item of manufacture as it is processed, rather than determining the relative position of two marks within a given product of manufacture as is the case in a web printing process. The major difference here is that individual alignment relative to other manufactured product is irrelevent in the U.S. Pat. No. 4,233,625 patent, whereas in web printing applications it is the primary focus of interest.

U.S. Pat. No. 4,253,111 issued Feb. 24, 1981 to Ernest J. Funk, et. al., for APPARATUS FOR BONDING LEADS TO SEMICONDUCTOR CHIPS. This patent describes a bonding apparatus that corrects for misalignment of semiconductor chips during the wire bonding process. Note that this patent specifically limits itself to a limited zone of consideration in the semiconductor chip. Additionally, there is no possibility of misalignment between the bond pads of a semiconductor chip—they are always in the same relative distance to one another. Such is not the case in a web printing process. Therefore, this patent can ignore the initial register problems associated with the web printing process.

A significant aspect of this and other similar patents is that they are designed solely as a post-manufacturing step or as a quality-assurance measure, and never as a method to provide feedback to a prior manufacturing step. Just the opposite is true of the web printing process. Here the misalignment of register marks must be fed back to previous printing stages to adjust for ink deposition, ink deposition timing, etc., to ensure that future manufactured product is in correct register.

U.S. Pat. No. 4,301,470 issued Nov. 17, 1981 to Volker Pagany, for ALIGNMENT APPARATUS. This patent describes the use of a TV camera to align semiconductor bars positioned on an X-Y table. This patent does describe a method by which individual bars may be realigned, but fails to incorporate any method by which the relative distances between the bars may be accurately calculated.

As stated previously, the web printing process is fundamentally different than the manufacture or positioning of piece parts, in that the initial register required by web print processes is a close manufacturing loop in which final web product material is manufactured according to data obtained from prior manufactured web material.

U.S. Pat. No. 4,389,669 issued Jun. 21, 1983 to Daniel Epstein, et. al., for OPTO-VIDEO INSPECTION SYSTEM. This patent describes a system for inspecting miniaturized solid state devices, such as may be found in semiconductor chips. The premise behind the system is the comparison of a good and bad part via a stereo video inspection process.

This system would not be applicable to the web printing process since to generate a comparison web product suitable for inspection would require that the web process be properly registered, which is exactly the purpose of the comparison operation. Thus, the use of stereoscopic inspection techniques is limited to instances in which a "good" product may be relatively easily generated.

U.S. Pat. No. 4,567,506 issued Jan. 28, 1986 to Morimasa Shinoda, et. al., for MONITORING APPARATUS FOR COLOR PRINTING. This patent describes a visual camera and strobe system used for manual inspection of a web printing process. The technology surrounding this patent deals primarily with synchronization of the camera to the web material with the use of a strobe system, and has no method of providing for distance measurement or the use of a movable zoom camera system.

U.S. Pat. No. 4,736,680 issued Apr. 12, 1988 to R. Langdon Wales, et. al., for CLOSED LOOP REGISTER CONTROL. This patent describes a closed loop register control system used in association with a printing press and comprising a television camera in combination with a strobe light and a solid-state imaging device that enables continuous scanning of the sheet web.

This system permits comparison of a television image and the desired web image to be made and then adjustments can be made to the web printing process to compensate for the detected differences. While this is a closed loop system as describe in the disclosed exemplary embodiments in this application, the Wales patent still requires that a reference be provided for comparison with the television imaging system. The disclosed method and apparatus in this application dispenses with this requirement and permits initial register to be performed without the requirement of comparison web material. This has a significant time and cost savings for manufacturing, as the generating of an acceptable comparison web sample can take time and waste material. Note the following issues concerning this patent:

(A) This is the only combination television-strobe patent dealing with web manufacturing.

(B) This patent cites the U.S. Pat. No. 4,389,669 Epstein patent that covers all television cameras including strobes and digital to analog (D to A) conversion of RGB.

(C) The Wales patent specifically uses a fixed lens, making initial register across a wide web material require multiple cameras for full-product monitoring.

The Wales patent requires "proof" sheets, or target comparison material to be generated in order to perform proper comparisons and generate the required feedback control for the web printing operation.

U.S. Pat. No. 4,794,453 issued Dec. 27, 1988 to Herman C. Gnuechtel, et. al., for METHOD AND APPARATUS FOR STROBOSCOPIC VIDEO INSPECTION OF AN ASYNCHRONOUS EVENT. This patent describes an apparatus and method particularly suited for use with the closed loop color-to-color registration system of a commercial web printing apparatus utilizing a CCD camera having an image sensor and a synchronization generator circuit which generates periodic scan pulses which trigger the image acquisition scan of the image sensor. This process results in a highly stable and reliable acquisition of a low noise image of registration marks on a printed web that may be later processed by a registration control system.

The Gnuechtel patent, like the Wales U.S. Pat. No. 4,736,680 patent, describes a closed-loop registration control system in which optical data is sampled by means of a strobe and processed to control the overall production of the printed web material. The Gnuchtel patent does illustrate a moveable camera inspection station. However, there is nothing in the Gnuchtel patent that describes methods or apparatus by which one may calibrate the position of the image sensors or provide a method of determining the relative positioning error in the camera location. The Gnuchtel patent also fails to allow the use of wide field of view lenses or Zoom Lenses to provide the ability to locate web registration marks over a wide field of view. This capability requires a more sophisticated approach to the calibration of the actual camera position with respect to the web material and is disclosed later in this document.

In short, the Gnuchtel is a first order manual solution to a much more complex problem of automatic initial register control. The Gnuchtel patent essentially brings new technology to the Wales patent but goes no further in improving the overall accuracy of the camera positioning techniques disclosed by Wales.

In contrast, the present invention and associated embodiments permit multitasking of functions described in the Gnuchtel and Wales patent using multiple field views over the entire width of the printed web and using the same inspection device (lens/camera/processing unit). Furthermore, the teachings of the present invention go far beyond that in the Gnuchtel patent in that the disclosed Zoom Calibration method may be utilized to implement in a multitasking fashion any number of features in the Gnuchtel patent in combination with other web inspection/control functions which are not possible with the Gnuchtel/Wales technology.

U.S. Pat. No. 4,887,530 issued Dec. 19, 1989 to Jeffrey W. Sainio, et. al., for WEB REGISTRATION CONTROL SYSTEM. This patent describes a system for generating indicia of registration error between the respective printing units of a web-fed, four-color printing press. An optical line scanner is disposed over a web to generate signals indicative of the brightness level of successive nominal pixels along a line traverse to the motion of the web. The respective printing units each generate registration marks on the web, the relative positions of which are indicative of the relative cyclical (rotational) and traverse (lateral) positions of the printing units with respect to the web.

As the web moves past the scanners, successive line scans generated by the scanner provide the equivalent of a two-dimensional raster scan of a strip of the web centered on the expected center line of registraton marks produced by the respective printing units. The centers of the respective registration marks are determined, and the cyclical (rotational) and traverse (lateral) positions of the printing unit adjusted in accordance with deviations from expected relative positions. The Sainio patent specifically describes the use of symmetrical, right-angle diamonds for facilitating the calculation of the center of the registration marks.

Note, however, that Sainio only claims the use of photo-optical line scanner sensors (using a tungsten-halogen lamp as the illumination source) and does not make use of any Zoom Lens technology to obtain wide field registration or provide any method of overcoming the need for multiple cameras to perform wide-field registration operations. Sainio's method and disclosure are limited to sensor arrays which are positioned perpendicular to the direction of web travel, meaning that the method described can only be used when the press is operating. The reason behind this requirement is that the sensor array must see a registration mark pass its position to enable the edge detection algorithms described by Sainio to operate properly. Sainio's specific mention of diamond-shaped registration marks is designed in fact to aid this process and provide a method of overcoming inherent deficiencies in the image sensing method disclosed in this patent. However, the fact that Sainio's method does not permit a wide field of view with accurate distancing restricts the use of this apparatus to low-resolution registration applications. To accurately perform high-quality print registration requires a variable field of view which not possible with the Sainio invention.

A significant issue in this type of sensing apparatus is that of press web jitter. Press web jitter can be defined as variations in the web velocity as it passes through the press due to mechanical characteristics of the press and resonating interactions between the web material and press mechanics as the web progresses through the manufacturing process. This jitter makes sensing as described in the Sainio patent troublesome, as it becomes difficult to accurately determine the exact relative position of the registration mark center because of this inconsistency in web velocity. For example, if the web velocity suddenly increases during traversal past the sensing device, then the resulting image will generate a signal signature which is different than a normal registration mark. As mentioned previously, Sainio used a diamond-shaped registration mark to help offset this problem, but this approach is insufficient to correct the problem of web jitter over the range of permissible web manufacturing processes. It is clear from modern production criterion that another approach to solving this problem is dictated.

Note, however, in contrast to Sainio, the presently disclosed invention makes use of stroboscopic synchronization of the image capturing device, and as such does not require that the press be moving. Additionally, the use of image processing techinques in conjunction with the Zoom Calibration method disclosed herein permits a wide variety of registration marks to be used with no loss of accurate distance calculation measurement control. Another significant difference in the presently disclosed invention as compared to the Saino disclosure is that with image processing it is possible to achieve registration with arbitrarily configured registration marks. Image processing can, when coupled with the Zoom Calibration method, permit the use of patterns within the web product to be used as registration marks for distance calculations. No prior art system claims to permit this type of registration using the final product itself as the registration mark. Finally, the stroboscopic synchronization of the presently disclosed invention combined with image processing techniques and accurate distancing provided by the Zoom Calibration method permit press jitter to be compensated for in the web inspection/control function.

U.S. Pat. No. 4,932,320 issued Jun. 12, 1990 to Michel Brunetti, et. al., for METHOD AND DEVICE FOR REGISTERING COLORS IN AN OFFSET ROTARY PRESS. This patent describes a system for positioning objects relative to one another comprising taking an image of a group of marks formed on the medium, and analog-to-digital converter connecting the image-taking equipment to digital recording memories, and a data processing system for measuring the mark separations relative to two perpendicular axes and for generating separation correction signals for displacing the object.

Of significant note in the Brunetti patent is the lack of any support for wide-field Zoom Lenses which permit the location of widely disparate registration marks. Furthermore, Brunetti neither claims nor discloses any method to calibrate the accurate position of a camera or image capture device in respect to the web material registration marks. No method is provided to compensate for mechanical wear in the system as well as permit compensation for registration drift across a wide width web.

As with previously discussed patents, the Brunetti patent address only a single-function inspection system. The disclosed Zoom Calibration method, in contrast, permits a multi-function capability within the same optical camera system. This would not be possible with the Brunetti teaching, as it discloses no method by which wide-field variations may be captured, nor is there any camera distance calibration method to permit accurate distance measurements across the web width.

U.S. Pat. No. 5,329,466 issued Jul. 12, 1994 to Patrick Monney, for REGISTRATION CONTROL DEVICE FOR USE IN A ROTARY PRINTING MACHINE. This patent describes a registration control device that makes use of a row of discrete photosensitive elements arranged perpendicular to the traveling direction of the print web and in a plane situated above and parallel to the web. Though the Wales patent was cited in the Monney application, the approach taken in the Monney patent is conceptually different than Wales since the fixed sensor array approach in the Monney patent assumes that the sensor will be fixed, and that access to the entire width of the web must be accomplished at the expense of using additional linear rows of photosensors.

While the use of an integrated row of image sensors is an advancement in technology as applied to web registration control, it suffers from the same drawbacks as other conventional camera/microscope single-lens systems, or systems with a single mobile camera. The problem of accurate camera positioning with respect to the web medium is still an issue and one that is not fully addressed by any of these approaches. Additionally, the Monney disclosure lacks the capability of a wide field of view, requires that the press be moving to operate effectively, and suffers from the same press jitter problems as the Sainio invention.

Resister Control Patents

The Monney and Sainio patents use a linear array fixed scanner dedicated register control, and thus no strobe movement is required for their operation. As stated previously, this does produce a limitation on the width range with which these systems may operate. Typically, the wider field of width inspection required, the higher the cost of these systems.

All other register control patents are of the analog type, photocell and incandescence lamp. There are many of them but they all use marks and relate back to the Crosfield patent of 1953.

The patents cited above trace the use of a television camera for visual inspection and control. Digital to analog conversion and sophisticated algorithms are used for inspection, identification of components on circuits boards and integrated circuit chip carriers. In all cases fixed lenses are used making the system configuration tailored to a single, fixed-position inspection purpose. This restriction is too limiting for many printing operations, especially those who have many customers or customers with stringent quality control requirements that dictate full-width inspections of manufactured web material.

The later patents, including Wales, register control advanced to the use of both a camera and strobe for registration mark detection, but in no case has there been any use of movable Zoom Lenses with wide-field inspection capability. The teaching to accomplish this is the focus of the disclosure in this patent application.

Zoom Lens Calibration Prior Art

The Zoom Lens Calibration patent by Lewis, et. al. presents a very versatile multiprocessing system that performs a number of functions using the same hardware with additional software for each function. This multi-functional capability provides an attractive overall cost structure when compared with the cost of a number of individual and separate products to provide the same performance. If, however, only one or two of the functions are required, the cost of the complete system can be considerably more than the cost of one or two separate systems.

This disclosure describes a system that provides some of the benefits of pending application Zoom Lens Calibration at a greatly reduced cost. In addition it describes new and improved features that provide significant new capabilities over those described in Zoom Lens Calibration.

These features enable new applications of automatic register control never before possible that result in extraordinary waste reduction. Two different applications will be disclosed in detail.

Considerable effort has been expended in the printing industry in developing alternative non solvent based ink curing systems such as Ultraviolet and Electron Beam curing to lessen air pollution. While air pollution has been reduced, the waste material cannot be recycled due to the difficulty in removing the contamination of the polymerized ink and coating agents. Additional cost is incurred in the more expensive ink and costs in disposing of the waste material as land fill instead of recycling. Thus, one form of pollution (air) is traded off for another (ground or landfill pollution).

With the growth of four-color process printing in web fed direct mail, newspapers, and commercial printing, initial register waste and running register waste is by far the largest single cause of waste material. Thus, another advantage of the present invention is to reduce both air and ground pollution by significant reductions in waste material for existing solvent based ink systems as well as for alternative Ultraviolet and Electron Beam ink curing systems.

Two unique features of "Zoom Lens Calibration" using duplicate marks allow focal length and press speed variations with no sacrifice in the measurement of register accuracy make possible new applications of automatic register control with substantial reductions in waste material. Typically, current systems providing register functions require fixed focal distances and constant web speed to ensure alignment accuracy.

New applications that utilize these unique features provide significant reductions in waste material as will be explained in this disclosure. Particularly affected are major areas of full four-color printing in direct mail, newspaper, and commercial printing.

The significant reduction in waste material for these applications may require a reevaluation of the overall pollution potential of UV and E-beam curing over conventional heat set solvent curing.

With the growth of four-color printing in direct mail, commercial printing, and newspaper printing, the amount of waste material has increased substantially as the number of copy changes has escalated. Additionally, high accuracy color register requirements has greatly increased waste material attributable to job changeover transitions in which initial color register must be performed, and during register transient conditions such as occur during web splices, and at each start-stop.

In Zoom Lens Calibration a method for obtaining initial register with random insertion of printing cylinders was disclosed. In practice this method functions exactly as disclosed and is well suited for significantly reducing the setup time particularly for variable repeat presses where mark patterns can be larger due to the large field of view when using a Zoom Lens.

For the reduced cost system the Zoom Lens is replaced with a fixed lens of high magnification with a very small field of view necessary to obtain the high resolution of 0.001 inch per pixel required for automatic register control.

A new method for rapidly achieving initial register is disclosed using fixed lens where initial register errors can be significantly greater than the spacing of the marks. This overcomes the limitation of all current register controls that require manual adjustment of the marks until all marks can be identified by the software before automatic initial register can be performed. This feature and a method for viewing faint or very light marks is described which provide for substantial reductions of waste material during initial register and during normal register control.

Automatic calibration using duplicate marks described in "Zoom Lens Calibration" enable a host of new automatic register control applications hereto fore not possible. Specifically the camera can be mounted where continuous focal distance changes, and variations in web velocity occur such as automatic register control on a blanket to blanket web offset presses with top and bottom staggered printing units. Automatic register control of colors and cut to print can now be accomplished with the camera no longer synchronized with the printing with the camera-strobe mounted on a shingle delivery of a cutting and/or creasing press and/or a sheeter.

Software is described which enable object recognition, faint or light marks, and the use of multiple cameras.

Prior Art Summary

The use of register marks for distance measurement and television technology for distance measurement are in the public domain. However, the combination of this technology with distance calibration over the width of the printed web is new to the art. Additionally, the prior art teaches only of measuring distances in a single direction, whereas the disclosed Zoom Calibration method permits accurate distance measurement in one, two, or three spatial dimensions.

While several patents, such as the Wales U.S. Pat. No. 4,736,680 and Gnuechtel U.S. Pat. No. 4,794,453 disclosure, describe a traverse mechanism on which the register mark scanning device is mounted, these implementations are necessarily semi-manually controlled because of the lack of accurate traversal distance calibration inherent in these systems. None of these systems have web inspection capability as they are register control devices only and dedicated solely to this function. The so-called traverse in these instances is used only to position the web scanner over the registration marks laterally. The traverse was never meant to move after initial positioning by the operator.

As such, the traverses, while motorized, are essentially manually positioned by an operator over the printed web during press operation. Lateral adjustments in this context are always accomplished via manual operator control. Note that the narrow field of view in both these implementations (inherent in any fixed magnification lens system) restricts the ability of the system to compensate for lateral web shift as the press heats up or the web material shifts during manufacture.

Thus, the manual positioning aspect of these systems means that it is impossible for the web printing system to be fully automated or controlled remotely. All of the register systems noted are single purpose systems used only for register control. They have neither the field of view nor the image processing capability to be used for any type of web inspection. Additionally, the use of fixed lens systems means that any distance measurements obtained by the Wales and Gnuechtel systems is inherently a relative distance measurement, and not an absolute distance, since there can be no calibration standard by which to compared the measurement on a two dimensional web surface, since in most cases printing on the web surface is subject to thermal and mechanical forces that are not predictable. A significant disadvantage of the Wales/Gnuechtel systems and their counterparts is an inability to obtain automated absolute distance measurements from a given printed web reference and the edge of the web. This lateral alignment problem is a very common web press setup issue, and as such there is great economic incentive to automate it without the need for constant human intervention. The Wales/Gnuechtel technologies are inadequate to solve this common problem in the art.

The use of a Zoom Lens with accurate calibration for distance measurement throughout its entire range is novel and solves several of the existing problems associated with fixed-lens systems, including high cost, long-term accuracy and repeatability degradation, and the capability to perform wide-field analysis of web materials rapidly and at several different levels of image resolution and fields of view.

Additionally, while a variety of web inspection/control functions have been documented in the prior art, there is no single system that discloses or claims an apparatus or procedure for integrating all of these functions into a single hardware/software system. The field of view limitations and lack of distance calibration in the prior art relegates all of these systems to single-use applications. As a result, the overall system cost to implement a variety of web inspection/control functions increases linearly with the number of web image inspection (image capture) sites and web inspection/control functions to be implemented.

OBJECTS OF THE INVENTION

Accordingly, the objects of the present invention are (among others) to circumvent the deficiencies in the prior art and affect the following objectives:

1. Provide the ability to perform initial register operations that minimize web printing setup time and reduce material waste.
2. Provide the ability to perform initial register operations such that fine register operations may be started with minimal additional time or waste.
3. Provide the ability to use one mark pattern for initial and fine register processes.
4. Provide the ability to reduce the required size of the initial register mark pattern such that the mark pattern may be located within the artwork on the web and increase the accuracy of mark recognition.
5. Provide the ability to initialize color-to-color register.
6. Provide the ability to initialize color to a bindery operation.
7. Provide the ability to initialize front-to-back color-to-color register.
8. To provide an automatic register control to control print-to-print, front-to-back, and print-to-object in both the lateral and circumferential directions according to the teachings of Zoom Lens Calibration at a greatly reduced cost.
9. To provide a means for greatly improving the sensitivity of the system for viewing very light colored or faint register marks.
10. Provide the ability to use greatly reduced mark spacing so that mark patterns are smaller and can more easily be incorporated into the artwork.
11. To provide greatly reduced mark spacing with means to initially align the marks within their area of recognition to facilitate automatic final register.
12. To provide a greatly improved and rapid means for searching for a mark pattern used for automatic register control with multiple marks printed by one color.
13. To provide great flexibility in the number of cameras, either black and white or color that can be operated simultaneously from the same image processing platform.
14. To provide a very simple combination touch screen operator control and image display using the same monitor.
15. Provide the capability of recognition, measurement, and control of objects at great accuracy no matter how far the measurement device is located from the point of control.
16. To provide a means for storing images and transmitting them via remote communication.
17. To provide a means for obtaining data from remotely stored images to be used for any purpose including but not limited to diagnostic analysis of the machine, quality control and documentation, and for training purposes.
18. To provide the capability for full automatic register control including color-to-color alignment, splitting errors in artwork across the web by measuring a number of mark patterns, and for adjustment of fan-out or web shrinkage.
19. To provide a means to measure color from marks and/or directly from the artwork using three chip RGB cameras with software to relate color differences.
20. To provide the ability to perform automatic register control and automatic color monitoring and control and limited viewing or inspection at magnification of the fixed lens using the same hardware at greatly reduced cost over performing these functions with dedicated systems for each capability.
21. To use fixed lens cameras with different lens and field of view for different applications using the same hardware.
22. To provide the capability of measuring and controlling any number of registered colors, with automatic adjustment of gear and operator side register with a minimum of two mark patterns one on each side of the web.
23. To provide the capability of controlling register, color, front-to-back register, bindery register, and provide images for viewing these with the same hardware.
24. To provide the ability to measure register accuracy from marks and objects in both X and Y directions for applications where the printed web is no longer synchronized with the printing and/or does not run at constant speed.
25. To provide the ability to accurately measure and control register of marks and objects in both the X and Y directions where focal distance and speed variations occur.
26. To provide substantial waste reductions to lessen air and ground (landfill) pollution.
27. Provide an economic incentive for printers to migrate towards printing methodologies that reduce landfill waste.

While these objectives should not be understood to limit the teachings of the present invention, in general these objectives are achieved in part or in whole by the disclosed invention that is discussed in the following sections. One skilled in the art will no doubt be able to select aspects of the present invention as disclosed to affect any combination of the objectives described above.

BRIEF SUMMARY OF THE INVENTION

Reduced Cost System

In Zoom Lens Calibration, the camera, Zoom Lens and strobe were mounted on a movable motorized traversing mechanism. This provided the capability for obtaining images at any position on the entire web width and repeat range. Thus, 100% of the repeat length and web width could be inspected at different magnifications depending upon the zoom ratio of the Zoom Lens. In addition to providing visual and automatic inspection of the printed material, additional features were provided such as color-to-color, print-to-punch, and front-to-back register control. Almost all of these features are required for applications where the raw material is a roll that is unwound, printed, and/or converted in some manner and then rewound in a finished roll.

There are many more applications where the raw material is a roll that is unwound, printed, and/or converted in some manner into finished products instead of a roll. In these applications a sample of the finished product is easily obtained from the delivery of the machine thus eliminating the need for traversing cameras.

For these applications, however, there is still a need for automatic color-to-color, front-to-back, and print-to-object register control. These functions can be provided without the need for traversing cameras, Zoom Lens and a viewing monitor. A fixed lens can be used with a single monitor to serve as both the touch screen and for viewing the register mark pattern resulting in greatly reduced cost.

In addition, fixed lens cameras can be mounted on a motorized traverse providing the capability of performing a number of measurement and control functions including viewing of magnified images. These applications are most common when a finished printed product can be easily obtained for overall visual inspection and where the large field of view provided by the Zoom Lens is not needed.

Zoom Lens Calibration and Duplicate Marks

Initial Register

The technology of lens calibration as disclosed in Zoom Lens Calibration is required when using a fixed lens to eliminate a manual calibration of the lens field of view and to automatically compensate for focal distance changes when the camera is moved to different positions across the web. The duplicate marks are also important for recognition purposes in providing automatic initial register.

Process Variations

The technology of lens calibration as disclosed in Zoom Lens Calibration is also required when using a fixed lens. Using the duplicate marks for calibration automatically compensates for all variables from those associated in placement of the marks in prepress through on press camera lens field of view and focal distances including variations in paper stretch due to paper modulus, tension, and/or speed changes.

Register Mark Recognition

The duplicate marks are instrumental in the automatic detection of mark patterns enabling very rapid setup of the system reducing material waste and loss press time.

Light Colors

With the growth of color in printing, more and more 'light' colors are being printed (for example, yellow on a white background). When the color contrast is insufficient, the light color will not be recognized requiring manual control at greatly increased waste material.

The present invention includes a means for enhancing light colors with very fast image processing by restricting the search areas where the light marks should be located and enhancement of the surrounding areas.

Reduced Mark Spacing

Mark spacing (distance between adjacent marks) was originally selected so as to provide for non-overlapping marks due to errors in the making and the mounting of the printing plates. Sufficient distance between adjacent marks in Zoom Lens Calibration allowed the plates to be mounted with adjacent marks in their respective positions without overlap. This technique enables the use of the automatic initial register function immediately without the need for the operator to first manually separate marks that are overlapping. In reality other factors such as the lack of a zeroing function for centering the mechanisms used to adjust both circumferential and lateral register produce initial register errors that are far greater than the plate errors. The magnitude of these errors vary from machine to machine and are not predictable.

During actual running conditions the mark spacing could be very small which is desirable as it allows the hiding of the marks in the artwork where they cannot be seen.

The present invention teaches a method where very small mark spacing may be used suitable for normal running conditions. A very rapid means is provided for initially aligning the marks so that they do not overlap in their area of recognition thus facilitating automatic final register.

Object Recognition

With image processing of camera images, objects can be recognized and using the duplicate marks accurate distances in both the X and Y directions can be measured. This provides a unique capability for automatic register control between any number of objects within an image. One significant advantage of recognizing objects is the ability to directly measure distance errors on the same image between any two objects. This provides the capability for automatic register control for all objects that can be recognized through appropriate software. For example a hole and its center can be recognized and the distance between its center and the mark measured accurately. Automatic corrections can then be made to maintain the correct position between the center of the hole and the mark. This may be applied to any object for which recognition software can be written. Both X and Y register errors can be measured between objects whether they are printed or mechanically introduced into the substrate.

The advantage of recognizing objects is automatic register control can be applied in totally new applications where it was not possible in the past. This includes all applications other than those where both objects were a printed mark of a specific size.

Providing the images for both objects are in the same image captured by the camera, accurate distance measurements can be made using the teachings of Zoom Lens Calibration. These measurements can be used for adjusting motors providing automatic register control. The camera can be mounted at any location where both images can be viewed independent of the distance from the correction mechanisms.

Shingle Delivery

Until now registering on a web press has included scanning on a continuously moving web. With the camera and strobe the camera can be mounted on a shingle delivery and using image processing techniques recognize images relative to printed marks feeding back corrections to maintain registration.

For these applications the camera need not be synchronized with the printing process and images can be taken at random for purposed of measuring color registration form a mark pattern as well as print to cut accuracy in both the X and Y directions.

Multiple Cameras

The design of the system provides great diversity on the number of individual cameras that can be used. They can be a combination of color or black and white depending upon the application. The cameras can be illuminated with pulsed or Xenon flash tubes, pulsed infrared, and/or near infrared light sources and with pulsed ultraviolet light sources to provide for a number of different applications. These applications include conventional color-to-color register control, object-to-mark register control, reading of invisible marks such as used in security printing, automatic inspection of coatings for voids.

Any number of cameras can be in operation at the same time using the same hardware with different software.

Simple Single Monitor Touch Screen

A single monitor may be used which provides both operator control through a touch screen and provides viewing images that are selected specifically for viewing register marks and any other point of interest which can be viewed using a fixed lens. Software enables the adjustment and operation for all cameras through the touch screen with an automatic alert whenever operator attention is required with an image display indicating the area of concern. Software zoom capability provides enlargement of marks and spacing allowing very accurate identification of mark position errors for obtaining initial registration of marks or objects.

Remote Storage and Transmission of Images

With high-speed powerful personal computers such as those using the Intel Corporation Pentium II computer many other functions can be performed in addition to high speed image processing.

The remote communication capability over telephone lines or other communications means provides a whole new means for interacting with equipment and customers. Some of these new functions include diagnosis of hardware and software, the capture of complete images for research and development, record press performance operation such as register capability, provide documentation for the customer of any parameter measured and controlled.

Pre-Registration Process

The image based pre-registration process provides for a means to complete the initial registration and fine registration processes in a timely fashion, saving time and material waste. A touchscreen monitor and user interface computer system is used to display screens, menus, and images. Images are displayed on the touchscreen monitor such that the user can "touch" a point on the image display to locate a specific object or mark being printed.

The objects, or "targets", located may be any object provided all the objects located adhere to the target method used. Target methods will be described in detail later in the document. A common point on all of the objects would be identified. For example, the user would touch the intersection of crosshairs on all crosshair objects, or the upper left corner of a box on all box objects. The point selected on the object is not relevant. However, consistency of the point selected on the object is required from target to target.

By touching the image at a point on the object, global X and Y coordinates of the object may be assigned to the locations of the object on the images. The object coordinates are compared to designated key object coordinates to determine the relative distances the objects are apart.

The relative distances the objects are apart, or "offsets", are then used to determine individual station motor movements. Commands are then issued to move all station motors the appropriate offset distance. When motors are finished, all stations should be roughly in register.

From the rough register state, the fine register control system can automatically recognize the mark pattern. At this point the fine register control system holds the press in register.

Applications

Three applications of this process will be described, although the process is not limited to the three described.

Color-to-Color Initialization

One application of this process is the color-to-color initialization. By selecting targets from stations printing on the same side of the web, the offsets can be computed, and motors moved to bring all stations on the same side of the web into rough register.

Color-to-Bindery Process

Another application is a color-to-bindery process. For example, if a printing job requires lineholes, the color stations may be brought into rough register with the linehole bindery operation. An actual linehole is targeted and set as the key. Then, the color stations are targeted. The target for a color station typically is a linehole bug in this case. A linehole bug is a hollow box shape, which when in register, superimposes the linehole. All color stations are moved into rough initial register to the linehole.

Front-to-Back Color-to-Color Initialization

Another application is the front-to-back color-to-color initialization. By selecting targets on each side of the web, the color stations of one side of the web can be brought into rough register with the key color on the opposite side of the web. This is possible thru the setting of global coordinates. Global coordinates will be described in detail later in the document. When motor movement is complete, on the top side of the web the colors will be in rough register, the back colors will be in rough register on the back side, and all of back colors will be in rough register with the top side of the web.

Register Applications with Speed Changes

Register errors can be accurately measured for applications where the web speed is not constant which heretofore was not possible with existing technology. An example will be disclosed where this feature enables a substantial reduction of waste material.

Register Applications with Focal Distance Changes

The teaching of Zoom Lens Calibration enables applications where the camera can be located on an unsupported web where web flutter will cause erratic changes in focal distance. For every image the distance measurement is recalibrated. Thus, these variations have no affect on overall accuracy. This unique feature enables new print registration applications such as the location of a camera directly after a print unit in web offset printing where substantial web flutter is present with the result of a substantial reduction in waste material.

Complete Automatic Register Control All Variables

With either multiple cameras or using a traversing camera multiple mark patterns are scanned providing the capability for automatic adjustment of color or object registration in the X and Y directions, splitting of artwork errors over the complete repeat, and for web growth commonly referred to as fan-out.

Methods

Three methods of identifying targets and determining offsets will be described: the superimposed method, mark pattern alignment, and the drag method.

Superimposed Targets

The superimposed targets method uses printed control objects as the targets which, when in final register, are superimposed print on the web. When the printing press is in registration, all of the printing stations would print an object such that all of the objects align on top of each other on the web. The X and Y coordinates of the objects would be the same.

A printed control object is an ink deposit of any shape by a printing station. Typical control objects are, but not limited to: cross hairs, rectangles, squares, circles, horizontal lines, vertical lines, arrow shapes, star shapes, or any combination thereof. The control object is an ink deposit that is used as an aid by the press operator to bring the press into (and hold) final registration. The control object is not typically an object of the final product, rather an additional object either within, among, or adjacent to the final product. The use of a control object, or "bug", is a common practice in the industry.

Although the control object is used extensively, this method does not require a control object. Any objects that are printed superimposed when in register would suffice.

Advantages

The present invention utilizes control objects as targets that currently exist in the manual initial register process. Press operators and the art department that generate cylinder plates are familiar with the use of the object.

Disadvantages

The present invention is prone to error where the operator may select a target that may not be superimposed with the key when the press is in final register. In this case the erroneous target station will be moved significantly out-of-register.

Mark Pattern Alignment

The mark pattern alignment method uses the marks of a mark pattern as the target control objects. Each mark of the mark pattern is located on the web and corresponding X and Y coordinates are stored with the mark. The mark is then identified by which printing station prints the selected mark. The current mark pattern of the job is then selected for the camera web side. The actual in register locations of the stations are defined in the mark pattern. The stations are moved such that the marks end up in the alignment and orientation of the mark pattern.

Advantages

The present invention utilizes one set of control objects for initial and final register processes. This would be significant in printing work where the majority of the web is reserved for final product.

Disadvantages

The present invention requires another control object area of the web where cylinders cannot print.

Drag Target

The drag target method utilizes the touchscreen interface in that the user points to the object on the image, and "drags" the cursor to the desired in register location on the image. When the user stops the drag, and removes the "touch" from the touchscreen, the current location of the cursor defines the desired location of the object. Coordinates are set, and offsets can be computed. Motor movement is started, and the user watches the object move into register in the updating image on the touchscreen.

Advantages

The present invention simplifies the process from a user interface point of view.

Disadvantages

Using the present invention drag target mode, the front-to-back and color-to-color initialization becomes a trial and error process. This drawback can be minimized by using some of the other automated features of the present invention.

BRIEF DESCRIPTION OF THE DRAWINGS

For a fuller understanding of the advantages provided by the invention, reference should be made to the following detailed description together with the accompanying drawings wherein:

FIG. 4 illustrates an exemplary Two-Camera Simplified System;

FIG. 5 illustrates an exemplary Two-Camera Simplified System with traverse;

FIG. 19 illustrates waste reduction statistics for an exemplary newspaper color registration application;

DESCRIPTION OF THE PRESENTLY PREFERRED EXEMPLARY EMBODIMENTS

Figure 1:
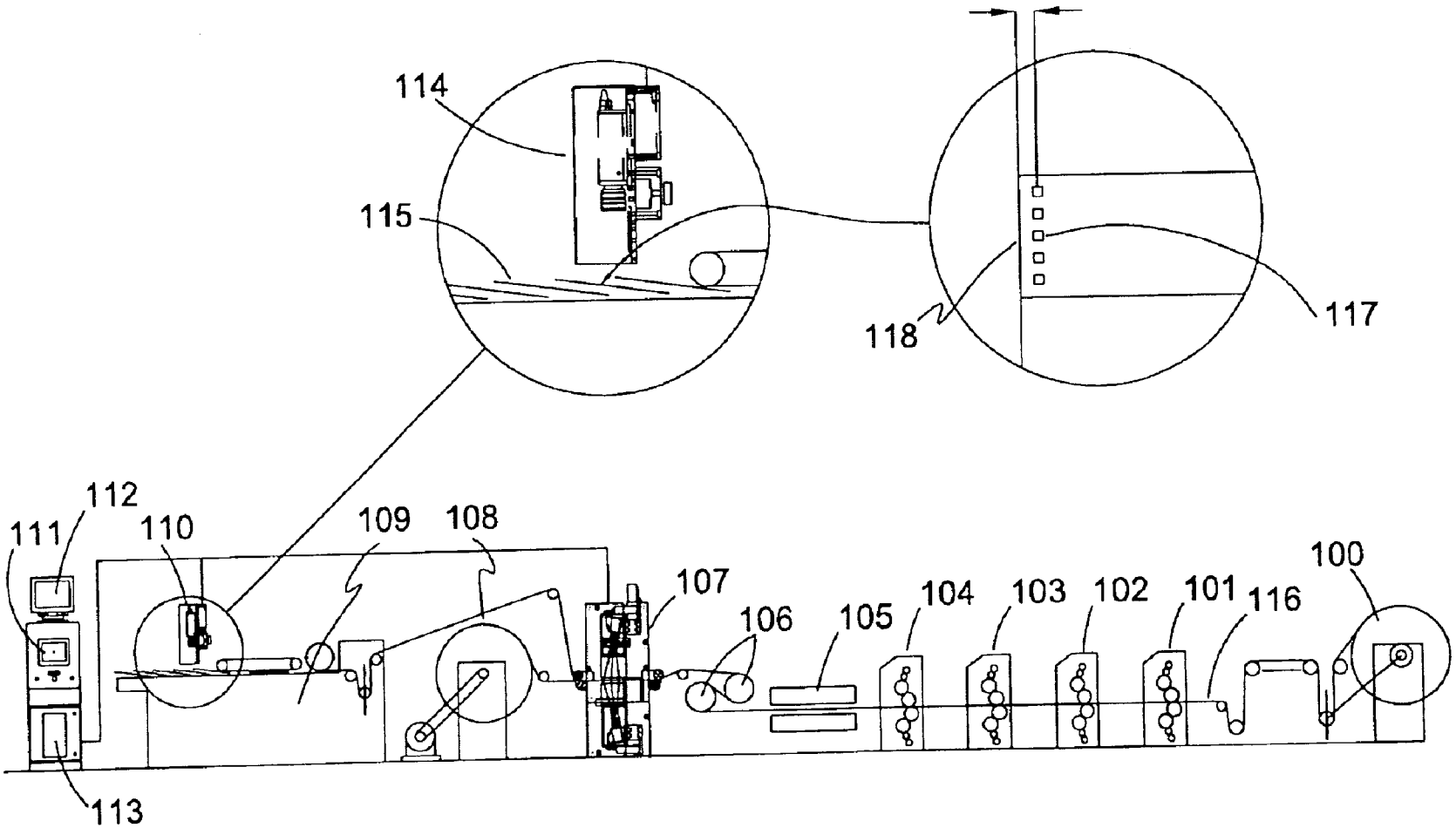
FIG. 1 illustrates an exemplary Press Configuration with Zoom Lens.

While this invention is susceptible of embodiment in many different forms, there is shown in the drawings and will herein be described in detailed preferred embodiment of the invention with the understanding that the present disclosure is to be considered as an exemplification of the principles of the invention and is not intended to limit the broad aspect of the invention to the embodiment illustrated.

Embodiments are Exemplary

While this invention is susceptible of embodiment in many different forms, there is shown in the drawings and will herein be described in detailed preferred embodiment of the invention with the understanding that the present disclosure is to be considered as an exemplification of the principles of the invention and is not intended to limit the broad aspect of the invention to the embodiment illustrated.

The numerous innovative teachings of the present application will be described with particular reference to the presently preferred embodiments, wherein these innovative teachings are advantageously applied to the particular problems of a SYSTEM AND METHOD FOR REGISTER MARK RECOGNITION. However, it should be understood that these embodiments are only examples of the many advantageous uses of the innovative teachings herein. In general, statements made in the specification of the present application do not necessarily limit any of the various claimed inventions. Moreover, some statements may apply to some inventive features but not to others. In general, unless otherwise indicated, singular elements may be in the plural and visa versa with no loss of generality.

Definitions

Throughout the discussion in this document the following definitions will be utilized:

System Blocks/Procedural Steps Not Limitive

The present invention may be aptly described in terms of exemplary system block diagrams and procedural flowcharts. While these items are sufficient to instruct one of ordinary skill in the art the teachings of the present invention, they should not be strictly construed as limiting the scope of the present invention. One skilled in the art will be aware that system block diagrams may be combined and rearranged with no loss of generality, and procedural steps may be added or subtracted, and rearranged in order to achieve the same effect with no loss of teaching generality. Thus, it should be understood that the present invention as depicted in the attached exemplary system block diagrams and procedural flowcharts is for teaching purposes only and may be reworked by one skilled in the art depending on the intended target application.

Personal Computer Not Limitive

Throughout the discussion herein there will be examples provided that utilize personal computer (PC) technologies to illustrate the teachings of the present invention. The term 'personal computer' should be given a broad meaning in this regard, as in general any computing device may be utilized to implement the teachings of the present invention, and the scope of the invention is not limited just to personal computer applications, or to a specific computer processor.

Additionally, while the present invention may be implemented to advantage using a variety of Microsoft™ operating systems (including a variety of Windows™ variants), nothing should be construed to limit the scope of the invention to these particular software components. In particular, the system and method as taught herein may be widely implemented in a variety of systems, some of which may incorporate a graphical user interface.

Touch Screen Not Limitive

Many preferred embodiments of the present invention make use of a touch screen interface as the primary means of communicating to the press operator. While this is the preferred method of communication, the present invention is in no way limited to this means of communication. Thus, the term 'touch screen' and/or operator interface should be construed in its broadest sense as being any means of communication between an operator (either locally or remotely) and the other components of the present invention embodiment.

English Measurements Not Limitive

The present invention will be described in terms of commonly used English system of measurements that is widely used in the printing industry. This in no way limits the scope of the present invention to applications using English measurement systems, as one skilled in the art will recognize that the present invention teachings may be applied equally well to similarly constructed systems using metric measurement systems, or scaled equivalents thereof.

Dimensions Not Limitive

Throughout the teachings within this document there may be specific mention of dimensions in regards to specific exemplary embodiments of the present invention. These dimensions are solely for use by those skilled in the art to aid in the understanding of the invention and are not meant to limit the scope of the teachings of the invention in any way. It is hoped that by providing a variety of concrete practical examples that include specific dimensions that the wide application of the teachings of the present invention will be made more clear to those skilled in the art. Thus, dimensions where given should not in any way limit the scope of teachings in regards to the present invention.

Marks Not Limitive

One skilled in the art will recognize that while several exemplary registration marking systems are disclosed in this document, this in no way limits the teachings of the present invention to these limited sets of registration marks.

Furthermore, while the geometry of marks shown in this disclosure is rectangular, any geometry may be suitable for use in the disclosed system. Therefore, the present invention specifically anticipates the use of common geometries such as rectangles, squares, circles, regular polygons, etc. within a wide variety of implementations utilizing the teachings of the present invention.

Additionally, duplicate marks mentioned herein can be in any configuration, including but not limited to rectangular arrays and other geometric patterns. In many preferred embodiments, however, columnar and rectangular arrangements have advantageous properties with respect to processing the web image data.

Sensor Not Limitive

While the present invention makes use of fixed lens camera systems in many embodiments, the scope of the present invention is not limited to this particular sensor mechanism. In practice, any method of acquiring a digitized image of the web would suffice for use with the teachings of the present invention.

Bit Resolution Not Limitive

One skilled in the art will recognize that while several exemplary image capture systems having 8-bit resolution are disclosed in this document, this in no way limits the teachings of the present invention to these limited bit resolutions. Sensor advances in the future will no doubt improve this resolution or permit use of cameras with different resolution bit widths.

Presses Not Limitive

While the present invention may be advantageously applied to offset printing presses, nothing in the teachings of the present invention limits the scope to this particular application. In fact, one of the strong advantages of the present invention is that it may be retrofitted or integrated into a wide variety of older printing presses to improve their overall performance and waste generation characteristics. Thus, the present invention may be applied advantageously to both new and old presses in either an integrated or after-market configuration.

Printed Objects

Printed objects—any ink deposit from the printing cylinders that has a defined boundary in an image.

Station

Station—a set of cylinders on a printing press that deposits one color of ink.

Targets

Targets—any printed object used to define the location of the ink deposits of a station.

Marks

Marks—ink deposits printed to a pre-defined size and shape, typically a square with half millimeter dimensions.

Mark Pattern

Mark Pattern—a set of marks printed to with a pre-defined orientation and dimensions.

Key

Key—a printed or other existing object that can be viewed in an image.

Offsets

Offsets—a calculated distance difference in the X and Y coordinates from a current station position to a pre-defined station position.

Basic System Overview

Figure 57:
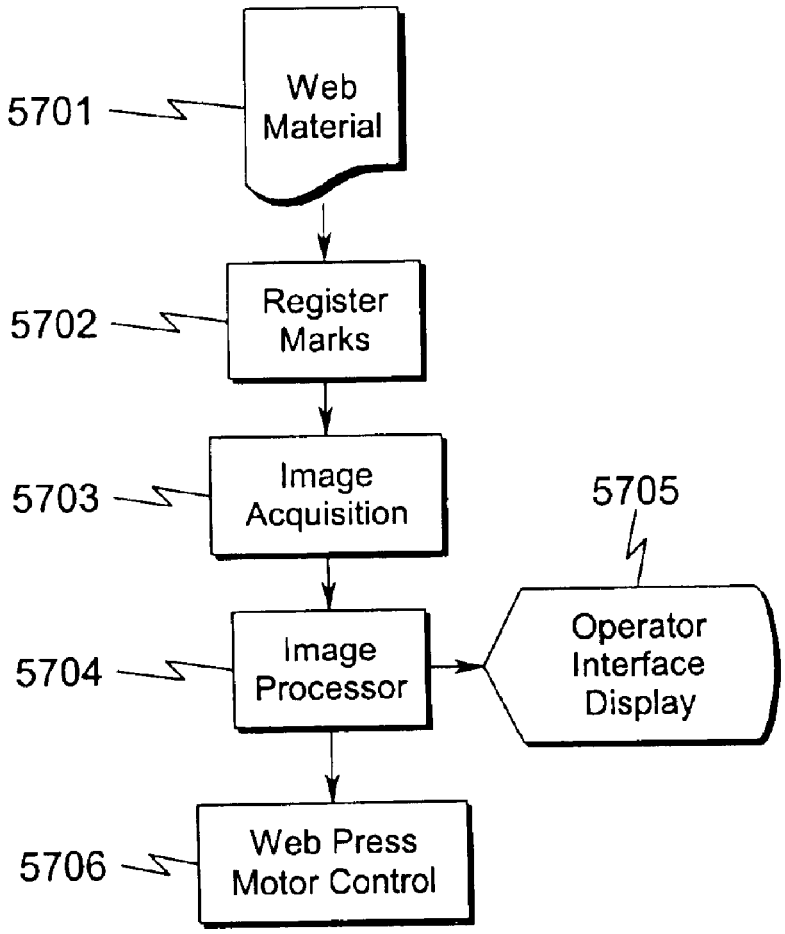
FIG. 57 illustrates an exemplary system process flowchart implementing the basic functions of a registration mark recognition system.

At its most basic level, the system disclosed by the present invention system is illustrated by the symbolic flowchart of FIG. 57. Here a web material (5701) incorporates register marks (5702) that are inspected by an image acquisition system (5703). This image is manipulated by an image processor (5704) that then interacts with an operator display (5705) and press motor controls (5706) to affect print registration of the web material (5701).

Basic Method Overview

Figure 58:
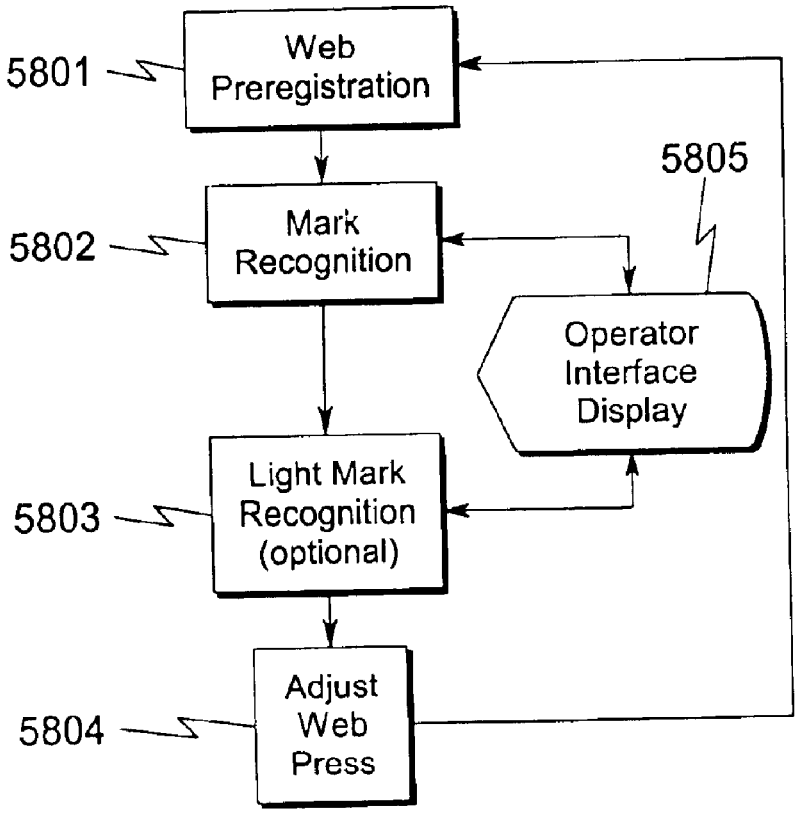
FIG. 58 through FIG. 59 illustrate exemplary process flowcharts implementing the basic functions of a registration mark recognition method.

At its most basic level, the method disclosed by the present invention is illustrated by the symbolic flowchart of FIG. 58. Here a web preregistration step (5801) initially aligns the web registration. This is followed by a mark registration step (5802) that may include a light mark registration step (5803). The output of these steps is optionally displayed on an operator display (5805). Additionally, depending on the result of the mark recognition (5802) and light mark recognition (5803) steps the web press may be adjusted (5804) to achieve the desired print registration.

Figure 59:
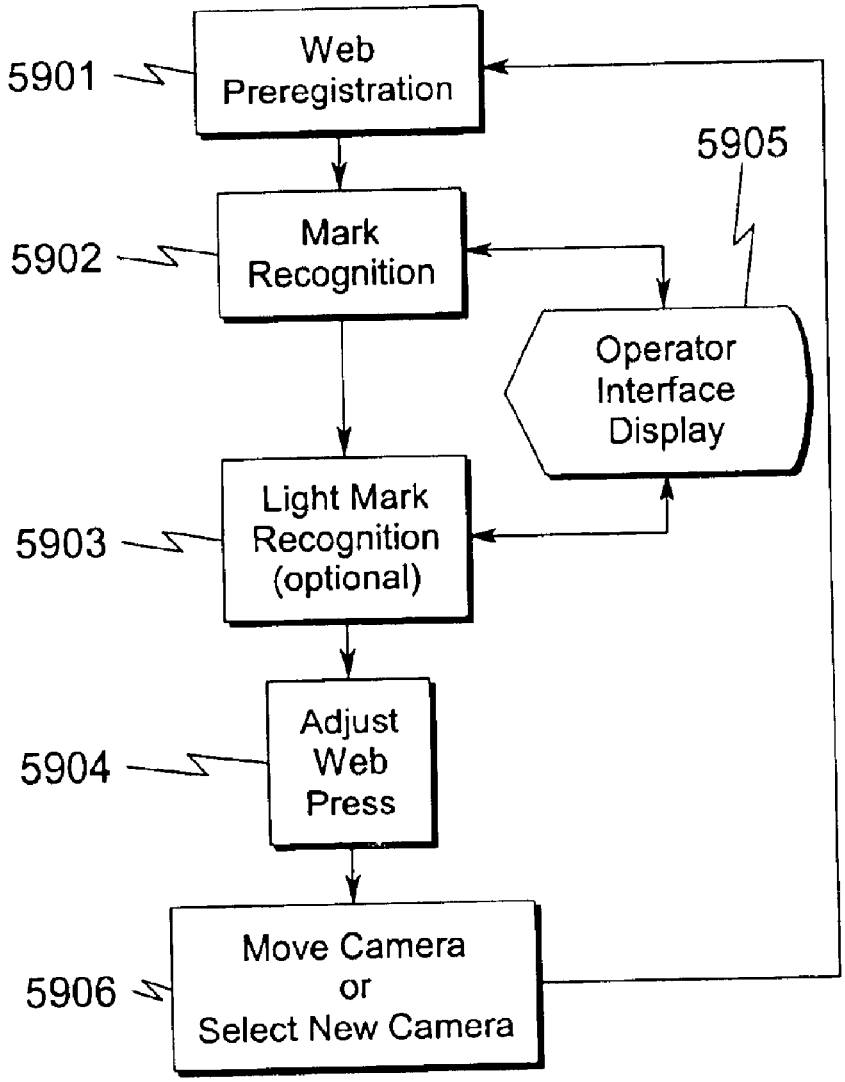

As illustrated in FIG. 59, the process of FIG. 58 may be optionally augmented by steps that move the image acquisition camera or select a new image acquisition camera (5906). This permits full width web registration to be performed at a very low cost.

Reduced Cost System Overview

FIG. 1 comprising four printing stations (101, 102, 103, 104) that print four colors on both sides of the web (116). The web starts from the unwind stand (100) progresses through the four printing stations through the two-camera traversing mechanism (107) to either an unwind (108) or to a sheeter (109). The two-camera traversing unit is the same as shown in Zoom Lens Calibration and is shown in detail in FIG. 2. The two cameras (201, 202) are equipped with Zoom Lens (203, 204) respectively and are mounted on traversing mechanisms (207, 210). Thus, the two cameras can be located anywhere across the web and can view the high speed printed web when using the rewind. The system has the capability of stopping the motion, and freezing the image on the monitor so that detailed inspections can be made. The system can also be used to scan a mark pattern and automatically maintain register.

Figure 3:
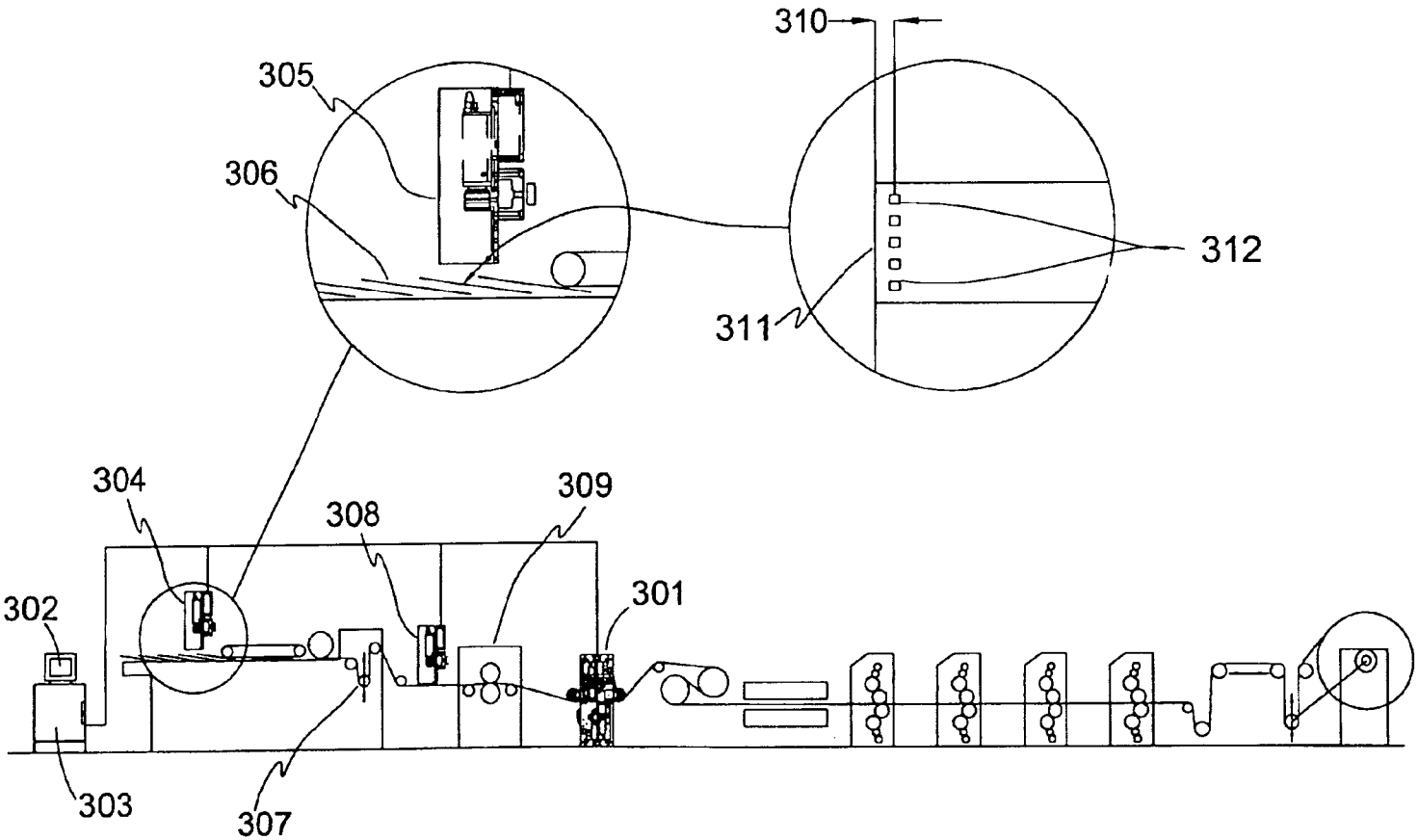
FIG. 3 illustrates an exemplary Press Configuration Simplified System.

FIG. 3 shows the same printing press of FIG. 1 with a much simplified two-camera system (301). FIG. 4 illustrates a detail of (301) showing the two camera assembles (401, 402). These two cameras are used for automatic register control and any other function that can be accomplished with a fixed lens stationary camera. They can be permanently positioned over a section of the printed web that contains the mark pattern. Thus, they can use a fixed lens and can be manually positioned across the web, therefore eliminating the need and expense of a Zoom Lens and the traversing mechanisms.

In addition the viewing monitor (112) of FIG. 1 can be eliminated requiring only the touch screen (302) of FIG. 3. The touch screen is used in this disclosure for the dual purpose of providing real time images of the mark pattern and as an operator interface. The two stationary cameras with fixed lens can provide the same functions of automatic register control as that of FIG. 1 or any other function that can be performed with stationary cameras with a fixed lens. The cost of the system of FIG. 3 is less than one/third the cost of the system of FIG. 1.

Fixed Lens Cameras with Traversing Mechanism

Figure 2:
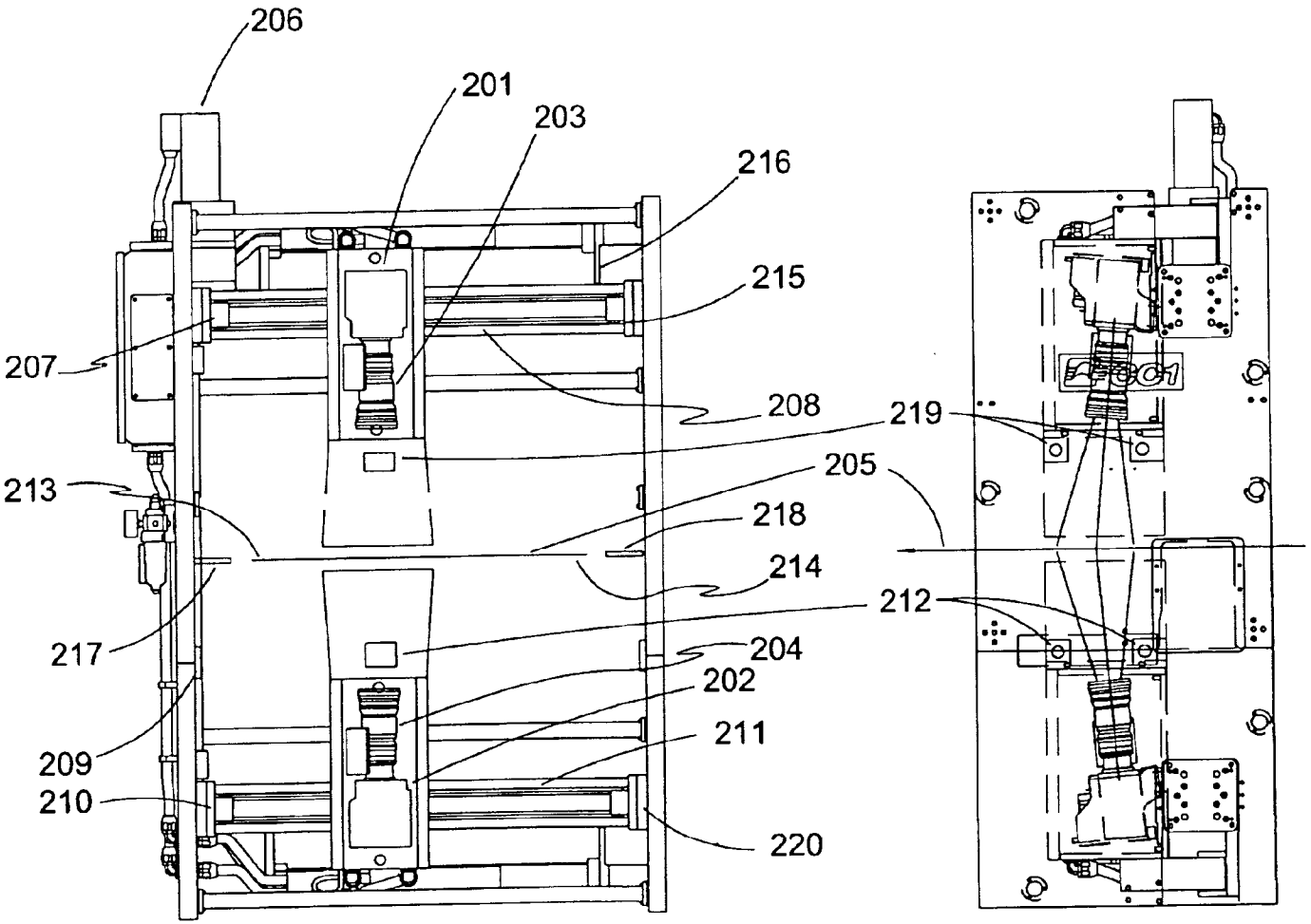
FIG. 2 illustrates an exemplary detailed Two-Camera Zoom Lens System.

The stationary fixed lens cameras of FIG. 4 can be motorized, thus enabling movement of the cameras laterally across the web in the same manner as the cameras equipped with Zoom lens of FIG. 2.

The motorized fixed lens cameras are shown in FIG. 5. The top camera (501) has a traversing mechanism (503) driven by motor (506). The bottom camera (502) has a traversing mechanism (504) driven by motor (507).

As in Zoom Lens Calibration two calibration plates (509, 510) are incorporated in the system (one for the top camera and one for the bottom camera) that allow the mounting and viewing of calibration plates to provide for absolute positioning and for absolute color measurement. As disclosed in Zoom Lens Calibration, precision distance measuring calibration plates were used to perform the same function as duplicate marks to calibrate any zoom position. These calibration plates can also contain color chips to calibrate colors (yellow, cyan, magenta, black, etc.) that would enable automatic initial positioning of keys further reducing make ready waste.

This fixed lens two cameras traversing assembly is considerably smaller and less costly than the Zoom Lens two-camera system of FIG. 2. It provides the capability of performing a number of new functions described herein that further automate register control and in addition measure and control color.

Material waste is composed almost totally of misregister and initially achieving color in the web offset process. The two-camera fixed lens system traverse of FIG. 5 is suited to address both of these areas of waste at very reasonable costs. The small size of the mechanism of FIG. 5 enables its application on most all existing web offset presses that are inline with a folder or sheeter where the Zoom Lens are not needed nor suitable because of their large size.

A single touch screen monitor is also used for both viewing and operator control thus reducing costs even further than that of FIG. 2.

The fixed lens traversing system of FIG. 5 is capable of performing all functions of the Two-Camera Zoom Lens System of FIG. 2 with the fixed lens chosen for one specific zoom ratio. As a practical matter the field of view is chosen for the higher resolutions required for automatic register control both in the X and Y directions for printed marks and objects and for monitoring color. For these applications, the traverse module is considerably smaller than the Two-Camera Zoom Lens System of FIG. 2 and thus is easily mounted in strategic positions on presses to small for the larger system of FIG. 2.

Duplicate Marks

In "Zoom Lens Calibration" duplicate marks were used primarily for the purpose of calibration of the Zoom Lens. In addition the duplicate marks provide automatic compensation for all other variables including errors in placement of the marks in prepress, on press camera focal distance changes, speed variations, and variations due to paper modulus and tension changes. Correction for all of these variables occur every time an image is taken and the duplicate marks are used in the manner as described in Zoom Lens Calibration and this disclosure.

Duplicate marks are used for the same purpose with a fixed lens as minor variations in focal distances due to positioning of the camera across the web would create register errors. Thus, the duplicate marks enable automatic calibration of the fixed lens without the need for providing a very accurate mechanism for maintaining an accurate focal distance across the entire web width.

Equally if not more important the duplicate marks provide calibration of distance measurement for every image which provides the capability to mount a camera on unsupported web with no adverse affect on register accuracy in the presence of web flutter. An example is the mounting of cameras directly after the printing nip on a web offset press and where back up rollers cannot be added as they would damage the printed image as the ink is not dry at this point. The result is further reductions in waste material as corrections can be introduced much sooner. The duplicate marks serve another very important function in that they enable the identification of the mark pattern providing for a completely automatic setup of the register control from finding and locating the register mark pattern to automatic operation.

Mark Patterns

Figure 6:
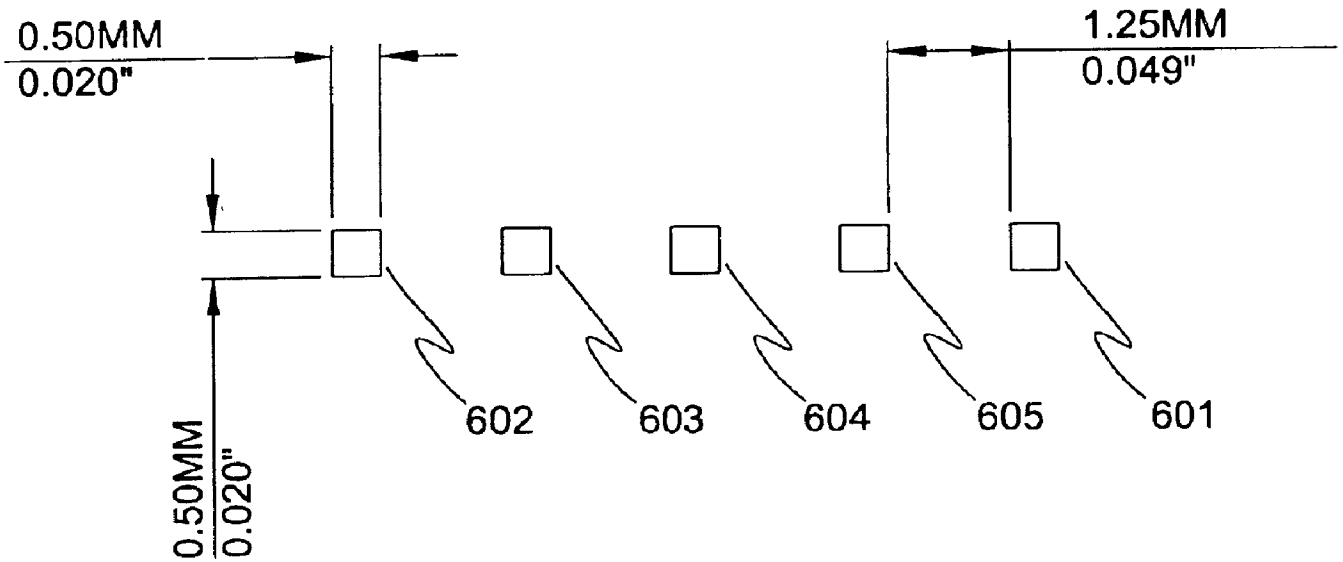
FIG. 6 illustrates a Mark Pattern with Four-color Duplicate Marks.
Figure 7:
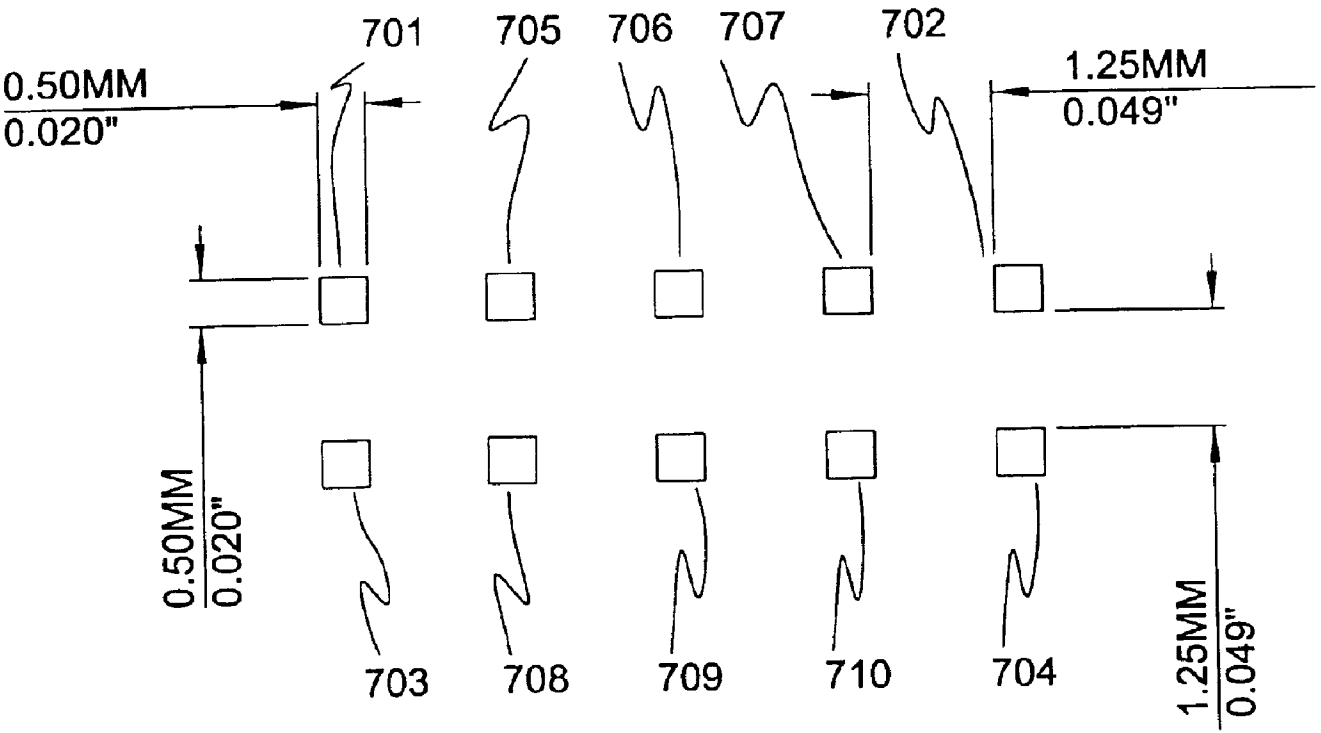
FIG. 7 illustrates an exemplary Mark Pattern with Seven-Color Duplicate Marks.
Figure 8:
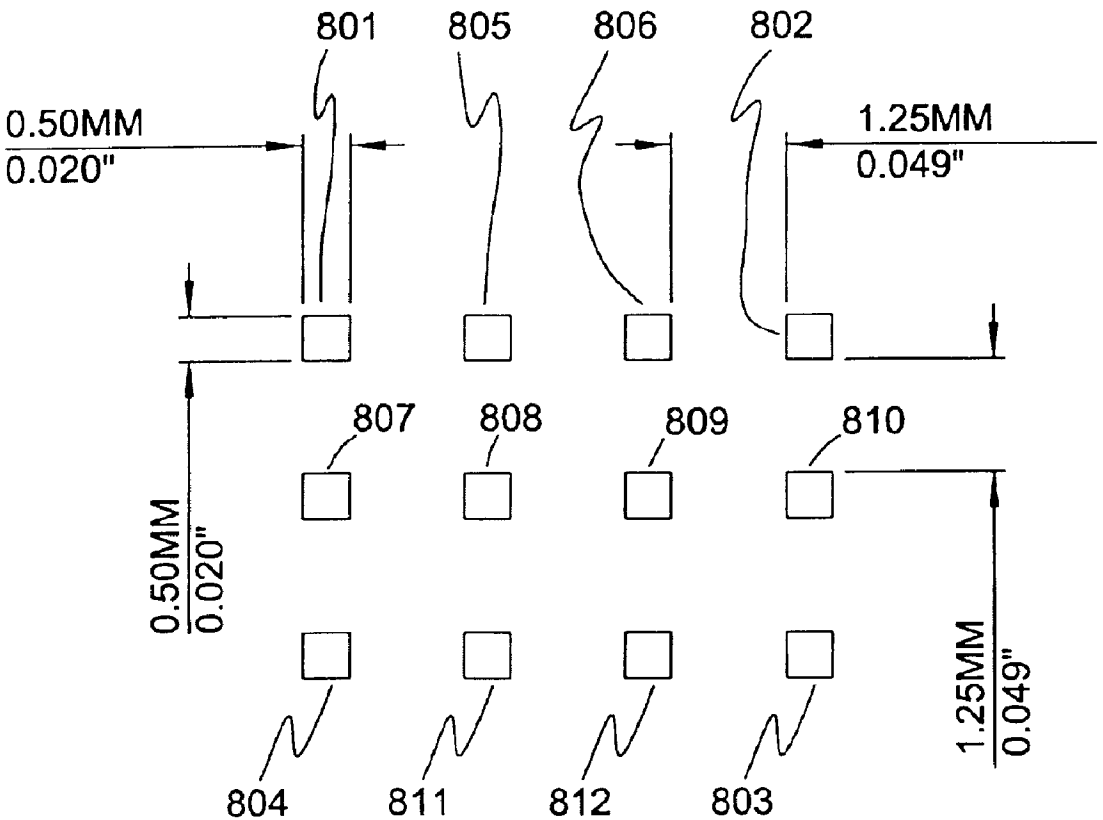
FIG. 8 illustrates an exemplary Mark Pattern with Nine-Color Duplicate Marks.

FIGS. 6–8 show three horizontal mark patterns which provide for a total of 4-, 7-, and 9-colors respectively. In FIG. 6 the duplicate marks (601, 602) illustrated are printed by the same color station. In FIG. 7 the duplicate marks (701, 702, 703, 704) are printed by the same color. In FIG. 8 the duplicate marks (801, 802, 803, 804) are printed by the same color station.

Register Mark Pattern Features

The simplicity and uniqueness of the mark recognition system to be described eliminates the need to coordinate a specific mark position in the pattern with a specific printing unit to print that color. That is, the prepress department can select any mark position and its color without regard for the press configuration or its installed register controls.

The operator (as will be explained) need only select the color unit that prints the color and its position within the selected mark pattern as will be described.

The identification or recognition of marks based on their color with full color images from a color camera is critical in the process of rapid setup and initial register to be disclosed.

All other register controls use some other means of mark identification such as different geometric shapes for each mark, or a specific sequence of colored marks. These conditions place an additional burden on both the prepress and printing press department as mark placement must be coordinated between the two departments or else the automatic register controls cannot be used correctly.

With all current systems considerable time and material are expended because of the necessity to manually position and align the marks very accurately within the mark pattern before the marks can be recognized and automatic register control be initiated.

Image Based Pre-Registration Process

Figure 30:
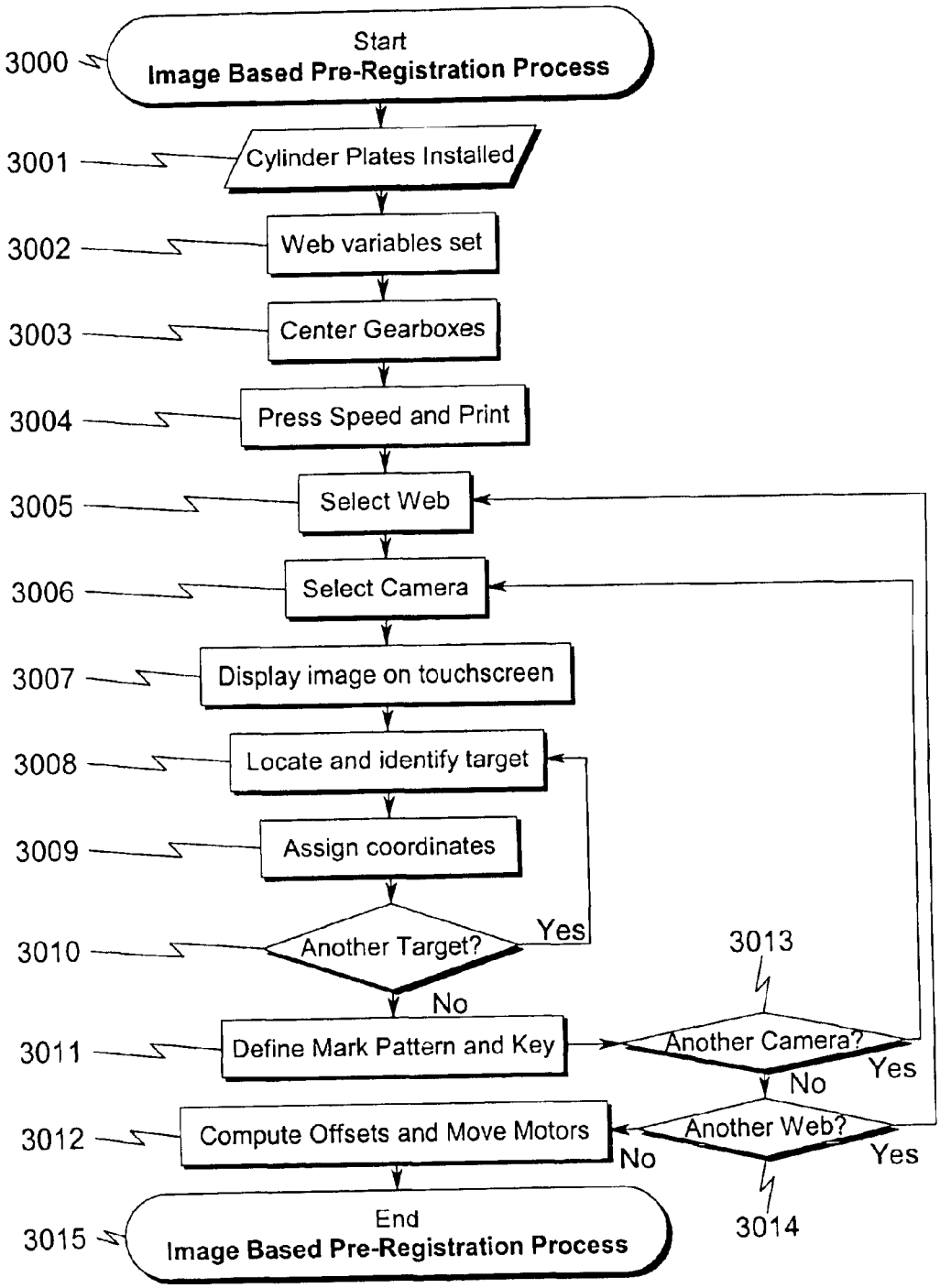
FIG. 30 illustrates an exemplary system process flowchart implementing an image based pre-registration system.

FIG. 30 illustrates an exemplary embodiment of the "Image Based Pre-Registration Process". This is the process by which register mark imaging is used as a means of bringing a press into initial or desired register. FIG. 30 is a step-by-step process of this concept (3000).

Before the imaging process can be started, a few preliminary steps must be undertaken on the press. First the cylinder printing plates must be mounted on each station's printing cylinder (3001). Important web variables such as web width and web length must be entered into the system (3002). All limited range register correction motors must have their gearboxes centered (3003). This is a process of driving a register motor for the total range time in one direction and then running the same motor in the other direction at approximately one-half the total range time. At this point the press is brought up to some nominal printing speed and it is made to print the material (3004).

At this point a touch screen interface may be used to locate all register targets on the printed material. This process is described in detail in the associated description for FIG. 14 contained herein. While a touch screen interface is utilized in many preferred embodiments of the present invention, any graphical interface may be suitable in this application. To locate the targets on the printed material the appropriate web (3005) and camera (3006) must first be selected on the touchscreen. The touchscreen displays an image of the current location of the camera (3007). Using controls on the touchscreen, the camera is moved to locate the first target (3008). When the target is viewable on the touchscreen image, the desired target is touched, assigned a station number, and given coordinates as to its location on the web (3009). This process is repeated with all desired targets (3010). With all targets defined for this camera, a desired register mark pattern and key station are selected (3011). This process is repeated for each desired camera (3012) and web (3013).

At this point all web mark patterns are located and the motor movements or "offsets" can be computed. These movements are calculated based on moving all the targets to their desired register mark pattern locations (3012). This concludes the "Image Based Pre-Registration Process" (3015).

Initial Rough Register Alignment Procedure

The mark pattern of FIG. 8 is used to describe the initial rough register alignment procedure. FIG. 8 includes dimensions of the mark pattern stored in memory to identify the mark positions and their offsets for automatic alignment as will be explained.

Figure 9:
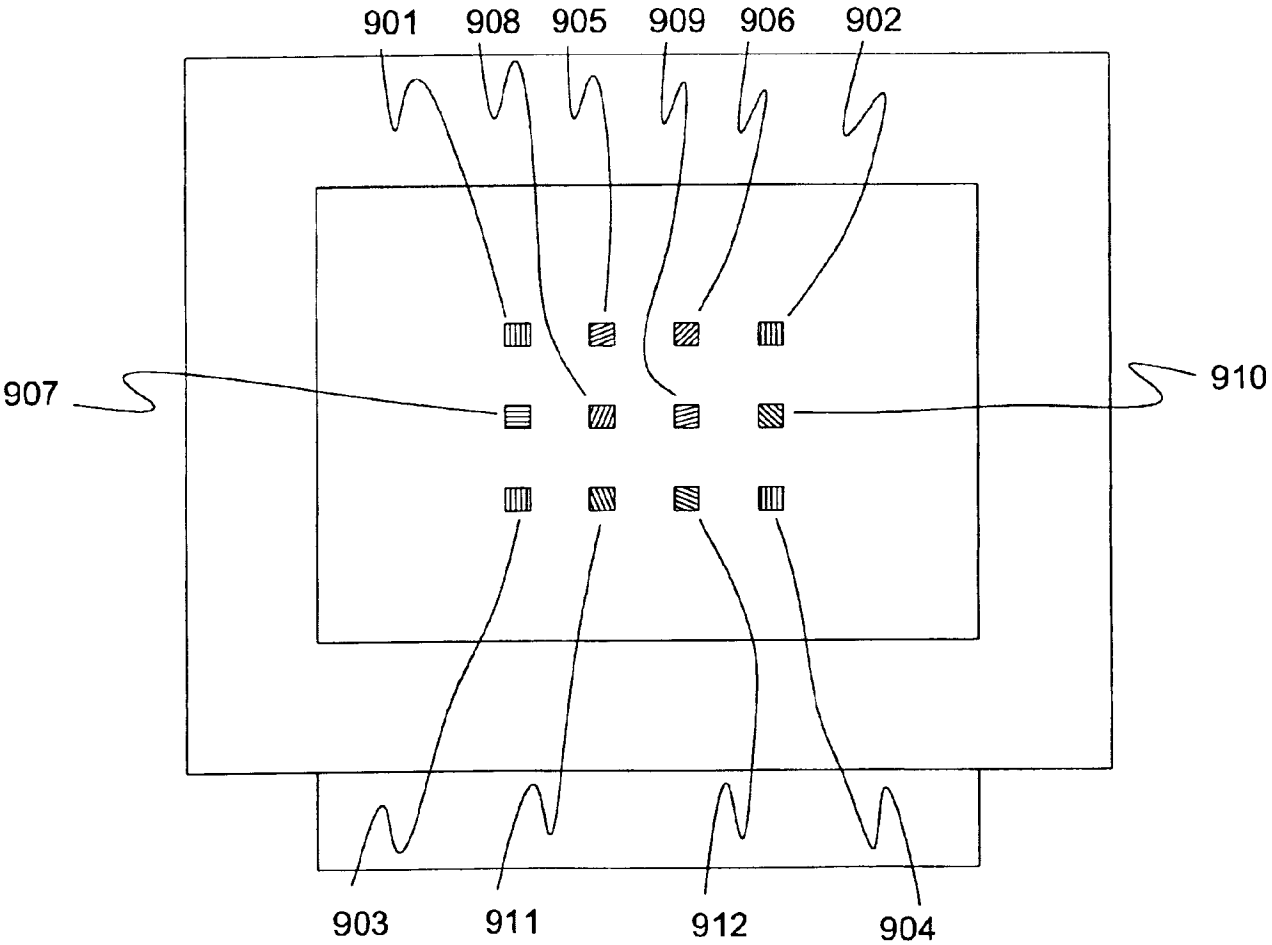
FIG. 9 illustrates exemplary mark positions after final alignment.

FIG. 9 shows the mark pattern of FIG. 8 as it will appear after all of the marks are aligned according to the following procedure. Each different colored mark is represented by a different cross hatching for the purpose of this discussion. In practice all marks can be easily identified on the monitor as they are of different colors. A high color fidelity camera and monitor are used with RGB color rendition thus allowing the identification of any color that is printed.

Figure 10:
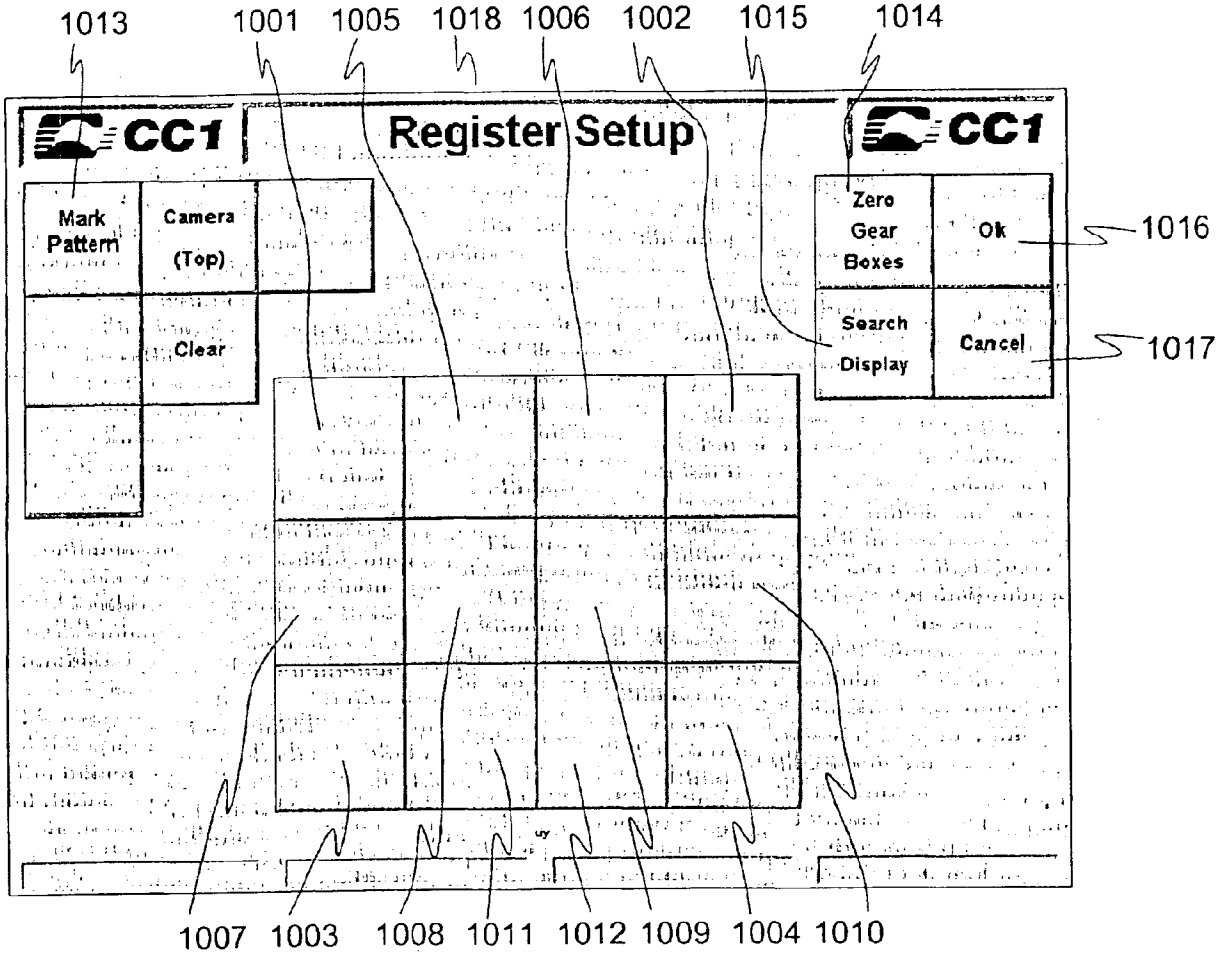
FIG. 10 illustrates exemplary register setup mark positions.

The steps in achieving initial register are as follows:

1. FIG. 10 illustrates the Register Setup screen that is selected from the main menu (not shown). The four-by-three mark pattern is the same as mark pattern as FIG. 8. Any one of several programmed mark patterns can be selected by repeatedly pressing the button labeled "Mark Pattern" (1013) of FIG. 10 until the selected mark pattern appears.

Next the "Zero Gear Boxes" button (1014) of FIG. 10 is depressed. Software is included which centers all limited range mechanical register adjusting mechanisms. All motors will move to one extreme limit switch and return one-half of the time that it would take to move from one extreme limit switch to the other extreme limit switch. This assures that the starting point is with all mechanical adjusting mechanisms at their center of travel thus limiting the possibility of running into a mechanical stop with a substantial loss of time and material.

The next step is to assign the number of the printing unit to each mark position. This is accomplished from information contained in the color proof that is given to the press operator before he starts up the job. The color proof includes the mark pattern with the actual color of the mark in each position of the mark pattern. Each mark in the pattern is matched with the number of the printing unit that will print that color as follows.

Figure 11:
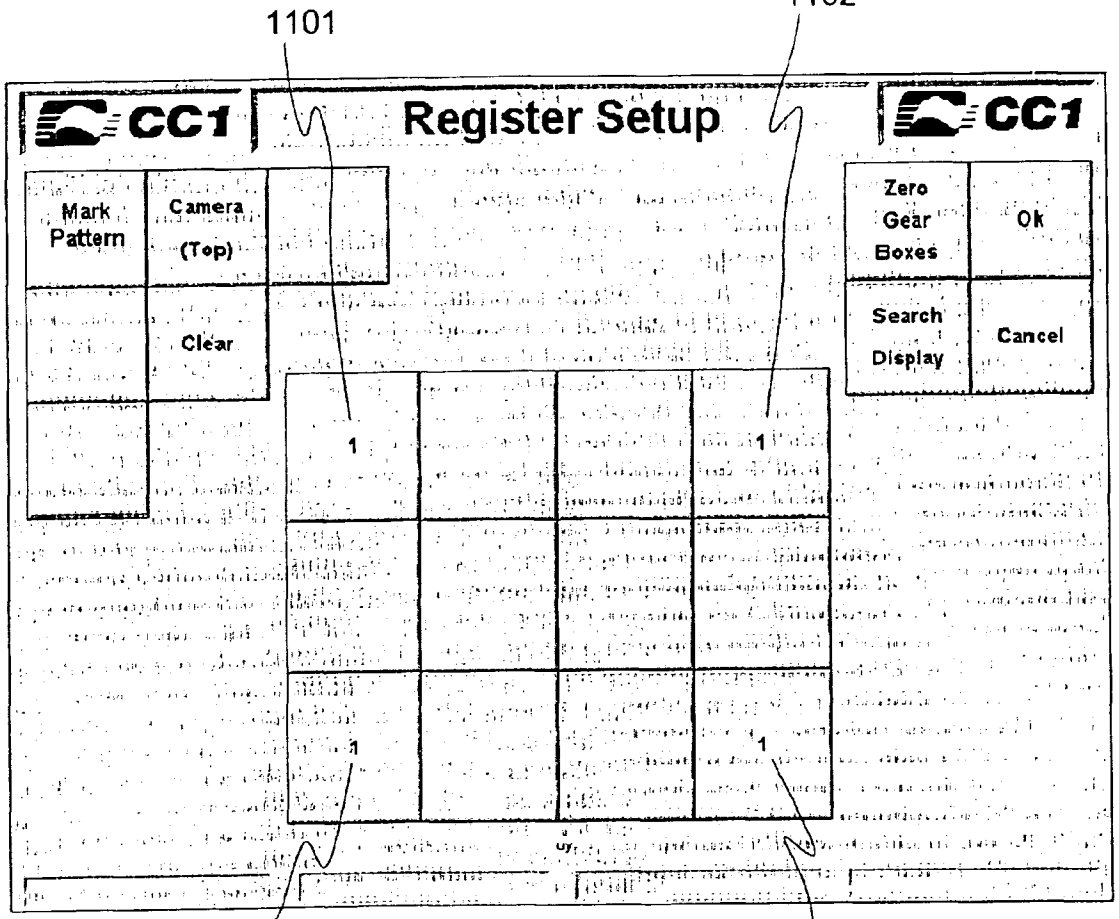
FIG. 11 illustrates exemplary register setup duplicate marks.
Figure 12:
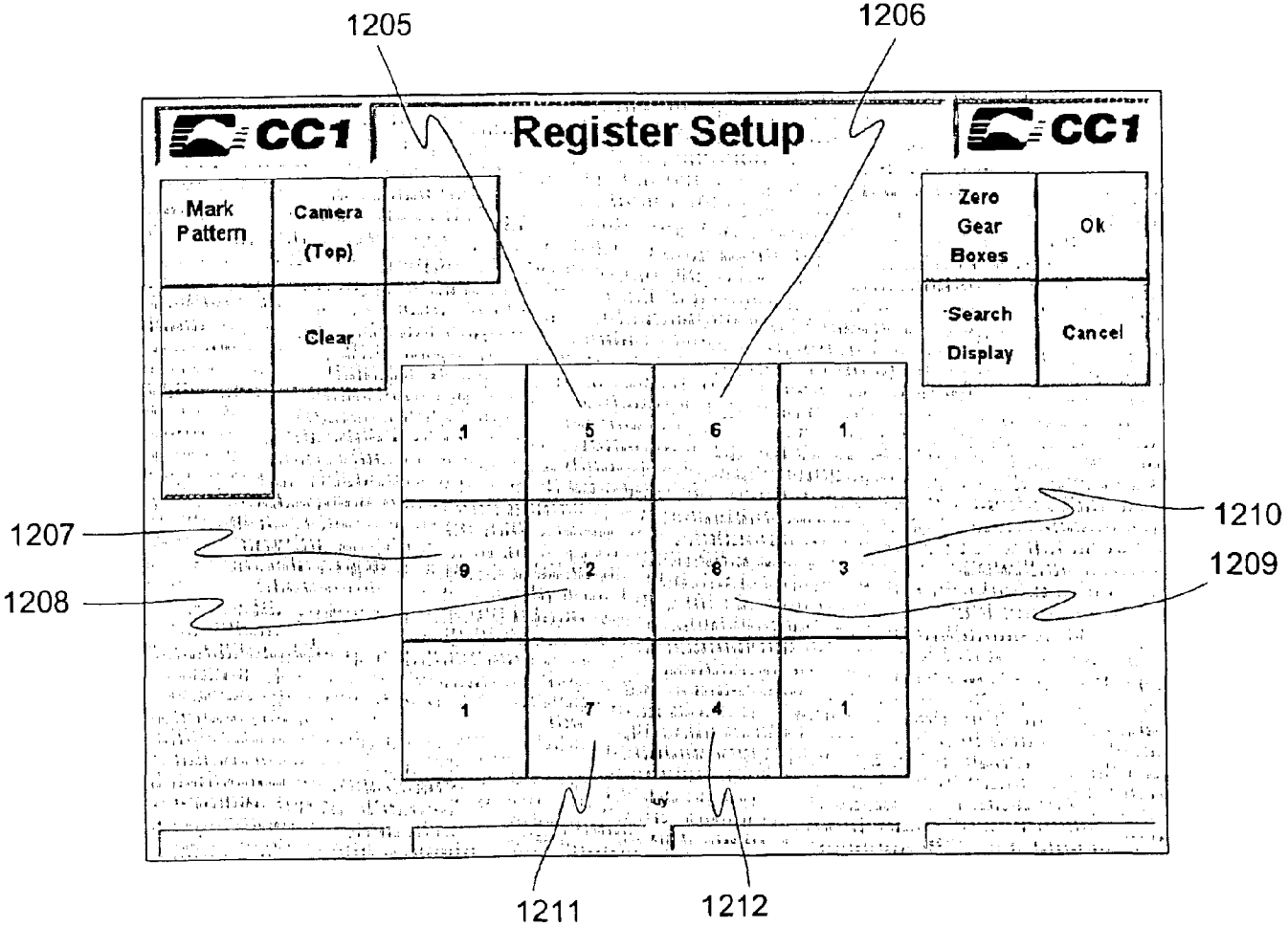
FIG. 12 illustrates exemplary register setup with all marks.

For example, if the duplicate marks are printed at color unit number 1, than any one of the four duplicate mark positions (1001, 1002, 1003, 1004) is touched once by the operator and the number of the printing unit (1) will appear in all four duplicate mark positions (1101, 1102, 1103, 1104) as shown in FIG. 11. FIG. 12 shows the remaining mark positions selected in the same manner depressing each button in turn until the number of the printing unit that prints that color appears in each box.

Specifically FIG. 12 shows mark (1205) selected as printing unit 5, mark (1206) selected as printing unit 6, mark (1207) selected as printing unit 9, mark (1208) selected as printing unit 2, mark (1209) selected as printing unit 8, mark (1211) selected as printing unit 7, and mark (1210) selected as printing unit 3, and mark (1212) selected as printing unit 4. In this manner the offsets for each mark can be calculated for each mark based on previously programmed information for each selected mark pattern.

Figure 13:
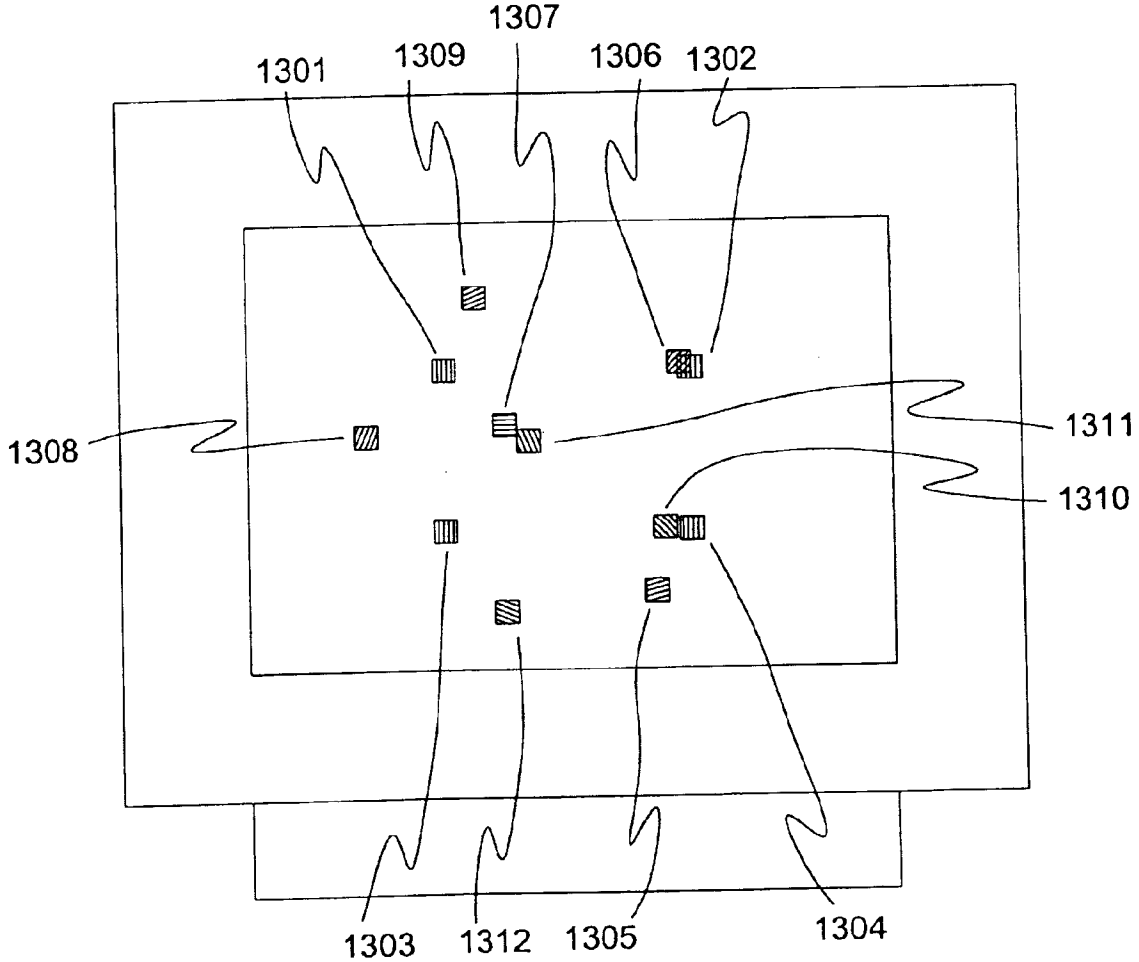
FIG. 13 illustrates exemplary typical mark positions after changing plates before initialization alignment.

2. The press is started and an image of all marks and their relative positions is obtained and frozen and the press can be stopped if desired. FIG. 13 illustrates a typical image of all marks before initial register has been achieved as shown in FIG. 9. Note the mark position errors are due to plate register and mounting errors that can result in marks overlapping (1306, 1302), touching (1307, 1311), and very close (1304, 1310). Every time new plates for a new job are installed an entirely non-predictable pattern will appear with any or all of these conditions present. Since the range of the register correction mechanisms is about plus or minus one-eighth of an inch, the initial register errors must fall within this range or it would not be possible to get the marks in register.

Figure 14:
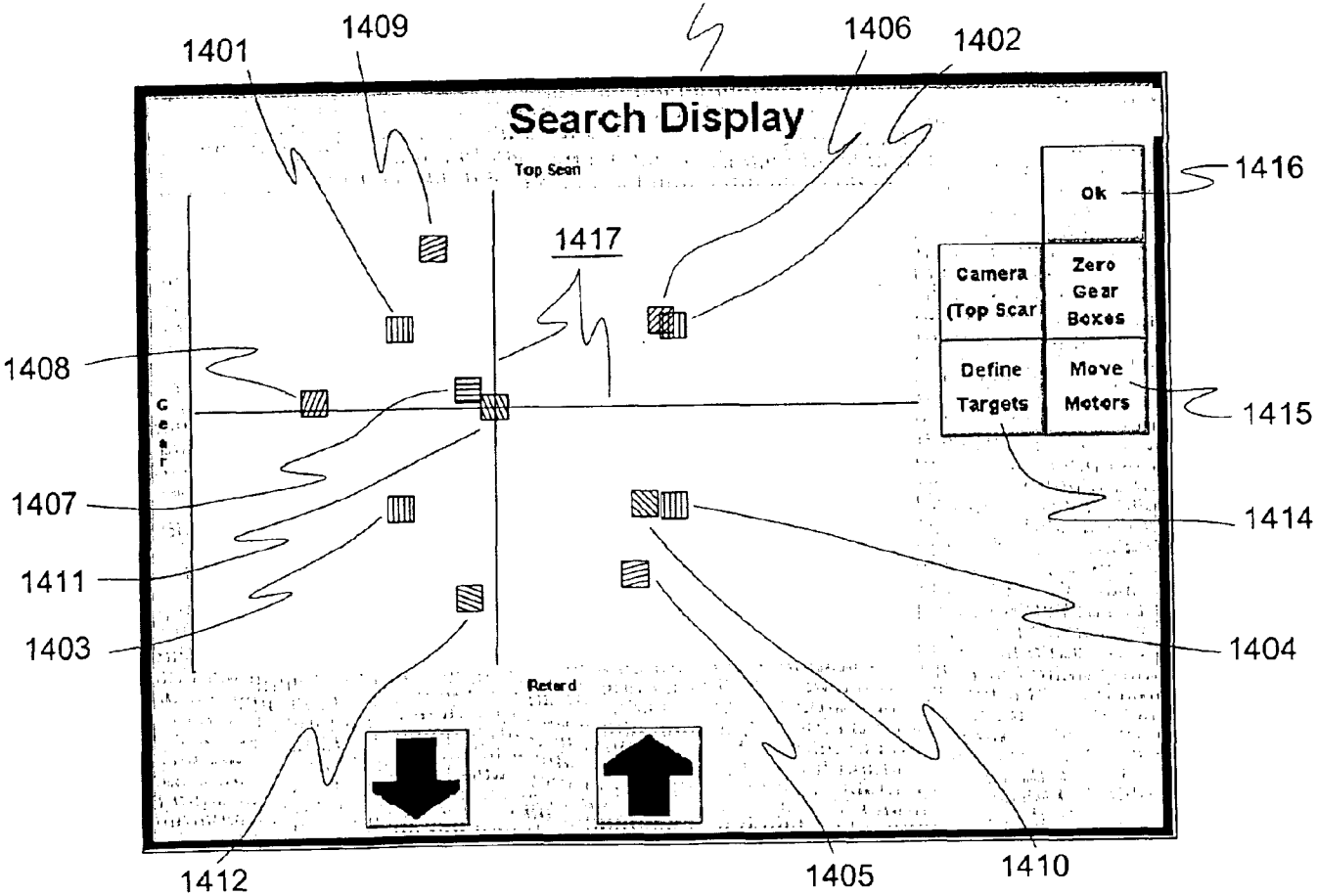
FIG. 14 illustrates exemplary select print stations cross hair within a search display.

3. Calculation of initial register errors is accomplished as follows. The initial register pattern of FIG. 13 is shown in FIG. 14 on the touch screen monitor with a superimposed menu (1413). The button (1414) "Define Targets" is pushed and the cross hair appears (1417). The operator puts his finger on the intersection of the X and Y cross hair (1417) and drags it to the center of each mark in sequence.

Figure 15:
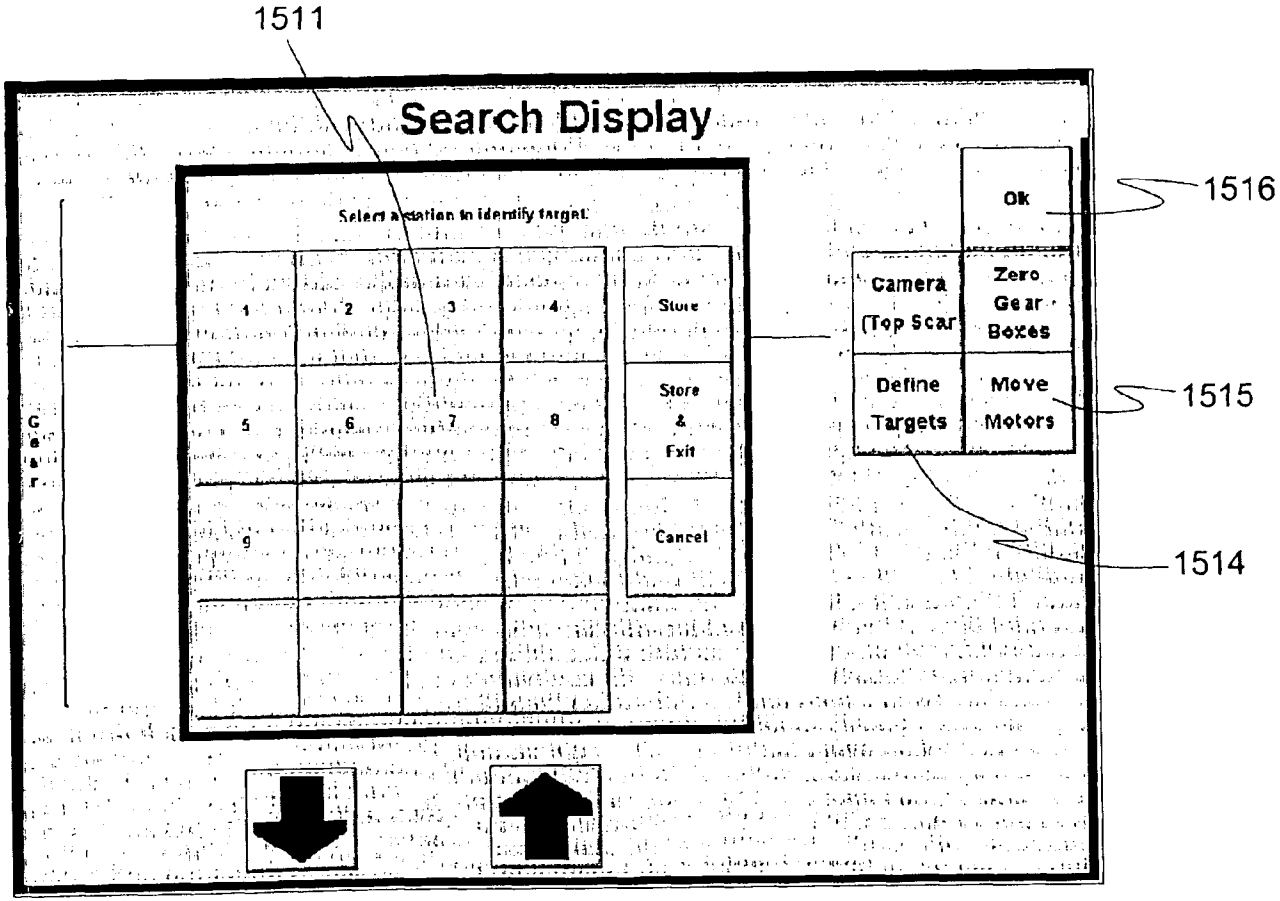
FIG. 15 illustrates exemplary assignment of print units within a search display.

When the cross hair is centered over the chosen mark, the button (1416) "OK" which brings up the menu of FIG. 15. The number of the color unit that prints this color mark is selected and pressed at the touch screen. The cross hair is dragged to each mark in turn with the number of the color unit that printed that mark selected in FIG. 15. Note: All four of the duplicate marks are selected per the above procedure with the same color unit selected as it prints all of the duplicate marks.

At the completion of this procedure all marks and their position in the mark pattern, the amount they must be moved to be in register, and the printing unit in which the mark is being printed have been identified.

4. To complete the procedure the "Move Motors" push button (1515) is pressed. All motors will move the exact amount required for the marks to take their correct position in the mark pattern. The correction motors are generally 2-phase synchronous motors that correct proportional to the time that they are energized. These ratios are entered and stored in the computer so exact correction can be introduced thus assuring the marks will be very accurately moved to their proper position. Note that the press need only run for as long as a single image can be obtained from which the initial register errors are determined according to the procedure just described.

Figure 16:
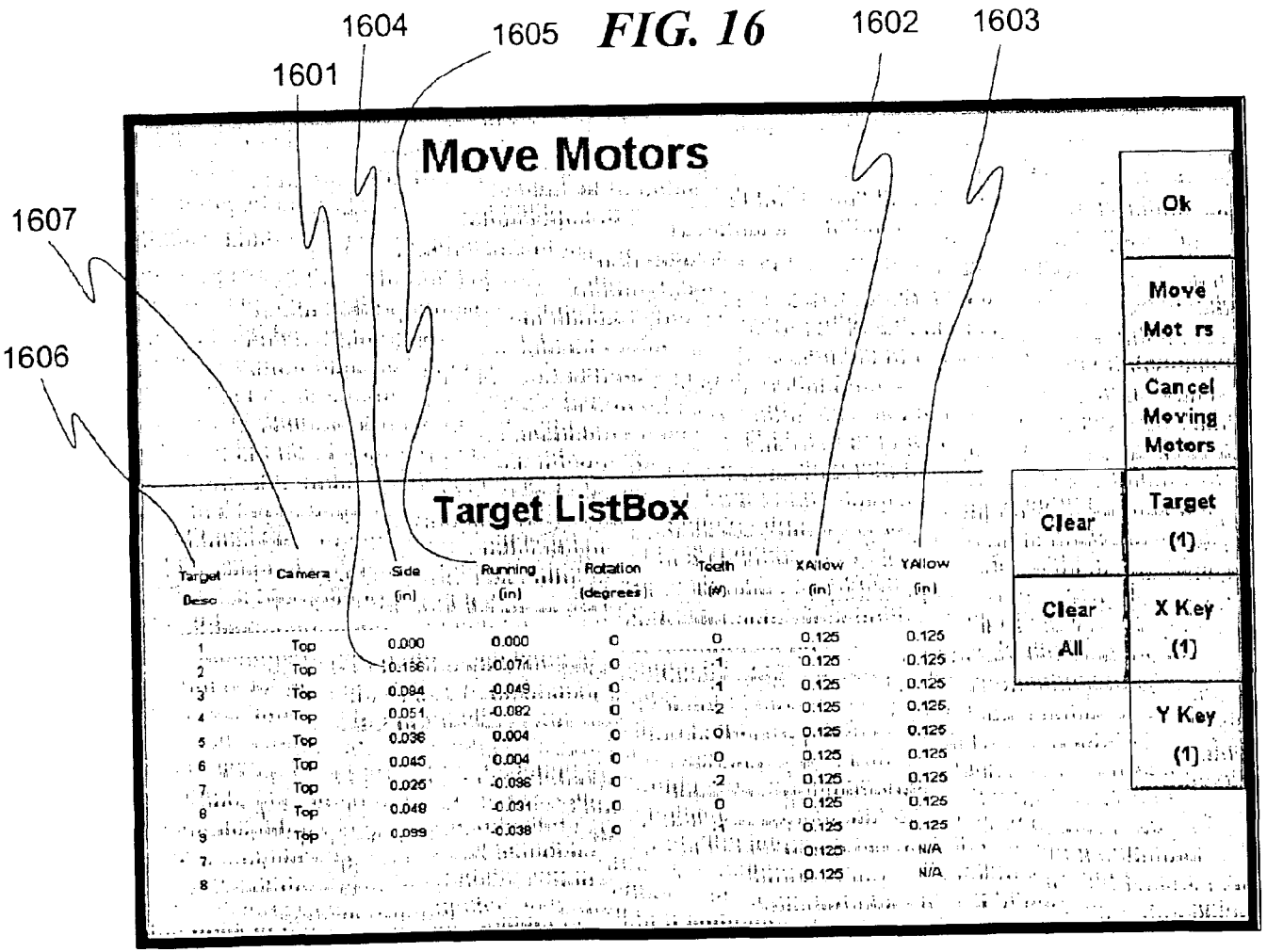
FIG. 16 illustrates exemplary initial register required corrections for alignment.

5. FIG. 16 is generated at the completion of step 3 and before the correction motors are energized. It displays the color units (1606), the camera associated with these colors unit, the amount of side (1604) and running register (1605) errors that with correction will center all marks within the correct position in the mark pattern. It also displays the amount of allowable correction dictated by the range of the correction mechanisms for this example as 0.125-inch in the X direction (1602) and the Y direction (1603).

It can be seen that the side correction of unit 2 is 0.168 with a maximum correction of 0.125. Thus, the error is greater than the maximum amount of correction available. Therefore, this station cannot be brought into register requiring the plate be remade and remounted. This saves considerable time and material as in the past the operator would try to obtain registration and after considerable time and material have been expended he would find out that the job could not be registered and that the plate must be remade and remounted.

Alternate Method of Mark Identification

Figure 17:
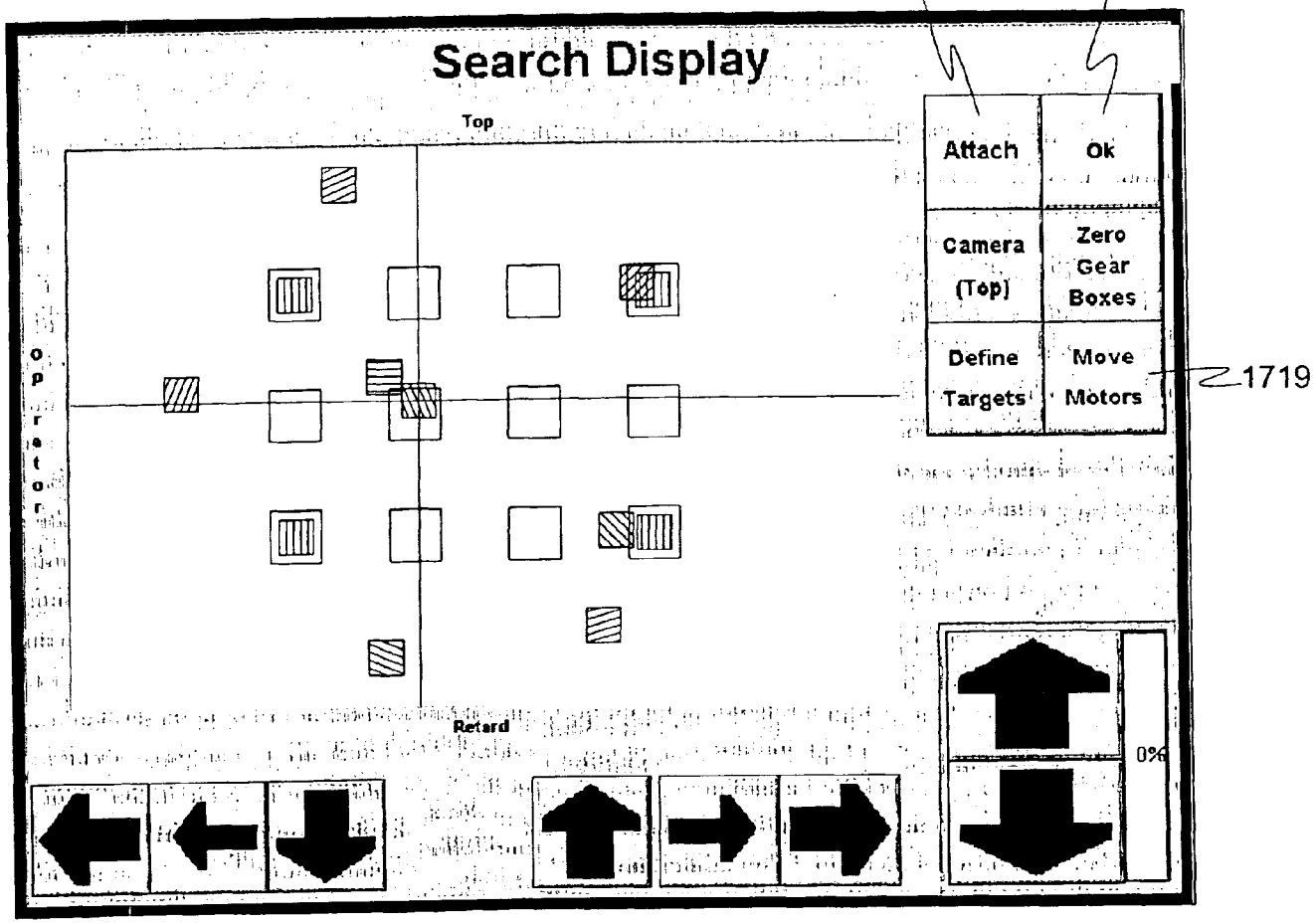
FIG. 17 illustrates an exemplary drag method for rough register alignment.

An alternate procedure is to identify both the printing unit that prints the color and the mark position in one step. This is shown in FIG. 17 using the same initial register pattern of the previous example. Note that in this procedure boxes appear that denote the final register mark pattern of FIG. 8 and The procedure for initial register using this procedure is as follows:

1. Move the cross hair over each mark in turn as before and when centered press (1717) "Attach" button. The cross hair will then drag the mark to the correct box that is its position in the mark pattern. When completed press (1718) "OK" and the menu from FIG. 15 will appear. Select the number of the printing unit that prints the mark as before. Select each mark in turn and drag it to its correct position in the mark pattern and identify the printing unit in which it is printed.
2. When all marks have been processed as stated, the "Move Motors" push button (1719) is depressed and all marks will move to their respective position in the mark pattern.

The drag method seems simpler as it reduces the number of steps in the initial register process. However, it is more prone to error as the operator must perform two operations on each mark selection instead of one. The procedure is more suited to dragging objects to areas where they will be in register with printed marks.

Reduced Mark Spacing

An advantage of the web offset printing process is copy changes can be made quickly and very inexpensively more so than with any other printing process. Each time a copy change is made, new plates with the new copy must replace the old ones. On all presses when new printing plates are mounted on the printing cylinder, there are color-to-color register errors due to variations in plate making, errors in mounting the plates on the press and errors due to the mechanical mechanisms which correct register not being in their ideal center position. These errors are considerably greater than the normal register variations caused by variations in the printing substrate during printing. As an example on most of the newer single repeat perfecting web offset presses have color register variations due to variations in the printing substrate and will stay within about 0.005 to 0.010 inch without register controls and to about 0.001 or 0.002 inch with register controls. Thus, it would be possible to have marks with spacing of 0.010 inch between marks providing a very tiny mark pattern that could easily by hidden within the artwork in an unobtrusive manner. While this has been tried in the past (without the procedure of manually positioning the marks as just described), substantial waste was incurred due to the need to manually align the marks to very tight tolerances before the system could recognize the marks.

Thus, initial register techniques enable very small and closely spaced marks that provide automatic register control under normal running conditions with a means of rapidly aligning the marks when plates are changed and where register misalignment may be orders of magnitude greater than the register errors encountered during steady running conditions.

Optical and Electronic Magnification

The image captured by the present invention can be magnified both optically and electronically. The selection of the fixed lens field of view determines the optical magnification and is a function of the application. For web offset printing a resolution of 0.001 inch is desired, which for a 512 by 512 pixel array provides a field of view of about 0.5 inches. This is more than sufficient to accommodate the initial plate areas as has been discussed. However, as smaller marks and spacing are utilized, it is desirable to electronically magnify the image enabling more accurate placement of the cross hair on the center of the mark when identifying the mark or dragging it to the correct mark position.

Object Recognition and Multiple Cameras

Figure 18:
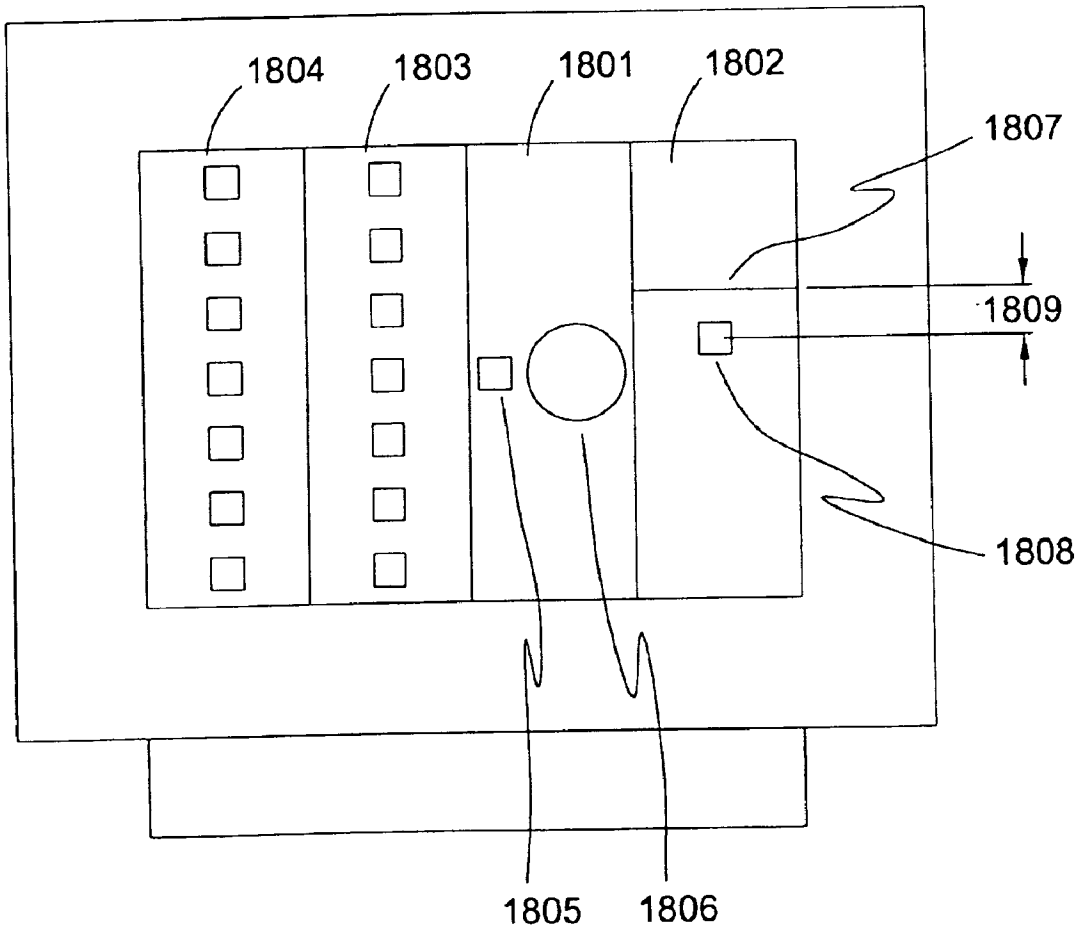
FIG. 18 illustrates Single monitor with multiple camera display and object registration.

FIG. 18 illustrates a composite image of the four fixed cameras with fixed lens of FIG. 3. Items (1804) and (1803)

of FIG. 18 are displays of vertical mark patterns from the top and bottom cameras of (301) FIG. 3 which are shown in more detail as (401) and (402) of FIG. 4. These mark patterns are similar to the mark pattern of FIG. 6 but with the marks arranged in the vertical direction and for six colors.

The mark or object pattern of (1801) is an image from (308) of FIG. 3 that includes a line hole object (1806) that is registered to mark (1805). Software automatically recognizes the round object, calculates the center of the circle and measures the distance form the center of the circle to the center of the mark (1805). Any variation is introduced as correction through a motorized differential attached to the line hole punch (309) of FIG. 3 (not shown).

Mark pattern (1802) is an image taken from camera (304) of FIG. 3 showing the cut (1807) of FIG. 18 that is (312) of FIG. 3 and mark (1808) that is one of the marks shown in FIG. 3 as (311). The cut and the mark are recognized with the distance (1809) of FIG. 18 maintained constant. Correction is introduced to motorized web compensator (307) of FIG. 3.

All of the advantages of initial register are available for objects as well as for marks.

Shingle Delivery

Camera (304) of FIG. 3 is shown mounted at the delivery of the sheeter where the edges of sheets (306) can be viewed. A mark of known dimensions or duplicate marks (312) are located near the cut edge (311) and are used to calculate the print to cut register errors in both X and Y. This information is used to provide automatic correction to a motorized web compensator (307) to maintain cut to print register. This is to maintain distance (310) constant.

In this application the camera is no longer synchronized to a continuously moving web. The accuracy is independent of web speed as well as focal distance. This feature is not available using the teachings of the prior art.

Newspaper Application Waste Reduction

This portion of the disclosure illustrates an exemplary application of automatic register control for multi-web newspaper printing presses that have at least one web of four-color process printing on one or both sides of the web.

Newspapers historically have consisted primarily of text with many pages of black ink on white newsprint. Recently, due to the success of color printing by the newspaper USA Today, color printing has become an integral portion of most commercial newspaper publishing operations. USA Today operates 39 printing plants in the United States all connected by satellite and all printing the same paper of one or more color leads. Their success has created the demand for four-color process printing in virtually every daily and weekly newspaper publication.

This trend toward full color process printing has drastically increased total waste most of which is generated during startup when new printing plates are first registered. However, on some newspaper presses considerable waste is generated at every paper splice. Every out-of-register copy that is discarded consists of several webs. Until now there has been no successful application of automatic register controls that address the specific conditions of this application as will now be explained.

FIG. 19 illustrates a spreadsheet representing the waste reduction that can be achieved on a typical newspaper printing press that prints a number of webs in black and white with a single four-color web. This example is for a typical small newspaper with a circulation of 50,000 (1901) having approximately 36 pages of print (1913). The actual waste for achieving initial register for each plate change is about 2000 newspapers. With a 90% or more reduction of this waste of 1000 newspapers (1914), a savings of 4.5 tons (1924) of newsprint per week or 235 tons of newsprint per year (1925) can be achieved. This represents a sizable reduction in newspaper waste that heretofore has been either recycled or deposited in landfill.

Until now newspaper printers have accepted registration waste as there has been no successful way to reduce the time to obtain proper print registration. The teachings of Zoom Lens Calibration and the teachings of the present invention provide a means to reduce this waste by more than 50%.

Newspaper Web Offset Register Control

Exemplary Newspaper Printing Press

Figure 20:
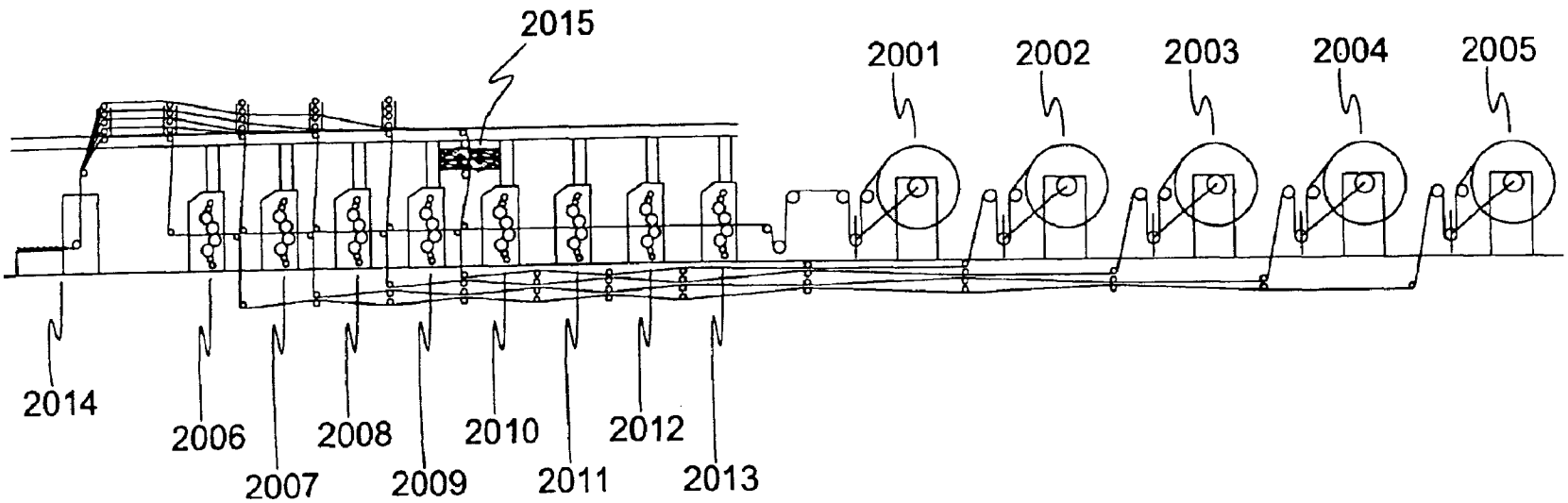
FIG. 20 illustrates an exemplary newspaper press configuration.

FIG. 20 illustrates a typical eight-color unit newspaper printing press with five webs feeding into a folder and delivering finished newspapers. Five roll stands (2001, 2002, 2003, 2004, 2005) feed printed webs into the printing units that are combined at folder (2014) into finished newspapers. Roll stands (2002, 2003, 2004, 2005) feed into printing units (2009, 2008, 2007, 2006), respectively. Each of these printing units prints a single color (black) on both side of the web.

Roll stand (2001) feeds into printing units (2010, 2011, 2012, 2013). These four printing units print the four-process colors (yellow, magenta, cyan, and black) on both sides of the web. At present the prior art teaches that four colors are registered (both initially and during the run) manually by the operator, and as to date automatic register controls have not been successful in this application for a number of reasons to be explained herein.

The complete registration of all stations is performed automatically if all marks can be immediately recognized. Otherwise the initial register procedure taught by the present invention would be used to position the marks so that they can be automatically recognized by the software so that final registration is performed automatically.

FIG. 20 illustrates a typical five-web newspaper printing machine with one four-color lead in a horizontal press configuration. Referencing FIG. 20, the color lead enters printing unit (2013) and continues through printing units (2012, 2011, 2010) where it exits and runs vertically through the two-camera unit (2015) similar to that illustrated in FIG. 4 and then combines with the other black and white webs at the folder. Thus, the only position where the two cameras can be mounted is directly after the fourth printing unit where all four colors of a mark pattern printed on both sides of the web can be viewed.

Web Velocity Variations

Figure 21:
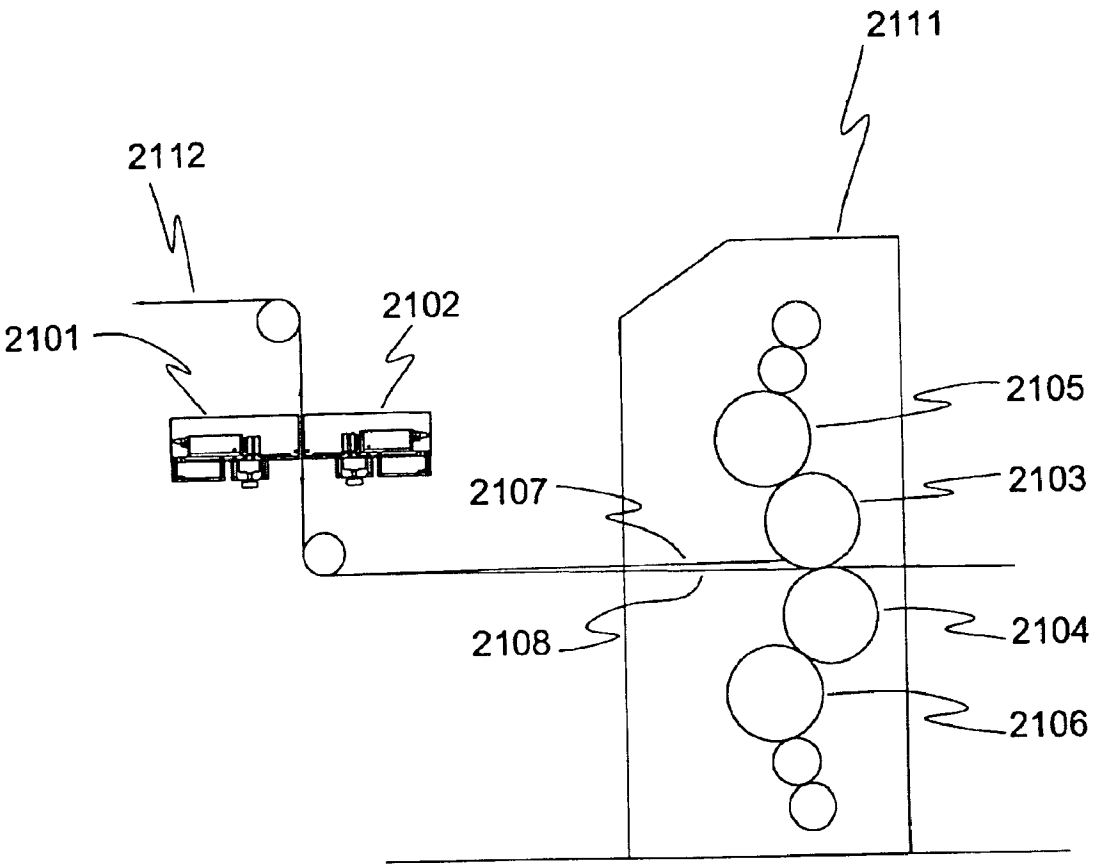
FIG. 21 illustrates an exemplary tension-velocity change due to blanket stagger.

FIG. 21 illustrates a greatly magnified view of this area of FIG. 20. It shows the top and bottom cameras (2102, 2101) and printing unit (2111) that is printing unit (2010) illustrated in FIG. 20. This printing unit has top plate cylinder (2105) that transfers its image to blanket (2103) and bottom plate cylinder (2106) that transfers its image to blanket (2104). For each revolution of the blanket cylinders, the image of top plate cylinder (2105) and the image of bottom plate cylinder (2106) are transferred to the web (2112). Note that blanket cylinder (2103) is staggered in relationship to bottom blanket cylinder (2104). The printing unit is typically designed in this manner so that the gaps in the plate cylinder where the plate is attached and locked into the printing cylinder do not occur at the same time as they would if the blanket cylinders were not staggered. This prevents a resonance effect due to gear bounce and vibration that causes the undesirable effect called doubling that appears in the print as a double image.

Figure 22:
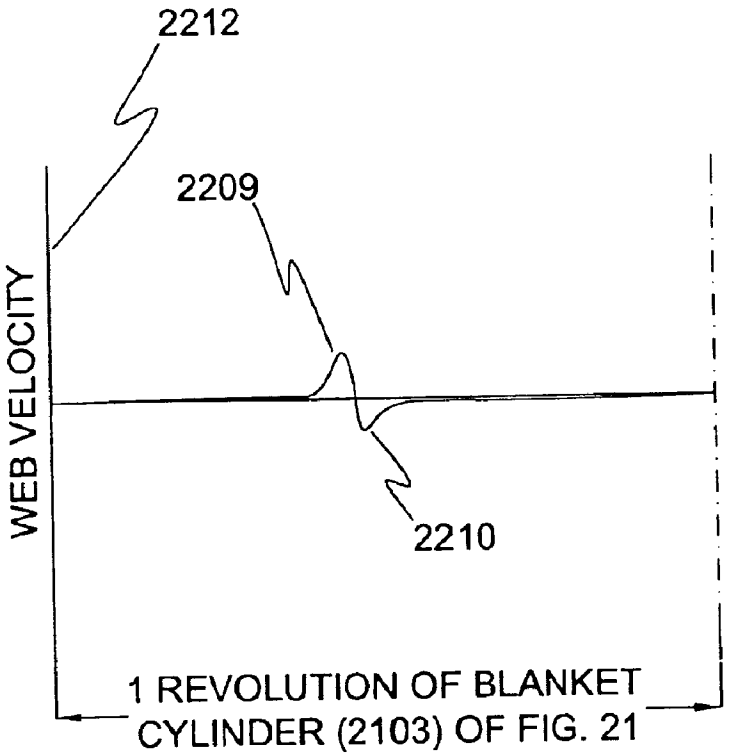
FIG. 22 illustrates an exemplary tension-velocity display graph.

The ink is tacky and the stagger of the blanket cylinder tends to have the web follow the leading blanket or top blanket (2103) shown as (2107). When the gap is reached and there is no ink, the web will release as shown at (2108). This causes a pulsating tension change with a velocity profile (2212) as illustrated in FIG. 22. Note the abrupt velocity change (2209, 2210). This abrupt velocity change occurs for each revolution of the blanket cylinder (2103) of FIG. 21. The present invention use of a strobe in some embodiments freezes the entire image in about 5 microseconds that at 1000 feet per minute is less than 0.001 inch of movement. All measurements are relative to each other and this disturbance has no affect on the accuracy of the measurement. Furthermore, the present invention configuration permits webs that are unsupported by press machinery to be inspected and registered without the need for any direct contact to the web by any stabilizing machinery. This is a direct result of the fact that focal length changes between the camera/sensor device and the web can be fully compensated for using image processing techniques.

In contrast, photocell and linear array systems require an absolutely constant web speed to provide accuracy. Any speed variation during the time that the marks pass the web scanner would produce erroneous error calculations in these prior art systems. Clearly this limitation as well as the lack of an initial register system as disclosed precludes the use of the photocell and linear array in applications where erratic speed changes are present such as just described.

Thus, it has been shown that the present invention may be placed at any point in the web processing line, including after the last print station at any position alongside any position in which the web contains ink that is not dry, after any staggered plate, top/bottom cylinder, or the like, as well as after any top/bottom blanket or the like. This freedom of positioning permits a tighter control of the web printing feedback loop and thus guarantees a higher quality product than that possible with the prior art methodologies. Of course, the present invention need not be placed in these positions and may be placed elsewhere in the printing process as are some conventional inspection systems. However, the present invention is the only system/method available that permits the inspection loop to begin when the web ink is still wet, or when the web is experiencing velocity variations, flutter, and/or a change in focal distance between the web and the inspection sensor.

Commercial Web Offset Register Control

Figure 23:
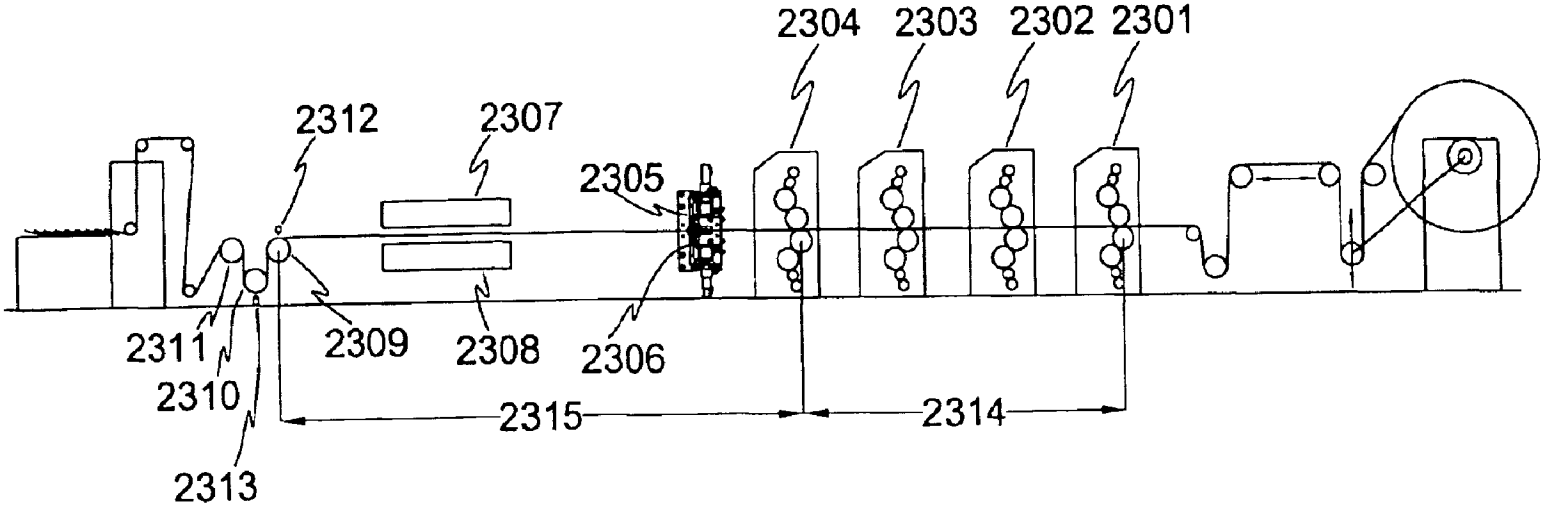
FIG. 23 illustrates an exemplary heat set printing press.

FIG. 23 illustrates a commercial web offset press. This press configuration is identical to the newspaper press of FIG. 20 with the exception that it includes a dryer (2307, 2308) and chill rollers (2311, 2310, 2312). The dryer and chill rolls are for curing inks that are printed on coated stocks on both sides of the web and where there is little absorption as there is when printing on newsprint. The high speed printed web remains in the dryer for sufficient time to heat the web after which it passes over the chill rolls which sets to permanently hardens it. This curing process is referred to as "heat set" web offset printing and is used in all high quality printing on glossy or coated stocks as in the printing of magazines.

As press speeds have increased over the years, the dryers and chill rolls have added significant additional printed web to the printing machine. Presently these machines print at over 2000 feet per minute and require dryers and chill rolls that can add additional printed web (2315) that is several times the web distance (2314) required to print the four process colors.

Thus, it would be desirable to measure the register errors at the position shown where cameras (2305) and (2306) are located. This would allow immediate measurement and control of color register with significant additional reductions of waste material for every start-stop, splice, and/or every initial register when plates are changed.

At present automatic color register controls using either photocells or linear arrays require that the web scanners be mounted with a backup roller so as to eliminat the undesirable affect of web flutter causing minute changes in focal distances that introduce false register errors. In the heat set process, the printed web cannot touch any roller from the first printing station (2301) until it reaches the chill roller (2309) and is subsequently permanently cured. Until it reaches the chill rollers, the ink is wet and would offset on any roller in its path damaging the printed images.

For this reason the first location where a backup roller can be located is at the chill rolls where presently web scanners using photocells or linear arrays would be located. The position of these web scanners is shown as web scanner (2312) scanning the top side of the web, and web scanner (2310) scanning the bottom side of the web.

Figure 24:
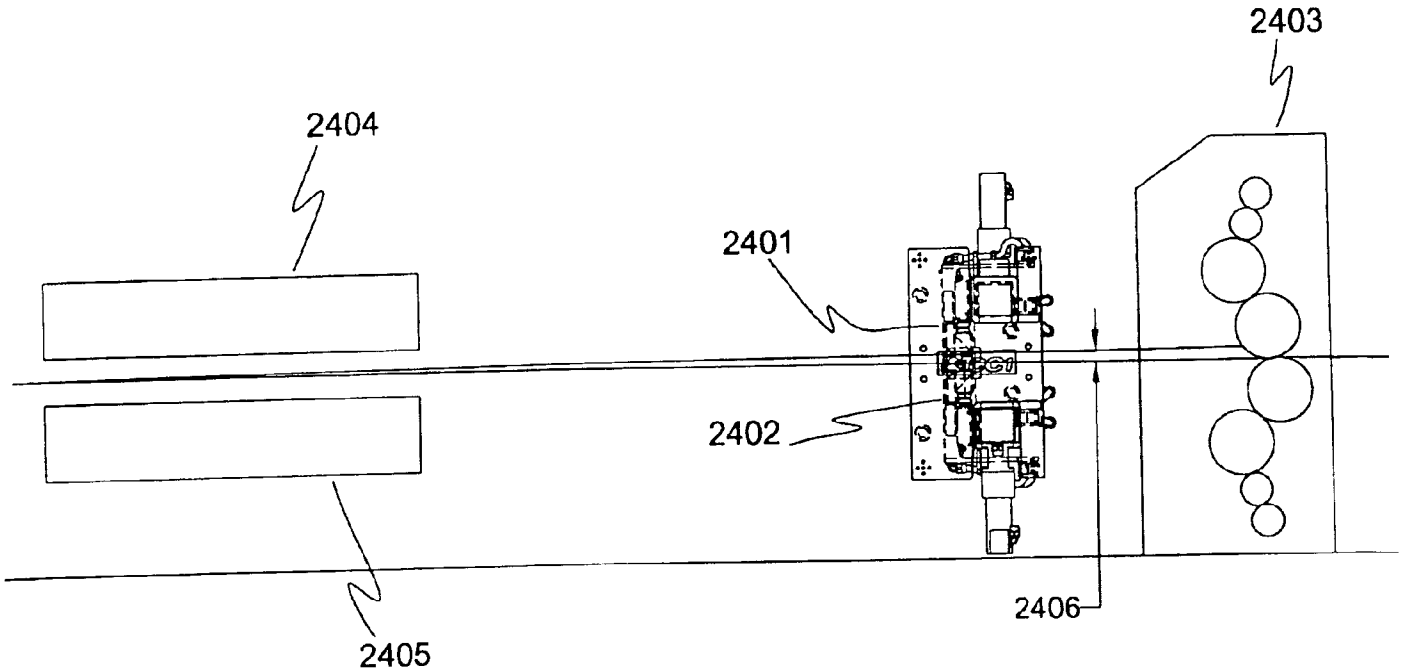
FIG. 24 illustrates magnified heat set printing press with focal distance changes.

FIG. 24 illustrates an expanded view of FIG. 23 with cameras (2305, 2306) of FIG. 23 represented by (2401, 2402) of FIG. 24, print unit (2304) of FIG. 23 represented by (2403) of FIG. 24 and a portion of dryer (2307, 2308) of FIG. 23 represented by (2404, 2405) of FIG. 24 respectively.

Figure 25:
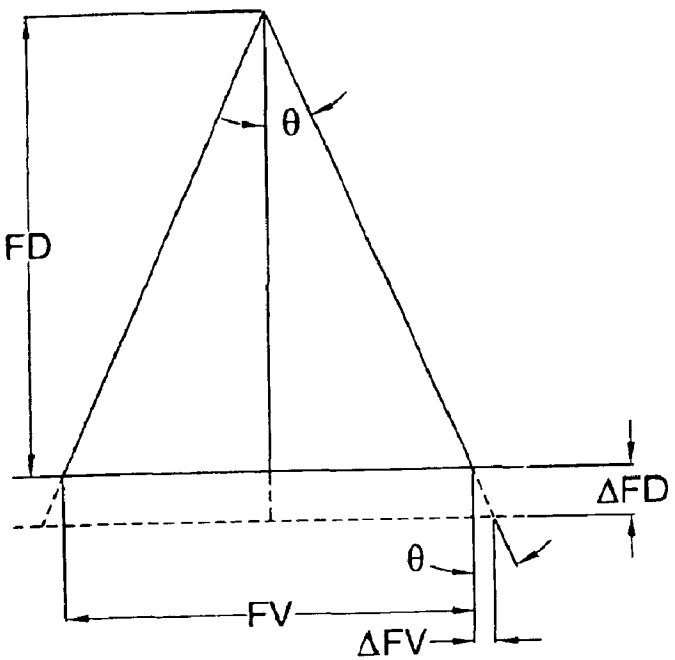
FIG. 25 illustrates field of view change with change in focal distance.

With the cameras located in this position, the release of the web due to the tack of the ink produces a change in focal distance (2406) of FIG. 24. The effect of a change in focal distance can be appreciated with reference to FIG. 25. The change in the field of view for a 0.10 inch change in focal distance (2508) is 0.006255-inch for a field of view (2507) equal to 0.5 inch, and for a focal distance (2506) equal to 4 inches. However, with the teachings of Zoom Lens Calibration the cameras can be located to view marks at positions (2305, 2306) of FIG. 23 without backup rollers since these focal distance changes are automatically calibrated each time a mark pattern image is obtained using duplicate marks.

Thus, the cameras can be located to scan unsupported web as in FIG. 24 with accuracy unaffected by web flutter or other focal distance variations such as just explained. In this instance with the cameras located this close to the last printing station additional waste can be eliminated with early detection and correction of errors instead of waiting until the web reaches the chill rolls as is current practice in photocell or linear array register controls.

Optimization/Correction of All Registration Error Variables

The following discussion illustrates how a variety of known registration errors may be simultaneously compensated using techniques and systems unique to the present invention.

Sources of Registration Error

Whenever new plates are installed on a web offset printing press there are three types of color registration errors associated with each new set of printing plates that require measurement and adjustment for optimum initial registration of all colors across the entire web width. These errors include:

1. Initial registration of the plates. The method for achieving initial register was presented in Zoom Lens Calibration with further refinements within the scope of the teachings of the present invention. A single mark pattern located somewhere within the printed web was used for initial alignment and for final registration of the printing plates with all marks aligned exactly as in the mark pattern.

2. Plate Skew. Plate skew errors are register errors due to non-parallelism of the printing plate across the entire web width. They are introduced in the manufacture of the plates or during the process of mounting new plates. Some presses have a motorized skew adjustment which allows skewing of the printing cylinder. However, with more accurate plate registration and mounting systems, plate skew errors are small enough that the operator can make adjustments to split the errors equally on both sides of the web.
3. Fan-out. Fan-out is a phenomenon evidenced by minute lateral changes in the printed image that appear from the operator side to the gear side of the printed web. It is called fan-out because the lateral image width appears to increase after it is first printed. As the web proceeds from the first to the last printing unit, it undergoes a transition due to the addition of water, impression pressure, and tension that tend to relax it. This produces a slight lateral growth that becomes narrower at each succeeding printing station. It is presently corrected using either a wheel that indents the web tending to reduce the width of the printed image minutely, or by profiling a tension across the web before it enters the first printing station. While neither of these mechanisms is discussed in detail within this disclosure, they are widely known and used in the printing industry. Suffice it to say that the complete two dimensional register system in this disclosure would require motorized mechanisms for fan-out if a completely automatic two dimensional register control is to be implemented.

For very high quality printing all three of these errors are present and must be addressed as errors as small as 0.002 inch can be visible in four-color reverse printing used extensively in all web offset printing. At present the operator makes adjustments for all three errors with considerable waste generated in achieving final register.

Measurement and Automatic Adjustment of Registration Error

The following discussion teaches a means for measuring and automatic adjustment for all three of these registration errors.

FIG. 24 shows a two-camera system that for this application will be the motorized two-camera system of FIG. 5. It should be noted that the traverses (503, 504) are very rugged linear mechanisms of the same type that is typically used for very accurate positioning in machine tools. The complete mechanical assembly is designed for permanent mounting and is squared to the press so as to be able to measure skew of the printing cylinder and plate.

Figure 26:
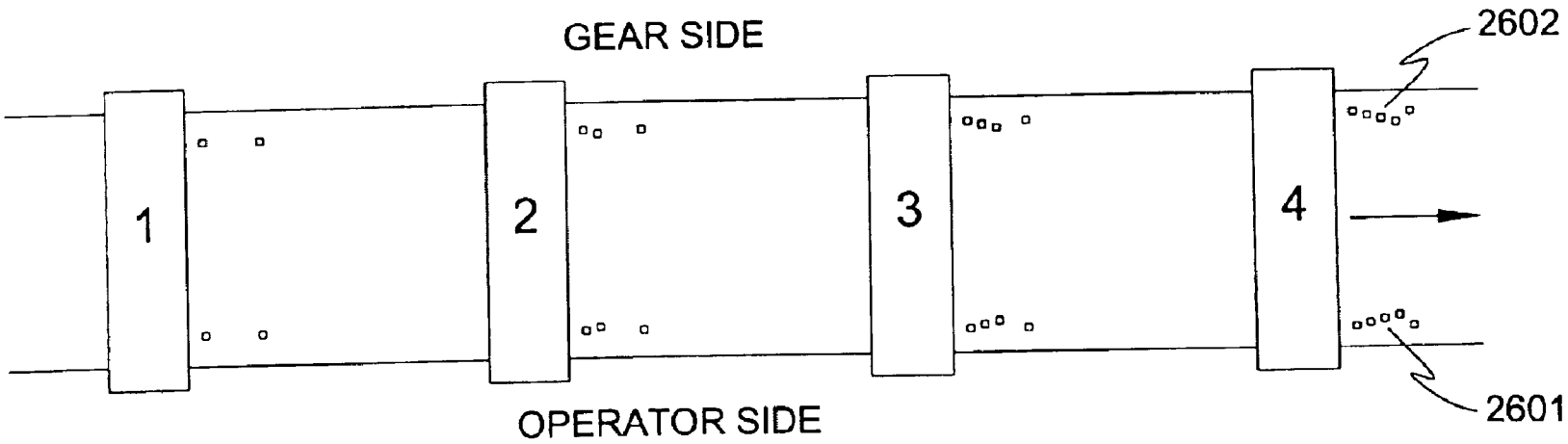
FIG. 26 illustrates mark patterns from the operator and gear side view.

Images of the two mark patterns, one on the operator side of the press and the other on the gear side of the press as shown as (2601, 2602) within FIG. 26 are obtained before any register adjustments are made.

Registration Procedure

It is intended in actual practice that typically a minimum of two images are required upon the initiation of printing with all marks of the mark pattern present and recognized before any adjustments are made in color registration. One image is required from the mark pattern on the operator side and another image is required of the mark pattern on the gear side from which all three errors as described above will be measured and appropriate corrections made as will be disclosed.

Figure 27:
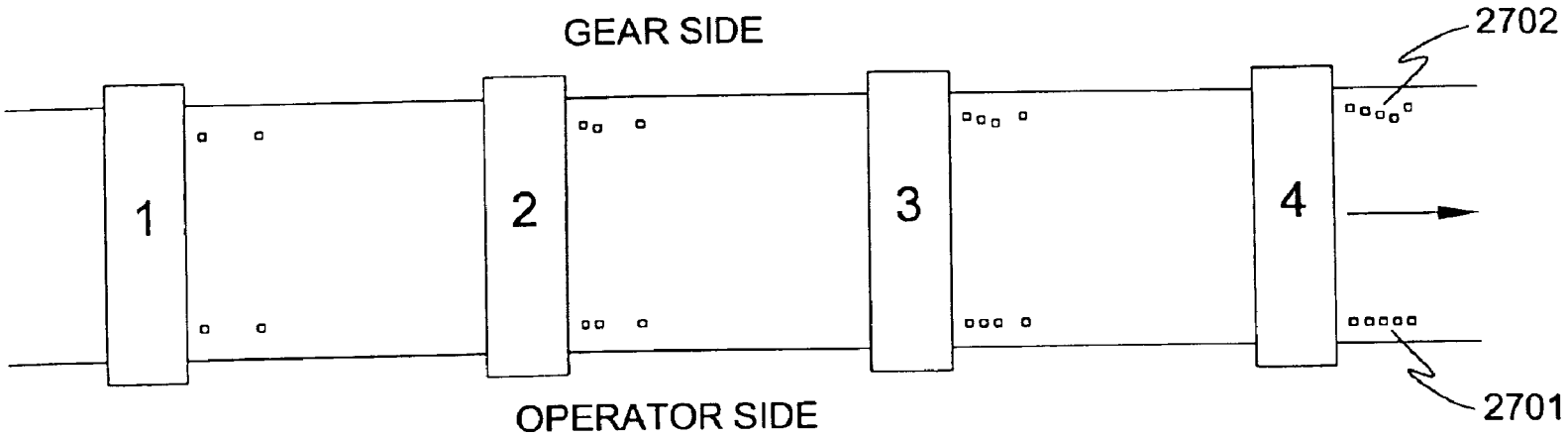
FIG. 27 illustrates aligned mark pattern from the operator side view.
Figure 28:
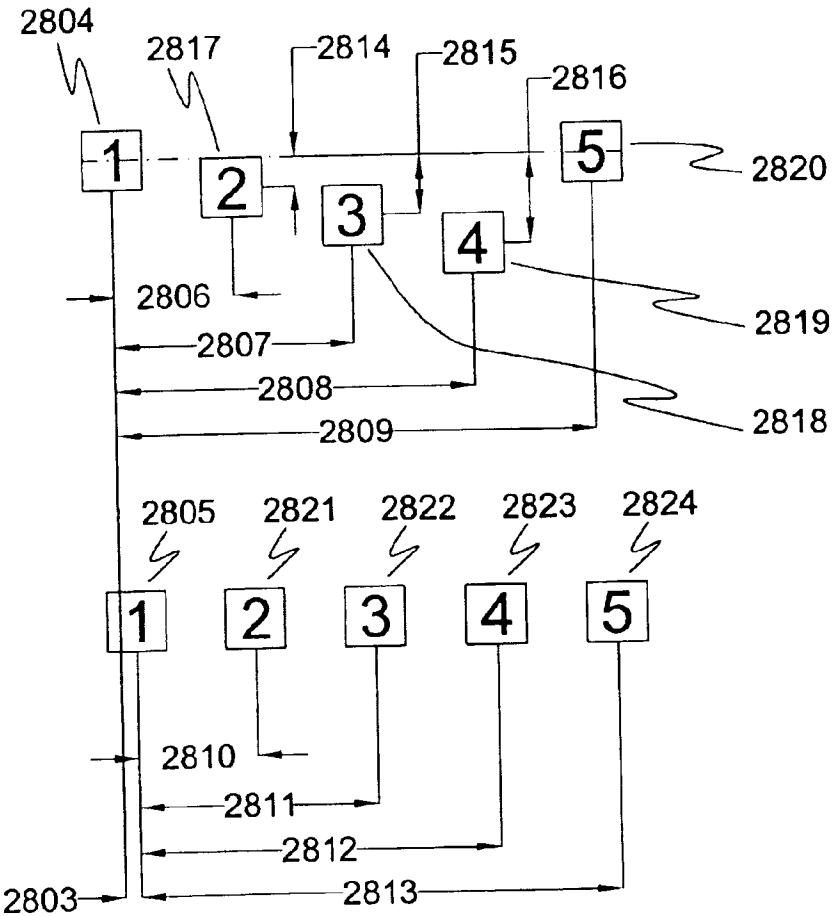
FIG. 28 illustrates XY correction coordinates of mark patterns.

FIG. 26 shows the mark patterns as first observed and before any register adjustment are made. It is assumed for this discussion that any overlapping marks will have been corrected as described elsewhere in this disclosure. Thus, all three errors will be present as shown in mark patterns (2601) on the operator side and mark pattern (2602) on the gear side of the press in FIG. 26. For purposes of simplification and clarity of explanation, the process will be broken down and described in three steps:

1. For this discussion an image of the mark pattern on the operator side (2601) of FIG. 26, is first aligned as set forth in this disclosure and in Zoom Lens Calibration and is shown as mark pattern (2701) in FIG. 27.
2. The camera is then moved to the other side of the web where an image of mark pattern (2702) of FIG. 27 is obtained. Both of these images are shown in FIG. 28 with the aligned image (2701) of FIG. 27 shown as marks (2805, 2821, 2822, 2823, 2824) of FIG. 28 and the image of mark pattern (2702) of FIG. 27 shown as marks (2804, 2817, 2814, 2815, 2816) of FIG. 28.
3. In FIG. 28, the duplicate marks (2805, 2824) of the aligned mark pattern and the duplicate marks (2804, 2816) are chosen as a reference for discussion purposes. However, any of the marks could be chosen as the reference. The skew of the reference marks (2803) is determined by measuring the number of pixels in the X direction to the center of mark (2805), moving the traverse to the other side of the web at the same strobe encoder setting and measuring the distance to the center of mark (2804). The difference (2803), of these two values represents the skew of the printing plate and any skew or parallel misalignment of the traverse and printing cylinder.
4. The skew of each mark is represented by the difference in X values or (2810–2806) as the skew of mark (2817) to mark (2821), (2811–2807) as the skew of mark (2818) to mark (2822), and (2812–2808) as the skew of mark (2819) to mark (2823).

Some presses are equipped with motorized cylinder skew adjustments that provide a means for automatic skew adjustment with the skew values just calculated introduced directly by adjusting these motors. Most presses do not have this adjustment and thus the skew errors are adjusted equally between each side by moving the circumferential register mechanism.
5. For purposes of this discussion the Y dimensions (2814) of mark (2817), (2815) of mark (2818), and (2816) of mark (2819) represent fan-out of each color or the growth of the printing width through the press. Fan-out can be partially or totally corrected with several mechanical devices that are well known in the industry. Needless to say these devices must be motorized if a full two-dimensional initial automatic register alignment is to be performed.

The steps above are meant to illustrate the three errors, and how they are related to the two dimensional registration of the complete plate and to each other.

In practice the two patterns are obtained and all errors that must be corrected are compared with available ranges of the correction mechanisms before corrections are introduced. If any error is out of range of the correction mechanism, the operator is alerted so as not to waste time and material before finding that perhaps an error in the plate would prevent registration, and the plate must first be remade to correct the error.

Registration Calculations Detail (7901)

The procedure and calculations to accomplish two-dimensional registration will now be discussed in detail.

Figure 29:
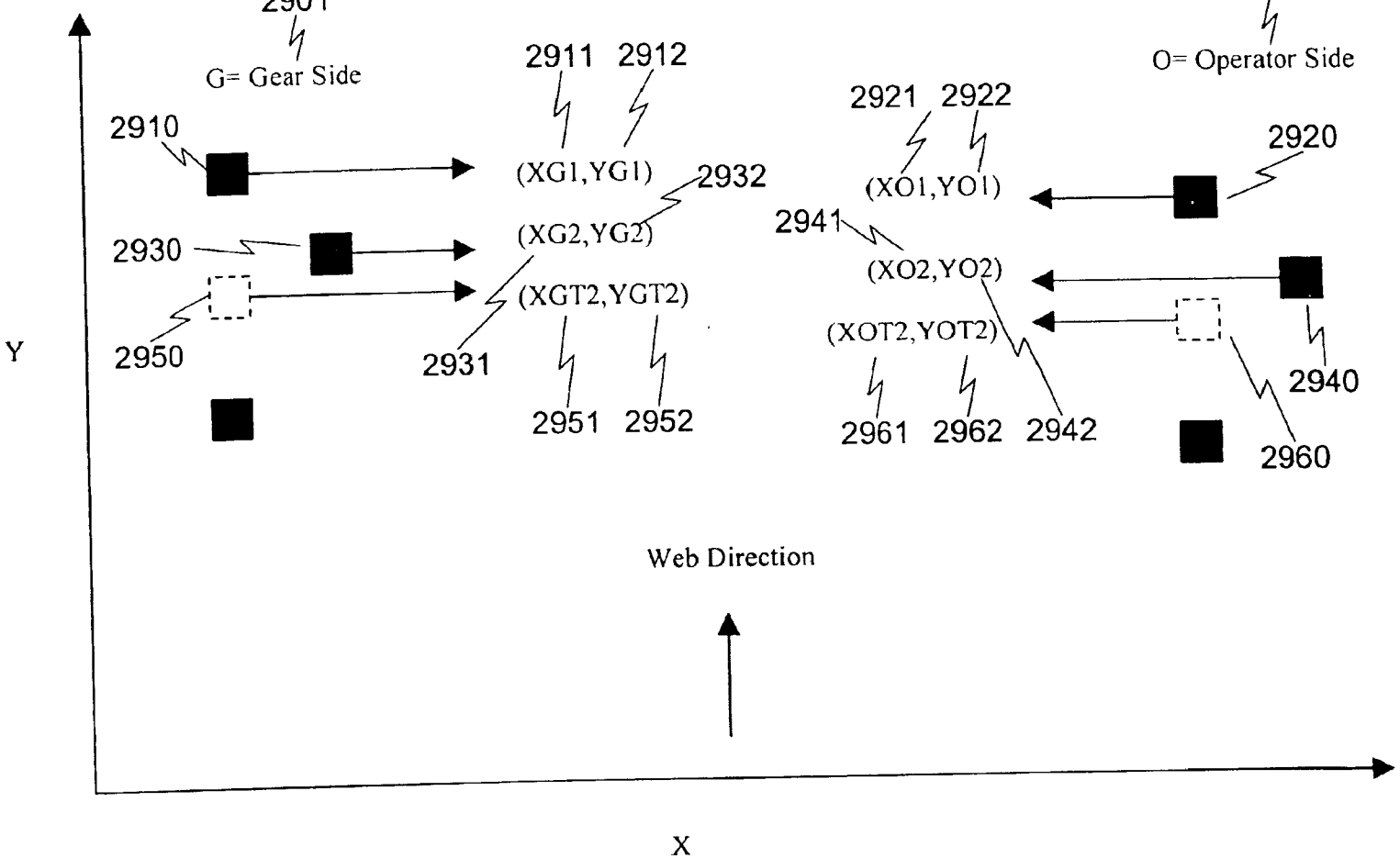
FIG. 29 illustrates automatic register alignment in two dimensions.
Figure 79:
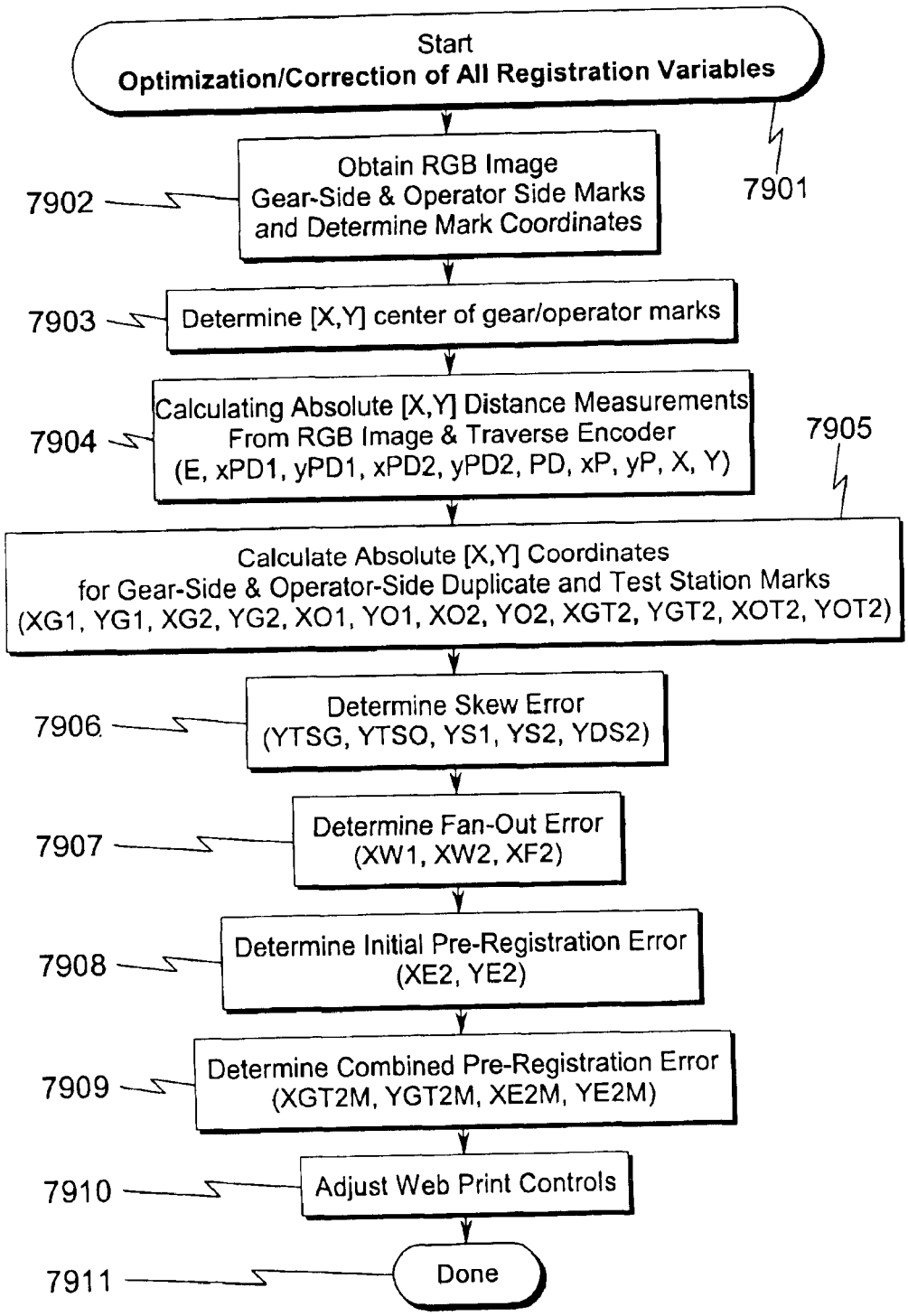
FIG. 79 illustrates an exemplary system process flowchart implementing a two dimensional optimization and/or correction of all registration variables.

FIG. 29 illustrates an exemplary representation of a three mark pattern printed on both edges of the web and used for making a two-dimensional preregistration on a press equipped with motorized circumferential, lateral, and/or fan-out correction mechanisms. FIG. 79 is a corresponding exemplary process flowchart corresponding with the following detailed description.

Duplicate marks with one additional mark are shown to describe the process. Any number of additional marks can be printed with the same process to be described applied to each additional mark.

Initial Register Measured Parameters (7902, 7903)

A camera takes an RGB picture of the Gear-side marks and determines the [X,Y] locations of each of the desired marks. A motor driven traverse with accurate encoder positioning is used to move the same camera and take an RGB picture of the Operator-side marks. The [X,Y] locations of these marks are determined. The pictures taken in each case use the same strobe firing point on the printed image that is synchronized by a cylinder encoder that corresponds one-to-one with the printed image.

X/Y Coordinate System (7904)

The center coordinates of each mark are measured in an absolute coordinate system based on a fixed origin in two-dimensional space lying in the plane of the printed web. Each [X,Y] coordinate pair is an absolute [X,Y] distance in inches from the absolute origin. The X-origin is defined to be the center of the camera image while the camera is positioned to one extreme of the traverse mechanism. The Y-origin is chosen to be the center of the camera image when the strobe is firing at a position that will allow marks on the Gear- and Operator-side to be fully detectable by image processing software.

To produce [X,Y] absolute distance measurements a few constants will need to be defined:

p=Pattern type: Horizontally oriented marks or vertically oriented xD=X Distance between Duplicate marks in inches (defined in mark pattern)

yD=Y Distance between Duplicate marks in inches (defined in mark pattern)

CI=Traverse encoder counts per inch

EO=Traverse encoder value at X-origin

D=Distance between Duplicate marks: if P is horizontal, then D=xD, else D=yD

To produce [X,Y] absolute distance measurements a few values will need to be measured from the desired sample RGB image and traverse encoder:

E=Traverse encoder value xPD1=X pixel location relative to the center of the camera image of the first Duplicate mark yPD1=Y pixel location relative to the center of the camera image of the first Duplicate mark xPD2=X pixel location relative to the center of the camera image of the second Duplicate mark yPD2=Y pixel location relative to the center of the camera image of the second Duplicate mark PD=Pixel distance between Duplicate marks: if P is horizontal, then PD=abs(xPD1−xPD2), else PD=abs (yPD1−yPD2)

xP=X pixel location of the target (the center of a desired mark) relative to center of camera image yP=Y pixel location of the target (the center of a desired mark) relative to center of camera image The following calculation gives absolute [X,Y] coordinates:

X=Absolute X coordinate in inches from absolute origin $$=(E-EO)/CI+(xP*D)/PD$$

Y=Absolute Y coordinate in inches from absolute origin $$=(yP*D)/PD$$

Operator/Gear-Side Measurements (7905)

Based on FIG. 29, the following parameters are calculated from the Gear-side (2901) image (2910, 2930):

XG1=Absolute X coordinate of the center of the first Duplicate mark (2911)

YG1=Absolute Y coordinate of the center of the first Duplicate mark (2912)

XG2=Absolute X coordinate of the center of the test station mark (2931)

YG2=Absolute Y coordinate of the center of the test station mark (2932)

Based on FIG. 29, the following parameters are calculated from the Operator-side (2902) image (2920, 2940):

XO1=Absolute X coordinate of the center of the first Duplicate mark (2921)

YO1=Absolute Y coordinate of the center of the first Duplicate mark (2922)

XO2=Absolute X coordinate of the center of the test station mark (2941)

YO2=Absolute Y coordinate of the center of the test station mark (2942)

Based on FIG. 29, the following parameters are determined for gear (2901) and operator (2902) sides (2950, 2960):

XGT2=Desired absolute X coordinate of the center of the test station mark (gear-side) (2951)

YGT2=Desired absolute Y coordinate of the center of the test station mark (gear-side) (2952)

XOT2=Desired absolute X coordinate of the center of the test station mark (operator-side) (2961)

YOT2=Desired absolute Y coordinate of the center of the test station mark (operator-side) (2962)

More measurements are determined here if more stations wish to be supported.

Skew Error Determination (7906)

The skew error is a Y offset error from Operator to Gear side that results from inaccurate plate mounting. To calculate the skew error, two constants must be defined:

YTSG=Y amount of skew error due to the traverse on the Gear-side

YTSO=Y amount of skew error due to the traverse on the Operator-side

The skew error is calculated like this for the first duplicate mark:

$$YS1 = Y \text{ skew error from gear to operator sides in inches of first duplicate mark}$$

$$= (YG1 - YTSG) - (YO1 - YTSO)$$

Similarly, the skew error for our test mark is:

$$YS2 = Y \text{ skew error from gear to operator sides in inches of the test mark}$$
$$= (YG2 - YTSG) - (YO2 - YTSO)$$

For perfect initial pre-registration, the skew error for every station should be identical to the skew error of the first duplicate mark. We therefore can calculate the difference skew error for our test mark:

$$YDS2 = Y \text{ difference skew error of test mark to first duplicate mark}$$
$$= YS2 - YS1$$
$$= (YG2 - YTSG) - (YO2 - YTSO) - ((YG1 - YTSG) - (YO1 - YTSO))$$
$$= (YG2 - YO2) - (YG1 - YO1)$$

Fan-Out Determination (7907)

The fan-out error is the amount the web will stretch in the operator-to-gear direction as it passes through the press. This is an X error measurement. To calculate fan-out for a desired test mark, the following calculations must be made:

$$XW1 = X \text{ distance in inches from the first duplicate mark on the Operator-side to the first duplicate mark on the Gear-side}$$
$$= XO1 - XG1$$

$$XW2 = X \text{ distance in inches from the test mark on the Operator-side to the test mark on the Gear-side}$$
$$= XO2 - XG2$$

Again for pre-registration purposes, we strive to make XW2 the same as XW1. We can calculate the fan-out error for our test mark like this:

$$XF2 = XW2 - XW1$$

Initial Pre-Registration Error Determination (7908)

In the absence of fan-out or skew errors, the initial pre-registration errors would be calculated as follows:

$$XE2 = X \text{ distance error from current test mark position to desired position}$$
$$= XGT2 - XG2$$

$$YE2 = Y \text{ distance error from current test mark position to desired position}$$
$$= YGT2 - YG2$$

Combined Pre-Registration Error Determination (7909)

If we wish to split the combined effects of the fan-out error and skew error across the web, we modify the desired pre-registration location for the test mark:

$$XGT2M = \text{Modified } X \text{ desired location for the center of the test mark}$$
$$= XGT2 - XF2/2$$

$$YGT2M = \text{Modified } Y \text{ desired location for the center of the test mark}$$
$$= YGT2 - YS2/2$$

We can now re-calculate the pre-registration errors, taking these factors into account:

$$XE2M = X \text{ distance error from current test mark position to desired modified position}$$
$$= XGT2M - XG2$$

$$YE2M = Y \text{ distance error from current test mark position to desired modified position}$$
$$= YGT2M - YG2$$

Web Print Control Adjustment (7910)

Given the optimized error values just calculated (7906, 7907, 7908, 7909) it is a simple matter to provide an activation means to affect control of any standard printing press motorized controls using this information. Thus, the registration of the printing press so controlled will be optimized over all three sources of registration error.

Additionally, if the calculated registration errors exceed the ability of the printing press to compensate or correct the error, it is possible to warn the operator so as to permit a remake of the press plates or other necessary machine adjustment without needless waste of web material. This waste safety check is completely absent from the prior art.

Symmetry

One skilled in the art will recognize that the 'Gear-side' and 'Operator-side' nomenclature used in the above description and throughout this disclosure may be swapped with no loss of generality in the teachings of the present invention. Additionally, some of the registration variables above may be favored for correction over others with no loss in generality within the scope of this disclosure.

Summary

While a detailed description illustrating how the three registration errors may be corrected using the teachings of the present invention, one skilled in the art will easily recognize that these corrections may be applied piecemeal and in any combination with no loss of generality in the present invention. Furthermore, not all the corrections need be applied in some circumstances to achieve acceptable registration performance.

Register Mark Recognition Process

Overview

The purpose of this part of the process is to provide a fast and accurate means of recognizing a mark or marks on the printed substrate. Each mark pattern consists of one or more marks printed by each printing station. If more than one mark is printed it must conform to one of the following mark pattern types:

1. Single Column,
2. Single Row,
3. Rows>Columns, or
4. Columns>Rows.

If more than one mark is printed, Duplicate Marks must generally occupy the extreme locations of the pattern. In a single column or single row pattern, there are two Duplicate Marks. In a multi-column or multi-row pattern, there are four Duplicate Marks.

The Mark Recognition Process

Figure 31:
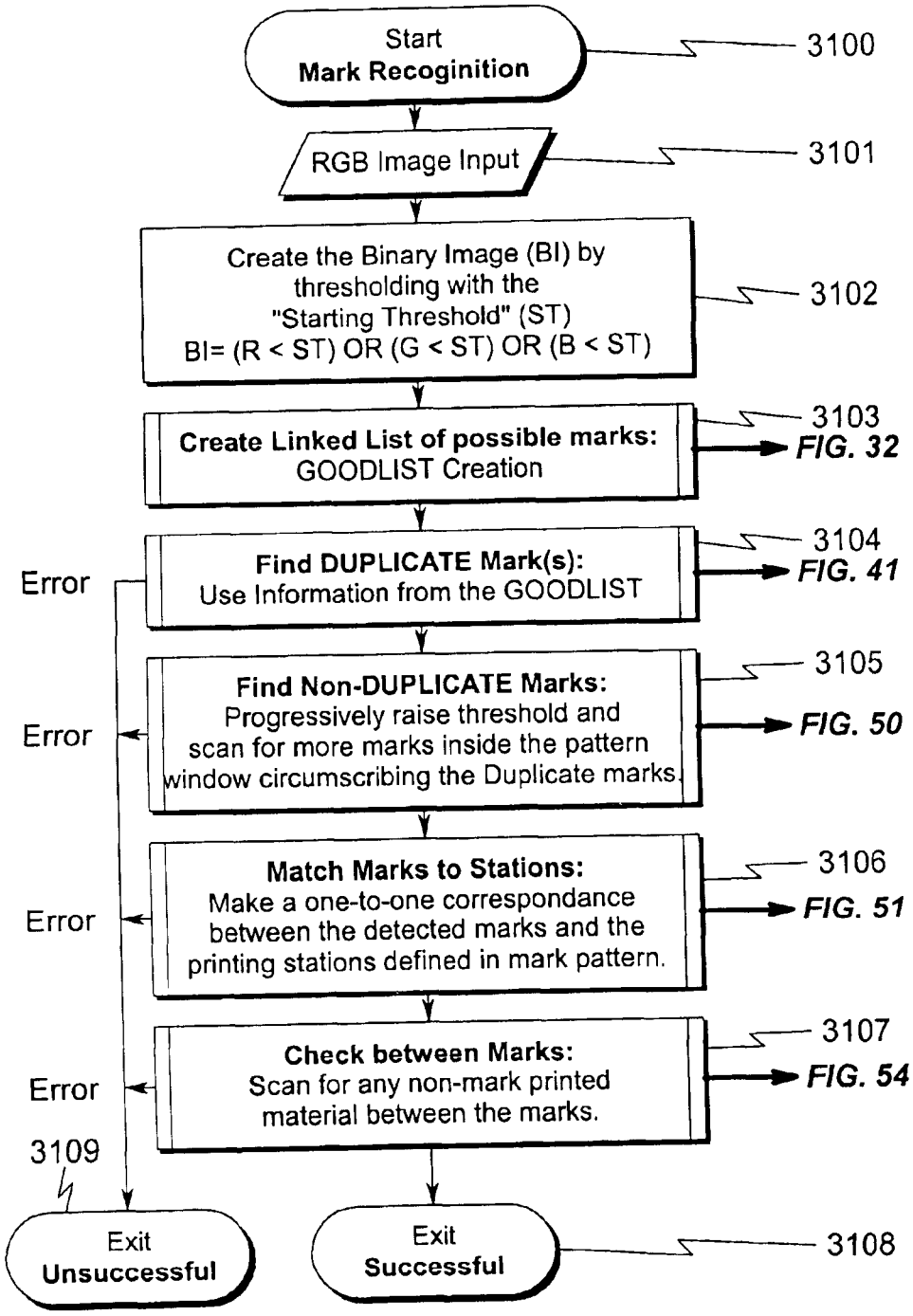
FIG. 31 illustrates an exemplary system process flowchart implementing an overall mark recognition system.
Figure 41:
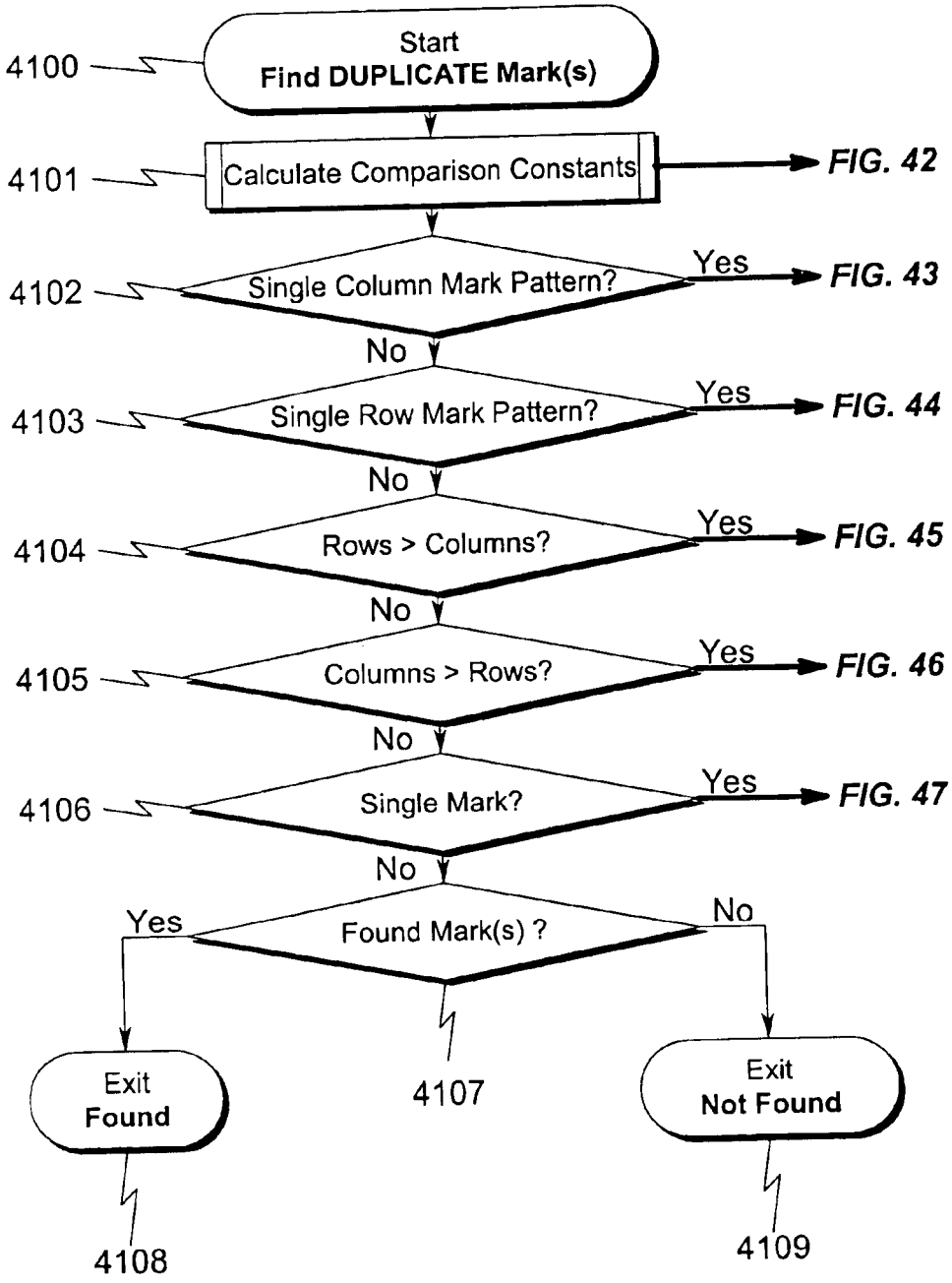
Figure 50:
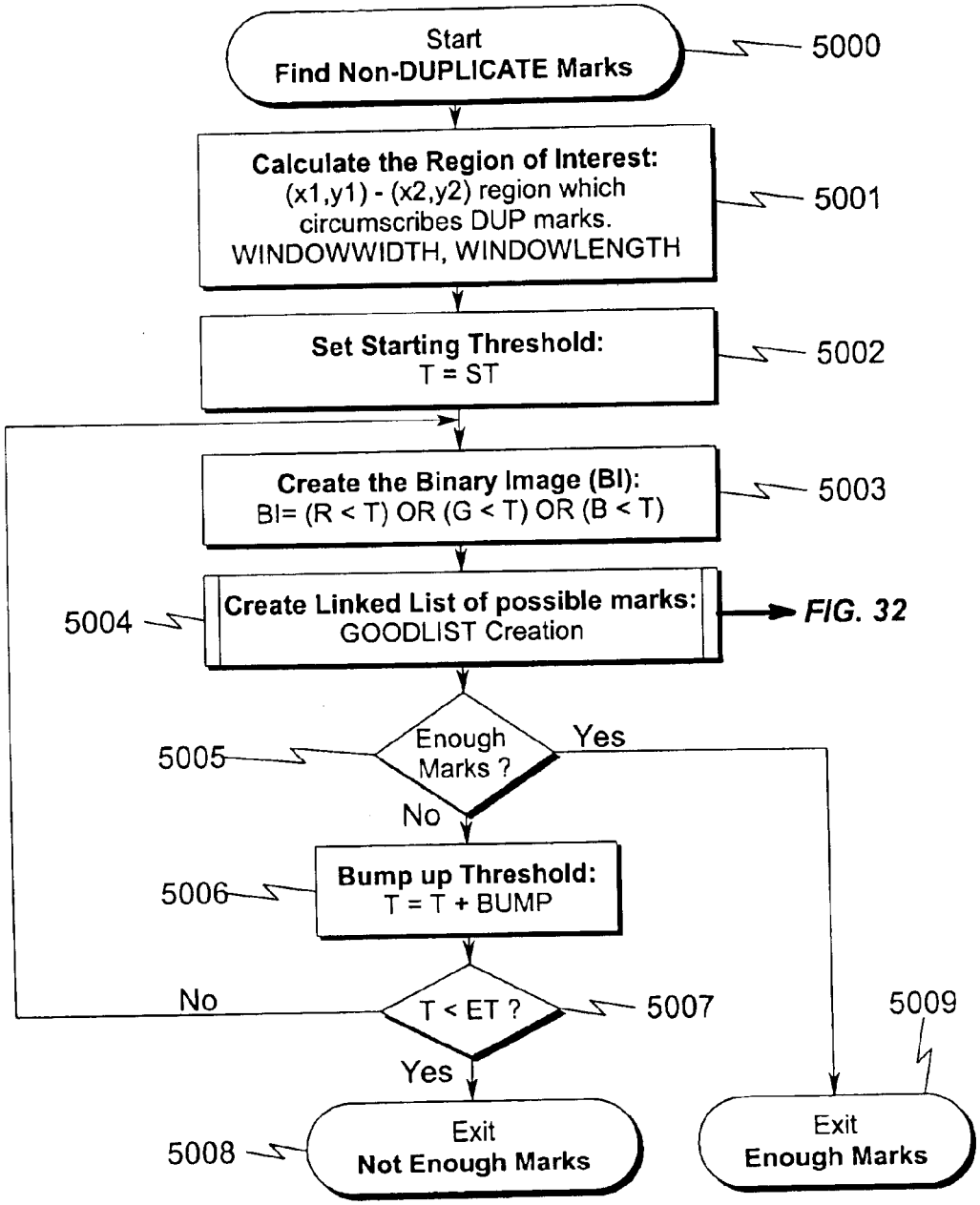
Figure 54:
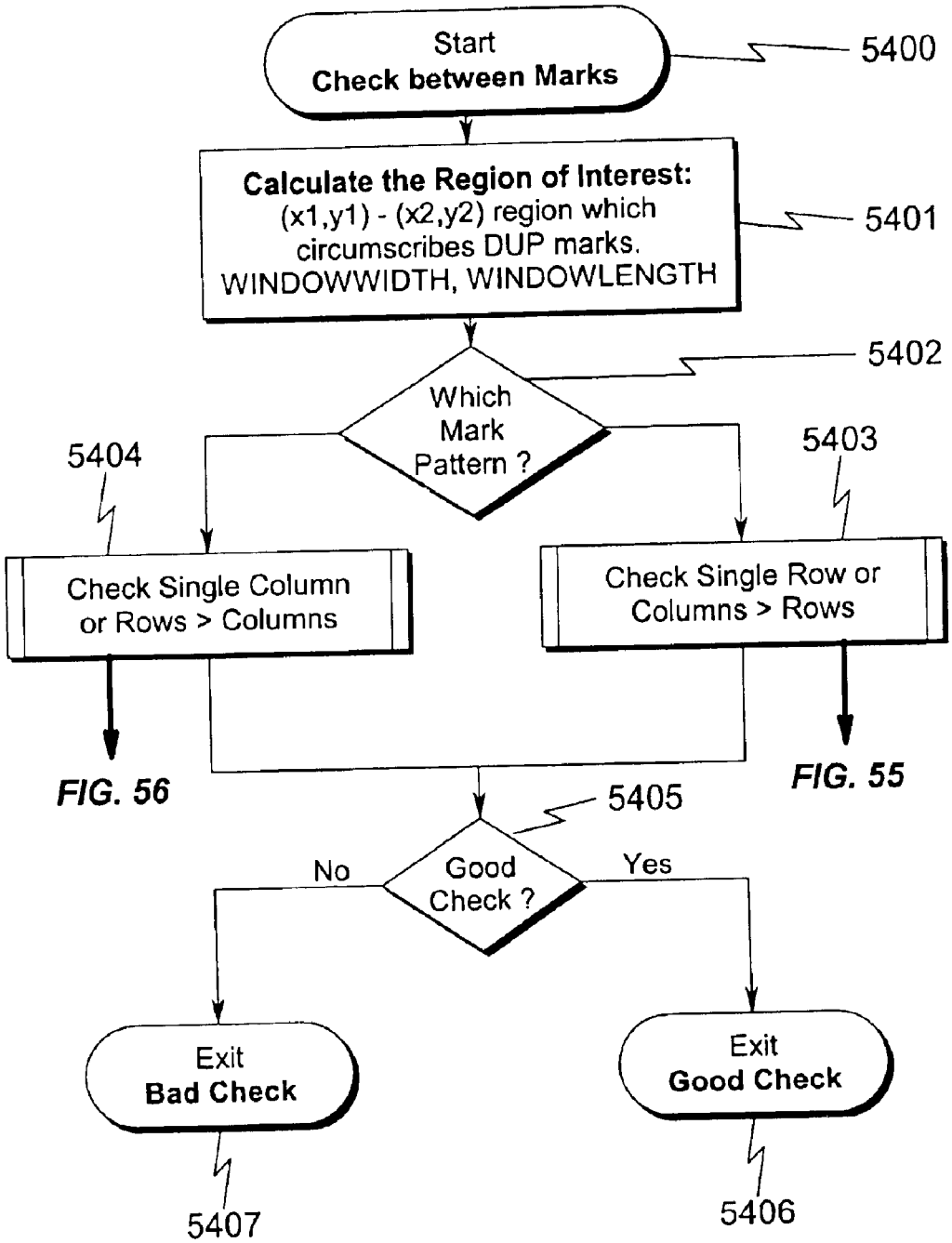

FIG. 31 illustrates a flowchart of the overall process of Mark Recognition (3100). The input to this system is an RGB image of the marks being printed (3101). The first step in the overall recognition process is to find the Duplicate Marks. The system assumes high contrast for these marks and therefore starts with a very conservative threshold to discretize (binarize) the RGB image. This is accomplished by comparing each Red, Green, and Blue Trixel with the starting threshold (ST) to compute the binary image (3102). With a binary version of the image, the next step is to create a list of possible Duplicate Marks (3103). This list will be called the GOODLIST and the process of creating this list is outlined in FIG. 32. Next the GOODLIST is examined on a higher level to determine is the Duplicate Marks are contained within the image (3104). FIG. 41 outlines the process for finding the Duplicate Marks from the GOODLIST. With the Duplicate Marks found, all non-Duplicate Marks must be detected (3105). FIG. 50 outlines this process. With as many marks as possible detected, the next step is to match printed stations from the mark pattern specification to the detected marks (3106). This process is outlined in FIG. 51. If this step (3106) passes, a final check is made between the marks (3107) to see if any erroneous print exists. This process is outlined in FIG. 54.

GOODLIST Creation

Figure 32:
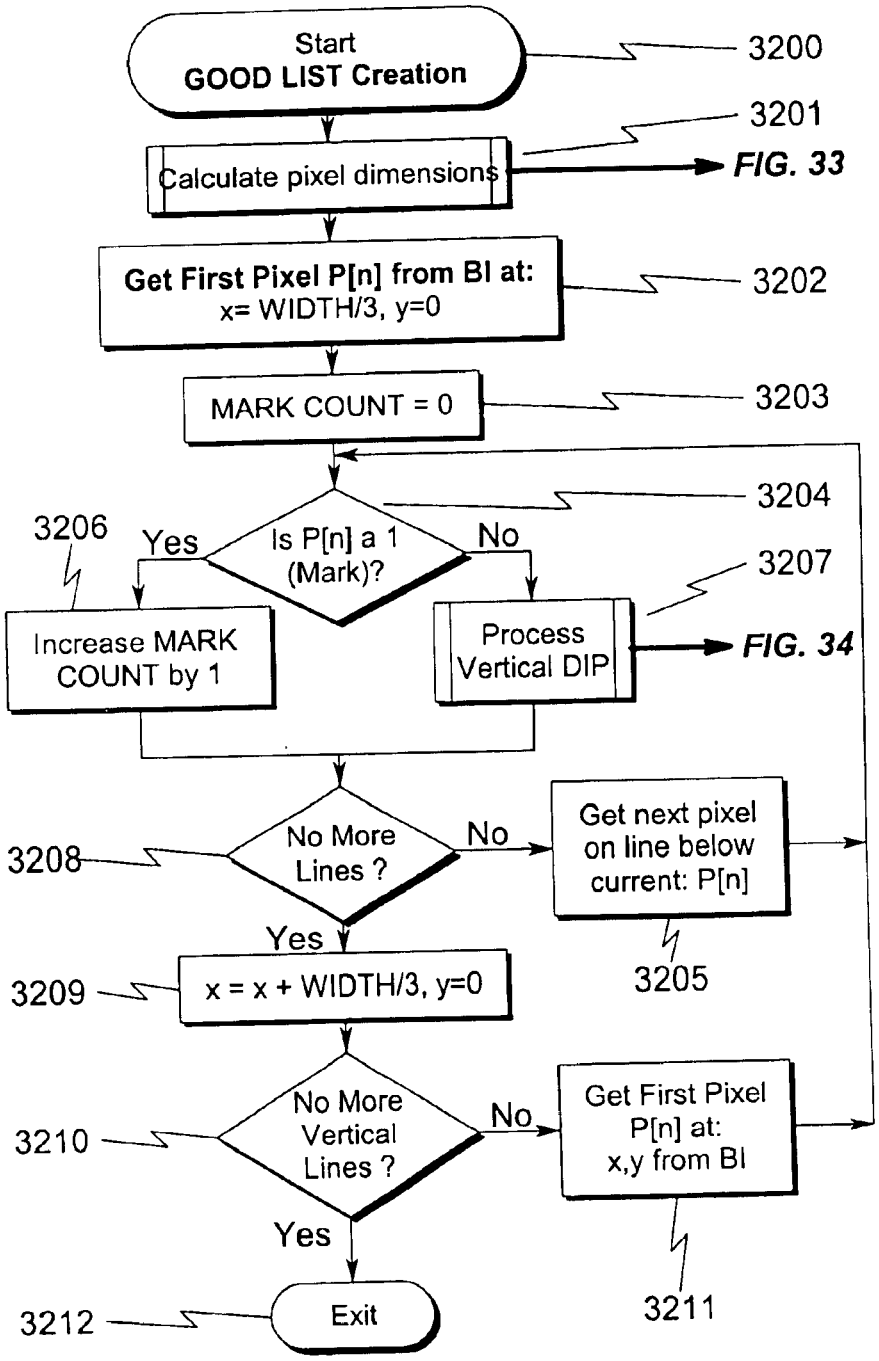
FIG. 32 through FIG. 56 illustrate exemplary system process flowcharts implementing the details of an overall mark recognition system.
Figure 33:
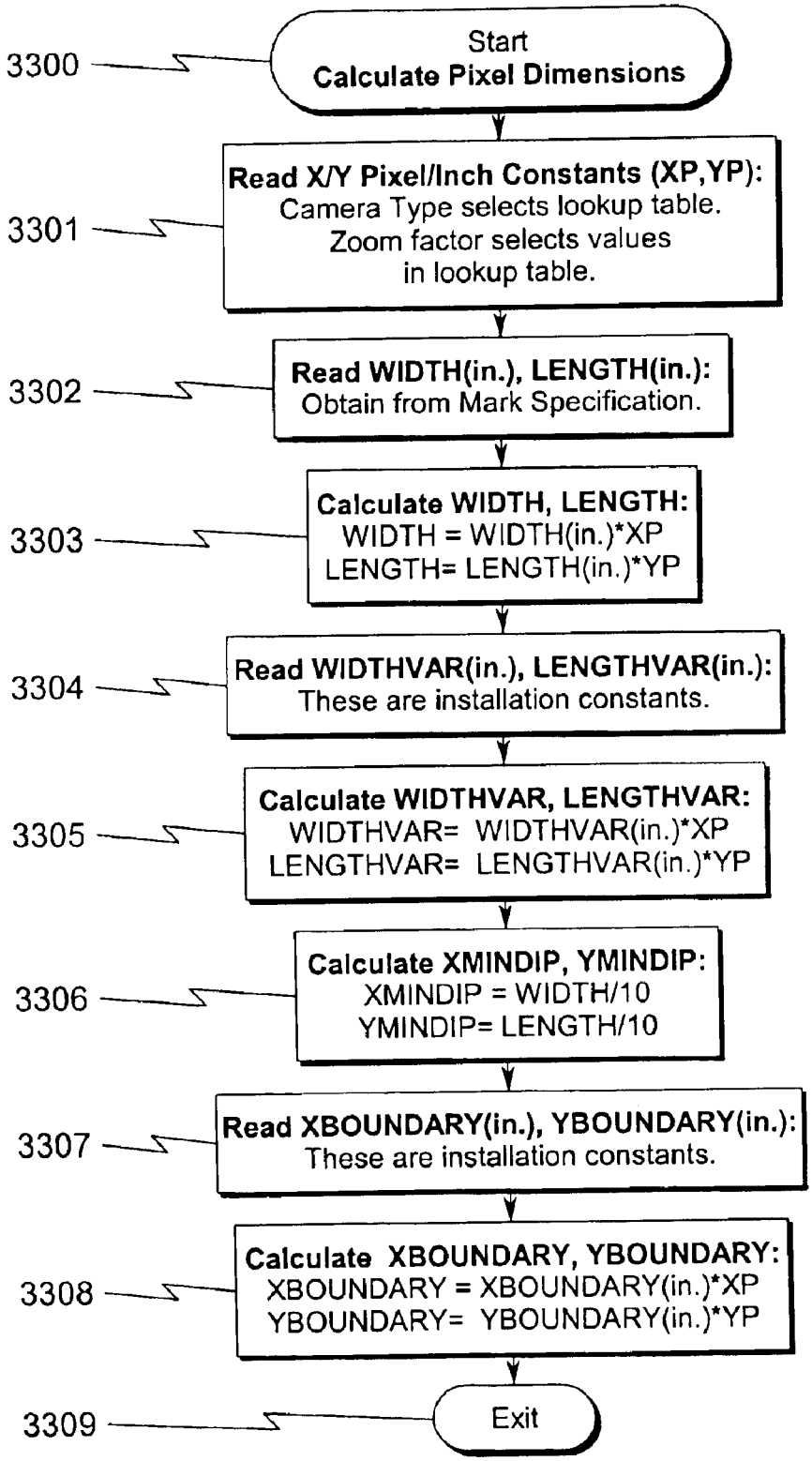

Referring to the start of FIG. 32 (3200), the first step in GOODLIST creation is to calculate some important pixel dimensions (3201) that will be used to analyze the image. Referring to FIG. 33 (3300), the process of calculating pixel dimensions begins. Given the camera type and zoom magnification used when obtaining the RGB image, the X/Y Pixel/Inch parameters are obtained from a lookup table (3301). The desired WIDTH and LENGTH of the register marks (in inches or millimeters) are read from the mark pattern specification (3302) and scaled to pixel dimensions (3303). The amount the WIDTH and LENGTH can vary is also read from the installation constants (3304) and scaled to their pixel dimensions (3305). Two other parameters, XMINDIP and YMINDIP are also calculated at this point (3306). These values provide a means for allowing small "holes" in marks to pass through the recognition process. The last two variables XBOUNDARY and YBOUNDARY are read from the installation constants (3307) and scaled to pixel dimensions (3308). At this point FIG. 33 exits back to FIG. 32 (3309).

Referring back to FIG. 32, the process of GOODLIST creation continues by taking a series of evenly spaced vertical slices through the binary image and attempting to recognize marks of the desired size. The starting coordinates are typically set to X=WIDTH/3, Y=0, and the first binary pixel is read (3202). The vertical mark size counter is also zeroed at this point (3203). If the read pixel is a one (3204), this means we are on a mark and therefore should increase our vertical mark size counter (3206). If the pixel is a zero (3204), this means we are on the background, and need to process a "vertical dip" (3207).

Process Vertical Dip

Figures 34, 35:
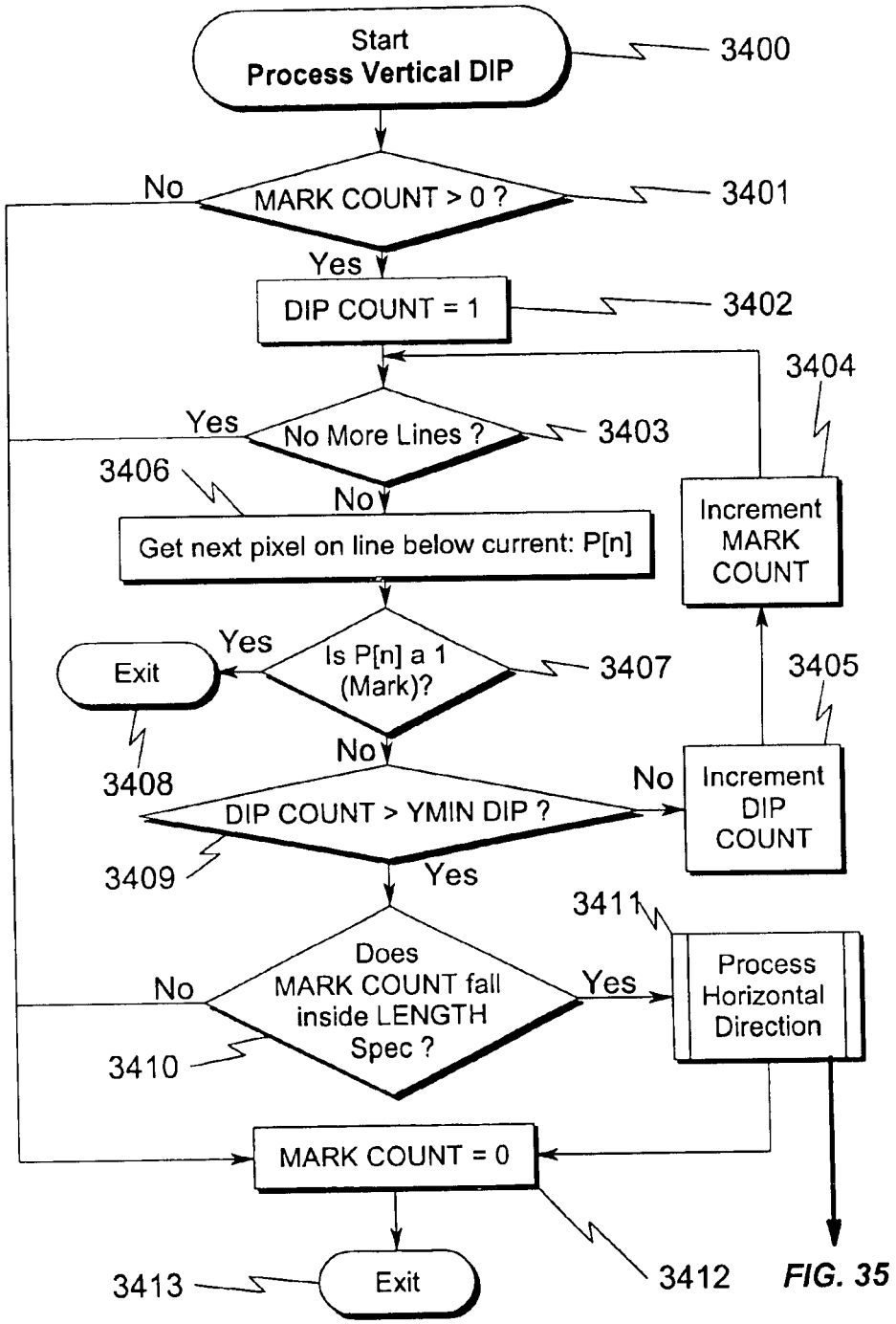
Figure 35:
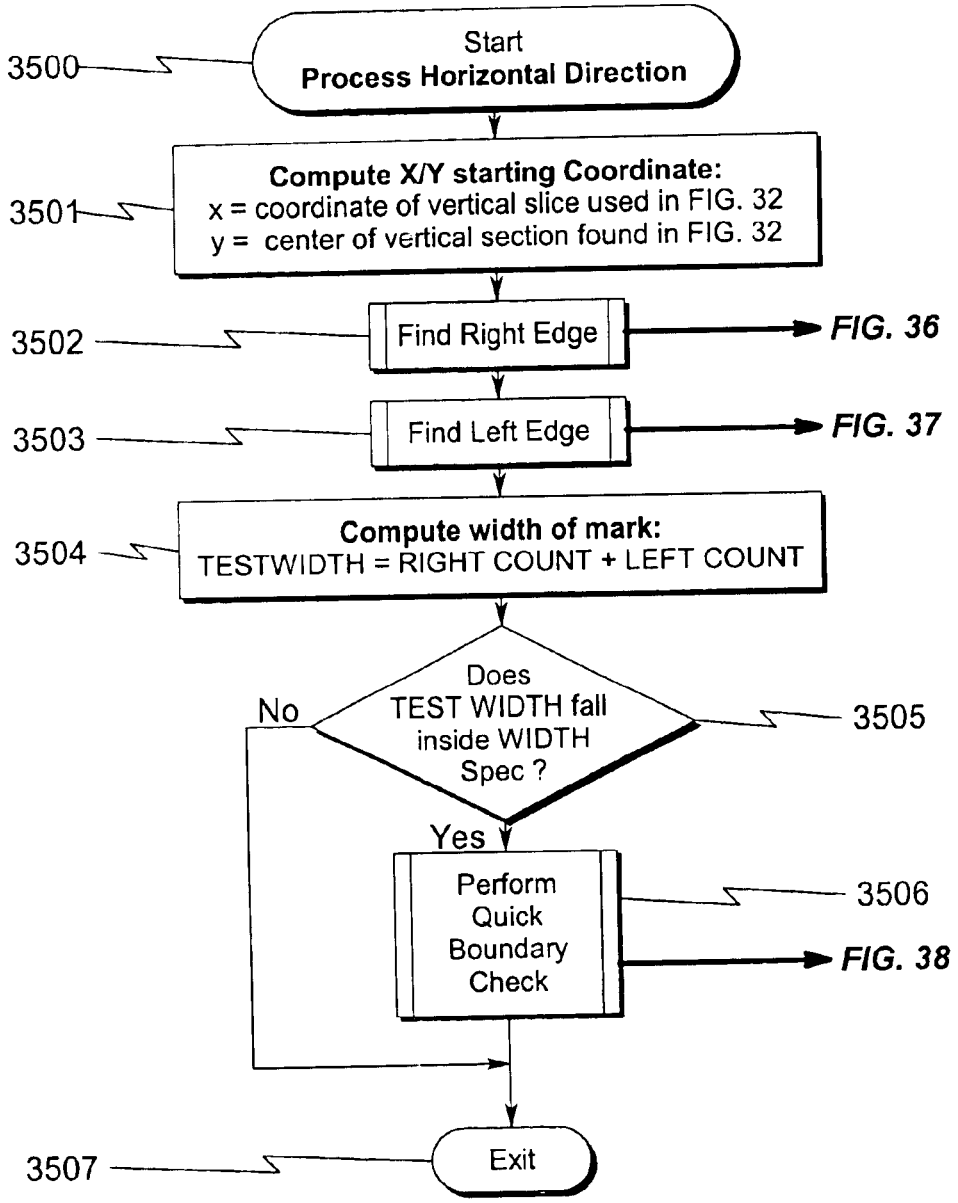

FIG. 34 illustrates the process of analyzing a "vertical dip" (3400). A "dip" is a term used here to describe a potential mark hole. These holes are allowed through the process as still belonging to a potential mark as long as they do not exceed XMINDIP or YMINDIP (3306). Upon entering FIG. 34, the mark size counter is tested to see if a mark was in progress (3401). If a mark was not in progress, FIG. 34 is exited (3413). If a mark was in progress, a counter called DIP COUNT is set to 1 (3402) to indicate that there is one pixel so far belonging to a "dip". Before getting another binary pixel for analysis, the Y coordinate is checked to make sure there are still more lines (3403). If there are no more lines, FIG. 34 is exited (3413) by first clearing the mark size counter (3412). The next line pixel is read and checked to see if it lies on a mark (3407). If it does, the "dip" has passed through and FIG. 34 is exited (3408). If the next line pixel lies on the background (3407), the DIP COUNT is checked to see if it exceeds the threshold for vertical "dips", YMINDIP (3409). If it does not the DIP COUNT is incremented (3405), the mark size counter is incremented (3404), and the loop continues at line count check (3403). If the DIP COUNT does exceed YMINDIP (3409), it is certain now that the background has been detected and the preceding mark size count may be examined as a potential mark. The mark size count is checked (3410) to see if it falls inside the LENGTHVAR (3305) around LENGTH (3303). If it does not, this vertical mark size does not belong to a mark of interest and FIG. 34 exits (3413) by first clearing the mark size counter (3412). If the vertical mark size is correct, the next step is to process the horizontal direction to find the horizontal mark size (3411).

Process Horizontal Direction

FIG. 35 illustrates the process of computing the horizontal mark size (3500). From the results of computing the vertical mark size, the [X,Y] starting coordinates are computed (3501). The X coordinate is the X value used in FIG. 32 for the vertical slice, and the Y coordinate is the center of the vertical slice (3501). First the Right edge of the potential mark is found (3502).

Find Right Edge

Figure 36:
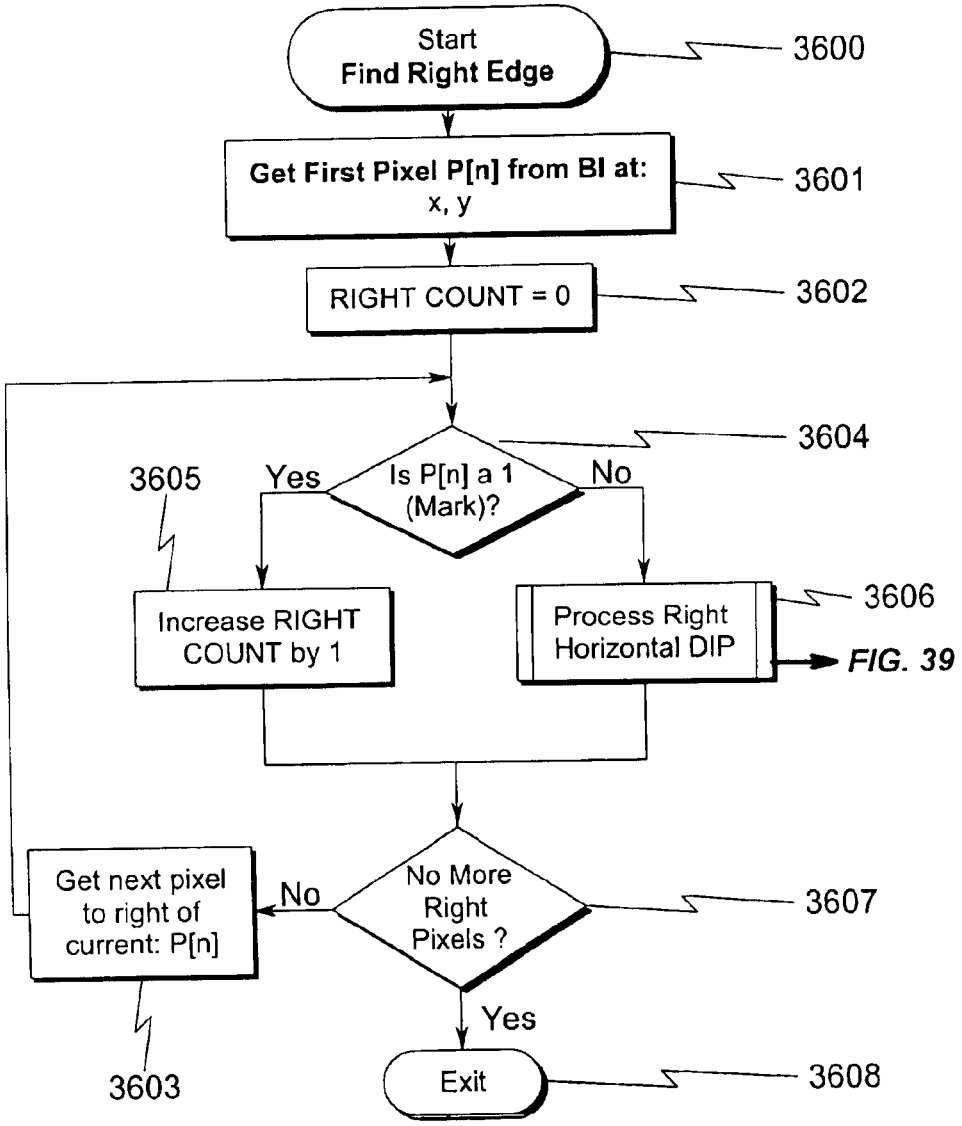

FIG. 36 illustrates the process of finding the right edge of the potential mark (3600). The first pixel is read from the binary image at coordinate [X,Y] (3601). A RIGHT COUNT counter is zeroed (3602). The pixel is checked to see if it lies on a mark (3604). If is does the RIGHT COUNT is incremented (3605). If the pixel lies on the background, the a right horizontal "dip" is processed (3606).

Process Right Horizontal Dip

Figure 39:
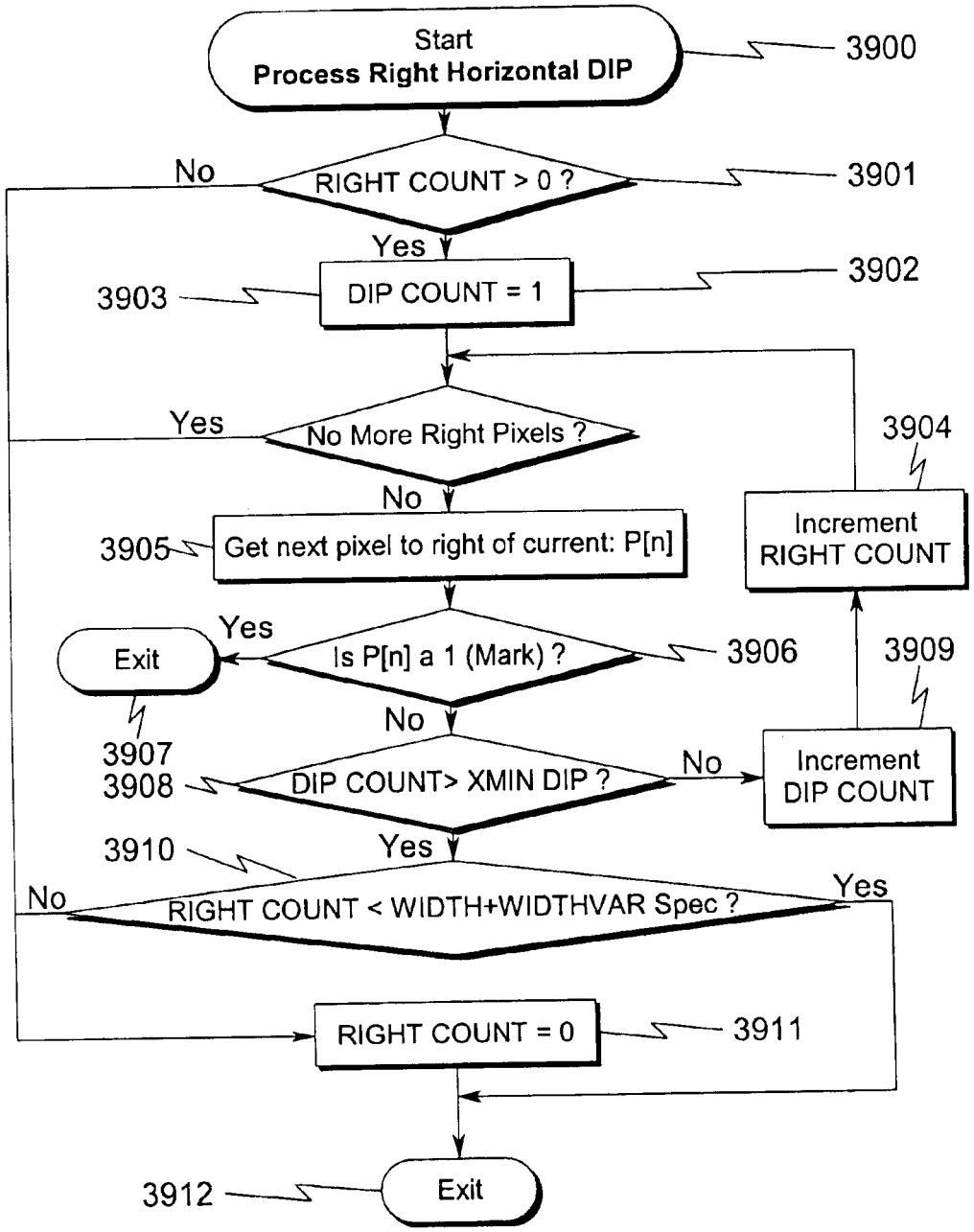

FIG. 39 illustrates the right horizontal "dip" processing (3900). First the RIGHT COUNT is checked to see if a mark was being processed (3901). If not, FIG. 39 exits (3912) by first clearing the RIGHT COUNT (3911). A DIP COUNT variable is set to one (3902) to indicate that a single pixel lies on a "dip". If the RIGHT COUNT does indicate that a mark was being processed, a check is made to see if any more right pixels exist in this slice on the image (3903). If not, FIG. 39 exits (3912) by first clearing the RIGHT COUNT (3911). If there are more right pixels (3903), the next right pixel is read from the image (3905). If this pixel is found to lie on a mark (3906), FIG. 39 exits (3907). If the next right pixel lies on the background (3907), the DIP COUNT is checked to see if it exceeds the threshold for horizontal "dips", XMINDIP (3908). If it does not, the DIP COUNT is incremented (3909), the RIGHT COUNT is incremented (3904), and the loop continues at right pixel check (3903). If the DIP COUNT does exceed XMINDIP (3908), it is certain now that the background has been detected and the preceding RIGHT COUNT may be examined as a potential mark. The RIGHT COUNT is checked (3910) to make sure it is not larger than the WIDTHVAR (3304) plus WIDTH (3303) allow. If it is larger, this mark size does not belong to a mark of interest and FIG. 39 exits (3912) by first clearing the RIGHT COUNT (3911). If the RIGHT COUNT is correct, FIG. 39 is exited (3912) and the RIGHT COUNT is not cleared.

Right Pixel Processing

Referring back to FIG. 36, processing of a right horizontal "dip" is now completed (3606). FIG. 36 continues by checking to see if there are no more right pixels to process (3607). If there are no more, FIG. 36 exits (3608) with whatever RIGHT COUNT is left. If there are still more pixels, the next right pixel is fetched from the image (3603) and the loop continues at pixel mark check (3604).

Find Left Edge

Figure 37:
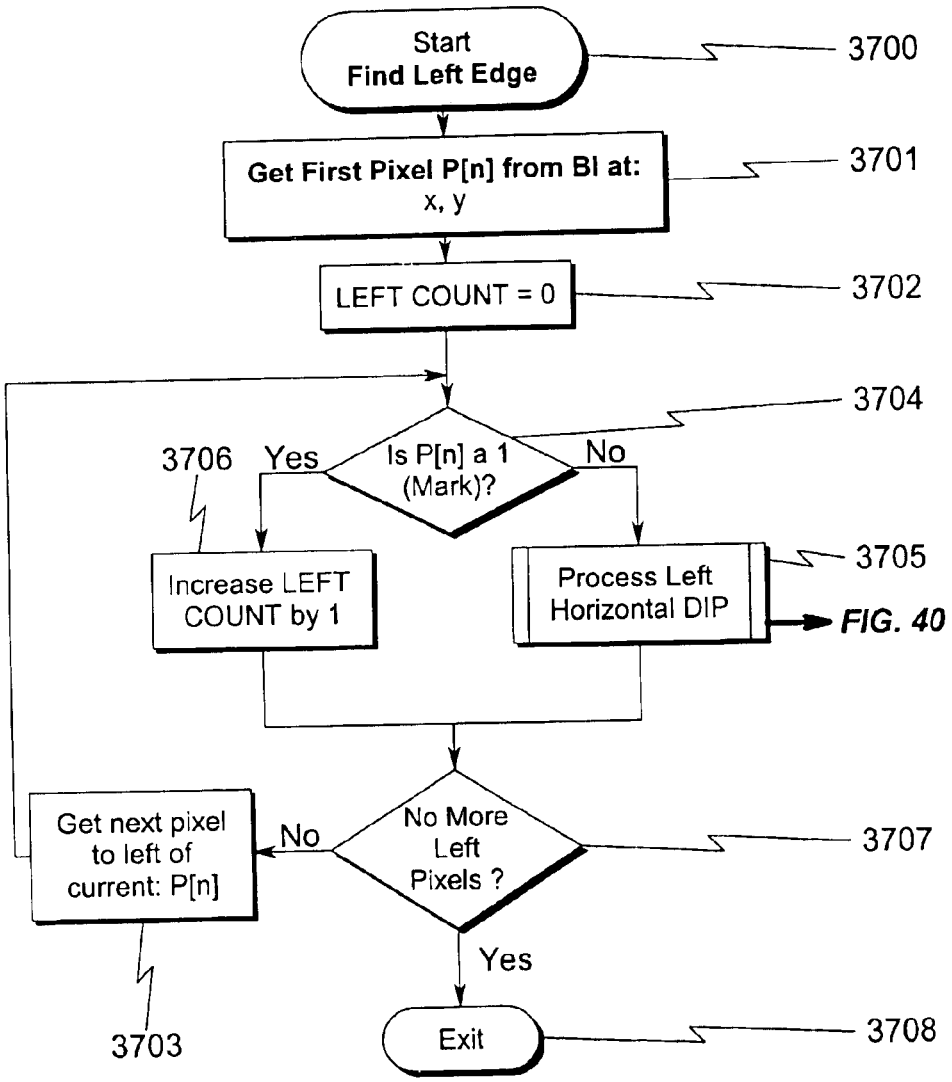

Referring back to FIG. 35, the process of finding the right edge of the mark has just completed (3502). Now it is time to find the left edge (3503). FIG. 37 illustrates the process of finding the left edge of the potential mark (3700). The first pixel is read from the binary image at coordinate [X,Y] (3701). A LEFT COUNT counter is zeroed (3702). The pixel is checked to see if it lies on a mark (3704). If is does the LEFT COUNT is incremented (3706). If the pixel lies on the background, the a left horizontal "dip" is processed (3705).

Left Horizontal Dip

Figure 40:
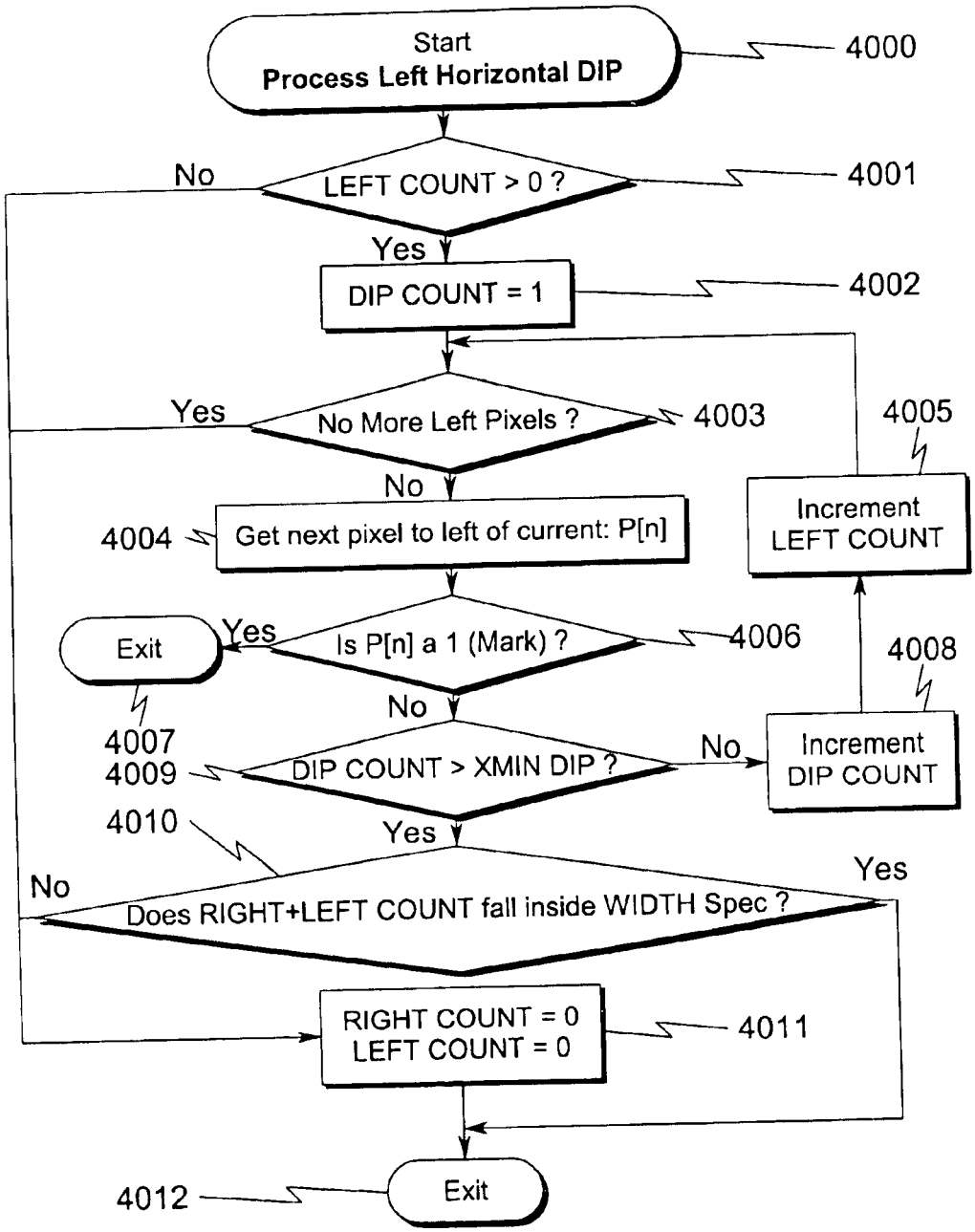

FIG. 40 illustrates the left horizontal "dip" processing (4000). First the LEFT COUNT is checked to see if a mark was being processed (4001). If not, FIG. 40 exits (4012) by first clearing the LEFT COUNT and RIGHT COUNT (4011). A DIP COUNT variable is set to one (4002) to indicate that a single pixel lies on a "dip". If the LEFT COUNT does indicate that a mark was being processed, a check is made to see if any more left pixels exist in this slice on the image (4003). If not, FIG. 40 exits (4012) by first clearing the LEFT COUNT and RIGHT COUNT (4011). If there are more left pixels (4003), the next left pixel is read from the image (4004). If this pixel is found to lie on a mark (4006), FIG. 40 exits (4007). If the next left pixel lies on the background (4006), the DIP COUNT is checked to see if it exceeds the threshold for horizontal "dips", XMINDIP (4009). If it does not, the DIP COUNT is incremented (4008), the LEFT COUNT is incremented (4005), and the loop continues at left pixel check (4003). If the DIP COUNT does exceed XMINDIP (4009), it is certain now that the background has been detected and the preceding LEFT COUNT may be examined as a potential mark. The LEFT COUNT plus RIGHT COUNT is checked (4010) to make sure it falls within the WIDTHVAR (3305) and WIDTH (3303) specification. If it does not, this mark size does not belong to a mark of interest and FIG. 40 exits (4012) by first clearing the LEFT COUNT and RIGHT COUNT (4011). If the size is correct, FIG. 40 is exited (4012) and the LEFT COUNT and RIGHT COUNT are not cleared.

Left Pixel Processing

Referring back to FIG. 37, processing of a left horizontal "dip" is now completed (3705). FIG. 37 continues by checking to see if there are no more left pixels to process (3707). If there are no more, FIG. 37 exits (3708) with whatever LEFT COUNT and RIGHT COUNT are left. If there are still more pixels, the next left pixel is fetched from the image (3703) and the loop continues at pixel mark check (3704).

Mark Width Calculation

Referring back to FIG. 35, the process of finding the left edge of the mark has just completed (3503). Now it is time to compute the overall mark width: RIGHT COUNT plus LEFT COUNT (3504). If this width does not fall inside the WIDTHVAR (3305) and WIDTH (3303) specification (3505), FIG. 35 exits (3507). If the width does qualify, it is now time to perform a quick outside boundary check to verify no erroneous print exists (3506).

Quick Boundary Check

Figure 38:
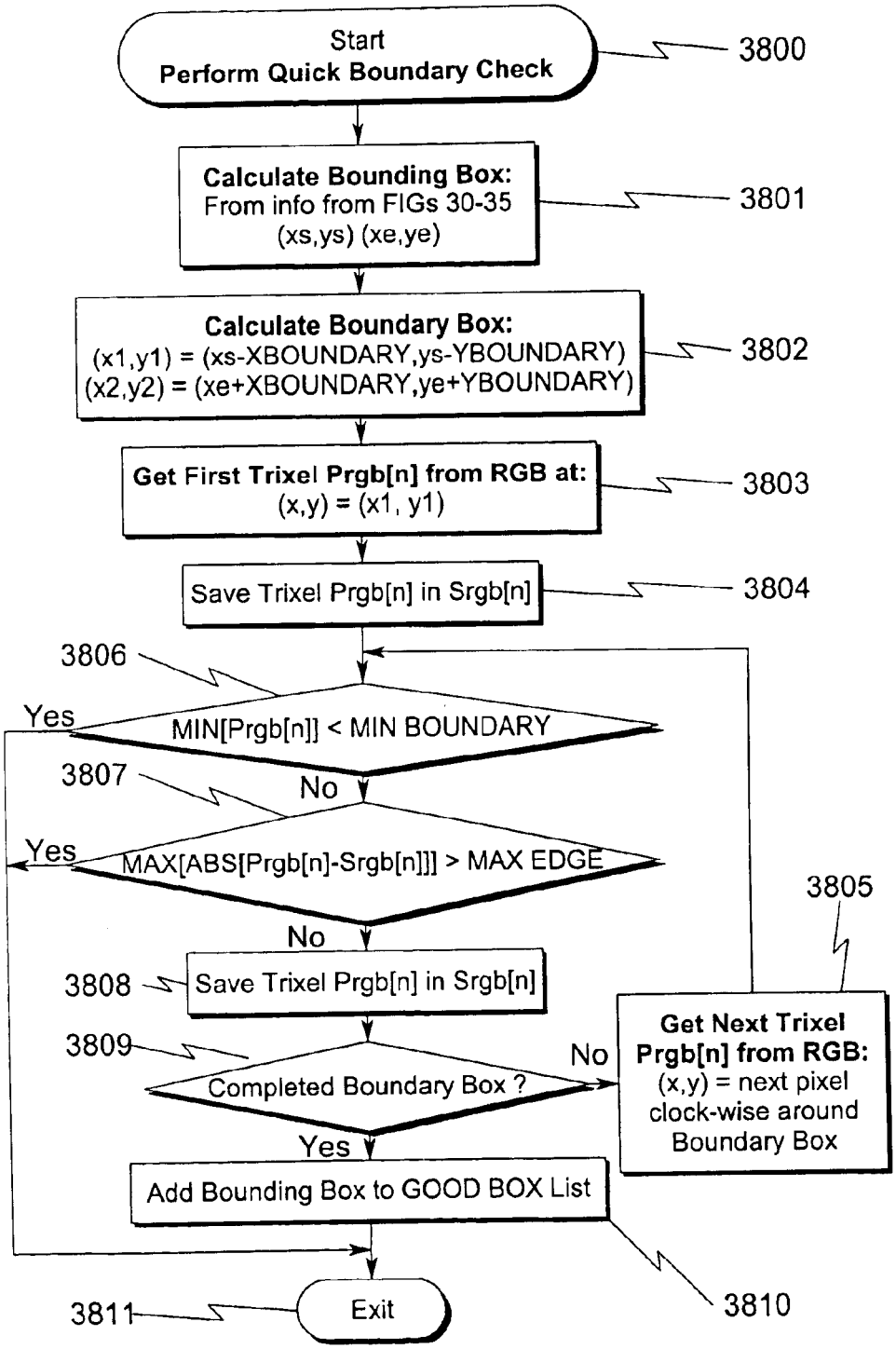

FIG. 38 illustrates the process of performing a quick boundary check (3800). First the potential mark's bounding box is computed (3801). This is the box which entirely encloses the potential mark: (xs,ys), (xe,ye). Next the boundary box is computed: (x1,y1), (x2,y2). (3802). This box is larger in all directions from the bounding box by XBOUNDARY (3308) and YBOUNDARY (3308). Starting at (x1,y1), the first RGB trixel is fetched from the RGB image: Prgb[n] (3803). This trixel is saved in Srgb[n] (3804). A check is made to see if the new trixel has any component less than MIN BOUNDARY (3806). MIN BOUNDARY is an installation constant, and typically is set to a value that demands the background to be brighter than the mark. If this boundary check fails (3806), FIG. 38 exits with this mark not being added to the GOODLIST (3811). If this check passes (3806), another check is made to look for large edges around the boundary (3807). If the absolute value of any component (Prgb[n]) minus its predecessor (Srgb[n]) is greater than MAX EDGE (3807), FIG. 38 exits with this mark not being added to the GOODLIST (3811). If this check passes (3807), the Prgb[n] trixel is saved in the Srgb[n] trixel (3808). If the boundary box has not been entirely traversed (3809), the next trixel (Prgb[n]) is fetched in a clock-wise fashion around the boundary box (3805). The loop continues at the MIN BOUNDARY check (3806). If the boundary box has been entirely traversed, FIG. 38 exits (3811) by first adding this mark to the GOODLIST (3810).

GOODLIST Completion

Referring back to FIG. 35, a mark has or has not passed the quick boundary check (3506). FIG. 35 exits (3507). Referring back to FIG. 34, the horizontal direction is fully processed (3411) and FIG. 34 exits (3413) by first clearing the MARK COUNT (3412). Referring back to FIG. 32, a vertical "dip" has been fully processed (3207), and a check is then made to see if any more lines exist in this vertical slice (3208). If so, the next line pixel is read from the binary image (3205) and the vertical slice loop continues at the mark check (3204). If no more lines exist (3208), the X coordinate is incremented by WIDTH/3 (3209) and the Y value is set to zero (3209). A check is made to see if no more vertical slices exist (3210). If not, FIG. 32 exits (3212). If there are more vertical slices left, the first pixel is fetched from the binary image at [X,Y] (3211). The loop continues at the mark check (3204). Referring back to FIG. 31, the GOODLIST creation process is complete (3103).

Find Duplicate Marks

Referring to FIG. 31, the duplicate marks are found (3104) after the GOODLIST creation (3103). FIG. 41 illustrates this process (4100).

Comparison Constants

Figure 42:
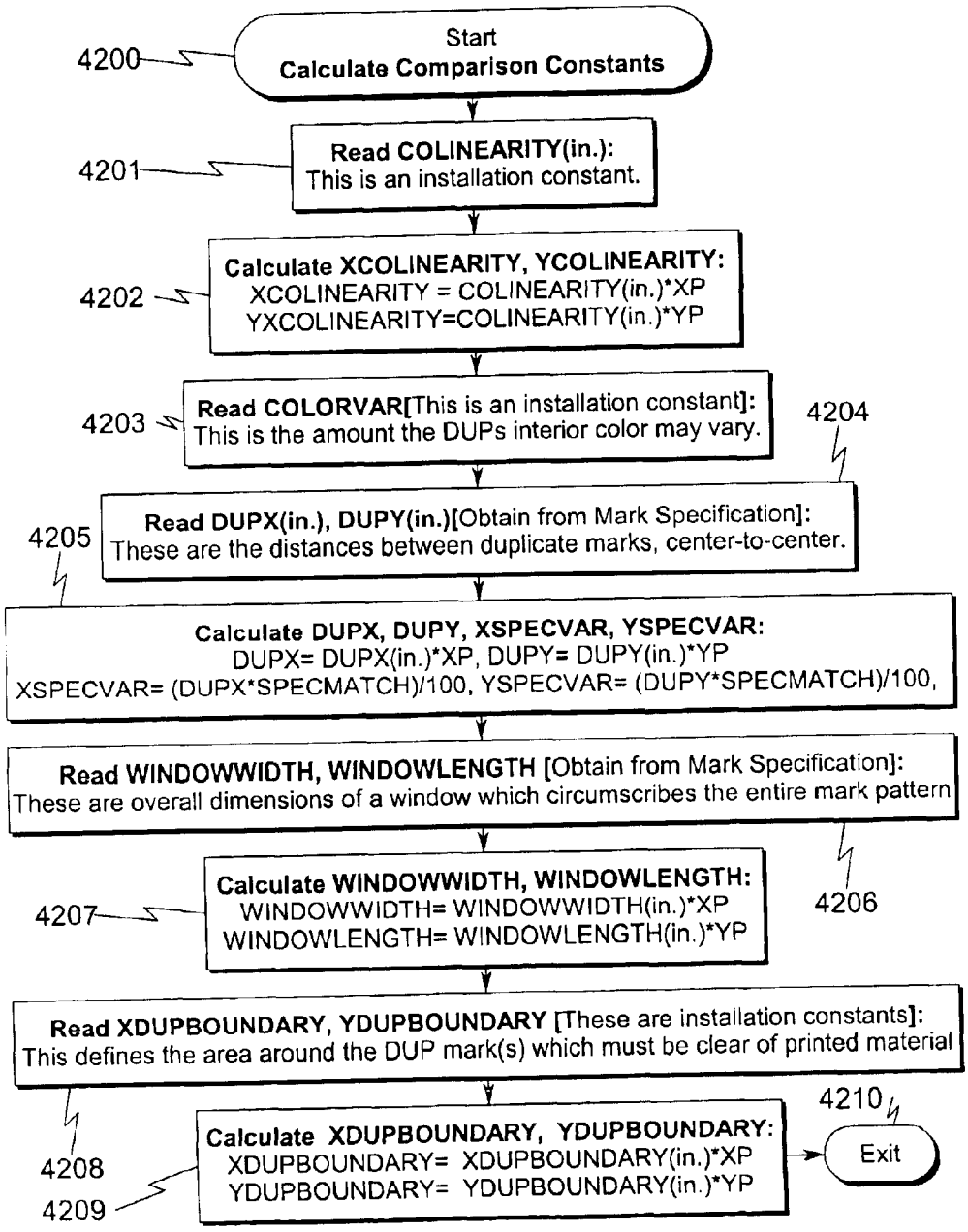

First some comparison constants must be calculated (4101). FIG. 42 illustrates the calculation of these constants (4200). First a COLLINEARITY value (in Inches or Millimeters) is read (4201). This is an installation constant and forces the duplicate marks to be either vertically or horizontally collinear by this amount. This value is scaled into the pixel dimensions: XCOLLINEARITY and YCOLLINEARITY (4202). An installation constant, COLORVAR, is read next (4203). This variance is a measure of how different the color of one Duplicate Mark to the other may differ before they are not considered Duplicate Marks.

The values DUPX and DUPY are read from the mark specification (4204). These are the absolute distances, center-to-center, desired between the Duplicate Marks. These values are scaled to their pixel dimensions (4205).

From DUPX and DUPY, another set of constants are calculated: XSPECVAR and YSPECVAR (4205). These values give the amount in pixels the distance between the Duplicates can vary and still be accepted.

The WINDOWWIDTH and WINDOWLENGTH constants are also obtained from the mark specification (4206). These are the overall width and length (Inches or Millimeters) of the mark specification. These values are scaled to their pixel values (4207).

Another set of installation constants, XDUPBOUNDARY and YDUPBOUNDARY, are read (4208). These constants define the X and Y area thickness around the outside perimeter of the Duplicate Marks that must be free of erroneous print to qualify as Duplicate Marks. These values are then scaled to pixel values (4209). FIG. 42 exits back to FIG. 41 (4210).

Mark Pattern Type Selection

Figure 43:
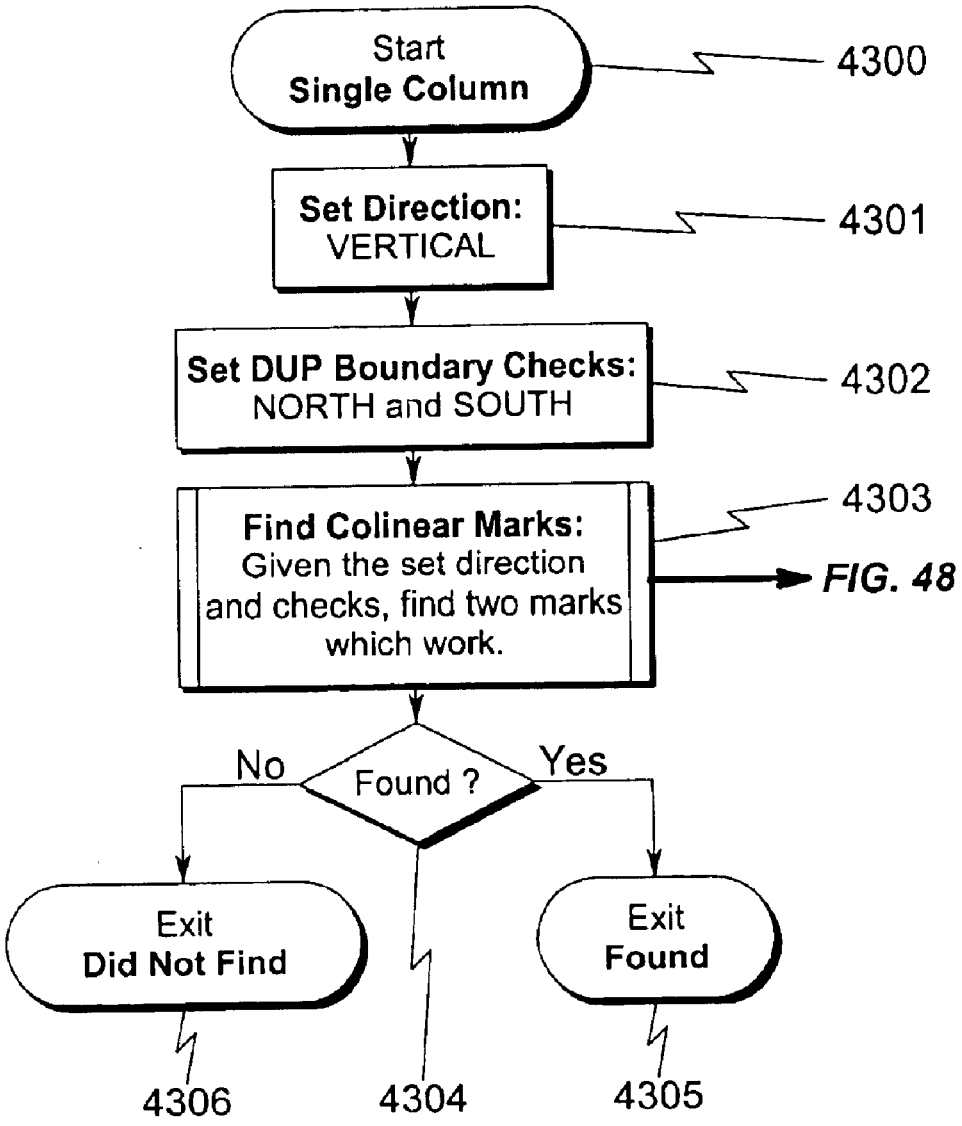
Figure 44:
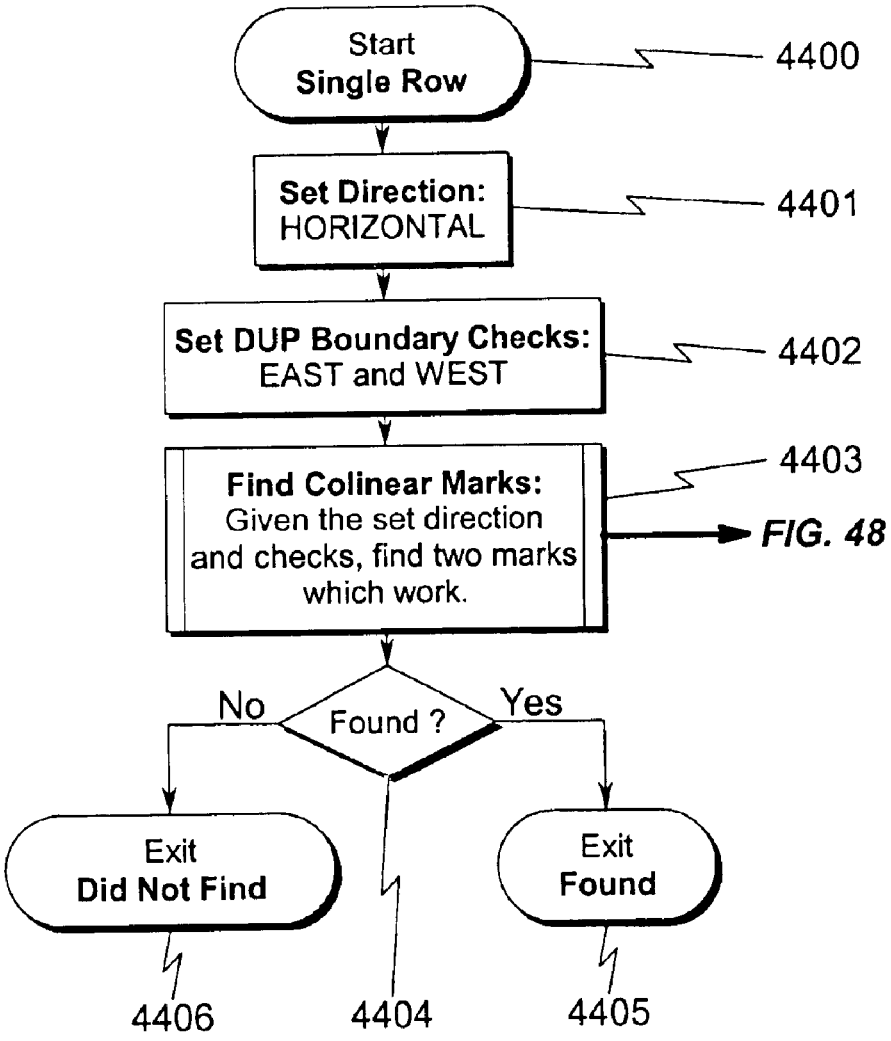
Figure 45:
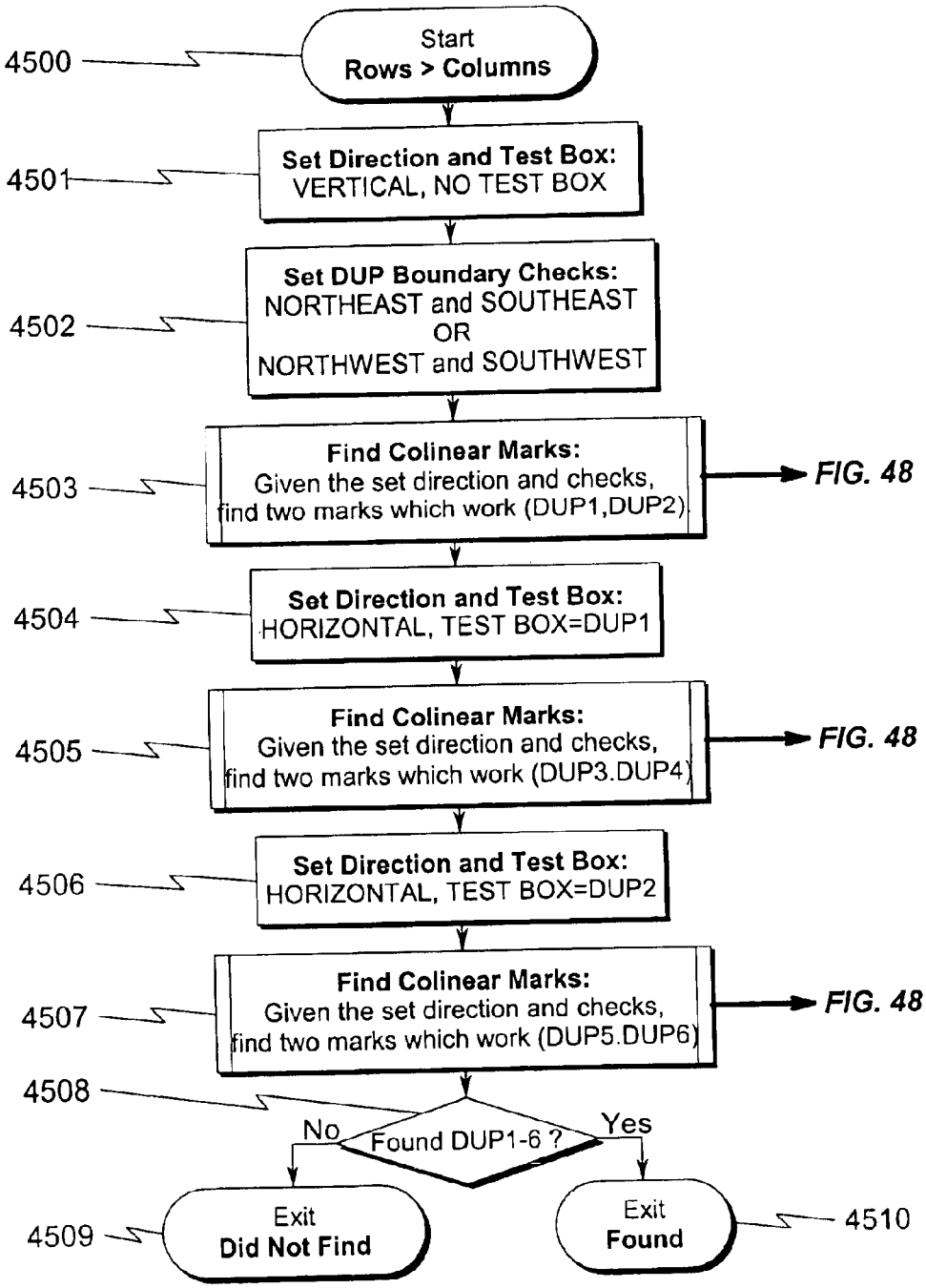
Figure 46:
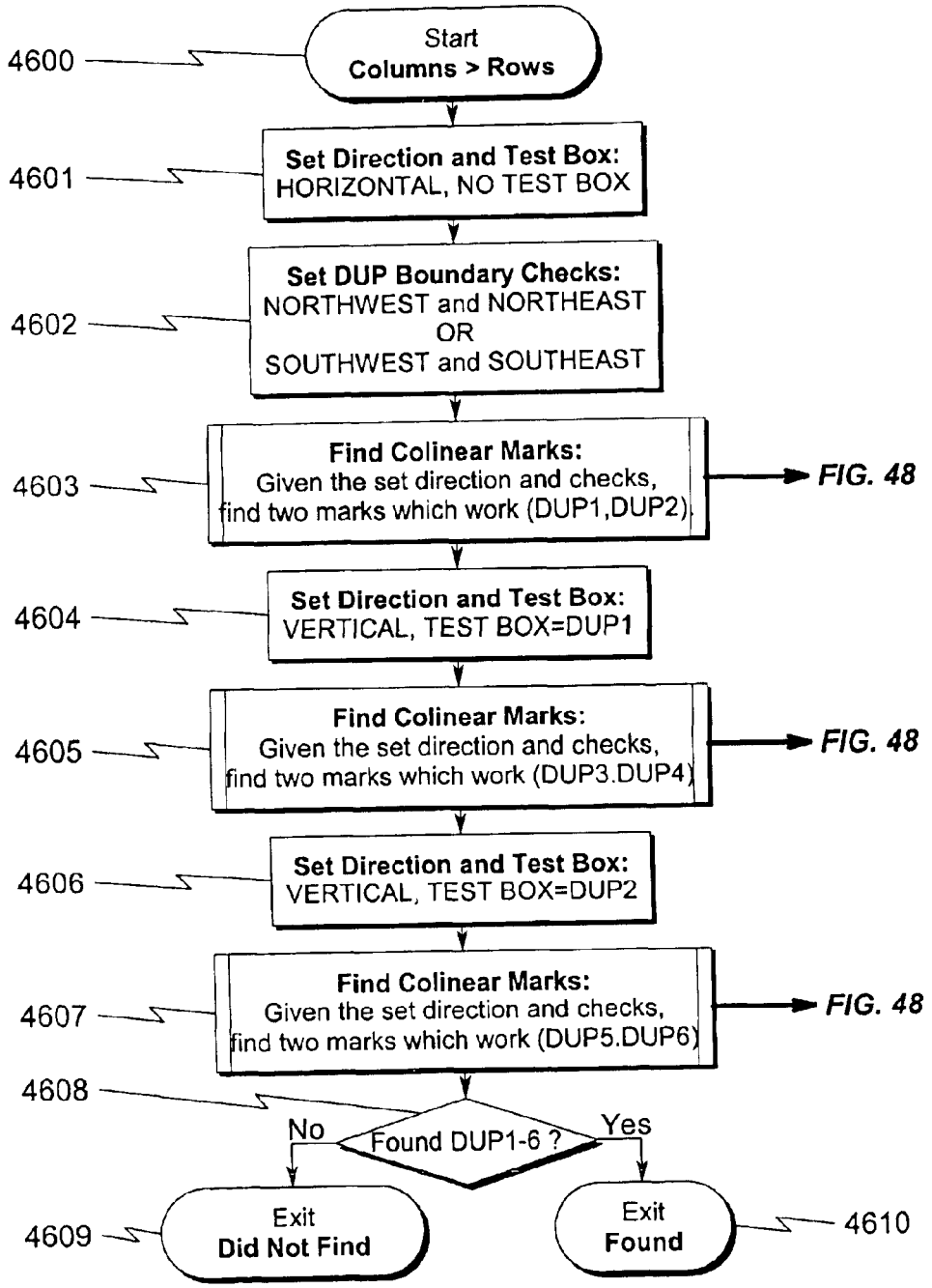
Figure 47:
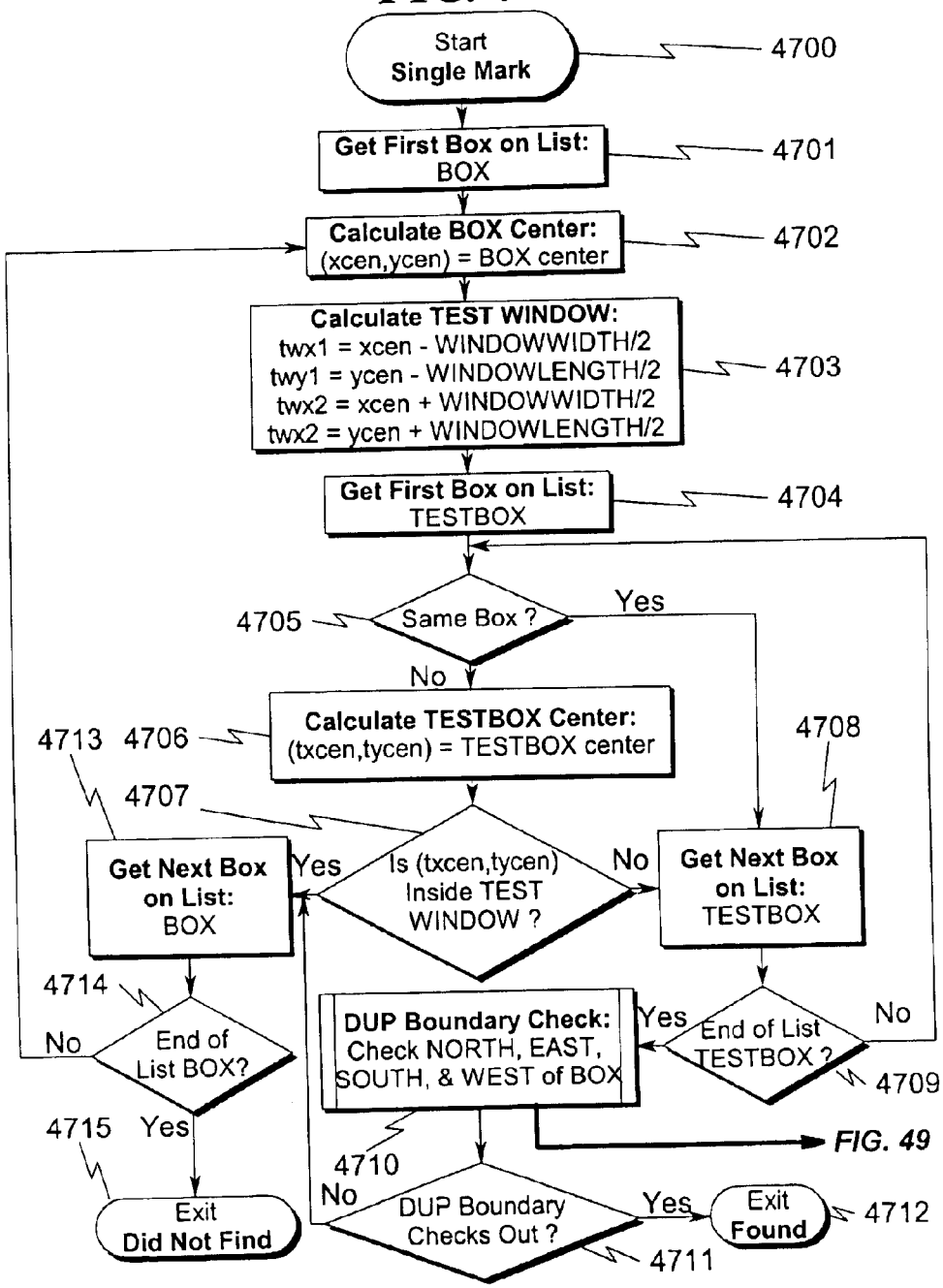

Referring back to FIG. 41, the comparison constants have now been computed (4101). The next step is to determine the type of mark pattern being printed in order to process the Duplicate Marks correctly. If the mark pattern is the Single Column Mark Pattern (4102), FIG. 43 is employed. If the mark pattern is the Single Row Pattern (4103), FIG. 44 is employed. If the mark pattern is the Rows>Columns Pattern (4104), FIG. 45 is employed. If the mark pattern is the Columns>Rows Pattern (4105), FIG. 46 is employed. If the mark pattern is a Single Mark Pattern (4106), FIG. 47 is employed. If Duplicate Marks are detected (4107), FIG. 41 exits back indicating success (4108). If the marks were not detected, FIG. 41 exits back indicating failure (4109).

Find Duplicate Marks: Single Column Mark Pattern

Figures 48, 49:
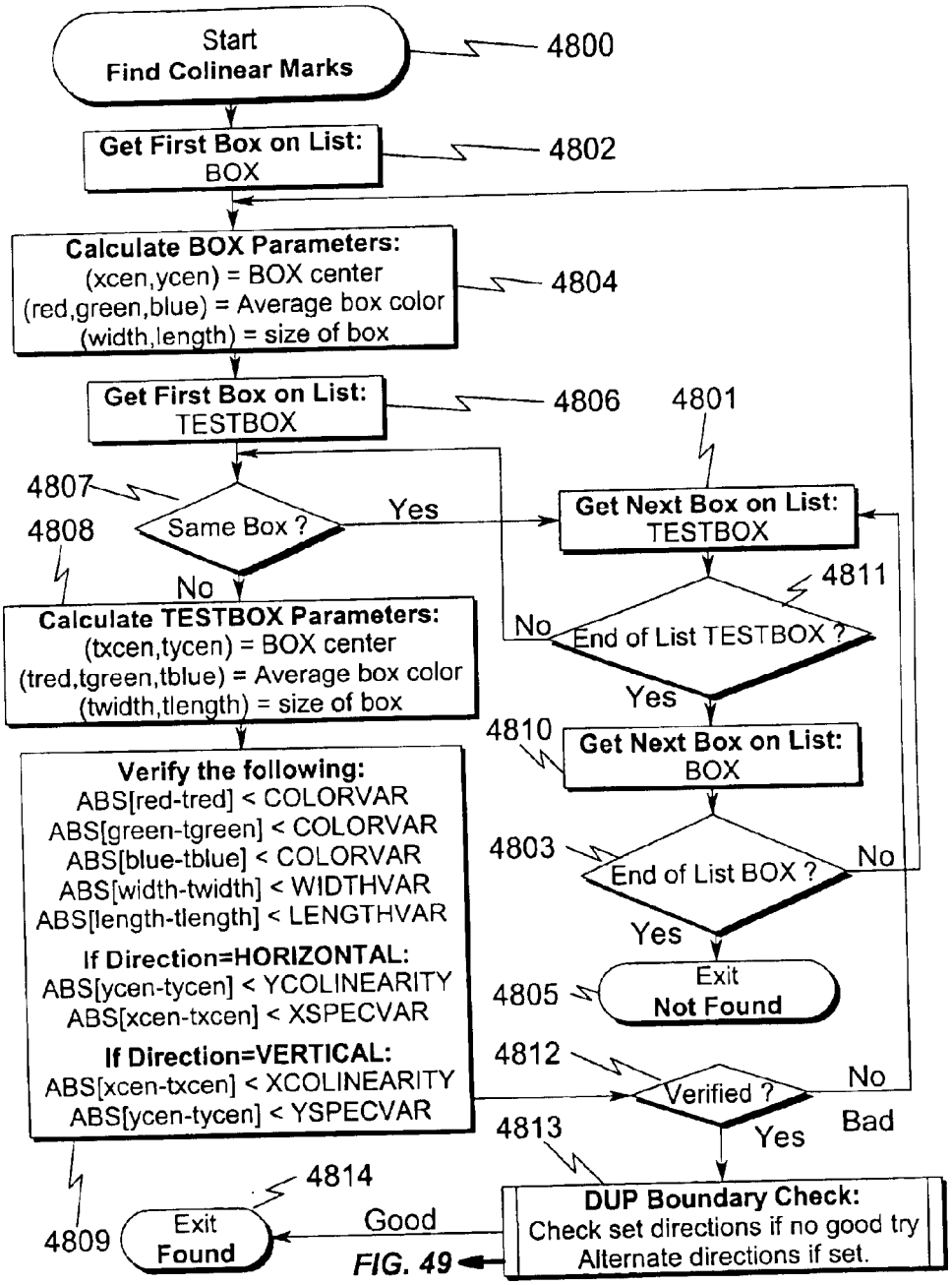
Figure 49:
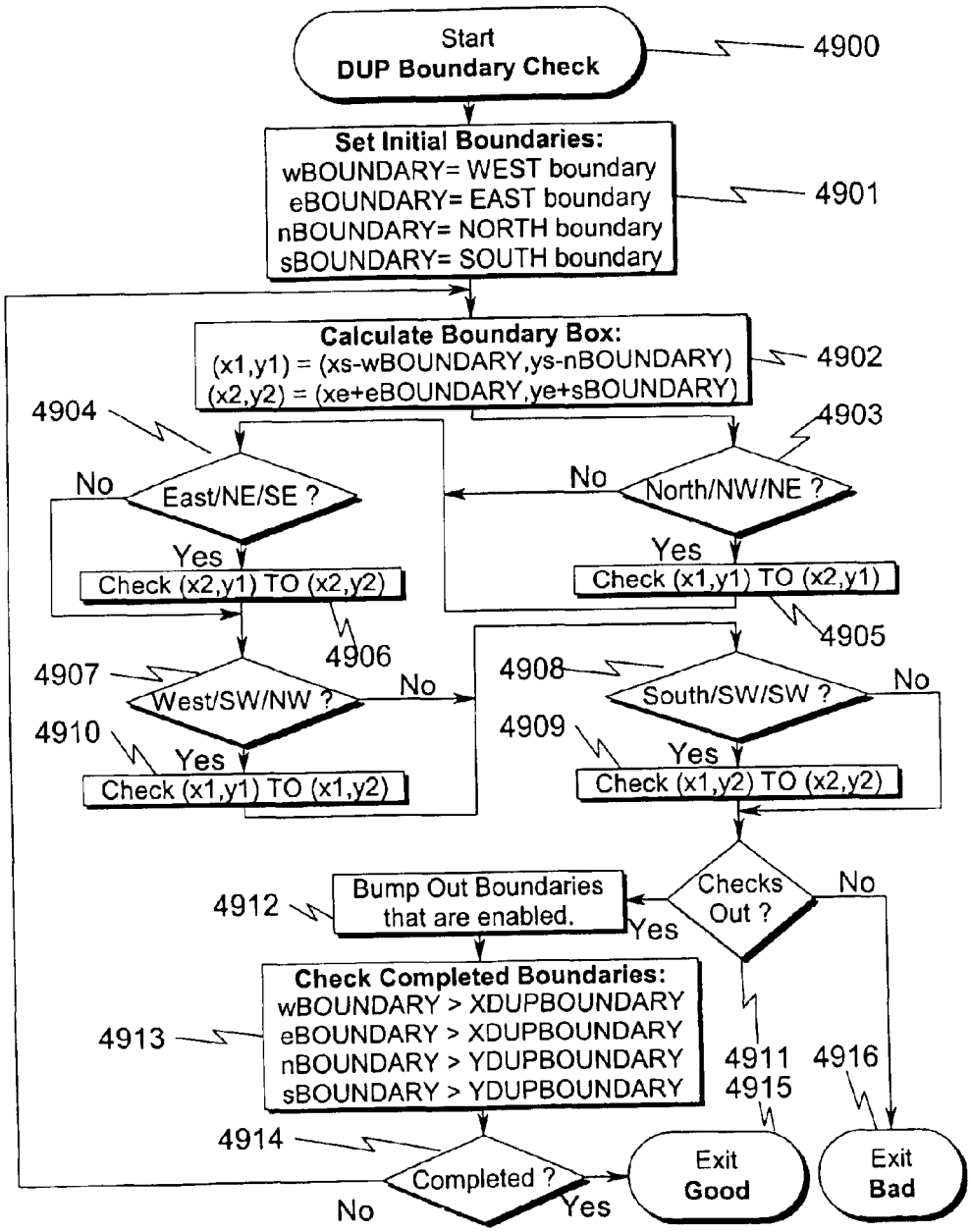

FIG. 43 illustrates the process of detecting Duplicate Marks that belong to the Single Column Mark Pattern (4300). First the direction is set to VERTICAL (4301), and the Duplicate Boundary checks are set to NORTH and SOUTH (4302). This forces the Duplicate marks to be collinear in the vertical direction and forces boundary checks to the NORTH of the top Duplicate and to the SOUTH of the bottom Duplicate. Given these settings, marks on the GOODLIST are checked against a set of rigorous collinear, dimensional, and color checks (4303). FIG. 48 illustrates this process. Refer below to "Finding the Collinear Marks", for a description of this process. If the Duplicate Marks are found (4304), FIG. 43 exits with success (4305). If not, FIG. 43 exits with failure (4306).

Find Duplicate Marks: Single Row Mark Pattern

FIG. 44 illustrates the process of detecting Duplicate Marks that belong to the Single Row Mark Pattern (4400). First the direction is set to HORIZONTAL (4401), and the Duplicate Boundary checks are set to EAST and WEST (4402). This forces the Duplicate marks to be collinear in the horizontal direction and forces boundary checks to the WEST of the left Duplicate and to the EAST of the right Duplicate. Given these settings, marks on the GOODLIST are checked against a set of rigorous collinear, dimensional, and color checks (4403). FIG. 48 illustrates this process. Refer below to "Finding the Collinear Marks", for a description of this process. If the Duplicate Marks are found (4404), FIG. 44 exits with success (4405). If not, FIG. 44 exits with failure (4406).

Find Duplicate Marks: Rows>Columns Mark Pattern

FIG. 45 illustrates the process of detecting Duplicate Marks that belong to the Rows>Columns Mark Pattern (4500). First the direction is set to VERTICAL (4501), and the Duplicate Boundary checks are set to NORTHEAST and SOUTHEAST or NORTHWEST and SOUTHWEST (4502). This will force a set of Duplicates (DUP1 and DUP2) to be detected that are collinear in the vertical direction and will be boundary checked in either of the two sets of directions listed above. Given these settings, marks on the GOODLIST are checked against a set of rigorous collinear, dimensional, and color checks (4503). FIG. 48 illustrates this process. Refer below to "Finding the Collinear Marks", for a description of this process. Use the first Duplicate Mark found (DUP1) as a starting point and set the direction to HORIZONTAL (4504). This will force the next set of duplicates (DUP3 and DUP4) to be collinear in the horizontal direction and collinear with DUP1. Given these settings, find the Duplicates (4505). Next use the second Duplicate Mark found (DUP2) as a starting point and set the direction to HORIZONTAL (4506). This will force the next set of duplicates (DUP5 and DUP6) to be collinear in the horizontal direction and collinear with DUP2. Given these settings, find the Duplicates (4507). If DUP3, DUP4, DUP5, and DUP6, were found (4508), FIG. 45 exits with success (4510). If not, FIG. 45 exits with failure (4509).

Find Duplicate Marks: Columns>Rows Mark Pattern

FIG. 46 illustrates the process of detecting Duplicate Marks that belong to the Columns>Rows Mark Pattern (4600). First the direction is set to HORIZONTAL (4601), and the Duplicate Boundary checks are set to NORTHWEST and NORTHEAST or SOUTHWEST and SOUTHEAST (4602). This will force a set of Duplicates (DUP1 and DUP2) to be detected that are collinear in the horizontal direction and will be boundary checked in either of the two sets of directions listed above. Given these settings, marks on the GOODLIST are checked against a set of rigorous collinear, dimensional, and color checks (4603). FIG. 48 illustrates this process. Refer below to "Finding the Collinear Marks", for a description of this process. Use the first Duplicate Mark found (DUP1) as a starting point and set the direction to VERTICAL (4604). This will force the next set of duplicates (DUP3 and DUP4) to be collinear in the vertical direction and collinear with DUP1. Given these settings, find the Duplicates (4605). Next use the second Duplicate Mark found (DUP2) as a starting point and set the direction to VERTICAL (4606). This will force the next set of duplicates (DUP5 and DUP6) to be collinear in the vertical direction and collinear with DUP2. Given these settings, find the Duplicates (4607). If DUP3, DUP4, DUP5, and DUP6, were found (4608), FIG. 46 exits with success (4610). If not, FIG. 46 exits with failure (4609).

Find Duplicate Marks: Single Mark Pattern

FIG. 47 illustrates the process of detecting the single mark from the GOODLIST (4700). First get the first box from the GOODLIST, call it BOX (4701). Next calculate the box center of BOX (xcen,ycen) (4702). Calculate the test window that is the bounding box centered on the box center and has the WINDOWWIDTH (4207) and WINDOWLENGTH (4207) as its width and length (4703). Get the first box on the GOODLIST, call it TESTBOX (4704). If this is not the same box as BOX (4705), calculate the center of TESTBOX (txcen,tycen) (4706). If (txcen,tycen) lies inside the bounding box window (4707), get the next box on the list from BOX (4713). If we are out of boxes for BOX (4714), FIG. 47 exits with failure (4715). If we are not out of boxes, continue the looping to calculating the BOX center (4702). If the TESTBOX is not inside the window (4707) or TESTBOX is the same box as BOX (4705), get the next box on the GOODLIST from TESTBOX (4708). If we are not out of boxes for TESTBOX (4709), continue looping to the same box check (4705). If we are out of boxes for TESTBOX, this means that no other boxes lie inside the window around our BOX. Perform a DUP Boundary Check to the NORTH, EAST, SOUTH, and WEST of BOX (4710). This process is illustrated in FIG. 49 and below in "The Duplicate Mark Boundary Check" section. If this check passes, FIG. 47 exits with success (4712). If this check fails, the next box on the GOODLIST from BOX is fetched (4713) and processing continues.

Finding the Collinear Marks

FIG. 48 illustrates this process of finding collinear marks (4800). First the first box on the GOODLIST is fetched and labeled BOX (4802). The center of this box (xcen,ycen), the interior color (red,green,blue) and the width and length (width,length) are calculated (4804). Next the first box on the GOODLIST is fetched and labeled TESTBOX (4806). If BOX is not the same box as TESTBOX (4807), the center, color, and dimensions of TESTBOX are calculated (4808). These values are checked against those of the original box (BOX) for discrepancies in color (COLORVAR), width (WIDTHVAR), and length (LENGTHVAR) (4809). Depending on the direction set (HORIZONTAL or VERTICAL), a collinear test in that direction and a specification match test are made (4809). If all these factors pass (4812), the two marks are put through a DUP Boundary Check (4813) in the directions specified to detect potential erroneous print. If this test passes, FIG. 48 exits with success (4814). This process is illustrated in FIG. 49 and below in "The Duplicate Mark Boundary Check" section. If the DUP Boundary Check fails (4813), the previous tests failed (4809), or BOX was the same box as TESTBOX (4807), get the next TESTBOX on the list (4810). If there are more boxes for TESTBOX (4811), continue looping at the same box test (4807). If there are no more boxes left for TESTBOX (4811), get the next BOX from the list (4801). If there are no more boxes for BOX (4803), FIG. 48 exits with failure (4805). If there are still some boxes for BOX (4803), continue looping at the BOX parameter calculation step (4804).

The Duplicate Mark Boundary Check

FIG. 49 illustrates the Duplicate Boundary check process (4900). First the initial boundary offsets are set (4901). These values determine the boundary box. Next calculate the boundary box (4902). If the directions have been set to NORTH, NORTEAST, or NORTHWEST (4903), check the area region to the NORTH of the mark for erroneous print (4905). If the directions have been set to EAST, NORTEAST, or SOUTHEAST (4904), check the area region to the EAST of the mark for erroneous print (4906). If the directions have been set to WEST, NORTWEST, or SOUTHWEST (4907), check the area region to the WEST of the mark for erroneous print (4910). If the directions have been set to SOUTH, SOUTHEAST, or SOUTHWEST (4908), check the area region to the SOUTH of the mark for erroneous print (4909). If any of these regions detected erroneous print (4911), FIG. 49 exits with failure (4916). If all the checks passed (4911), all the boundaries are bumped out 1 pixel farther (4912). Test (4913) to see if all the boundaries have reached either the desired XDUPBOUNDARY (4209) or YDUPBOUNDARY (4209). If the boundaries are complete (4914), FIG. 49 exits with success (4915). If the boundaries are not complete (4914), continue looping at the boundary box calculation step (4902).

Finding the Non-Duplicate Marks

Referring to FIG. 31, the non-Duplicate marks are found (3105) after the Duplicate marks are found (3104). FIG. 50 illustrates this process (5000). First the region of interest is calculated (5001). This is the mark pattern specification window circumscribed around the duplicate marks. Set the threshold to the starting threshold (ST), an installation constant (5002). Create a binary image from the original RGB image in the region of interest using the threshold (5003). Create a GOODLIST by slicing up the region of interest (see FIG. 32) (5004). If we did not find enough marks to accommodate our mark pattern (5005), bump up the threshold to make it more sensitive (5006). If the ending threshold has been reached (5007), an installation constant, FIG. 50 exits with failure (5008). If the threshold has not reaching the ending value (5007), continue looping at the create binary image step (5003). As soon as enough marks are detected (5005), FIG. 50 exits with success (5009).

Matching the Marks to the Stations

Figure 51:
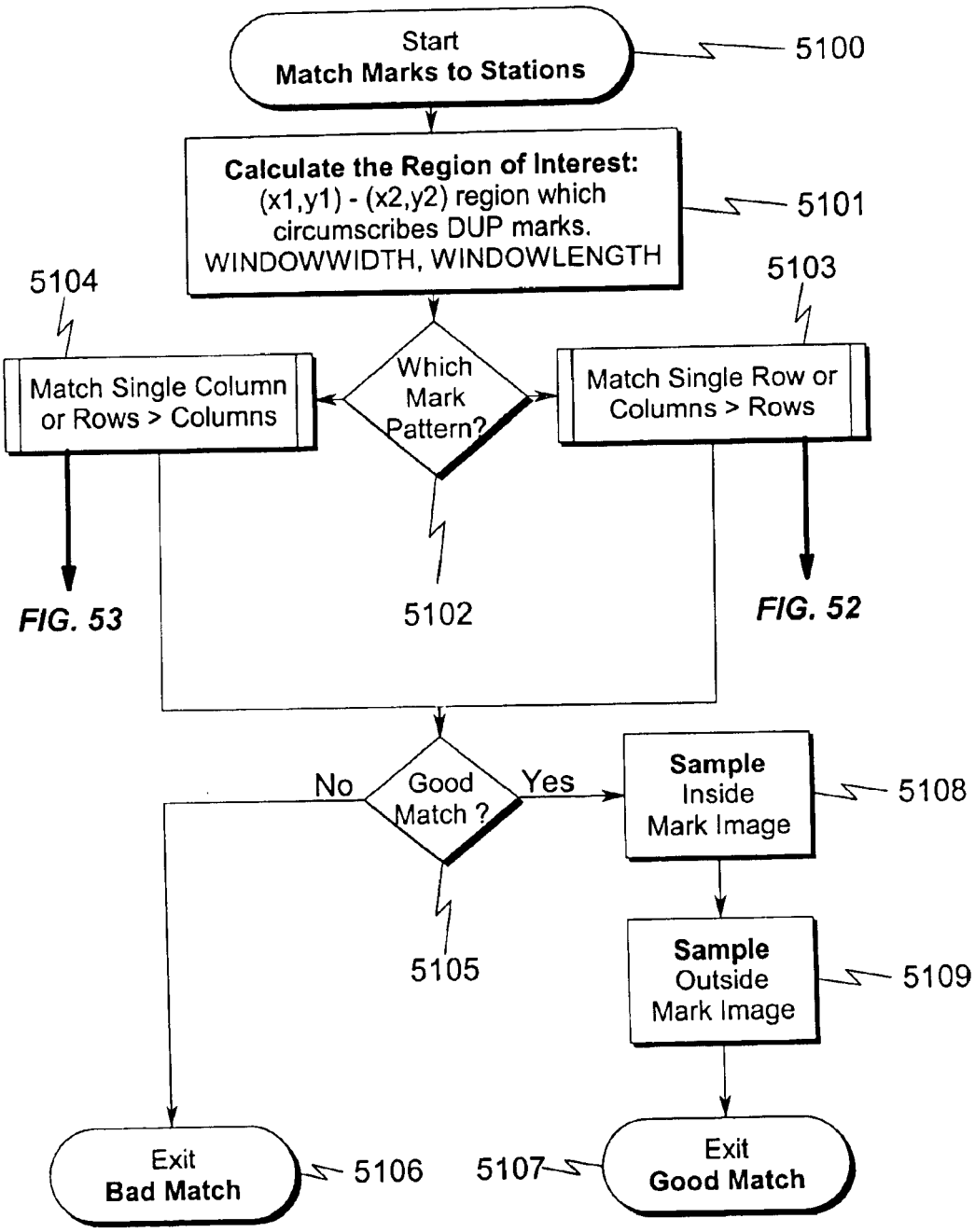
Figure 52:
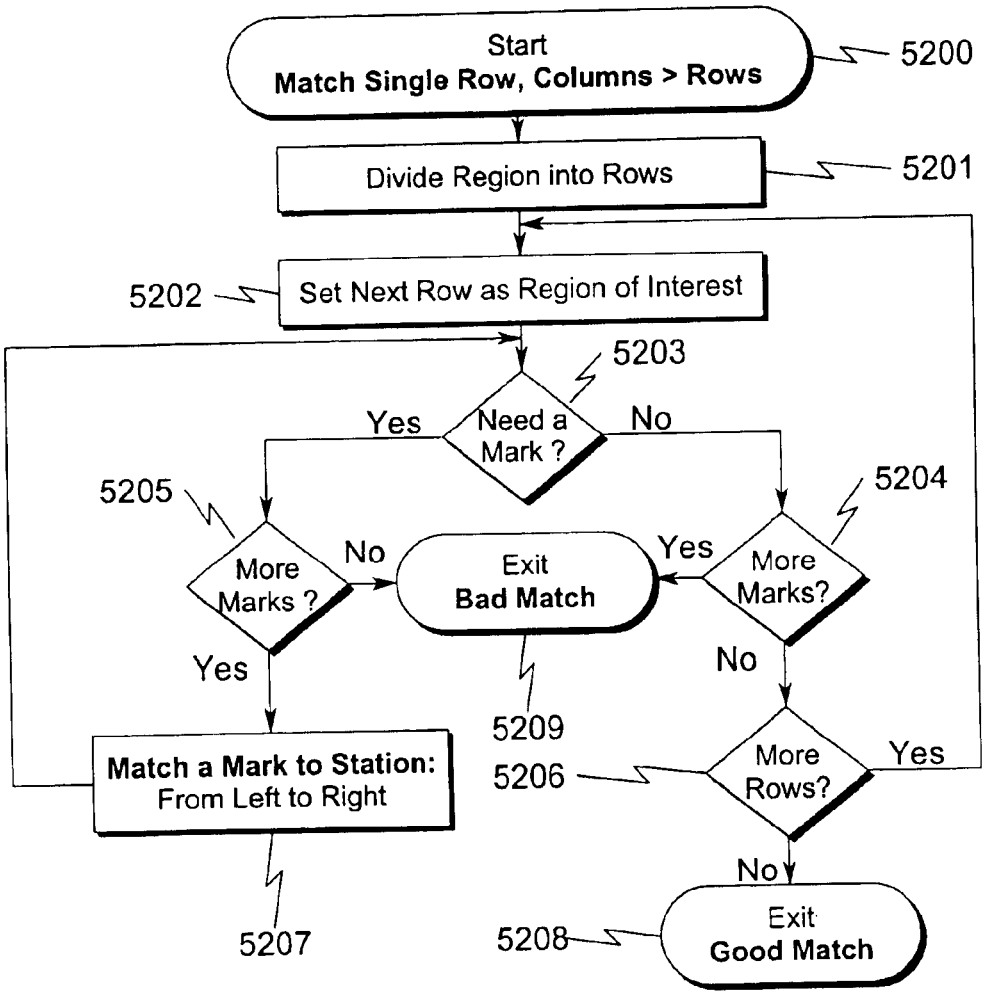

Referring to FIG. 31, the matching of marks to stations (3106) occurs after the non-Duplicate marks are found (3105). FIG. 51 illustrates this process (5100). First the region of interest is calculated (5101). This is the mark pattern specification window circumscribed around the duplicate marks. If the mark pattern is either the Single Row type or the Columns>Rows type (5102), match the marks to stations for these types (5103). FIG. 52 illustrates this process (5200).

First the region of interest is divided into rows of equal size (5201). The first row is selected as the region of interest (5202). If more marks are needed for stations in this row (5203) and more marks exist in this row (5205), match a mark to a station from left to right in the row (5207) and continue looping at the more marks are needed step (5203). If more marks are not needed for stations in this row (5203) and more marks do not exist in this row (5204), see if there are more rows (5206). If there are more rows (5206), continue looping at the set next row as region of interest step (5202). If there are no more rows to process (5206), FIG. 52 exits with success (5208).

If a mark is needed (5203) and no more marks exist in the row (5205) or a mark is not needed (5203) and there are more marks in this row (5204), FIG. 52 exits with failure (5209). Referring back to FIG. 51, an attempt at matching a Single Row or Columns>Rows pattern was attempted (5103). If this was a good match (5105), the marks for each station are sampled inside (5108) and outside (5109) to determine the interior and exterior color. FIG. 51 then exits with success (5107). If this was a bad match, FIG. 51 exits with a failure (5106).

Figure 53:
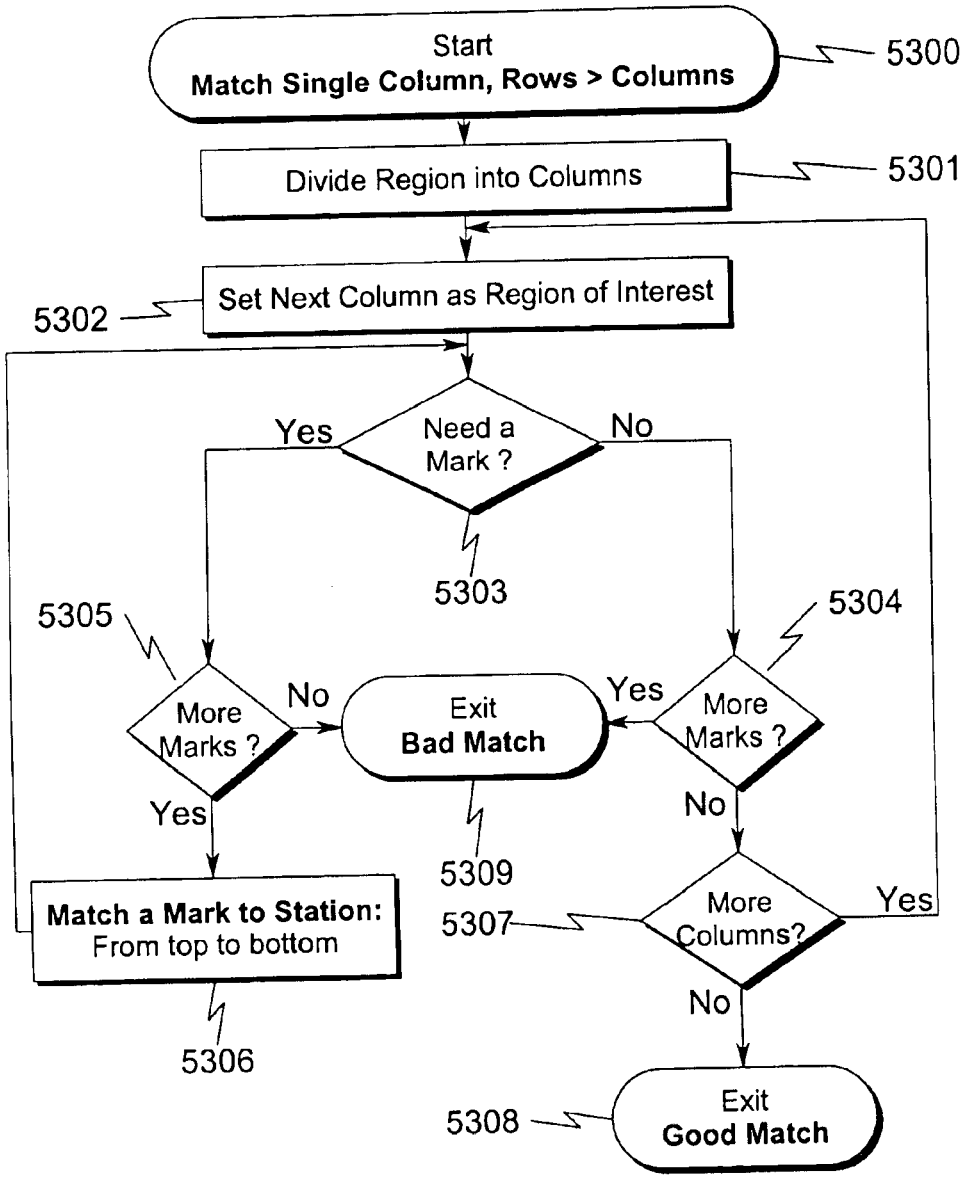

If the pattern (5102) was of type Single Column or Rows>Columns, try to match this type of pattern (5104). FIG. 53 illustrates this process (5300). First the region of interest is divided into columns of equal size (5301). The first column is selected as the region of interest (5302). If more marks are needed for stations in this column (5303) and more marks exist in this column (5305), match a mark to a station from top to bottom in the column (5306) and continue looping at the more marks are needed step (5303). If more marks are not needed for stations in this row (5303) and more marks do not exist in this column (5304), see if there are more columns (5307). If there are more columns (5307), continue looping at the set next column as region of interest step (5302). If there are no more columns to process (5307), FIG. 53 exits with success (5308).

If a mark is needed (5303) and no more marks exist in the row (5305) or a mark is not needed (5303) and there are more marks in this row (5304), FIG. 53 exits with failure (5309). Referring back to FIG. 51, an attempt at matching a Single Column or Rows>Columns pattern was attempted (5104). If this was a good match (5105), the marks for each station are sampled inside (5108) and outside (5109) to determine the interior and exterior color. FIG. 51 then exits with success (5107). If this was a bad match, FIG. 51 exits with a failure (5106).

Checking Between the Marks

Referring to FIG. 31, the checking between marks (3107) occurs after the matching of marks to stations (3106). FIG.

Figure 55:
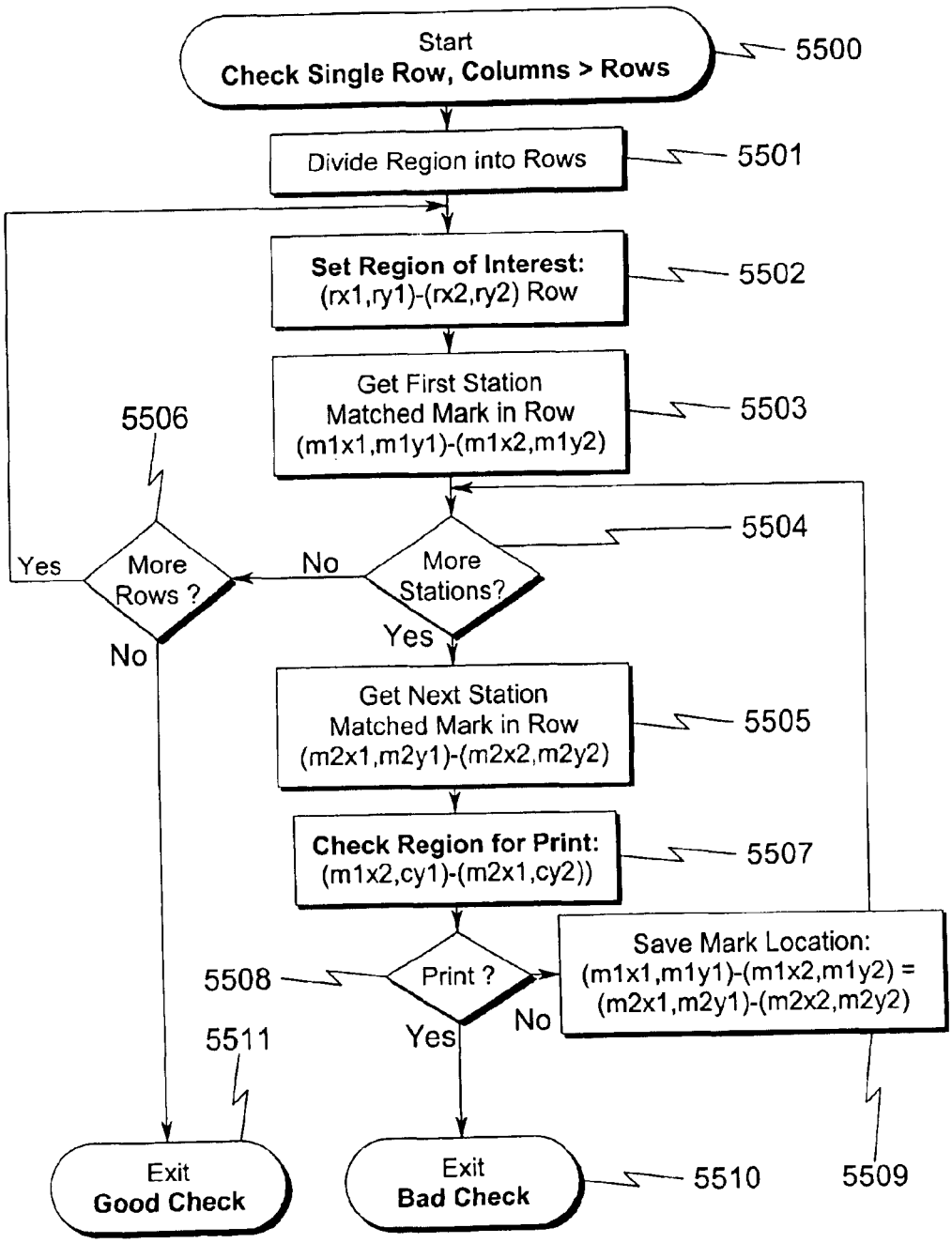

54 illustrates this process (5400). First the region of interest is calculated (5401). This is the mark pattern specification window circumscribed around the duplicate marks. If the mark pattern is either the Single Row type or the Columns>Rows type (5402), check between the marks for these types (5403). FIG. 55 illustrates this process (5500).

First the region of interest is divided into rows of equal size (5501). The first row is selected as the region of interest (5502). Get the first station's mark that was matched in this row (5503). If there are more stations to process in this row (5504), get the next station mark that was matched in this row (5505). Check for erroneous print in the area between these marks (5507). If there is some print (5508), FIG. 55 exits with failure (5510). If there is no print (5508), save this mark location (5509) and continue looping at the check form more stations in this row step (5504). If there are no more stations in this row (5504), see if there are more rows to process (5506). If there are not, FIG. 55, exits with success (5511). If there are more rows (5506), continue looping at the set row region of interest step (5502).

Figure 56:
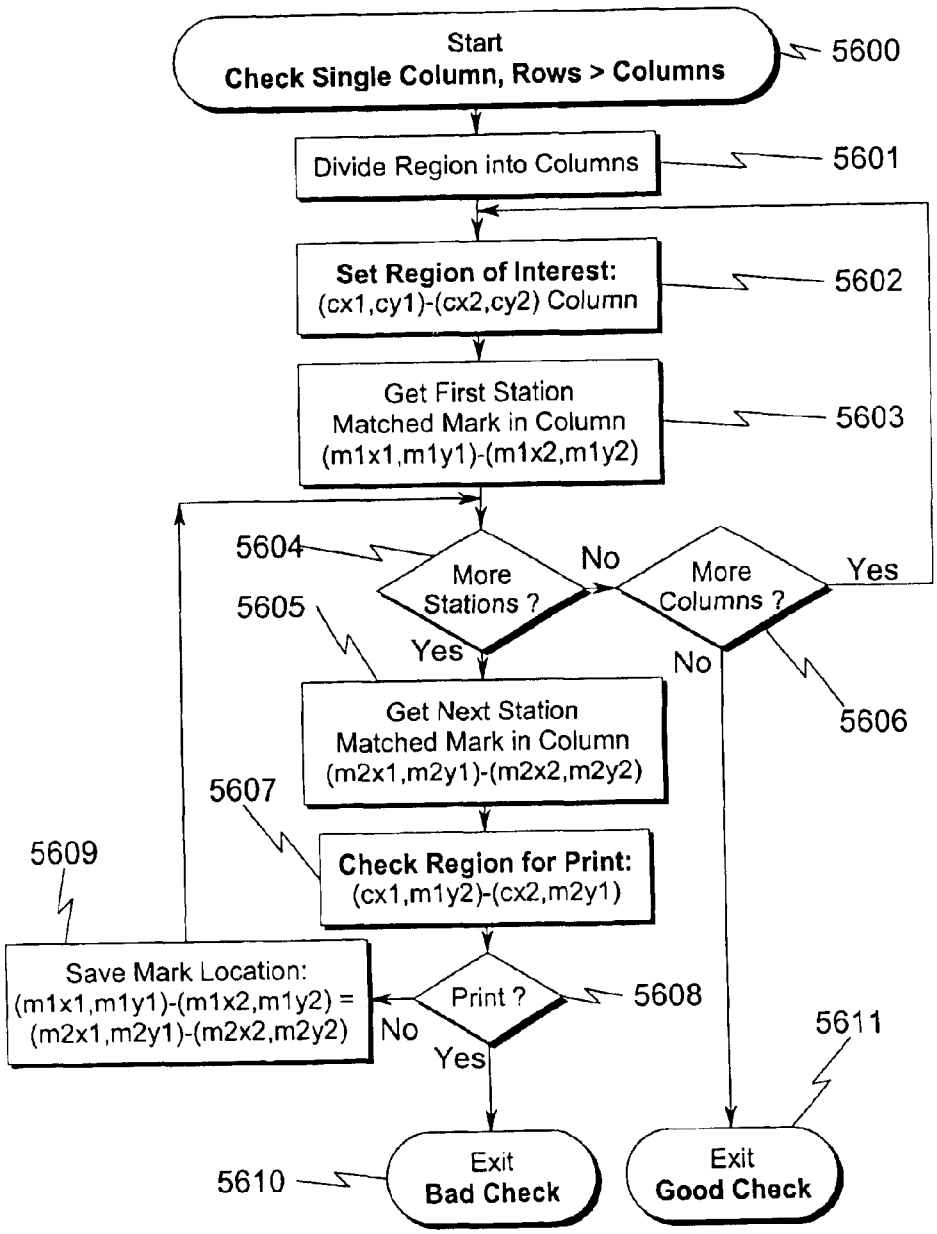

Referring back to FIG. 31, an attempt at checking between the marks for a Single Row or Columns>Rows pattern was attempted (5403). If this was a good check (5405), FIG. 54 exits with success (5406). If this was a bad check, FIG. 54 exits with a failure (5407). If the pattern (5402) was of type Single Column or Rows>Columns, try to match this type of pattern (5404). FIG. 56 illustrates this process (5600).

First the region of interest is divided into columns of equal size (5601). The first column is selected as the region of interest (5602). Get the first station's mark that was matched in this column (5603). If there are more stations to process in this column (5604), get the next station mark that was matched in this column (5605). Check for erroneous print in the area between these marks (5607). If there is some print (5608), FIG. 56 exits with failure (5610). If there is no print (5608), save this mark location (5609) and continue looping at the check form more stations in this column step (5604). If there are no more stations in this column (5604), see if there are more columns to process (5606). If there are not, FIG. 56, exits with success (5611). If there are more columns (5606), continue looping at the set column region of interest step (5602).

Referring back to FIG. 54, an attempt at checking between the marks for a Single Column or Rows>Columns pattern was attempted (5404). If this was a good check (5405), FIG. 54 exits with success (5406). If this was a bad check, FIG. 54 exits with a failure (5407).

Method of Finding Light Marks

Overview

The purpose of the light mark detection software is to find faint registration marks given an RGB image including a rectangular region of interest (ROI) including the faint marks and two duplication marks. The process is multi-step:

1. first to find or segment the duplication marks (d-marks) from the ROI,
2. next to process and enhance the rest of the ROI, and
3. lastly, to find the light registration marks within this area.

The Light Mark Finding Process

Figure 60:
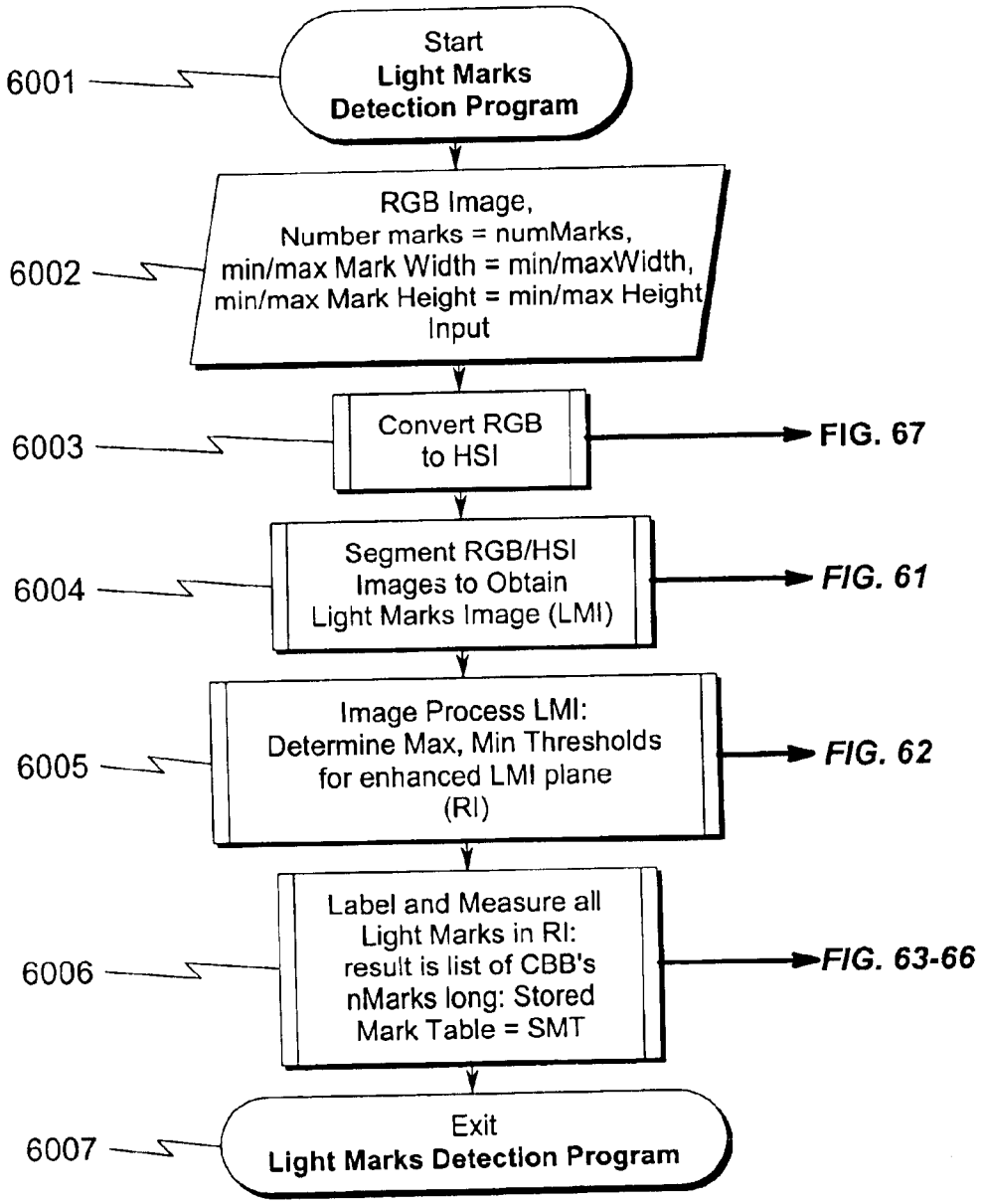
FIG. 60 through FIG. 76 illustrate exemplary system process flowcharts implementing the details of a light mark detection system.

FIG. 60 illustrates an exemplary system flowchart of the overall process of finding light marks within a given ROI. The detection process begins when the control program passes a Red-Green-Blue (RGB) image to the detection program (6001). Each color plane (Red, Green, and Blue) is a gray level image digitized (typically to 8 bits resolution) (6002). Also input are the number of marks to be found (numMarks), the min and max widths (minwidth, maxwidth) of the marks and the min and max heights (minHeight, maxHeight) of the marks (6002).

Figure 67:
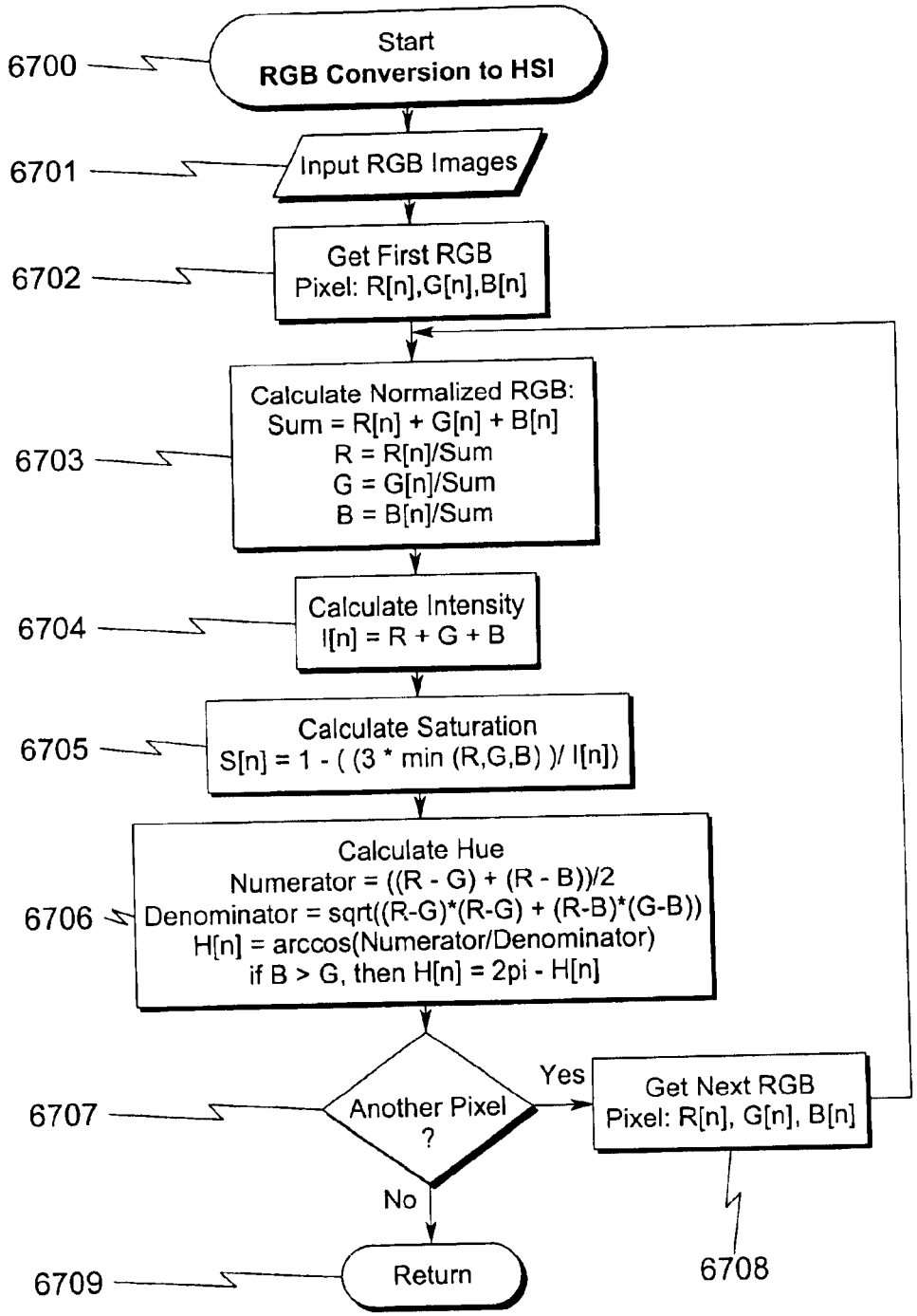

The input Red-Green-Blue (RGB) images are first used to calculate corresponding Hue-Saturation-Intensity (HSI) images (6003). These calculations are performed on a pixel-by-pixel basis. The formulas for HSI calculations are detailed in FIG. 67. These six separate images are used as input to the segmentation process (6004).

Figure 61:
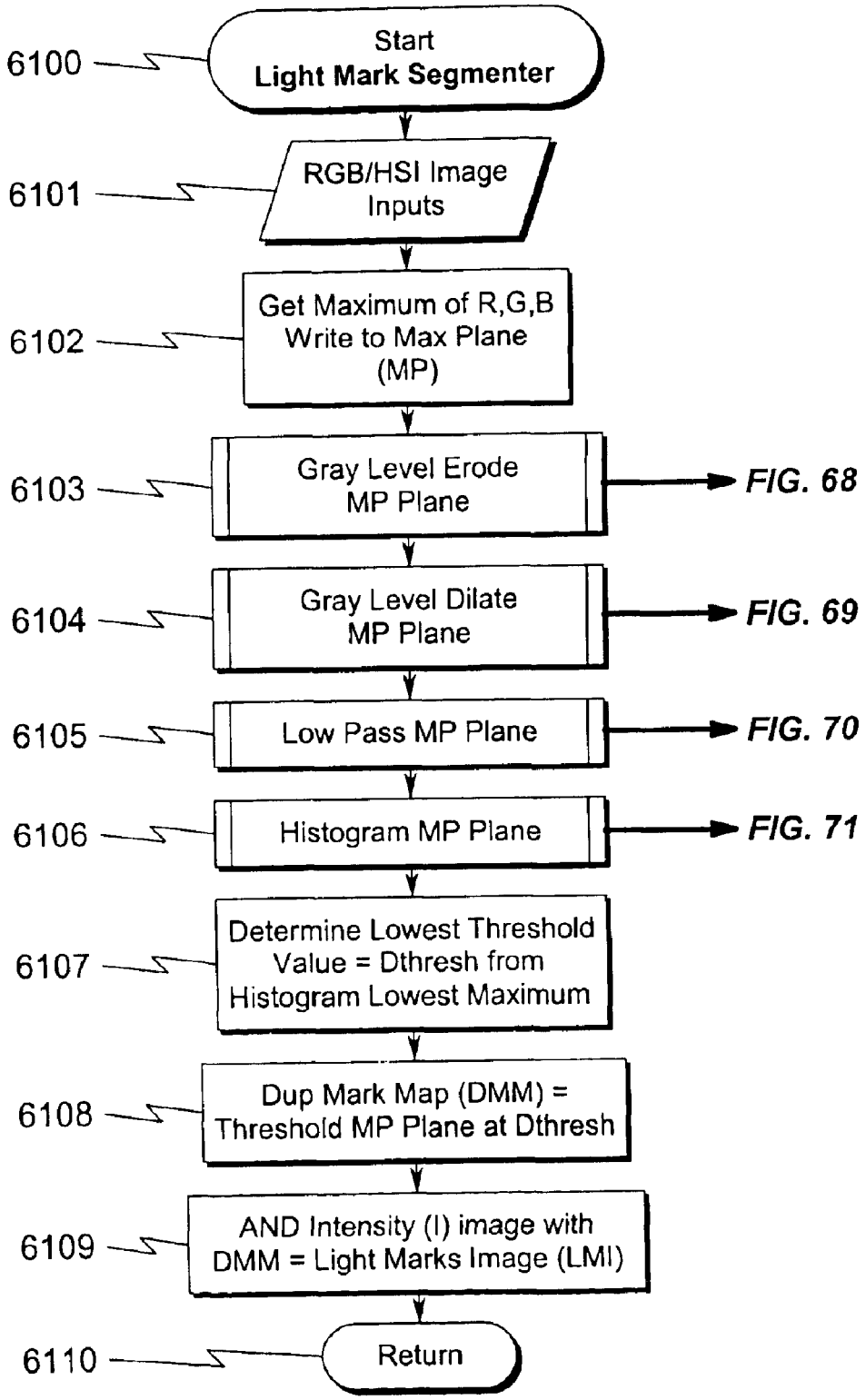

The light mark segmentation process illustrated in FIG. 61 is used to extract the d-marks from the rest of the ROI. The result of the segmentation operation is the Light Marks Image (LMI): an image ready for digital image processing and enhancement to find the light marks (if any).

Again referring to FIG. 60, the next step is to image process the LMI for light marks (6005). This process is detailed in FIG. 62. The result of this process is to create the Result Image (RI) that can be analyzed for light mark measurement.

Referring to FIG. 60, the final step is to label and analyze the image processed map for light marks (6006). This process is detailed in FIG. 63–FIG. 66. All light marks found are measured and their size and positions relative to the d-marks are the result of the operation.

Segmentation

An exemplary light mark segmentation process is detailed in FIG. 61. The basic idea behind segmenting out the d-marks from the rest of the image is variation in intensity. The intensity of an image is a measure of the image darkness or lightness. Since the d-marks are the darkest objects in the ROI passed to the segmentation software, they can be segmented by finding the lowest intensity objects in the ROI.

Referring to FIG. 61, light mark segmentation starts (6100) with the input RGB images and the input HSI images (6101) of the current image and the ROI of the current image to be checked for light marks. First, the maximum of the RGB planes is determined (6102). This is done by comparing the Red, Green, and Blue planes on a pixel-by-pixel basis. Thus, for a particular pixel position in each of the RGB planes: Pr, Pg, Pb, the maximum valued pixel is found and written to a Max Plane (MP). That is if Pr>Pg and Pr>Pb, Pr is written to MP. If instead Pg>Pr and Pg>Pb, Pg is written to MP. Finally, if Pb>Pr and Pb>Pg, Pb is written to MP. This is done for every corresponding pixel in the RGB planes.

Figure 68:
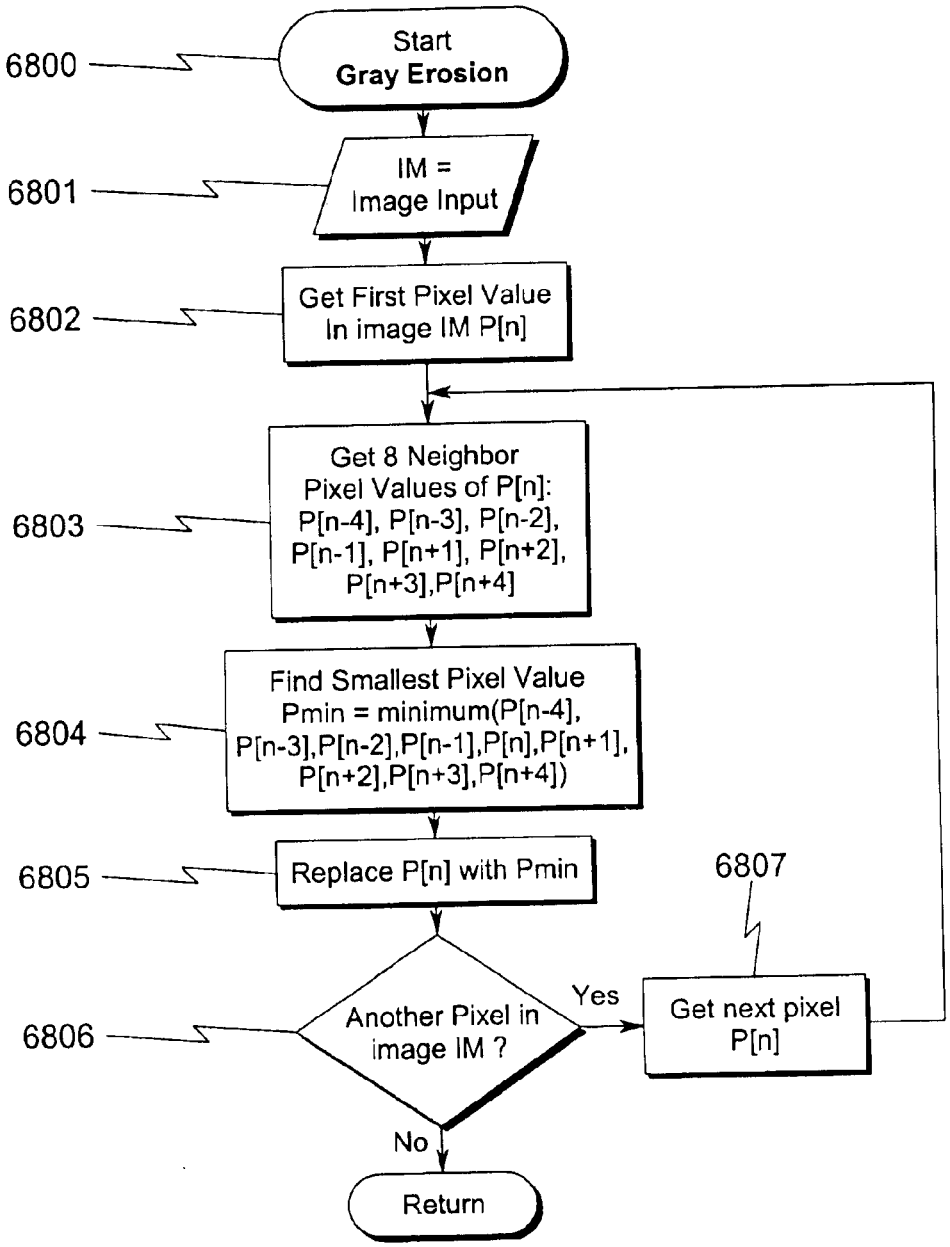

The resulting MP plane is now gray level eroded (6103). This process is detailed in FIG. 68. The process begins at (6800) when the subroutine is called. Any input image can be eroded. In this case, the MP plane is the input plane to be eroded and is set equal to the IM plane (6801). Every pixel in the IM plane is considered in gray erosion. The first pixel P[n] is first acquired (6802) and then the eight neighboring pixels P[n−4], P[n−3], P[n−2], P[n−1], P[n+1], P[n+2], P[n+3], P[n+4] (6803). The minimum pixel value of these 9 pixel values is determined (6804), that is the smallest pixel value in this group of 9 is determined and then replaces pixel P[n] (6805). If there is another pixel to be analyzed (6806), the next pixel in IM is then acquired (6807), set to P[n] and program control goes back to (6803) where the 8 neighbor pixels are determined. This process continues until all pixels in IM (MP) have been analyzed.

Figure 69:
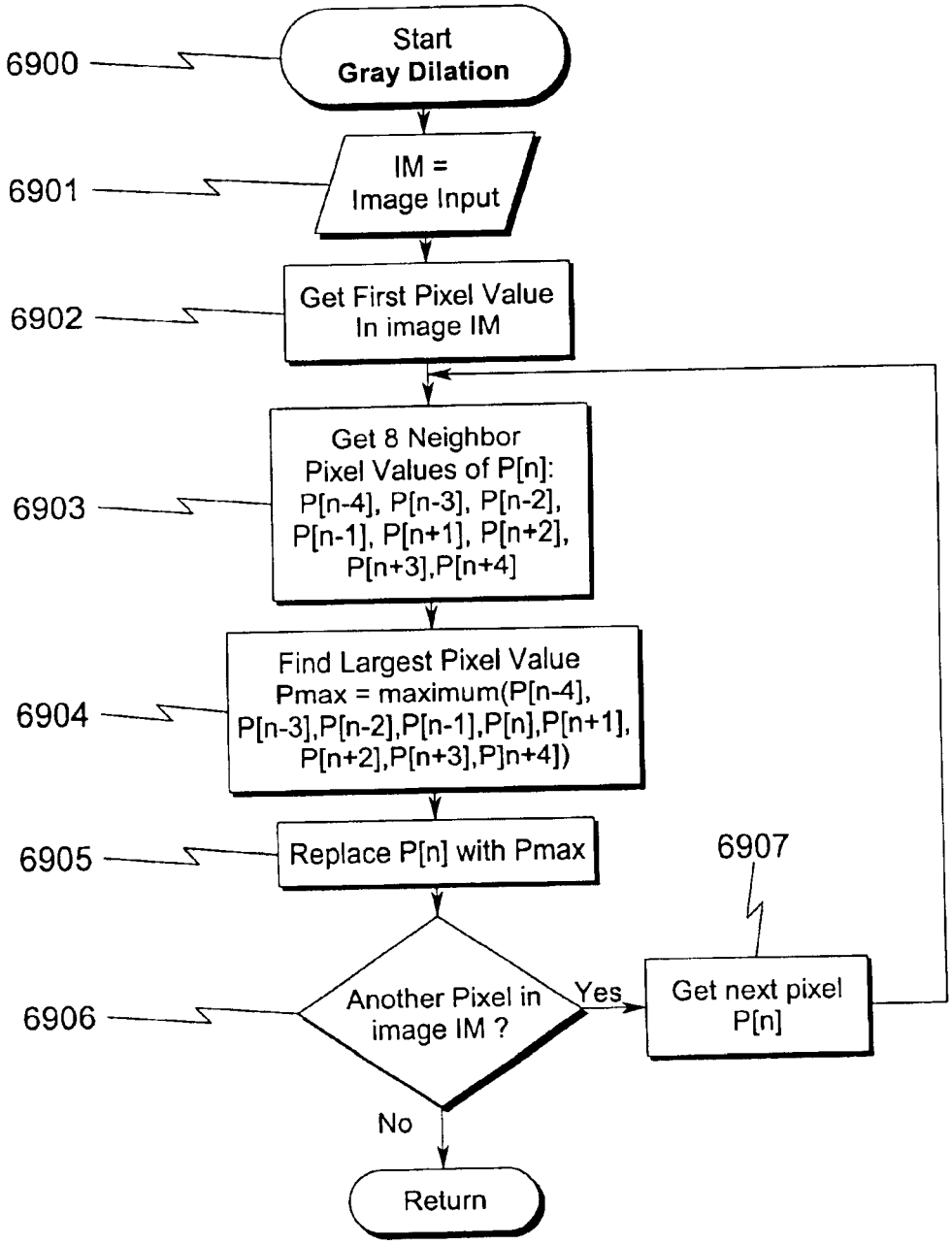

Returning to FIG. 61 with a gray eroded MP plane the next step is to gray dilate the MP plane (6104). This process is detailed in FIG. 69. The process begins at (6900) when the subroutine is called. Any input image can be dilated. In this case, the MP plane is the input plane to be dilated and is set equal to the IM plane (6901). Every pixel in the IM plane is considered in gray dilation. The first pixel P[n] is first acquired (6902) and then the eight neighboring pixels P[n−4], P[n−3], P[n−2], P[n−1], P[n+1], P[n+2], P[n+3], P[n+4] (6903). The maximum pixel value of these 9 pixel values is determined (6904), that is the largest pixel value in this group of 9 is determined and then replaces pixel P[n] (6905). If there is another pixel to be analyzed (6906), the next pixel in IM is then acquired (6907), set to P[n] and program control goes back to (6903) where the 8 neighbor pixels are determined. This process continues until all pixels in IM (MP) have been analyzed.

Returning to FIG. 61 with a gray dilated MP plane the next step is to low pass filter the MP plane (6105). This process is detailed in FIG. 70. The process begins at (7000) when the subroutine is called. Image filtering in general is called convolution. Convolution requires an input image (IM) on which to perform the convolution, an input 3×3 convolution kernel (K) that specifies the type of filtering to perform on IM and the convolution shift value (S) that is the divisor for each sum of product operation in the convolution. S normalizes the resulting or convolved image.

Figure 70:
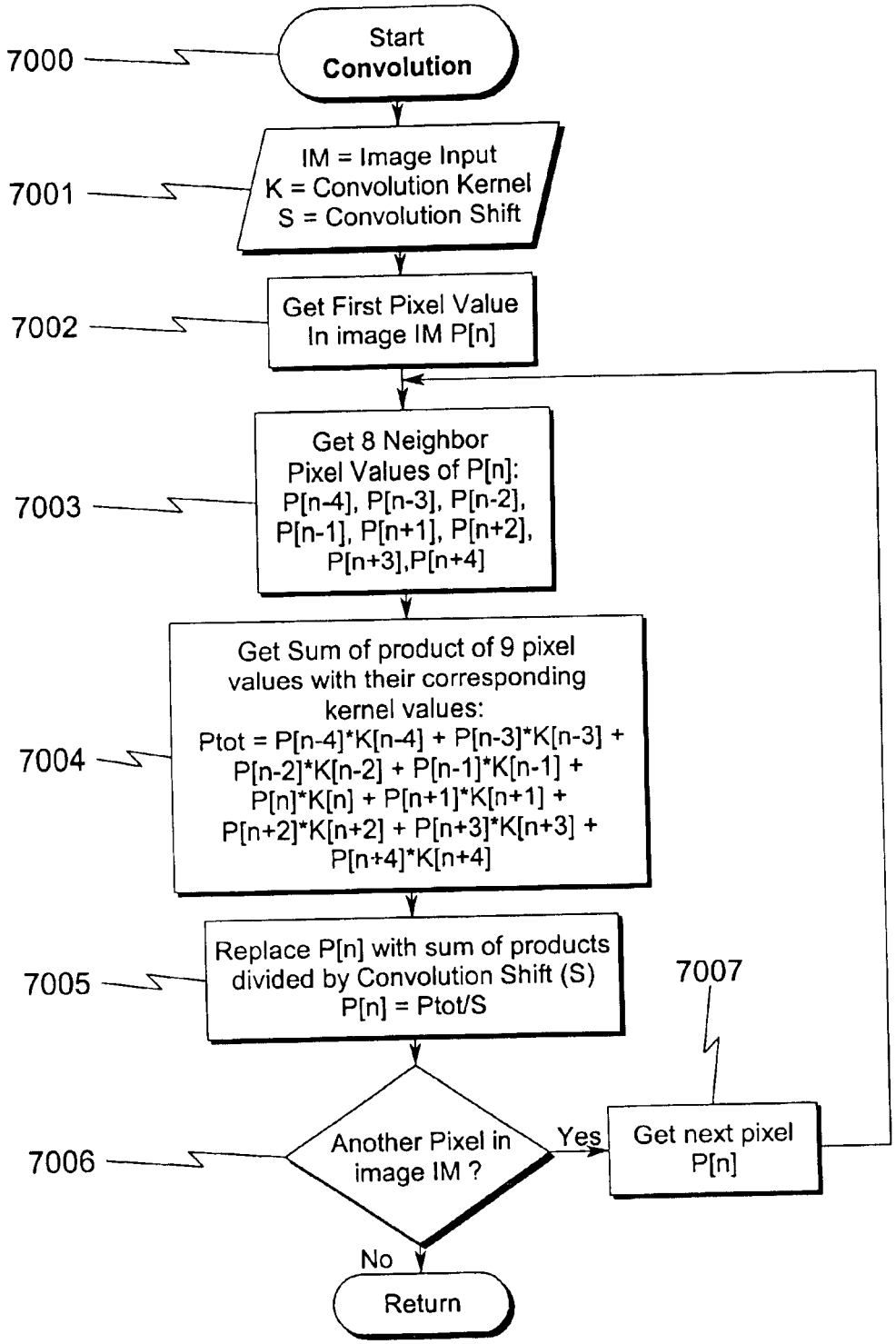

Referring to FIG. 70, our input image is the MP plane, which is set equal to IM for this operation (7001), K is set to a 3×3 convolution kernel of all 1's which is a low pass filtering operation, and S is set to 9 which results in a convolved image with the same intensity range as the input image. To begin the low-pass filtering operation the first pixel, P[n], in the input image IM (7002) is obtained. The next step is to get the eight neighbors of P[n]: P[n−4], P[n−3], P[n−2], P[n−1], P[n+1], P[n+2], P[n+3], and P[n+4] (7003). After this it is possible to calculate the sum of products of these 9 pixel values with their corresponding kernel values (7004). Arithmetically, the operation is as follows:

$$Ptot=p[n-4]*K[n-4]+P[n-3]*K[n-3]+P[n-2]*K[n-2]+P[n-1]*K[n-1]+P[n+1]*K[n+1]+P[n+2]*K[n+2]+P[n+3]*K[n+3]+P[n+4]*K[n+4].$$

Since this operation performs a low pass filtering operation, Ptot is the sum of the nine image pixels P[n−4] . . . P[n+4] since the kernel values are all 1. The next step is to replace the original input pixel P[n] with the normalized sum of products (7005). Ptot is divided by the convolution shift value, K=9 in this case and P[n] is replaced with the result. After this the next step is to check to see if there is another pixel that can be processed (7006). If there is it is obtained and set to P[n] (7007). After this P[n]'s eight neighbors are obtained as before (7003) and the normalized sum of products is calculated. Processing is terminated when all pixels have been processed.

Figure 71:
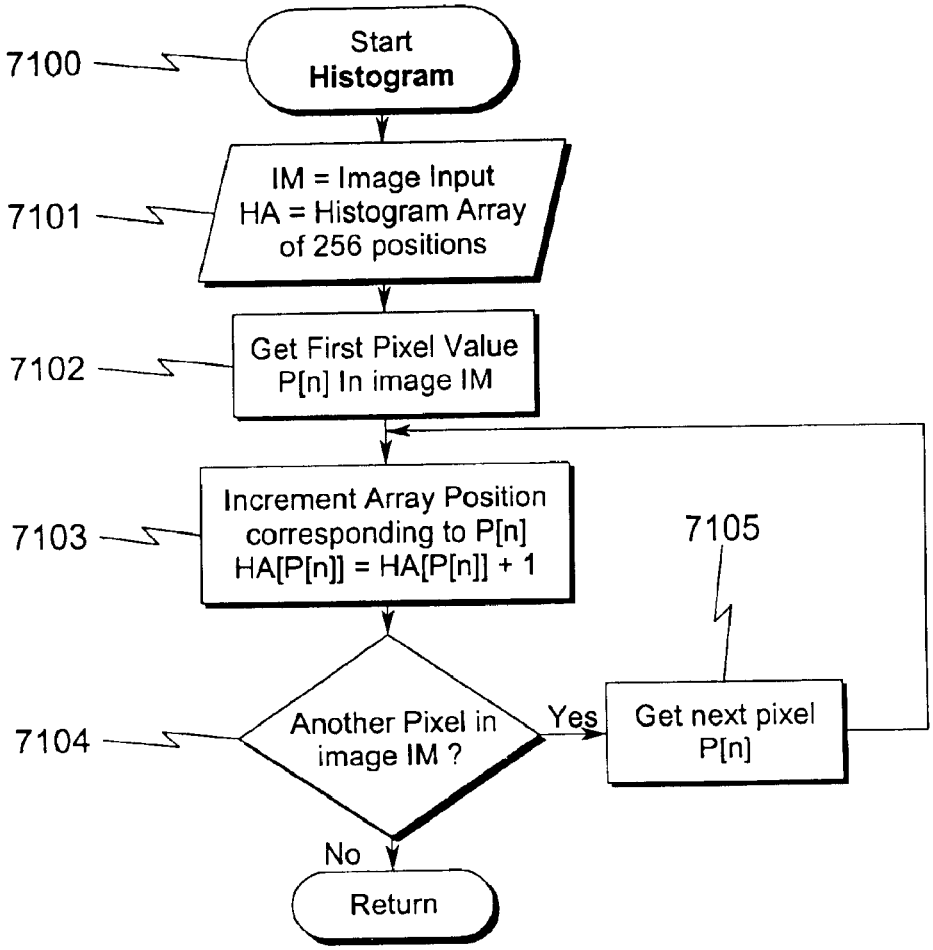

Returning to FIG. 61 with a low pass filtered MP plane the next step is to histogram the MP plane (6106). This process is detailed in FIG. 71. The process begins at (7100) when the subroutine is called. Histogramming is a method of determining the pixel intensity value distribution in an image. First the input image MP is set to the subroutine input image IM and an array of 256 integer values, 1 value for each possible intensity value in an image is created (7101). Next the first pixel (P[n]) in the input image (IM) is obtained (7102). The value of P[n] serves as the address into the Histogram Array (HA). The integer value stored at this address is incremented by 1 (7103). Next the image is checked to see if there is another pixel that can be processed (7104). If there is, the next pixel value P[n] is obtained (7105) and this new pixel value serves as the address into the HA as before (7103). If there are no more pixels to process in IM, the routine is exited with the HA returned.

Returning to FIG. 61 with a histogram of the MP plane, the next step is to determine the threshold value for the lowest intensity in the image and threshold the MP plane using this value (6107). This is accomplished as follows: the HA array is analyzed to find the first maximum or "bump". This maximum is assumed to be the d-marks in the image. The half power point of this maximum is then determined by finding the right-hand valley corresponding to this maximum, this is the d-mark threshold value (Dthresh). Then the MP plane is thresholded such that all pixel values in MP that are less than Dthresh are set to 0 and all pixel values greater than or equal to Dthresh are set to 1 (6108). The result of this operation is the d-mark Map (DMM) that has a pixel value of 0 where the d-marks are in the ROI and 1 everywhere else in the ROI where the ROI should be analyzed for light marks.

Returning to FIG. 61 with a DMM, the next step is to logically AND the input intensity (I) image with the DMM (6109) to create the Light Marks Image (LMI). This process has the result of setting all pixels in the I-image to zero for all corresponding pixels in the DMM that equal 0 (where the d-marks are) and leaving all other pixels in the I-map untouched. At this point an LMI image with only light mark and substrate information ready for further processing has been generated.

Image Processing and Enhancement of ROI

Figure 62:
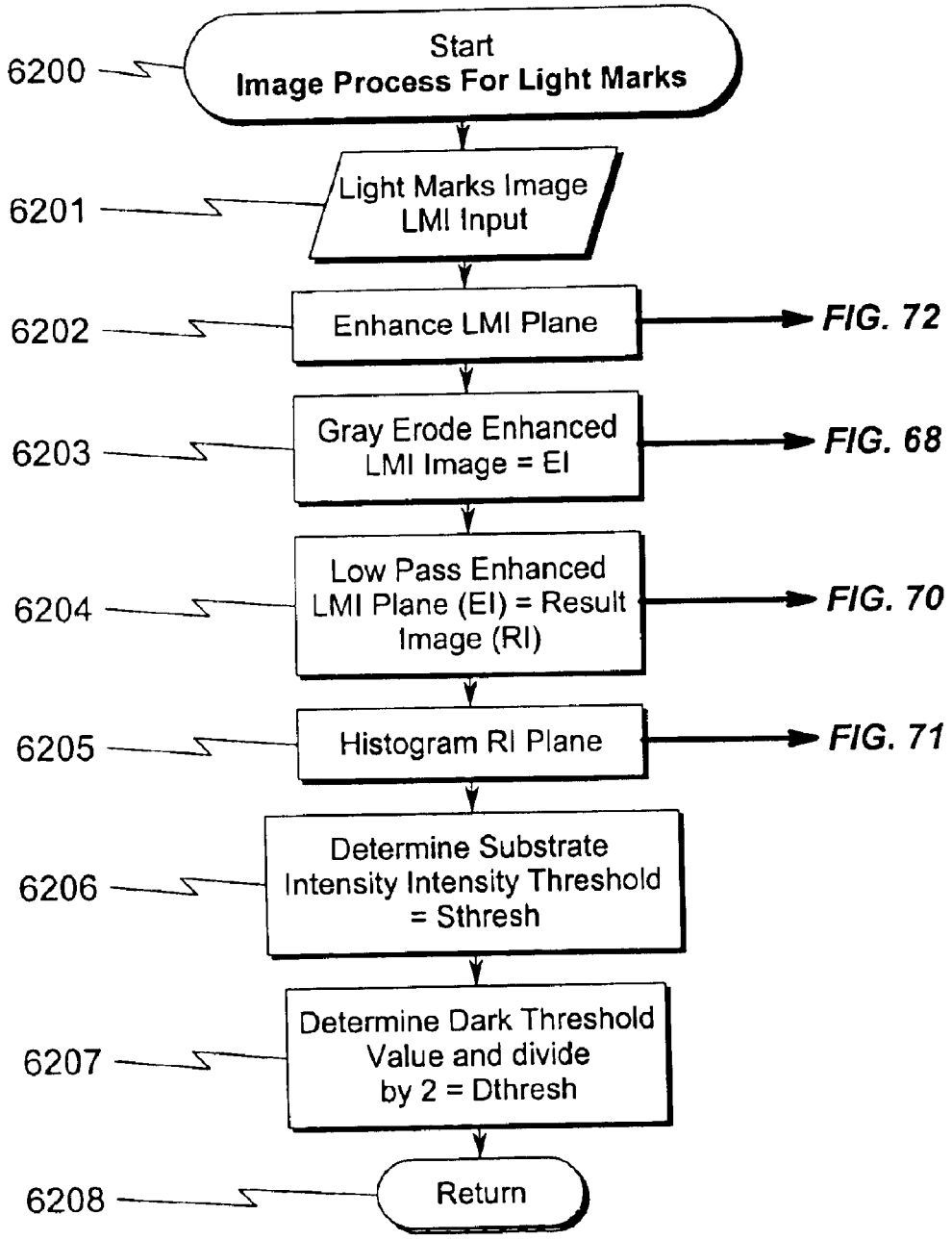
Figure 72:
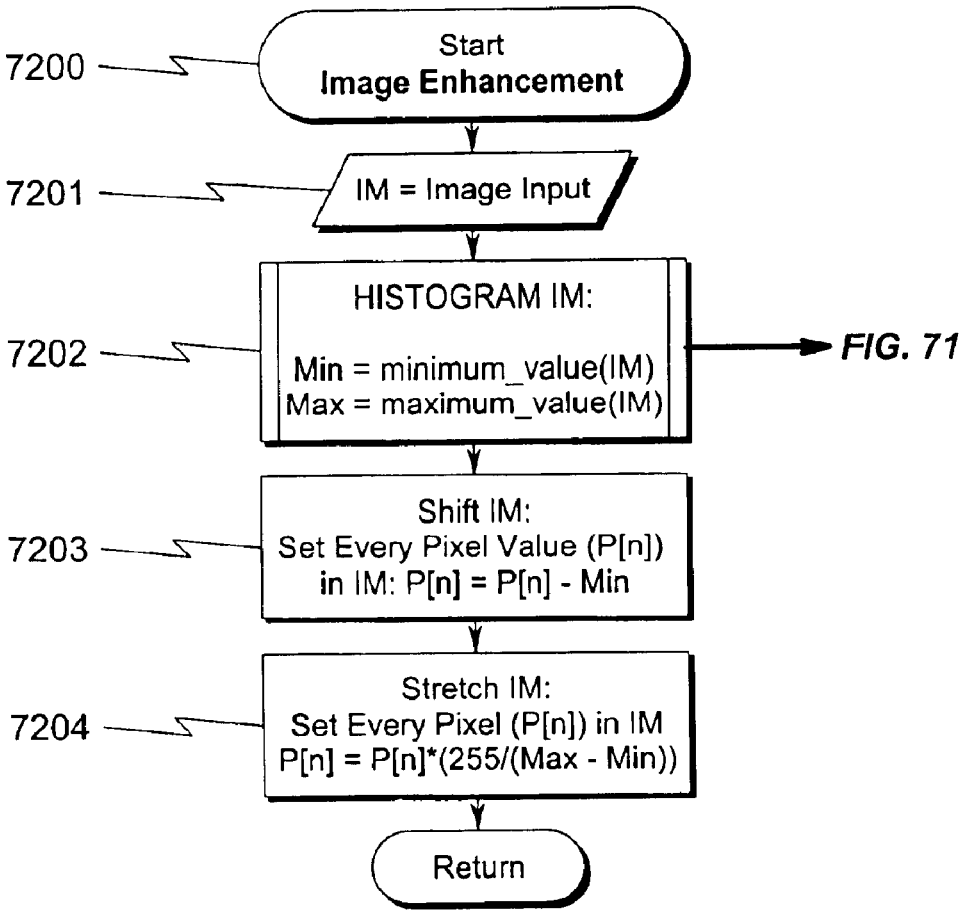

Referring to FIG. 62, the image processing of the LMI begins at (6200) with the input LMI (6201) from the previous segmentation process. The input LMI image is now enhanced (6202). This is accomplished as shown in FIG. 72. The idea is to find the actual difference between the lightest and darkest pixels in the I-image and "stretch" this range through the entire range of possible values which is 256 because each pixel is digitized to 8 bits. The subroutine (7200) is entered and sent the input image, the LMI plane in this case equal to the Image Input Plane (IM) (7201). The next step is to histogram IM (7202) in the same manner as already discussed in FIG. 71. From the histogram the maximum and minimum pixel values Max, and Min are next obtained. The next step is to subtract Min from every pixel in IM (7203). The next step is to multiply every pixel in IM by 255/(Max−Min) (7204). The result of these two operations result in IM being contrast enhanced, that is accentuating the difference between the darker pixel values and the lighter pixel values.

Returning to FIG. 62, the next step is to gray erode the enhanced LMI plane (6203). This process has already been detailed in FIG. 68. The effect of the process is to group darker valued pixels together thus making a darker mark area more homogeneous.

Returning to FIG. 62, the next step is to low pass filter the enhanced LMI plane (6204). This process has already been detailed in FIG. 70. For a low pass filter operation a 3×3 kernel of all 1's and a shift value of 9 is typically used. This operation results in all pixels in the image being replaced by the average of those pixels and their 8 neighbors thus "blurring" or low-passing the images. This process has the effect of making the lighter and darker areas in the image even more homogeneous. The result of this operation is the results image (RI).

Returning to FIG. 62, the next step is to histogram the RI plane after these operations (6205). This process has already been discussed in FIG. 71. Because the input image, the RI plane, is an enhanced image of light substrate with various (potentially) darker marks, a histogram with a minimum of 1 major lobe will be obtained. The lobe closest to the maximum (256) will correspond to the substrate because the substrate will have a higher intensity value than the darker marks.

The next step is to determine the substrate threshold value (Sthresh) that is the peak value position of the upper lobe (6206). The next step is to obtain the dark threshold value (Dthresh) by finding the left hand valley of the upper lobe (the point where the number of set pixels is negligible in the histogram) and dividing this value by 2 (6207). This value represents a safe value to begin thresholding the RI map and insure the light marks have not been thresholded out. The final step (6208) is to return to the calling routine with both upper and lower thresholds (Sthresh & Dthresh) and the RI image.

Light Mark Detector

Figure 63:
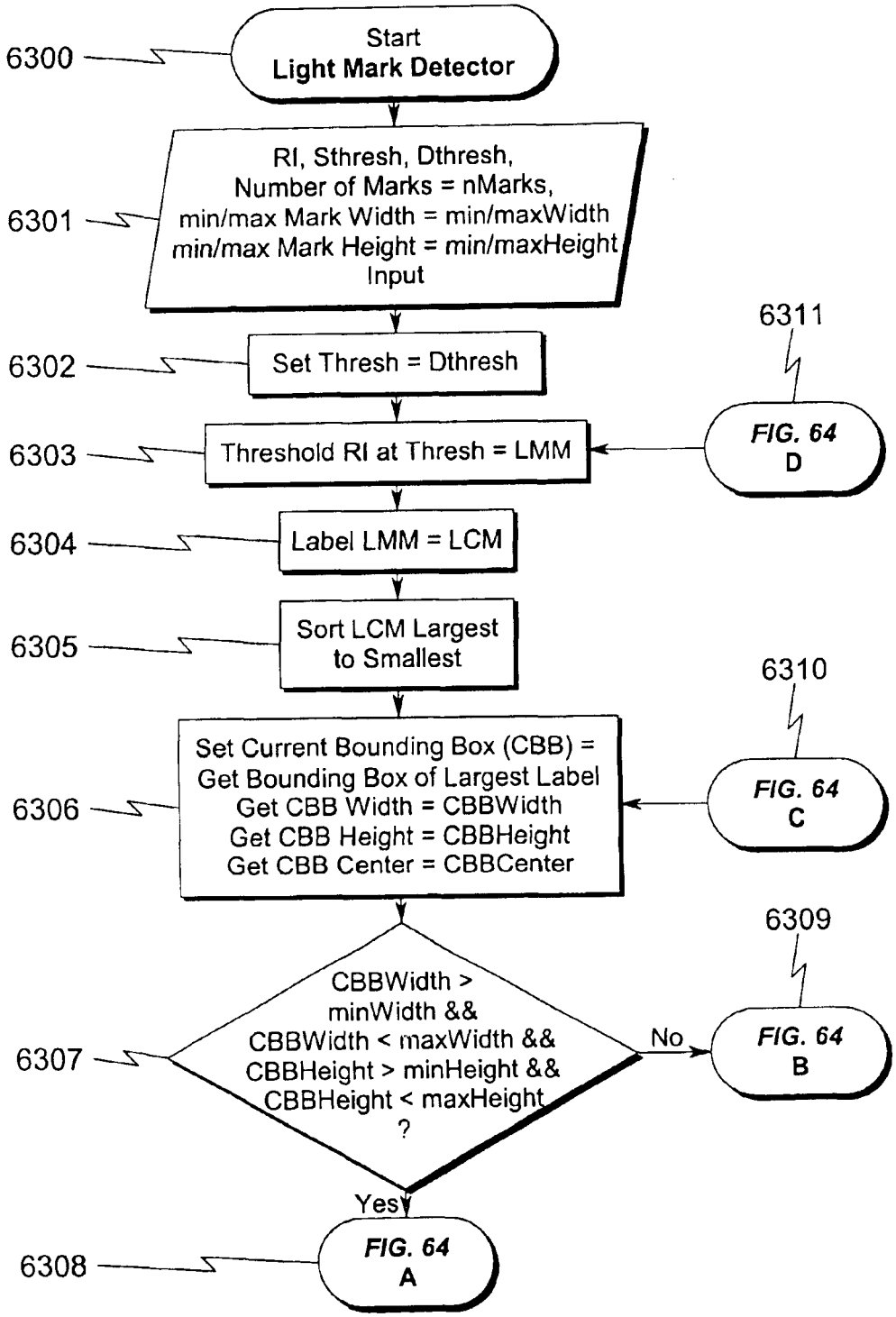

Returning to FIG. 60, the object is to now search for light marks in the RI plane (6006). This process is detailed in FIGS. 63–66. Referring to FIG. 63, the light mark detector is started (6300), inputs are the RI plane, Sthresh, Dthresh, nMarks, minwidth, maxwidth, minHeight, maxHeight (6301). The operation begins by setting a variable, Thresh= Dthresh then thresholding the RI plane at the Thresh value (6303) creating a light mark map (LMM). The LMM is an image consisting of only two pixel values: 0 for light marks and 1 for substrate. At this point it is desirable to measure the light mark areas within the LMM. This is done by by labeling the LMM (6304). This is a two-pass image processing function which assigns all set 8-connected pixels (any pixel that has a value of one immediately adjacent on any diagonal to another set pixel) the same numeric label value. This is an Imaging Tech supplied software routine. All pixels with the same numeric label value belong to the same label. This numeric value and the number of pixels that belong to it are stored in a label list (LCM) that is output from the labeling process.

The next step is to sort the LCM largest to smallest (6305) using an Imaging Tech supplied routine. The next step is to cycle through the LCM, getting the first (and largest) label. By reading the numeric label value for this label, it is possible to cycle through the LMM to find all pixels that belong to this label. The next step is to find the minimum X and Y and the maximum X and Y extents of the pixels of this label in the image using an Imaging Tech supplied routine. This gives a bounding box (CBB) which completely encompasses the label (6306) as well as the height, width, and center coordinates of the CBB: CBBHeight, CBBWidth, CBBCenter.

Figure 64:
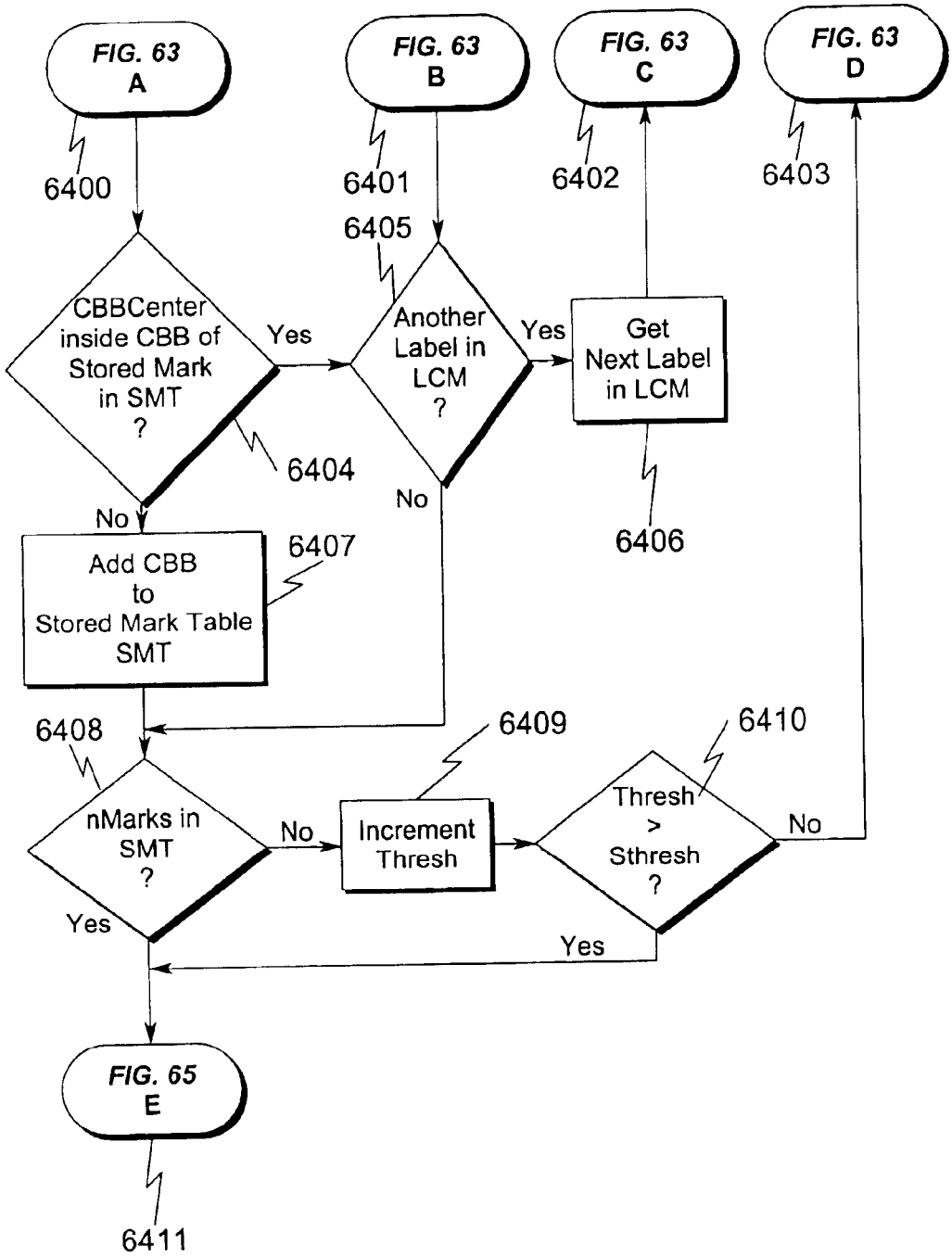

The next step is to determine if CBBHeight and CBBWidth fit within the mark min and max sizes input to the program: minWidth, maxwidth, minHeight, and maxHeight (6307). If they do not (6309), the LCM is checked for another label as detailed in FIG. 64 (6401), (6405), another label in the LCM is acquired (6406), (6402). Referring back to FIG. 63 (6310), this new label is checked as just detailed until the LCM is exhausted. If CBBHeight and CBBWidth fit within the mark min and max sizes input to the program (6308) another path is taken. Referring to FIG. 64 (6400), the center of the current CBB: CBBCenter is checked against a list of previously found marks: the Stored Mark Table (SMT) (6404). It is determined whether CBBCenter lies within any of the CBB's stored in the SMT. If it does exist in the SMT (6405), the next label in the LCM is acquired and checked in the same manner as before. If CBBCenter does not lie within any of the CBB's stored in the SMT, a new light mark has been found. This CBB is added to the SMT (6407). At this point, the SMT is checked to see if there are nMarks CBB's stored in it (6408). This check is also performed when the LCM has been exhausted of labels to check (6405). If there are nMarks in the SMT (6411) processing continues as described below on FIG. 65. If there are not nMarks in the SMT, the original threshold variable Thresh is incremented by 1 (6409), then checked to insure it is less than Sthresh, the substrate threshold (6410). If Thresh is greater than Sthresh, processing continues as described below in FIG. 65. Otherwise, processing continues as described before in FIG. 63 (6311).

The idea of the process is to threshold and label the image containing the light marks at successively higher threshold values until all marks are found at their own, optimum threshold value. This insures that light marks will be found before lighter substrate imperfections.

Figure 65:
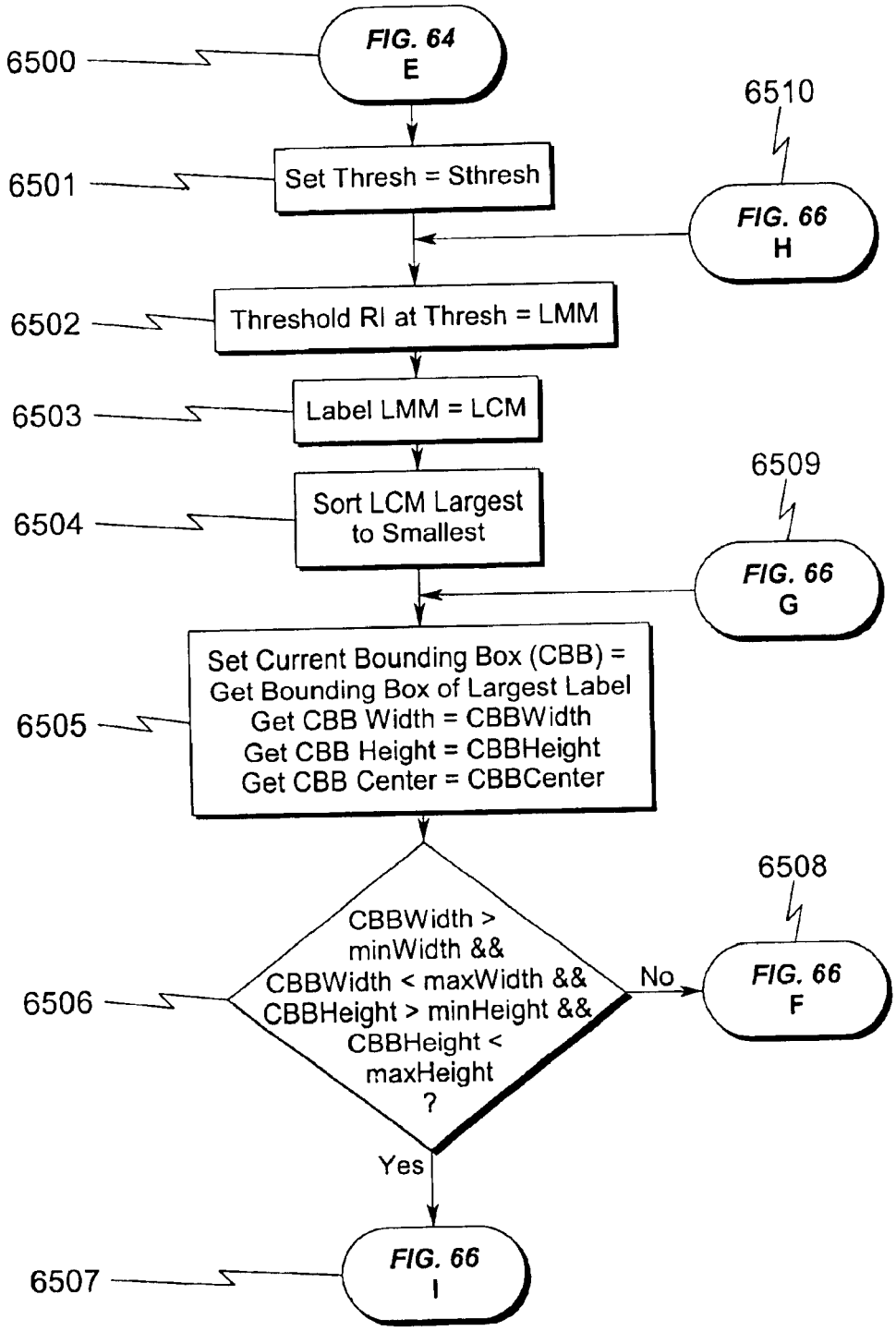

Continuing with FIG. 65 which occurs at the conclusion of either nMarks CBB's being in the SMT or Thresh incremented up to the substrate threshold Sthresh, the entire process is repeated but this time beginning the thresholding process at Sthresh and decrementing Thresh until nMarks CBB's are again found in the SMT or Thresh is decremented down to the dark threshold Dthresh. In detail the operation begins (6500) by setting Thresh=Sthresh, the substrate threshold (6501) then thresholding the RI plane at the Thresh value (6502) creating a light mark map (LMM). Next the LMM is labeled usin an Imaging Tech supplied routine (6503). The next step is to sort the LCM largest to smallest (6504) using an Imaging Tech supplied routine. The next step is to cycle through the LCM, getting the first (and largest) label. The next step is to find the minimum X and Y and the maximum X and Y extents of the pixels of this label in the image using an Imaging Tech supplied routine. This gives a bounding box (CBB) which completely encompasses the label (6505) as well as the height, width, and center coordinates of the CBB: CBBHeight, CBBWidth, CBBCenter.

Figure 66:
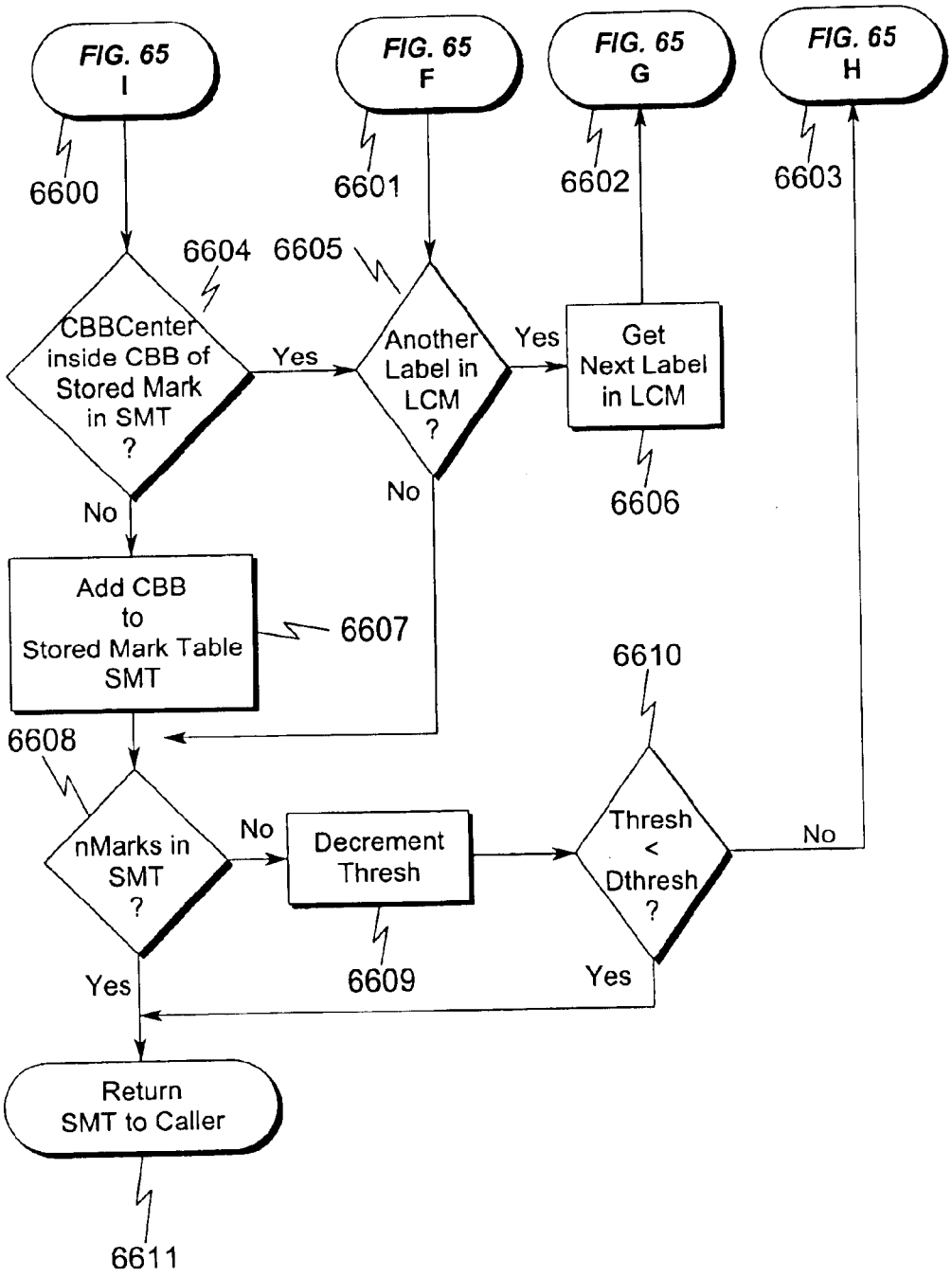

The next step is to determine if CBBHeight and CBBWidth fit within the mark min and max sizes input to the program: minWidth, maxwidth, minHeight, and maxHeight (6506). If they do not (6508), the LCM is checked for another label as detailed in FIG. 66 (6601), (6605), another label in the LCM is acquired (6606), (6602). Referring back to FIG. 65 (6509), this new label is checked as just detailed until the LCM is exhausted. If CBBHeight and CBBWidth fit within the mark min and max sizes input to the program (6507) another path is taken. Referring to FIG. 66 (6600), the center of the current CBB: CBBCenter is checked against a list of previously found marks: the Stored Mark Table (SMT) (6604). It is determined whether CBBCenter lies within any of the CBB's stored in the SMT. If it does exist in the SMT (6605), the next label in the LCM is acquired and checked in the same manner as before. If CBBCenter does not lie within any of the CBB's stored in the SMT, a new light mark has been found. This CBB is added to the SMT (6607). At this point, the SMT is checked to see if there are nMarks CBB's stored in it (6608). This check is also performed when the LCM has been exhausted of labels to check (6605). If there are nMarks in the SMT (6611) the SMT is returned to the calling program. If there are not nMarks in the SMT, the original threshold variable Thresh is decremented by 1 (6609), then checked to insure it is greater than Dthresh, the dark threshold (6610). If Thresh is less than Dthresh, the SMT is returned to the calling program. Otherwise, processing continues as described before in FIG. 65 (6510).

The effect of searching for nMarks CBB's from a low threshold direction and a high threshold direction has been to calculate a list of CBB's (the SMT) with bounding coordinates just inside the input min and max Mark widths and heights. This process adds an additional level of security in finding actual light marks and not substrate defects.

Reduced Mark Spacing

An advantage of a web offset press is that copy changes can be made quickly and very inexpensively more so than with any other printing process. Each time a copy change is made, new plates with the new copy must be changed. On most all presses there are errors in location of the plates that are caused by errors in plate making, errors in mounting the plates on the press and errors due to the mechanical mechanisms which correct register not being in their center position. These three sources of errors will show up immediately when the press starts printing. Normally for most all presses, the maximum error for all colors both in the lateral and circumferential directions are well within plus or minus 0.25 inch. In this disclosure a camera with a field of view of 0.5 inch in both the X and Y direction provides a 0.001-inch resolution for each pixel and is ideally suited for web offset automatic register applications. Thus, all marks will fall within the field of view of the camera.

If a mark pattern such as FIG. 8 is used, the initial register errors, due to the above, can be significantly larger than the pattern with many of the marks falling outside of the duplicate marks as shown in FIG. 13. Normally the operator would manually move all of the motors associated with the lateral and circumferential register mechanisms to bring all colors in alignment. Considerable waste material and loss press time is associated with this manual process costing many thousands of dollars per year.

The following is a disclosure of a method for rapidly measuring the circumferential and lateral errors for each mark and an automatic method for moving the respective register motors so that all stations are within tolerance for the automatic final register system to operate.

Two methods for achieving this initial register are described.

Procedure 1

A typical pattern of the mark positions upon mounting new plates for the mark pattern shown in FIG. 8 is shown in FIG. 13.

1. Each mark usually is a different color and easily identified from the frozen image of the marks as shown in FIG. 13. Note 1: The marks are shown hatched in FIG. 13 to distinguish each mark as color images are not available for this disclosure. Note 2: The operator knows which color is associated with each printing tower.
2. Each mark in the frozen image is selected by touching the center of the mark. Each time a display is presented which enables the operator to input the tower number for that mark. This procedure is performed for all marks within the pattern and in the frozen image.

Based on this information the magnitude of correction is calculated to bring all stations into alignment or so that none of the marks overlap and all marks can be recognized by the software.

3. The mark pattern is then presented on the display with each station selected for each mark position.
4. The button "move motors" is pressed and all stations will move to within the tolerance required to enable the automatic final register cycle.

Procedure 2

A second method for achieving the same thing starts with the situation of initial register shown in FIG. 13.

1. A superimposed image of the mark pattern with each position of the mark pattern shown as a square box is superimposed over the frozen image and centered within the field of view. Each mark is dragged in turn to its respective box with the printing tower identified as in procedure 1 above.
2. The button "move motors" is pressed and all stations will move to within the tolerance required to enable the automatic final register cycle.

Method of Object Recognition

The purpose of the software is to characterize an input printed or cut object in multiple terms for later recognition. The printed or cut object could be such objects as a square mark or a straight cut. For the purposes of this document it is assumed that the object to be recognized is a square black mark on a white substrate. The Intensity (I) image of this object will be sufficient to adequately characterize this object. Input to the algorithm, therefore, will be an I-image with a Region of Interest (ROI) encompassing the mark and surrounding substrate. The algorithm makes conventional measurements on the object such as width, height, and location. In addition, a shape number is calculated for the object. The benefits of using shape numbers are many, but for our purposes, the great advantage is that shape numbers are size invariant. The shape number of a small rectangle (or square) is the same as that of a large rectangle. This property can be a great help in overcoming the effects of web jump—when the object is not fully represented in the image because the sync of the press has changed relative to the encoder sync on the camera system.

Shape Characterization Process

Figure 73:
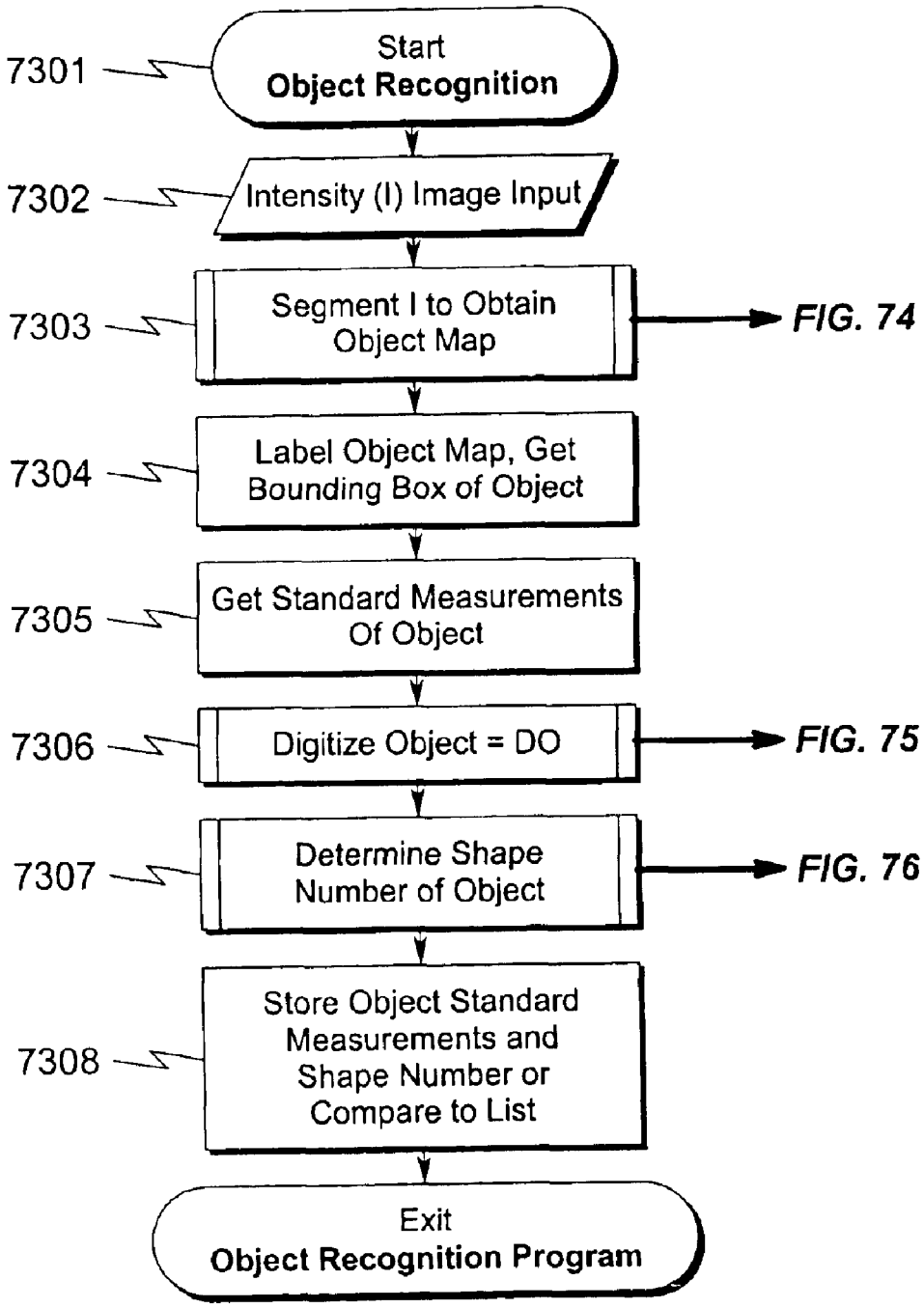

FIG. 73 illustrates a flowchart of the overall process shape characterization. The process begins (7301) with the Intensity (I) image of the desired object to be characterized or recognized (7302). The I-image is first segmented (7303) to separate the object from the substrate. This process is detailed in FIG. 74. The result of this operation is an Image Map where all pixels that correspond to the object are set equal to 1, and all pixels that correspond to the substrate are set equal to 0. The resultant image map is now labeled using Imaging Technology supplied routines (7304). The result of this operation provides the location and dimension of a bounding box that completely encloses the object. Next, standard measurements of the object are made using Imaging Technology supplied routines that operate on the bounding box (7305). The standard measurements include width, height, centroid, perimeter, and area. Next, the object is converted to a digitized object (7306). This process is detailed in FIG. 75. The result of this operation is much simpler version of the original object. Next, the shape number of this digitized object is determined (7307). This process is detailed in FIG. 76. Finally, all standard measurements and the shape number are stored and compared to previously stored members in a list. If a match is found in terms of shape numbers, further processing can be done using the standard measurements to determine the degree of probability that the object has been recognized before.

Segmentation of Intensity Image Input

Figure 74:
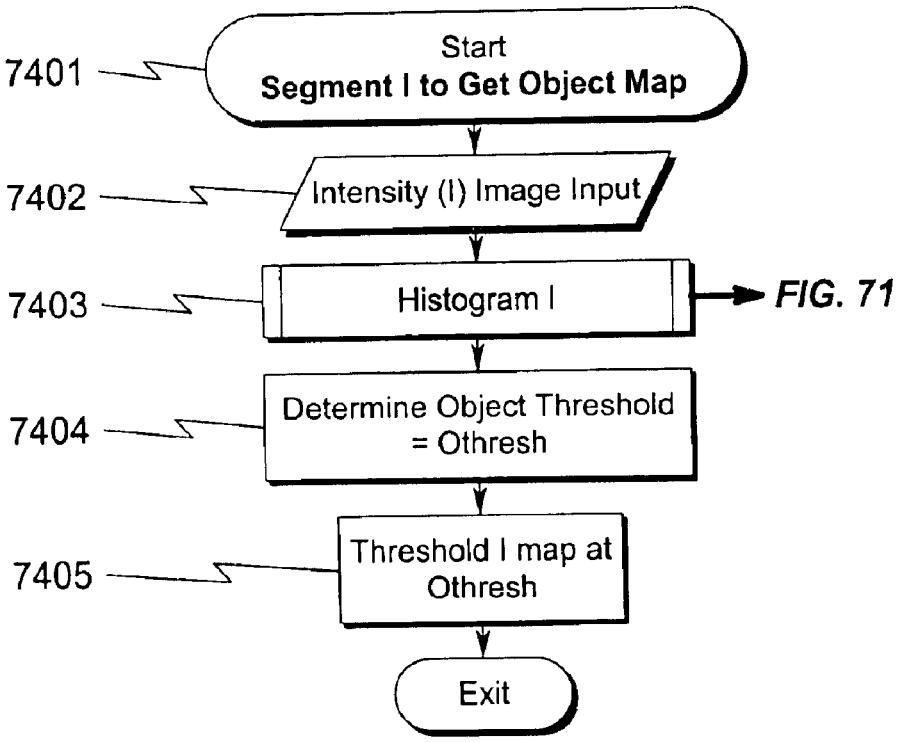

For the purposes of this example, the segmentation process is detailed in FIG. 74. The process begins (7401) with the input I-image containing the object and substrate (7402). Next, the I-image is histogramed (7403). This procedure has already been described in FIG. 71. The histogram in this case will be bi-modal with the lower maxima corresponding to the mark and the higher maxima corresponding to the substrate. The next step is to determine a mark threshold (7404). This is determined by setting the threshold value, Othresh equal to the right hand half-power point of the maxima closest to zero. Next, the I-map is thresholded at this threshold of Othresh (7405). The result of this procedure is to provide an object map where pixels corresponding to the object are set to 1 and pixels corresponding to the substrate are set to 0.

Object Digitization

Figure 75:
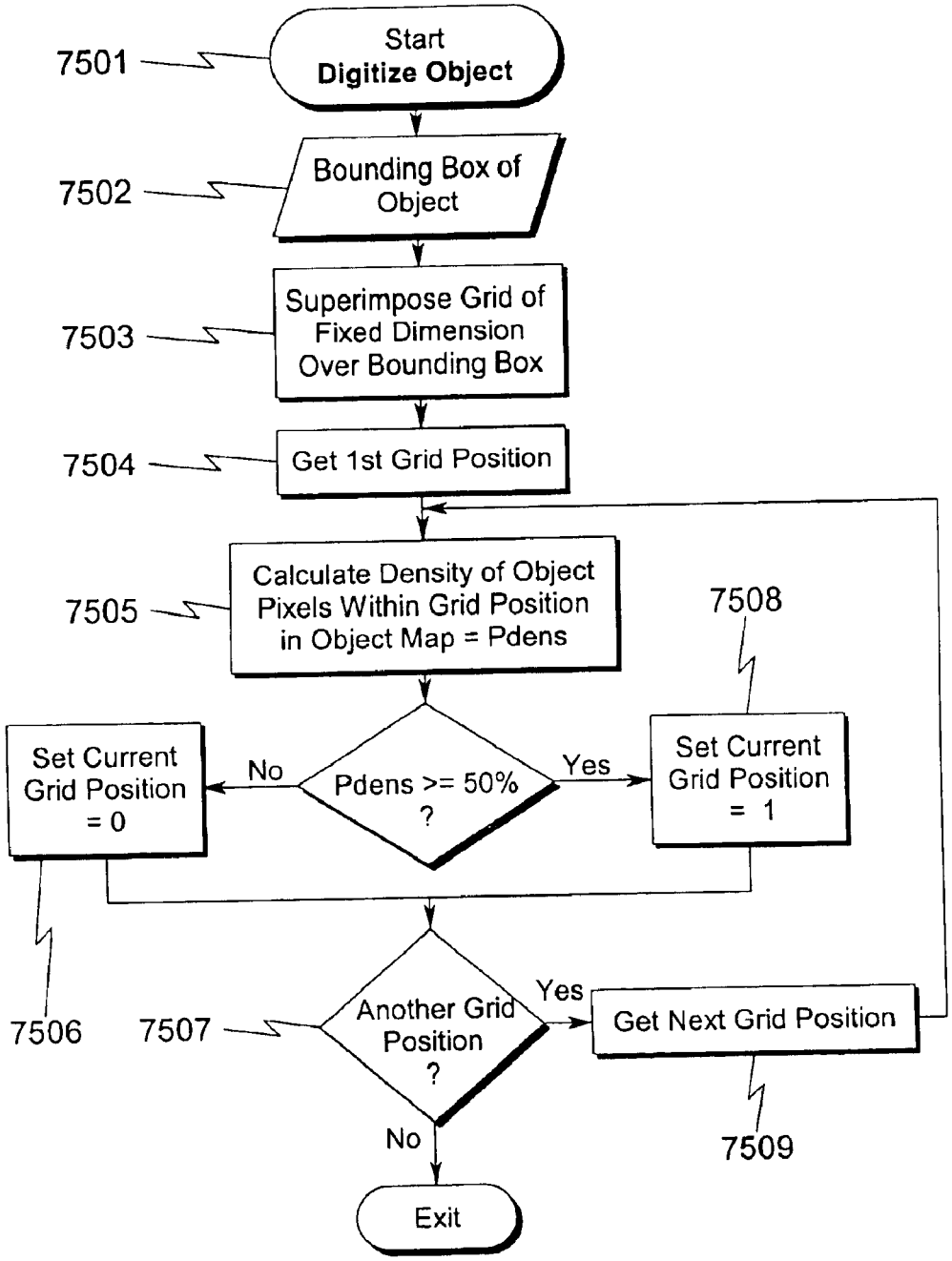

After the labeling and object standard measurement process has been performed (already been described), the object is digitized. This is to provide a simpler object to be shape classified in the next operation. Referring to FIG. 75: the process is started (7501) with the image map and bounding box of the previous operation (7502). Next, a grid of given width and height is superimposed over the object (7503). Each position within the grid is analyzed. The first position (0,0) is obtained (7504), all object pixels within the grid (0,0) superimposed on the object map are counted. The ratio of counted object pixels to the total number of pixels is the object density within this grid position (7505). If this density is greater than 50%, the corresponding grid position (in this case (0,0)) is set to 1 (7508). Otherwise the grid position is set to 0 (7506). The next grid position is obtained and the process is repeated for every grid position (7507, 7509). At the conclusion of this operation, the digitized object (DO) has been created. This object is a much simpler representation of the original object in a lower resolution grid space.

Shape Number Determination

Figure 76:
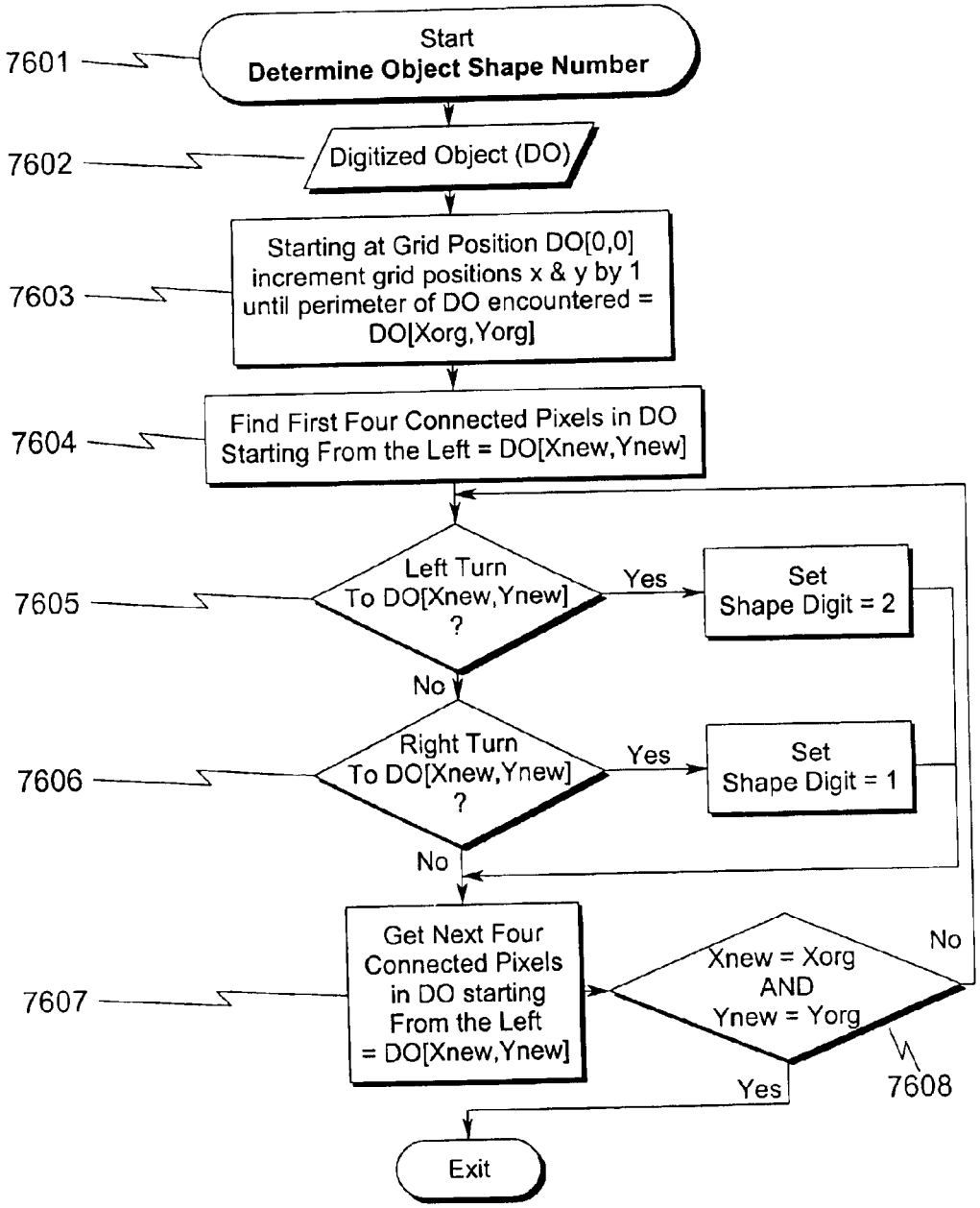

Referring to FIG. 76 (7601), the digitized grid object of the previous operation is input to the shape number determination algorithm (7602). Essentially, this algorithm finds the perimeter of the digitized object and follows the perimeter until it reaches its starting point. As it traverses the object perimeter, it records each time it must make a left or right turn to stay on the object perimeter. The direction of preference is arbitrarily chosen to be left, this ensures that the object perimeter is completely traversed. If arbitrary values are assigned to left and right turns such as right=1, and left=2, then a digitized object shape can be characterized as a sequence of left and right turns. For example, a square object would consist of four consecutive right hand turns and the shape number would therefore be 1111. As can be seen, shape numbers are rotational and size invariant. First the object perimeter must be found. This is accomplished by starting at DO grid position (0,0) and incrementing each axis count by 1 until a non-zero value (1) is found at that grid location. This location is remembered as serves as the trigger to terminate the algorithm when the object perimeter has been completely traversed (7603). Next the first four connected pixel, starting from the arbitrarily chosen direction of preference (left) is found (7604). Four connected pixels are pixels that are adjacent to a center pixel but only on cardinal points (north, south, east, and west). Diagonally adjacent pixels are not considered. If the change of direction from the first pixel to the first four connected pixel is to the left, the first shape number digit is set to 2 (7605). If the first direction change is to the right, the first shape number digit is set to 1. If there is no change in direction, no shape digit is added. The next four connected pixel in DO, starting from the arbitrarily chosen direction of preference (left) is found (7607). This pixel position is checked to see if it is the original starting position, if so, the process is finished. If it is a new perimeter pixel, the shape digit for this direction change (if any) is determined and concatenated with the shape number.

Method of Checking Color of Marks

Overview

The purpose of the color monitoring software is to analyze the RGB color density of each mark and substrate (which is stored at mark recognition time) to see if a tolerance has been exceeded. If it has, an error flag is set and then passed back to the calling routine to warn the operator that a color density out-of-tolerance situation exists.

The Mark Color Density Check Process

Figure 77:
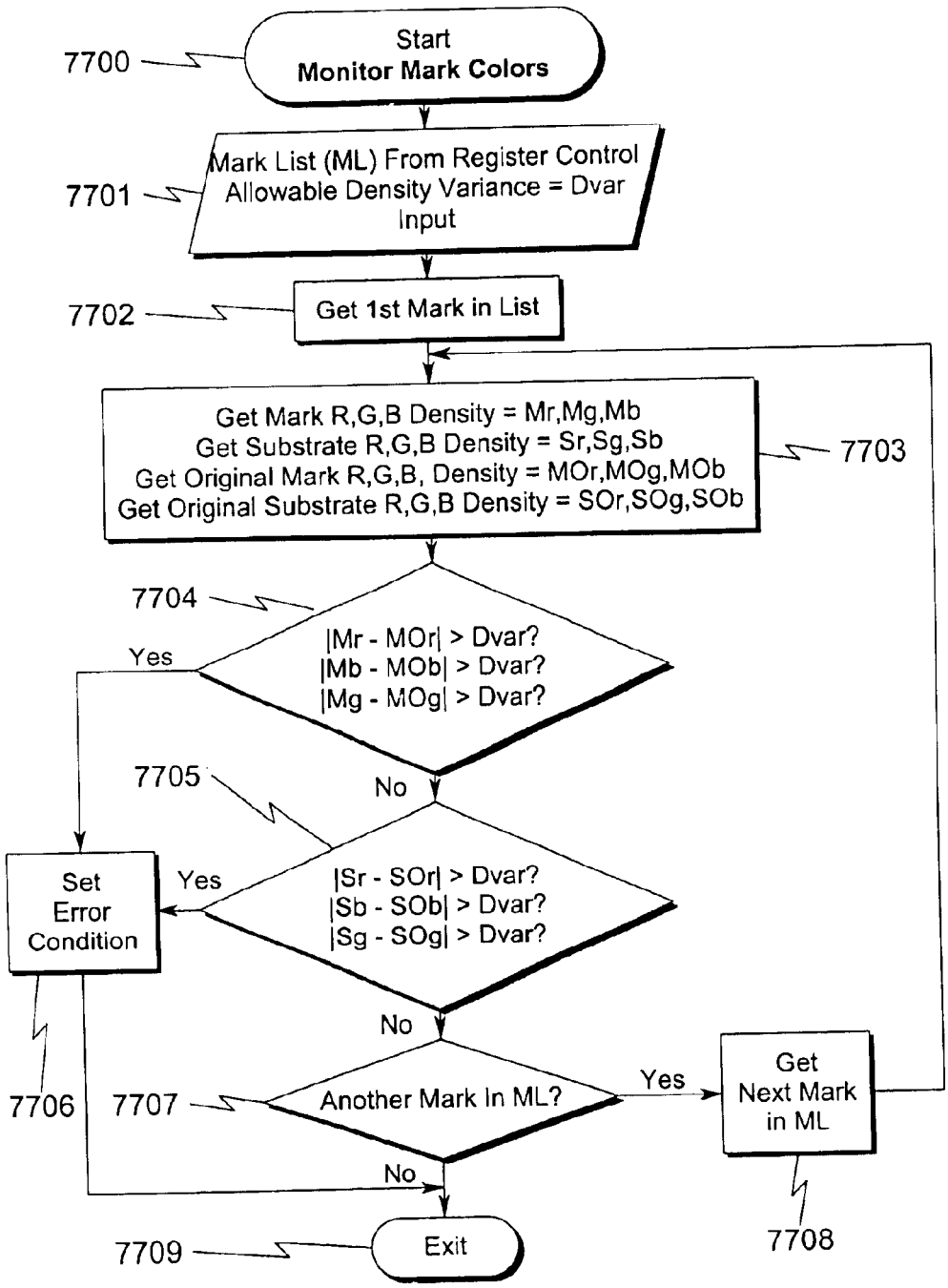
FIG. 77 illustrates an exemplary system process flowchart implementing a color monitoring system.

FIG. 77 illustrates an exemplary system flowchart of the overall process of checking color density of the marks in the mark list (ML) found at registration time (7700). The process begins with the input mark list=ML from the registration process and an input density tolerance=Dvar which may be optionally input by the operator or as a system setup variable (7701).

The ML, in addition to containing registration information for all marks in the list, also contains the most recent density in RGB (=Mr, Mg, Mb) for each of the marks as well as the most recent substrate (surrounding white-non-mark area) density in RGB (=Sr, Sg, Sb) around each mark. In addition, each mark entry in the ML contains the original mark density in RGB when the mark was first stored (=Mor, Mog, Mob) and the original surrounding substrate density in RGB when the mark was first stored (=Sor, Sog, Sob).

The process begins by getting the first mark entry in the ML (7702). Next, all needed values (7703) are extracted for this mark entry:

1. the current mark density Mr,Mg,Mb,
2. the original mark density Mor,Mog,Mog,
3. the current substrate density Sr,Sg,Sb, and
4. the original substrate density Sor,Sog,Sob.

Then the current mark density is checked against the original mark density (7704). If any of the following cases exist: abs(Mr−Mor)>Dvar, abs(Mg−Mog)>Dvar, abs(Mb−Mob) >Dvar, then an error flag is set (7706) and control is returned to the calling routine (7709). Otherwise, the current substrate density is checked against the original substrate density (7705). If any of the following cases exist: abs(Sr−Sor) >Dvar, abs(Sg−Sog)>Dvar, abs(Sb−Sob)>Dvar, then an error flag is set (7706) and control is returned to the calling routine (7709). Otherwise, the ML is checked to see if another mark is in the list (7707). If there is another mark in the ML, the next mark is retrieved (7708) and control returns to (7703) where the mark specifics are obtained and the process just described is repeated. If the ML is exhausted, control is returned to the calling routine (7709).

Shingle Delivery

In FIG. 3 a camera (304) is located on the delivery of the sheeter. This camera is magnified in FIG. 3 as (305). The camera is shown viewing the edges of cut sheets on the delivery of the sheeter. Through image processing techniques the edges of the sheets are determined and the distance from the edges to a mark located near the edge is calculated from images that are continuously taken during production. If the distance between the edge of the cut sheet and the mark changes, correction signals are sent to the motor that moves the compensating roller (307) in the direction to reestablish this distance.

Multiple Cameras and Object Recognition

FIG. 3 shows two additional cameras (304, 308). Camera (304) is viewing a punched object that is a line hole relative to a mark that is shown in the image in FIG. 18 as (1801). Camera (308) is shown as viewing the edge of a cut sheet relative to a mark also shown as (1802) in FIG. 18. The other two images (1803, 1804) shown in FIG. 18 are the mark patterns printed on the top and bottom of the web and viewed by the two cameras contained in assembly (301).

These image are constantly updated in nearly real time with all errors in color-to-color register both top and bottom, line hole to print, and cut to print monitored and automatically corrected through motors attached to their respective register correction mechanism.

Color Measurement and Control Web Offset Printing

Overview

Within the context of web offset printing, obtaining and maintaining register and obtaining and maintaining color are the two major quality issues which also contribute to nearly all of the printing waste. The teachings of the present invention provide the means to significantly improve and maintain registration during initial setup and during the print run with a corresponding substantial reduction in overall printing waste.

Cost Justification

Note that when implementing color measurement and control with the present invention, the same hardware described and used for registration and disclosed herein may also be utilized to both measure and control color both at start up and during the run. Since the traversing mechanism associated with a single camera is less costly than adding two more cameras for color measurement and control, this presents a very economical method of implementing this functionality within the context of existing web printing operations. Given that the hardware is common for both applications, the remaining components comprise additional software in addition with some interface logic to control the printing press color inking mechanisms.

With additional register mark patterns, similar to the ones used for registration, the ink keys (mechanical controls in the printing press that determine the quantity of printing ink that is dispensed) can be set automatically for each set of new printing plates with a substantial reduction in setup time and material waste. This automatic control both eliminates the need for manual human intervention into the printing process (thus saving labor), but also produces a substantially higher quality print product while simultaneously eliminating vast amounts of pre-registration printing waste.

Web Offset Ink System

The web offset printing system is by far the most economic and highest quality process for printing process color reproductions. A minimum of four printing units are required and generally print the four-process colors yellow, cyan, magenta, and black. While the pigments used in the inks that print these colors are not pure, they are stable with sufficient quality control that they can reproduce over and over again the same results in color fidelity on the same stock. This is true for magazine printing as the same inks are always deposited on the same coated stock with the same degree of whiteness.

The inks are used as delivered with no additions. The solid printed color is determined almost exclusively by the thickness of the ink film. This ink film is changed by adjusting an ink key that meters the ink to an area across the width of the printing press. On high quality presses an ink key covers a width of about one inch and thus a 38-inch wide press used extensively for printing magazines would have 38 ink keys per color unit. Thus, for a 38-inch wide press would have a total of (38×4=152) ink keys that must be adjusted for each new four-color job.

For each new press run new plates are installed which print a different four-color reproduction than the previous job. Thus, the ink keys must be readjusted to meter the correct amount of ink to print a solid of the correct color each time a new press run is commenced.

Ink Key Adjustment Methods

Preset Ink Key Adjustment

At present the adjustment of these ink keys is done either manually or by presetting the keys based on information obtained during the making of the plates. One way is to measure the inked areas on a plate when it is manufactured and then preset the ink keys based on these measurements.

Single-Purpose Traversing Sensor

There is also at present activity in trying to adjust the ink keys using a sensor that traverses the width of the web. However, this is a very narrow and somewhat expensive single purpose approach to the problem and has not been proven technically successful regardless of the price.

Densitometer

The most common method used by every magazine printer to adjust the ink keys is based on densitometer readings taken from printed marks of the four colors. The ink keys are adjusted until a specific densitometer reading is achieved. This reading provides the proper ink film for the solid printed mark which then assured that the correct ink is metered to print the correct color in the area covered by that ink key.

As long as the same inks and substrates are used, the densitometer reading of a solid printed mark will be the same regardless of the total ink used to print the area covered by that ink key. It is required to periodically recalibrate the densitometer using a white (uniform density) calibration plate supplied for that purpose. Thus, providing the same substrate is being printed with the same degree of whiteness, and the same inks are used, the densitometer readings for the solid printed marks will be the same. If the substrate is changed and has a different degree of whiteness, the densitometer reading will be different since the calibration white plate has not changed.

RGB Color Measurement with Calibration Plate

FIG. 77 as described in the supporting text above provides a means to obtain RGB readings of the color and white background of any area, object, or mark. It would be desirable to convert the RGB readings from a RGB camera directly to densitometer readings thus easily replacing the densitometer and the manual means for setting the ink keys.

Although there has been much progress in converting various color coordinates specifically in relationship to RGB due to the personal computer and desktop publishing there is no precise means of doing so at present. Even if there were, the camera would still have to be calibrated to provide absolute readings in the same manner as the densitometer.

An easier and more accurate means of providing densitometer readings is to provide a calibration plate just as was done in Zoom Lens Calibration to calibrate the Zoom Lens. The holders for the calibration plates are mounted on the traverse shown as (509) and (510) of FIG. 5. Item (509) is for the top camera (501) and item (510) is for the bottom camera (502). A color calibration plate is installed on each calibration holder and read by each respective camera.

The calibration plate includes as a minimum, a small patch of colors (yellow, magenta, cyan, and black) with a number of white patches of various degrees of whiteness. All of the patches are read using a precision densitometer with the densitometer reading stored in a lookup table in computer memory. Each of these same patches are then read by the camera and also stored in computer memory as RGB values. For each specific stock and ink, the densitometer readings and RGB readings are stored in a lookup table. This table is used to correct solid ink density measurements on the printing press corresponding to the RGB readings of the same marks taken by the camera from the samples read by the densitometer. A test would be run that purposely offsets the ink densities by manually adjusting the ink keys first in the lighter density direction and then in the darker density direction with both density and RBG readings stored in the computer lookup table.

In practice, there will be significant improvements in adjusting the ink keys over the manual use of the densitometer, including:

1. A significant reduction in waste time and material.
2. The camera could first read the whiteness of the substrate, and recalibrate itself from the background substrate or one of the white chips mounted on the calibration plate. This feature would provide the same density readings for all substrates.
3. This technique would make a significant improvement in roll-to-roll printing applications as presently there is no means of obtaining a sample for measurement purposes as in those applications where a sample is easily obtained from the folder.

Automatic Adjustment of Ink Keys

The procedure to adjust the ink keys automatically could utilize either the fixed lens system of FIG. 5 and/or the large field of view Zoom Lens System of FIG. 2 and/or any of the teachings of Zoom Lens Calibration. Using the color calibration plate just described, a set of marks like the register marks of FIG. 7 but separated by a much smaller distance (such as 0.25 mm instead of 1.25 mm) would be printed one set for each ink key. The duplicate marks would provide the means of relocation of the mark sets for each ink key with rough location as defined by the encoder attached to the traverse.

As each mark set is read, an adjustment is made to the respective key. The time to read all 38 mark sets would enable a correction to be introduced immediately with sufficient time for the ink film to change based on the previous correction before another reading and correction is introduced. At present, most printing presses are equipped with motorized ink keys that can be energized either directly or through a serial communication channel. This communication interface may be easily integrated by one skilled in the art with the teachings of the present invention to fully automate the ink key adjustment procedure and eliminate the need for substantial human intervention as is currently the norm in the printing industry.

The only potential objection to the present invention process for color ink key adjustment is that small printed mark sets must be incorporated within the copy one mark set for each ink key. This is easily accomplished in magazine printing or where a folder is in line with the printing press. For these applications the marks can be printed in an area that is required for the folder (hidden by the binding) or plate gap (outside the useable print field) and which is trimmed off in the bindery later.

It should be noted that the description above included the four process colors (yellow, magenta, cyan, and black) because these four colors are used in every process printing where the greatest improvements are made over the prior art. The system can be extended for any other color or color combination in the same manner with the addition of other color to the calibration plate. One skilled in the art will recognize that this technique can be applied equally well to colors visible to the human eye as well as colors that are only visible when excited by other forms of non-visible radiation. Thus, the term 'color' should be widely generalized within this context.

As a practical matter maintaining color fidelity of colors other than the process colors is more important and the present invention has wide practical application to this widespread problem in the printing industry.

Color Monitoring

Overview

There are a number of other applications in web offset printing where small mark sets cannot be printed for each ink key because of esthetic reasons and the marks cannot be trimmed off later as in magazine printing. Two such applications are 1. the printing of direct mail; and
2. the printing of newspapers.

Direct Mail Web Offset Printing

In the printing of direct mail, additional marks can be printed in the copy. The major color concern for these applications are the fidelity of the special colors such as Coke™ red, Blue Bonnet™ Blue, etc. Multiple patterns are printed across the web, and it is not as important that the overall color of all patterns varies as it is to maintain the same color of all patterns.

The color measurement system illustrated in FIG. 77 can be used as is without the need for a color calibration plate in this example. In these circumstances, a difference in color reading is to be monitored instead of an absolute color reading as in the initial adjustment of ink keys. The color of any number of areas or objects can be monitored with the color first adjusted to its correct value and then compared during printing for color variation.

An offshoot of this technique to save time and material for obtaining the correct color of multiple patterns is to first adjust the baseline pattern either by eye or using a densitometer, and then having the automated control system described herein to duplicate the color on the remaining patterns by adjusting the ink keys automatically for the other patterns of the same color.

Newspaper Web Offset Printing

As a small example of the wide application of the teachings of the present invention, two specific applications in the printing of newspapers utilizing color monitoring and adjustment techniques will now be discussed.

Adjustment of Keys

Small marks cannot be printing in a newspaper because of esthetic reasons. However, solid bars of one or two colors can be printed such as is done in newspapers such as USA Today. These bars could be read across the web with automatic adjustment of ink keys in the same manner as in the ink key adjustment procedure described above.

Maintain Color With Change and Wear of Plates

Most newspapers will not allow small mark sets to be printed across the entire web width for automatic key adjustment. However, a major color problem is the variation in color of the same process printing when plates are changed for different editions. With the centralization of newspaper printing it is becoming commonplace for a number of different area newspapers to be printed at the same facility. Color variations in a newspaper advertisement occur as the edition is changed using the same process printing but on new plates. In this situation the advertiser may obtain a copy of all newspaper editions and complains because the perceived color is different in each addition, as there is currently no mechanism to permit the newspaper publisher/printer to ensure that all newspaper editions have the same color complement for the identical advertisements.

For this application the color of the register marks may be monitored according to the teachings illustrated in FIG. 77 and stored when the print job is first run. When the plates are changed for the next newspaper edition the color difference will be detected and a global change can be made to all affected ink keys. That is, the ink key settings are very close as the copy has not changed. Thus, the color change can be corrected by making the adjustment globally to all keys of each affected color. This color compensation will thus ensure that as subsequent newspaper editions are printed, the color complement for all advertisements will be comparable to that of the initial baseline newspaper edition.

Ink Water Balance

In the offset printing process, non-image areas are coated with water that prevents ink from adhering to the non-image areas and then to the printed material. The control of the ink water balance is extremely important as too much water or too little water greatly affects color. The initial adjustment of the ink keys is straight forward as the ink water balance is initially properly set up when the plates are new. This allows presetting of the ink keys based on densitometer readings (correlated RGB readings) as disclosed as the ink water balance will remain constant for some time.

A more difficult problem that causes unacceptable color variations is changes in the ink water balance as the press warms up, as plates wear, and due to other factors which affect the ink water balance. These variations cannot be corrected by adjusting the ink keys but require an adjustment in the water metering system. There is at present no means for distinguishing the difference between density readings caused by ink film variations that can be corrected with adjustment of the ink key settings, and density readings caused by variations in ink water balance and can be corrected only with adjustment in the water metering system. For this reason automatic on-line systems that adjust ink keys have had only limited success, as they cannot be used for the more important on-line color variations that are caused by variations in the ink water balance.

The following discussion discloses a method to determine the difference between an ink density difference reading that is due to a difference in ink film thickness that can be corrected with adjustment of ink keys and the same reading that is caused by a difference in ink water balance. This method may be implemented with advantageous results using the mark recognition system disclosed elsewhere in this disclosure.

The disclosed method allows the system to be used for initial adjustment of the ink keys when new plates are installed, and for adjustment of either the ink keys or ink water balance as required to maintain consistent color during the run. The system employed to monitor or measure density of marks, areas, objects, etc. is illustrated in FIG. 77. RGB values can be read from anywhere on the entire repeat length or from calibration plates located on the side of the traverse.

Ink Key Adjustment

Figure 82:
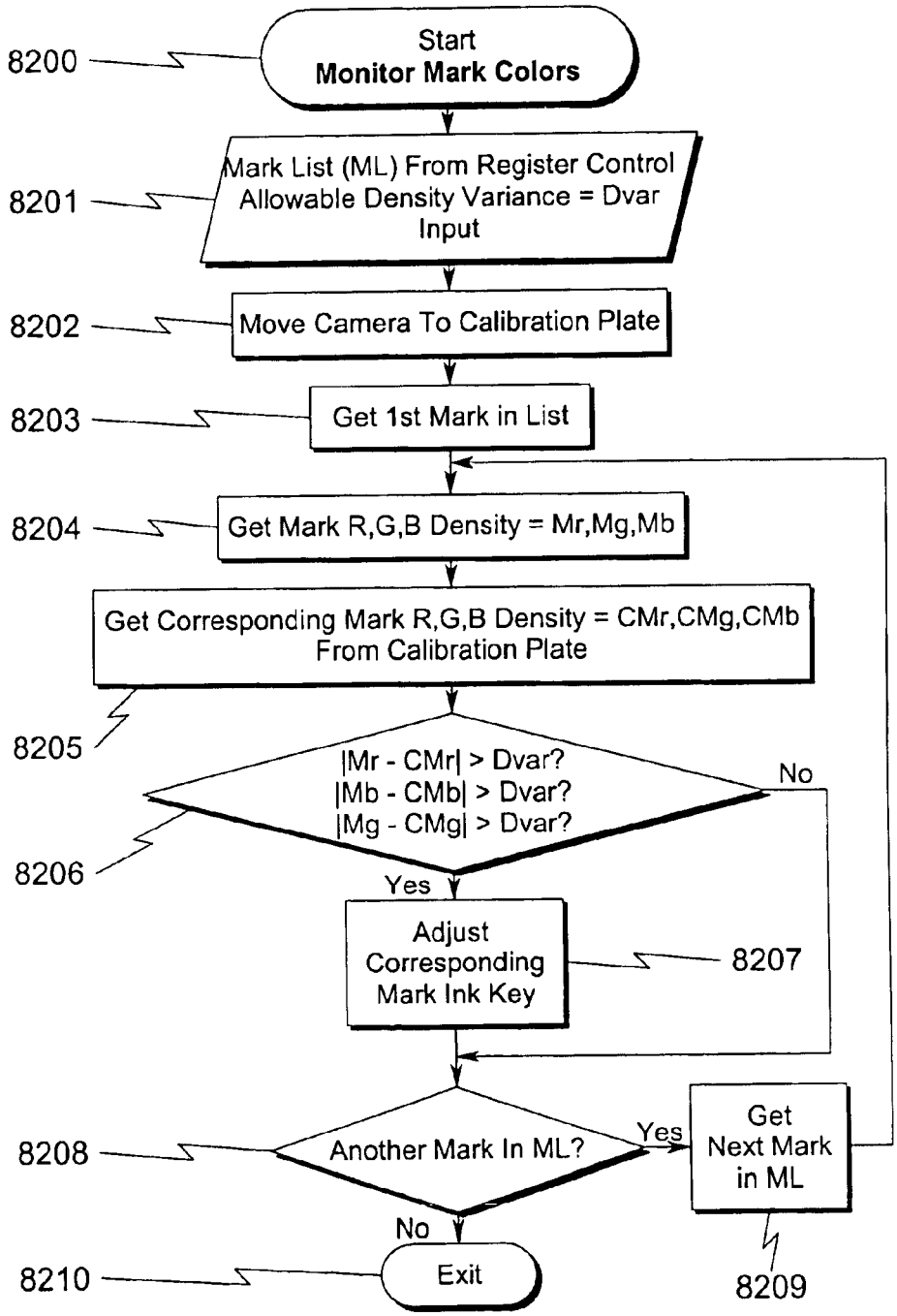
FIG. 82 illustrates an exemplary system process flowchart implementing a color monitoring and/or control variant of the present invention wherein color ink keys are modulated to provide absolute color control.

FIG. 82 illustrates an exemplary system process flowchart providing a procedure for automatic adjustment of ink keys based on the placement of individual marks within the range of a plethora of inking keys positioned across the plates that ink the web. This procedure (8200) will now be discussed in detail.

Initially, the mark list is obtained from a register control process (8201). The monitoring of marks for ink key adjustment consists of moving the camera to the calibration plate (8202) shown as (509, 510) of FIG. 5 on which is mounted chips of various colors including but not limited to yellow, magenta, cyan, black and various shades of white. One skilled in the art will recognize that a wide variety of colors and color configurations may be used for this process. These color chips (individually or collectively referred to as a calibration plate) have been read with a densitometer and the camera and both densitometer readings and their corresponding RGB values stored in a lookup table. Both densitometer reading and the corresponding RGB values of variations of the color of the calibration color chips are also stored in the look up table to relate the densitometer reading to and color variation that is obtained in RGB. Thus, for any RGB value the corresponding density reading can be determined from the look up table.

The camera can be calibrated as often as necessary by moving the camera to the calibration plate and taking the RGB values of each color chip and comparing them with the RGB values stored in memory. Calibration of the camera is done either by mathematically correcting the values or by recalibration of the RGB values through the software provided for that purpose.

The camera is then moved sequentially to each mark in the mark list of (8201), starting with the first mark (8203), and using the RGB values stored (8204) and compared with the mark density readings of (8205). The thresholds and deviations relative to the correction required at each ink key is calculated and in (8206) with the corresponding ink key adjusted as in (8207). The process is repeated for each mark set in the mark list (8208, 8209). This procedure provided the means for determining the ink key correction to correct for a specific density do to ink film thickness. This process is ideally suited for initially adjusting the ink keys with substantial savings in time and material.

Ink/Water Balance

Figure 83:
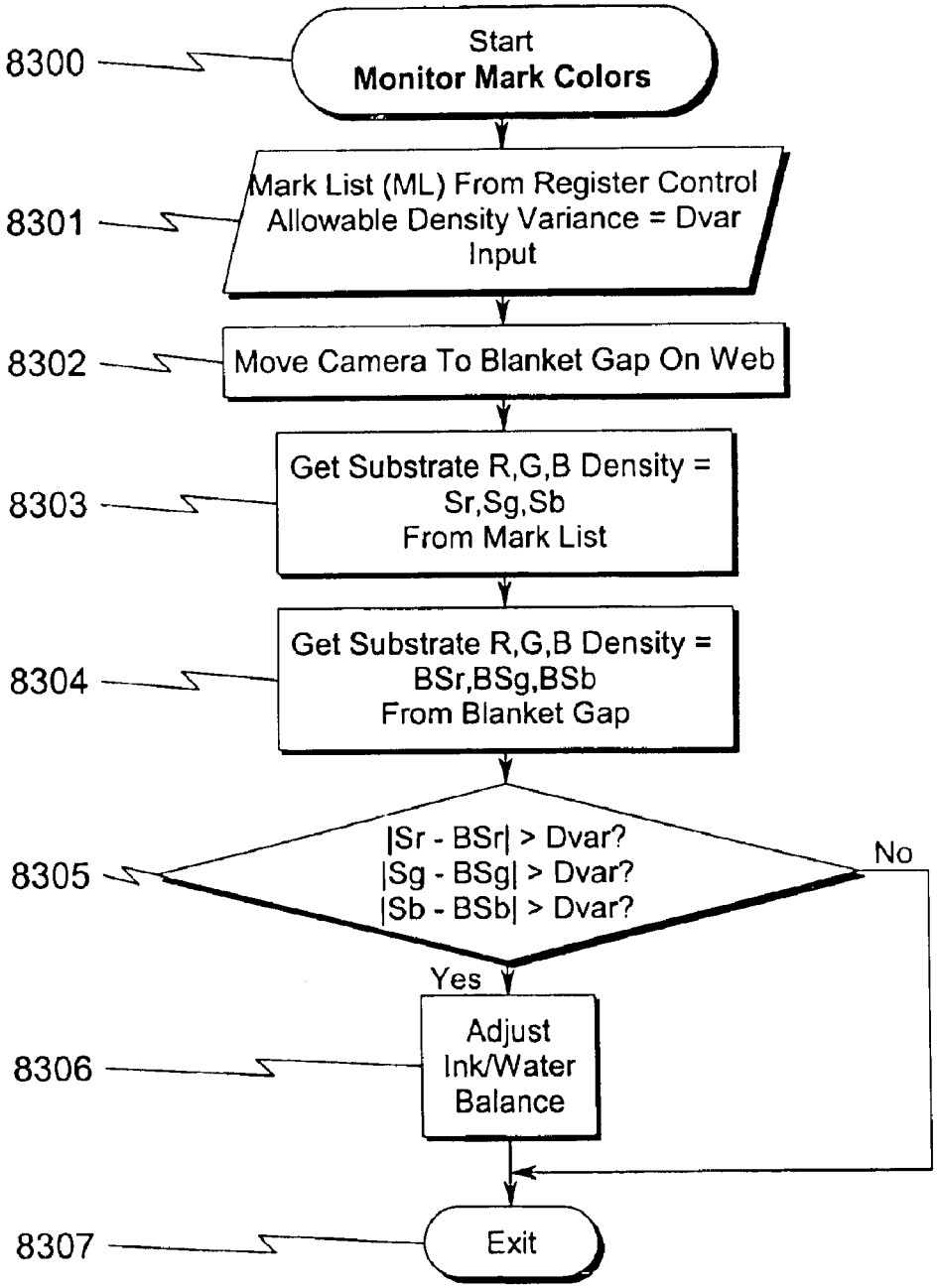
FIG. 83 illustrates an exemplary system process flowchart implementing a color monitoring and/or control variant of the present invention wherein ink/water balance is modulated to provide absolute color control.

In FIG. 83 illustrates an exemplary implementation of an ink/water balance control sequence (8300). This provides a means for measuring and correcting color variations due to changes in ink water balance. Since the applied water has an impact on the color of the web paper, the present invention makes use of the web corresponding to the plate gap to form a white reference that is used to then calibrate the water deposition rate in order to achieve desired color characteristics on the printed web.

The camera used in this procedure may be calibrated using the procedure (8202) of FIG. 82. Marks are obtained from the mark list with their RGB values obtained and stored. The marks in this instance consists of the white areas around each mark set and the corresponding white areas of the plate/blanket gap directly opposite the mark set so as to have a comparison of the white area where there is printing and the white area where there is no printing. These variations can be compared to the desired difference for perfect ink water balance with adjustments made to the water metering system when ink water variations are detected using this method.

Referencing FIG. 83, the typical ink/water balance adjustment process (8300) begins with obtaining a mark list (8301) and moving the camera/sensor to a plate/blanket gap on the web (8302). Here the web substrate density is obtained (8303) from the mark list corresponding to the ink keys. The substrate background density is then obtained from the plate/blanket gap (8304) to provide a reference for the values obtained from the mark list corresponding to the ink keys (8303). The ink key values (8303) are compared to the plate/blanket gap values (8304) and if the difference is significant (8305) the ink/water balance is adjusted (8306) to improve the color ink deposition. Otherwise, the process is terminated (8307). Note in a typical application, this process may be repeated as a background process to continuously monitor and correct the ink/water balance based on changes in press conditions.

It should be noted that density readings can be obtained from any mark either solid, screened, and for any color or combination of colors using the means of this disclosure. Additionally, different algorithms can be used to detect and correct all keys either globally or individually. Finally, a wide variety of ink water adjusting means may be associated with various press inking systems. The present invention specifically encompasses all these variants, as it is the first to utilize the plate/blanket gap within the web itself to permit calibration of the ink/water balance adjustment.

Integrated Color Monitoring and Control

One skilled in the art will recognize that the ink/water balance methodology of FIG. 83 may be easily incorporated within the methodology of ink key adjustments illustrated in FIG. 82 to form a complete color control and monitoring system. This integration is significant because for the first time a single system can perform complete registration control in addition to color monitoring control with all print process parameters being monitored and automatically corrected for without resorting to elaborate manual intervention. Nothing in the prior art approaches this level of automation and integration, nor does the prior art teach any of the techniques associated with plate/blanket gap calibration of color ink deposition.

Typical Implementation

It should be noted that many preferred embodiments of the system just discussed incorporate duplicate marks for every ink key and/or ink/water balance adjustment. These duplicate marks are be used in conjunction with corresponding color marks for each color ink key to inspect the color as applied to the web. For example, a four-color press with 38 color adjustment keys would have 38 sets of duplicate marks and additionally 38 sets of color marks (yellow, cyan, magenta, for example). If properly distributed throughout the web, these marks will permit the process of FIGS. 82 and 83 to completely control the color deposition and adjust for a wide variety of press variations and dynamic manufacturing conditions.

Total Quality Control

Overview

Figure 78:
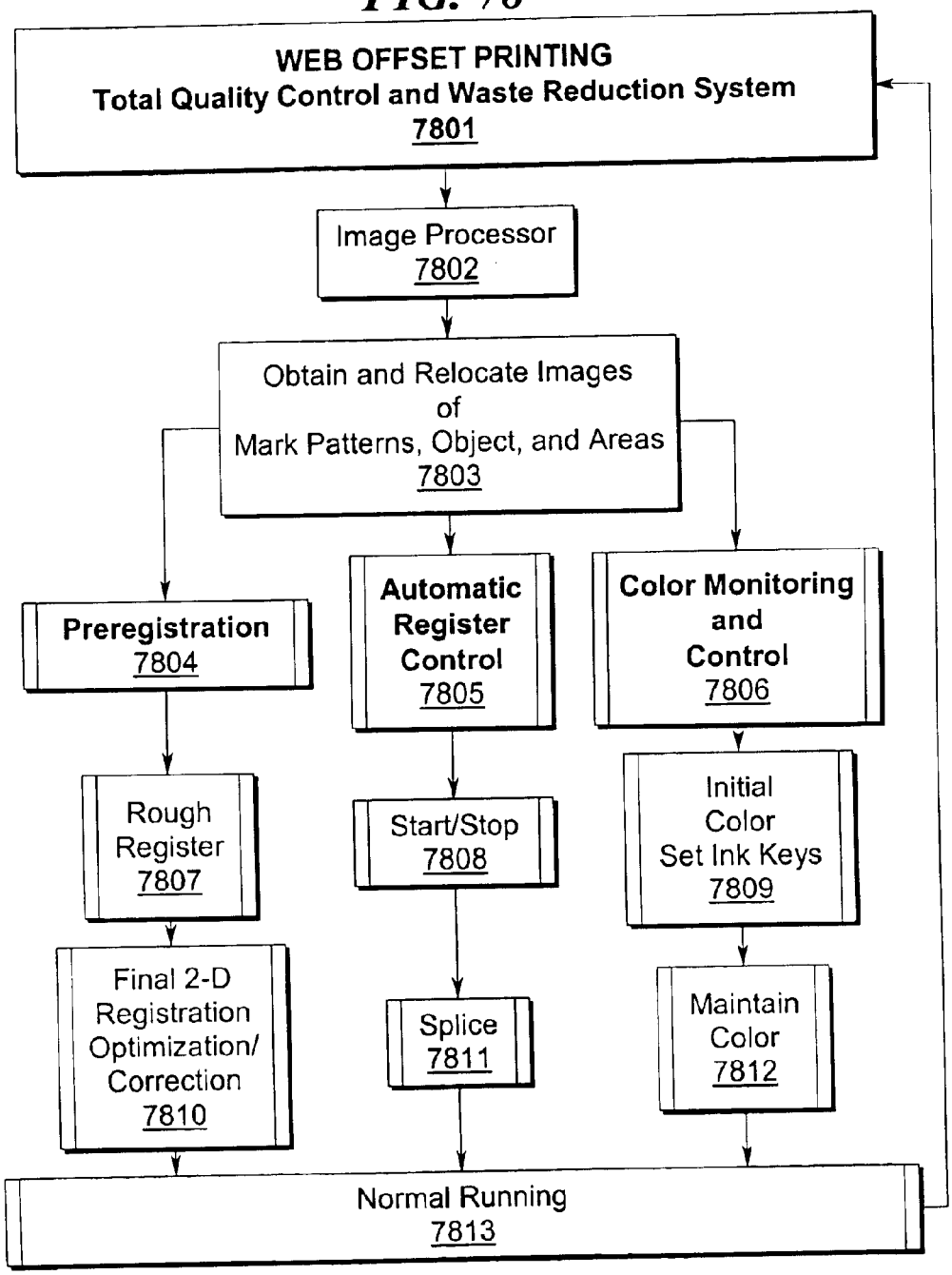
FIG. 78 illustrates an exemplary system process flowchart implementing total quality control and waste reduction system for a typical web offset printing application.

FIG. 78 illustrates a flowchart representing how the present invention addresses the three major areas that define total quality in web offset printing in terms of a WEB OFFSET PRINTING Total Quality Control and Waste Reduction System (7801). The Image Processor (7802) block may be viewed in some preferred embodiments as a representation of the hardware image processor depicted in FIG. 3 as computer (303), touch screen control (302), cameras (304, 308, 301) and in FIG. 1 as Computer (113), touch screen (111), color monitor (112) and cameras (107, 110).

The image processors obtain a number of different images (7803) as described within the teachings of the present invention from which information is extracted and utilized to improve quality and significantly reduce time and material waste in the three major areas of importance:

1. preregistration (7804),
2. automatic register control (7805), and
3. color monitoring and control (7806).

Preregistration Sequence (7804)

The Preregistration (7804) sequence is broken into two areas:

1. rough register (7807) which has been disclosed in FIGS. 9–17, and
2. final two dimensional register (7810) disclosed in FIG. 28;

both of which have been previously discussed in this disclosure.

Automatic Register Control (7805)

The Automatic Register Control (7805) sequence acts on normal register errors to automatically restore register to its previous position after tension and other disturbances during start-stops (7808), splices (7811), and any other condition that would produce a register error.

Color Monitoring and Control (7806)

The Color Monitoring and Control (7806) sequence provides the means as disclosed in FIG. 77 to measure color variations. With two different variations of this concept one with application in the initial adjustment of ink keys when setting up a new job, and the other for monitoring color through the run to maintain consistent quality. These two methods use the an exemplary process flow as illustrated in FIG. 77 and are fully disclosed previously in this disclosure.

Normal Running Operation (7813)

Given the three sources of error that define total quality in web offset printing processes, each of the error correction paths (7804, 7805, 7806) may be activated asynchronously in many implementations to dynamically adjust printing operation prior to and during normal running operation (7813). One skilled in the art will recognize that this functionality may be easily implemented in many multitasking or threaded task processor environments.

Summary

The system/process flow illustrated in FIG. 78 is unique in the industry for several reasons. Generally, most of the features present in this automated total quality control system are currently performed manually in the prior art, and in situations where they are not, the systems tend to be single-purpose in their functionality. The present invention breaks with tradition by permitting ALL the errors associated with poor quality and printing waste to be attacked simultaneously, thus providing for a superior web product as well as drastically reduced waste from the overall printing process.

Product-by-Process

Overview

The present invention should be viewed in terms of the disclosed system, method, process, and additionally in terms of the product created by the process disclosed herein. The rationale for the claim of the printed web itself as being novel lies in the fact that the present invention web printing systems and associated method/processes have a product distribution that is of a different kind and substantially higher quality than that possible with conventional web printing systems.

Quality and Waste Improvement in Newspaper Printing

The typical quality of newspapers with four-color process printing is poor with large register variations throughout the run greatly distorting the printed images. Originally printers and their advertisers were enamored with the addition of four-color process printing in a newspaper. Now they are insisting on quality which has become a large issue with advertisers who are reluctant to pay a premium for process printing after seeing their add in the newspaper with intolerable register variations that distort the product representation. This is especially true of the major metropolitan newspapers all of which run at least one color lead. Many of these printers operate older machines that were not designed for four color printing and thus produce significant poor quality through out the run. Until now there has been no solution to improve quality with all three functions manually controlled by the operator.

Prior Art Product Distribution

Figure 80:
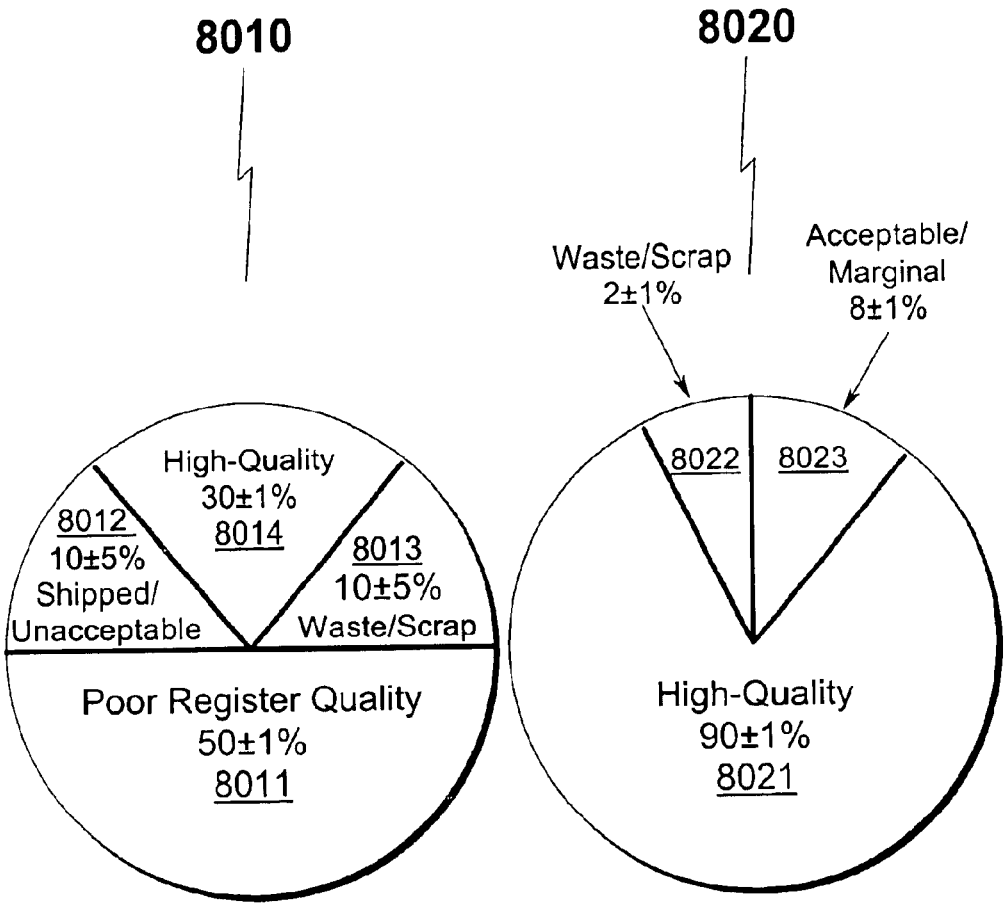
FIG. 80 illustrates an exemplary newspaper waste recovery profile based on a typical product mix possible using an exemplary preferred embodiment of the present invention.

Referencing FIG. 80, an analysis of the comparative quality distributions of the present art (8010) versus the present invention (8020) based on the exemplary economic analysis presented in FIG. 19 and other data reveals that the distribution curve for the present invention is markedly different than that possible with the prior art. Within the context of the prior art (8010), the distribution indicates that while the majority (50%) of the product produced is of a poor register quality (8011) that is nonetheless marginally acceptable for the customer, there typically exists approximately 10% of the printed product that is unacceptable (8012), yet still shipped to the customer for economic reasons. Furthermore, up to 10% of the printed material is considered waste/scrap (8013) due to setup registration errors. Note that this percentage will be higher for short runs, but even for the example illustrated in FIG. 19 is approximately 2% for a common newspaper with a moderate production run.

Within this printing context, there will be some high-quality output (8014), but this result is predominantly due to random variations in the process and cannot be guaranteed over the life of any given production run without incurring a higher percentage of waste (8013).

Present Invention Product Distribution

In contrast to the prior art, the present invention product distribution (8020) is of a completely different character. Here, the majority (90%) of the product produced is of the high-quality (high registration compliance) variety (8021), whereas there is negligible waste (8022), and only a small quantity of product (8%) that is of the acceptable/marginal variety (8023). Furthermore, the acceptable/marginal (8023) component of the product output represents the sum of uncorrectable errors in the printing process plus the feedback control loop delay associated with the present invention as implemented on the printing press. Since the printing control system and method described herein permits the observation camera or other sensor to be placed directly after application of the ink to the web material, this feedback control loop may be much shorter than possible with the prior art.

Summary

While the example provided in FIG. 19, and the distribution charts illustrated in FIG. 80 are only exemplary, they indicate that the present invention when applied to web printing permits a given lot of web material to be qualitatively different than that produced by the prior art. Whereas the prior art printing methods were forced from an economic perspective to accept marginal color registration in many circumstances (because to do otherwise would increase waste/scrap quantities that would drive up the cost of the print job), the present invention changes the printing dynamic by essentially eliminating waste completely from the printing process, and converting what was waste into acceptable/marginal output product.

Thus, the vast majority of the product produced by the present system is of the high-quality superior registration quality, and as such the disclosed invention produces a product that is consistently of a different kind than that possible with the prior art. As such, it should be considered a 'super-registered' web product, consistently of better quality than that possible with the prior art. While this super-registered web product has a direct economic impact on reducing waste and increasing profits for a given printer, it should be noted that the present invention also has the capability of permitting older printing presses that have a plethora of alignment and aging problems to produce a super-registered web product in situations where the printing press would not have been able to produce even acceptable/marginal product in the past. The dynamic feedback provided by the present invention in conjunction with a short feedback loop and three-dimensional compensation for web and press variations permits even an aging press in many circumstances to produce an overall product distribution that surpasses the capabilities of even newer modern day printing presses.

Computer Software

As would be known by one skilled in the art and as indicated in the present disclosure, the system and method described herein and generally illustrated in FIGS. 1–80 may be reduced to computer instruction codes and embodied on a computer readable storage means. This may take the form of a wide variety of storage media well known in the art and/or contemplated for future use. Thus, the present invention specifically anticipates the incorporation of the system and methods discussed herein in the form of tangible computer software products.

Furthermore, while not limiting the scope of the present invention, the present invention specifically anticipates that one or more components of the present invention may be implemented using the Microsoft™ Windows™ operating environment in all its variations or its equivalent commercial embodiments, including but not limited to any system incorporating a graphical user interface.

Environmental Impact

Overview

The present invention has wide application to all forms of the printing industry, as well as other industries that operate on webbed products using rollers, printing, punching, and the like. Since a primary advantage of the present invention over the prior art is the simultaneous minimization of setup time and resulting waste products, it can easily be understood by one skilled in the art that the present invention has the potential to substantially improve the environment by reducing landfill waste and the like.

Exemplary Waste Savings Analysis

It is instructive to analyze the potential waste savings for a typical small newspaper application to gain a grasp on exactly to what extent the present invention may improve the environment. An exemplary waste savings analysis is illustrated in FIG. 19, wherein an exemplary newspaper application (1900) consisting of a circulation of 50000 newspapers (1901) using standard printing press configurations (1902, 1903, 1904, 1905, 1906) and conventional ink and paper costs (1907, 1908, 1909). Standard production run information (1910, 1911, 1912, 1913) results in a savings of approximately 1000 papers per make ready count (1914).

When calculating the actual waste savings, the number of active printing webs (1915), and paper/ink characteristics (1916, 1917, 1918, 1919) are used to calculate the total cost of each newspaper (1920). This information (1920), when coupled with the number of papers saved due to waste reduction per make ready (1914) results in a cost savings for each make ready run (1921). Multiplying the number of make ready runs per week [23] (1922) by the number of papers saved per make ready run [1000] (1914) results in a total number of 23000 newspapers saved per week (1923). This equates to approximately 4.5 tons of newsprint saved per week of production (1924), or approximately 235 tons of newsprint saved per year of production (1925).

Equating this lost newsprint to manufacturing cost in terms of ink and paper cost yields a savings of US–2,487 per week or US–129,336 per year. What is significant to note in this analysis is that the present invention installed cost may in fact be less than this yearly material savings. Thus, the printer has an economic incentive to reduce waste by making use of the present invention, as the equipment costs can be recovered within one year, with subsequent years having increased profit margins associated with annual savings of US–129,336 throughout the useful life of the present invention. Additionally, a total of 235 tons/year of unnecessary landfill waste is eliminated via utilization of the present invention on top of the yearly cost savings.

Color Correction and Waste

It is significant to note that as discussed previously, the teachings of the present invention permit multi-color corrections to occur automatically, and to a degree of conformance much stricter than would be possible using manual adjustments and human inspection. The results in terms of both print quality and reduced waste are dramatic as compared to the prior art. The analysis illustrated in FIG. 19 is a direct result of the performance of these present invention teachings.

Remote Operation of the Present Invention

The operation of the present invention may be affected both locally and remotely. While one skilled in the art will clearly recognize that the present invention may be integrated into a printing press environment as illustrated by the examples in FIGS. 1–24, there also exists a possibility of using the system as described in a remote capacity.

Figure 81:
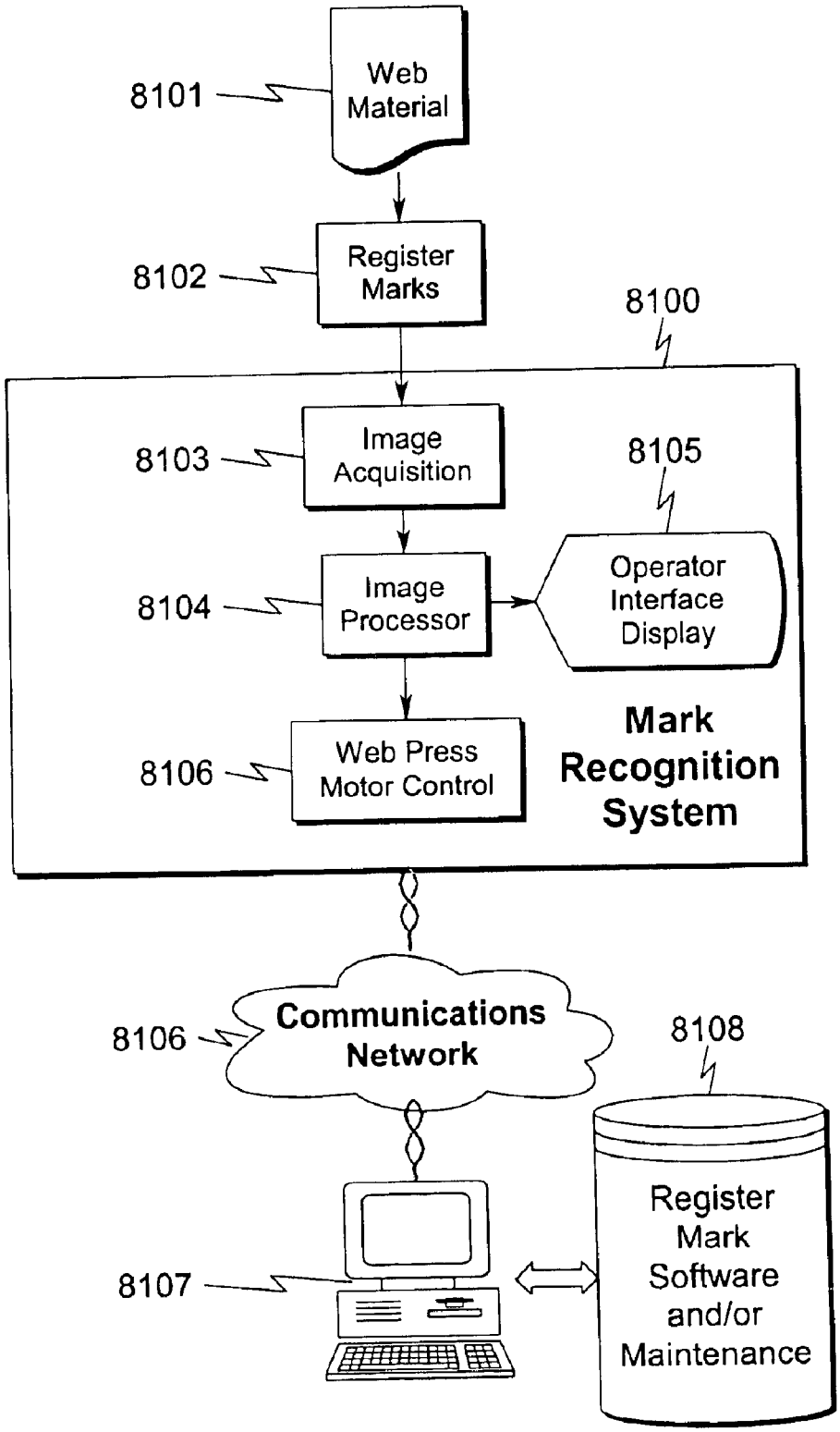
FIG. 81 illustrates an exemplary variant of the present invention in which a local print registration system is remotely controlled and/or updated via a communications network and remote processing system with associated software database, thus permitting remote diagnosis and/or control of an operational printing press system.

Referencing FIG. 81, the general system configuration of FIG. 57 has been augmented by identification of the local mark recognition system (8100) comprising an image acquisition means (8103), image processor means (8104), operator interface display means (8105), and web press motor control means (8106). This mark recognition system (8100) operates as described previously in regards to inspecting a web material (8101) on which register marks (8102) have been applied.

This local system (8100) is augmented for remote applications with a communication network means (8106) connected to a remote processing system means (8107), which is typically a personal computer running a graphical operating system such as a variant of the Microsoft Windows operating environment but is not limited to this configuration. This remote processing system means (8107) has associated with it a remote storage device database means (8108) containing register mark software and/or other maintenance and inspection software. Using this configuration, the mark recognition system (8100) may be remotely updated and/or inspected from a location not local to the actual printing press. This capability is extremely useful in both troubleshooting printing press problems but also provides a means for providing custom software updates to a printing press system based on demands of various new printing requirements.

One skilled in the art will recognize that while the communication network (8106) illustrated in FIG. 81 may conceivably be any form of digital and/or analog communications medium, in many instances the preferred method of communication will make use of the Internet. This technique in some circumstances will also permit the mark recognition system (8100) to download updated register mark software from a remote database (8108) via use of the remote processing system (8107).

Preferred System Context of the Present Invention

The present invention may be incorporated into a wide variety of system contexts, although one preferred system context in regards to web printing is illustrated by the configurations in FIGS. 1–29. Note, however, that these are only exemplary system applications. Given the relative low cost of this mark recognition system, it is amenable to a wide variety of other applications where a low cost alternative to Zoom Lens Calibration is desirable. The presently disclosed system may in some circumstances be augmented by a Zoom Lens Calibration system to affect a system with hybrid capabilities and costs of each system.

Conclusion

Various systems and methods of register mark recognition have been documented and shown to provide a substantial improvement in the art when applied to a variety of web printing applications. It is instructive to note that while the present system may be economically implemented using a fixed lens camera system, in fact any image sensing system may be used to implement the image capture portion of the disclosed system. Thus, based on the teachings of Zoom Lens Calibration, any of the systems and methods illustrated herein may be implemented using a Zoom Lens camera.

Furthermore, it is important to realize that the present invention can be implemented economically from a variety of perspectives. First, the present system teaches a multi-functional use of a camera system, including inspection, registration (both rough initial and fine), continuous press adjustment, color monitoring, color adjustment, ink key modulation, ink/water balancing, and/or remote press diagnosis and control. Individually most of these features are lacking in the prior art, and when integrated into a single system they represent a significant cost reduction over other single-function systems.

Second, the present invention actually SAVES the printer money by significantly reducing waste during pre-registration and during normal press operation. This waste savings can in some cases actually pay for the added equipment costs associated with the present invention and thus provide an economic incentive for the printer to conserve environmental resources by not wasting paper and other consumables.

Third, the present invention for the first time permits in situ calibration of color ink deposition using the web itself and/or external calibration plates to automatically adjust registration, color-to-color register, color quality, ink key adjustments, as well as ink/water balancing. All of these adjustments traditionally were manually controlled, and the use of the present invention teachings permits a significant reduction in manual labor and maintenance associated with traditional printing processes. The ability to remotely monitor and diagnose a printing press operation using the present invention is yet another feature that promotes the economics of this new paradigm, as the prior art does not teach this functionality in the context of register mark or printing press processing.

Finally, the present invention permits a product mix of a different and higher quality kind to be produced by the average printing press, thus both reducing waste and allowing older presses to actually produce product that is not generally possible using manual control techniques. Thus, retrofits of existing presses can fit them to be economically viable in short run situations where previously the waste created was a significant barrier to their economic viability.

In short, the present invention permits total quality management of the printing process, and while the general commercial printing industry is only one area in which the teachings of the present invention may be applied, it is one significant area in which the present invention can significantly change both the type of product produced as well as the way in which it is manufactured.

Although a preferred embodiment of the present invention has been illustrated in the accompanying Drawings and described in the foregoing Detailed Description, it will be understood that the invention is not limited to the embodiments disclosed, but is capable of numerous rearrangements, modifications, and substitutions without departing from the spirit of the invention as set forth and defined by the following claims:

What is claimed is:

1. A registration optimization and/or correction system comprising:

(1) means for obtaining an RGB image of gear-side and operator side marks on a web;

(2) means for determining the [X,Y] coordinates of gear-side and operator side marks;

(3) means for determining the [X,Y] center of said gear-side and/or said operator-side marks;

(4) means for calculating absolute [X,Y] distance measurements from said RGB image and a traverse encoder;

(5) means for calculating absolute [X,Y] coordinates for gear-side and operator-side duplicate and test station marks;

(6) means for determining skew error;

(7) means for determining fan-out error;

(8) means for determining initial pre-registration error;

(9) means for determining combined pre-registration error;

(10) means for adjusting web print controls;

wherein said means for adjusting web print controls is adjusted based on said skew error, said fan-out error, said initial pre-registration error, and/or said combined pre-registration error.

2. A registration optimization and/or correction process comprising:

(a) obtaining an RGB image of gear-side and operator side marks on a web;

(b) determining the [X,Y] coordinates of gear-side and operator side marks;

(c) determining the [X,Y] center of said gear-side and/or said operator-side marks;

(d) calculating absolute [X,Y] distance measurements from said RGB image and a traverse encoder;

(e) calculating absolute [X,Y] coordinates for gear-side and operator-side duplicate and test station marks;

(f) determining skew error;

(g) determining fan-out error;

(h) determining initial pre-registration error;

(i) determining combined pre-registration error; and (j) adjusting web print controls based on the results of steps (f)–(i).

3. The web product created by the registration optimization and/or correction control process of claim 2.

4. A computer usable medium having computer-readable program code means providing registration optimization and/or correction, said computer-readable program means comprising:

(a) computer program code means for obtaining an RGB image of gear-side and operator side marks on a web;

(b) computer program code means for determining the [X,Y] coordinates of gear-side and operator side marks;

(c) computer program code means for determining the [X,Y] center of said gear-side and/or said operator-side marks;

(d) computer program code means for calculating absolute [X,Y] distance measurements from said RGB image and a traverse encoder;

(e) computer program code means for calculating absolute [X,Y] coordinates for gear-side and operator-side duplicate and test station marks;

(f) computer program code means for determining skew error;

(g) computer program code means for determining fan-out error;

(h) computer program code means for determining initial pre-registration error;

(i) computer program code means for determining combined pre-registration error; and (j) computer program code means for adjusting web print controls based on the results of steps (f)–(i).

5. The computer usable medium of claim 4 wherein said medium is compatible with a personal computer (PC).

6. The computer usable medium of claim 5 wherein said computer code means utilizes a graphical user interface.

7. The computer usable medium of claim 6 wherein said graphical user interface utilizes a Microsoft™ Windows™ operating environment.

* * * * *